US007334650B2

(12) United States Patent
Giroux et al.

(10) Patent No.: US 7,334,650 B2
(45) **Date of Patent: *Feb. 26, 2008**

(54) APPARATUS AND METHODS FOR DRILLING A WELLBORE USING CASING

(75) Inventors: Richard L. Giroux, Cypress, TX (US); Gregory G. Galloway, Conroe, TX (US); Tuong Thanh Le, Katy, TX (US); Raymond H. Jackson, Spring, TX (US); Gregory R. Nazzal, Kingwood, TX (US); James C. Swarr, The Woodlands, TX (US); David J. Brunnert, Houston, TX (US); William M. Beasley, Waller, TX (US); Brent J. Lirette, Houston, TX (US); Albert C. Odell, Kingwood, TX (US); Jim Terry, Houston, TX (US); Dave McKay, Stonehaven (GB); Samir Alkhatib, Aberdeen (GB); Mike Wardley, Aberdeen (GB)

(73) Assignee: Weatherford/Lamb, Inc., Houston, TX (US)

( * ) Notice: Subject to any disclaimer, the term of this patent is extended or adjusted under 35 U.S.C. 154(b) by 43 days.

This patent is subject to a terminal disclaimer.

(21) Appl. No.: 10/772,217

(22) Filed: Feb. 2, 2004

(65) Prior Publication Data

US 2004/0245020 A1 Dec. 9, 2004
US 2007/0056774 A9 Mar. 15, 2007
US 2007/0119626 A9 May 31, 2007

Related U.S. Application Data

(63) Continuation-in-part of application No. 10/257,662, filed as application No. PCT/GB01/01506 on Apr. 2, 2001, now Pat. No. 6,848,517, said application No. 10/772,217 and a continuation-in-part of application No. 10/331,964, filed on Dec. 30, 2002, now Pat. No. 6,857,487.

(60) Provisional application No. 60/444,088, filed on Jan. 31, 2003, provisional application No. 60/452,186, filed on Mar. 5, 2003, provisional application No. 60/452,202, filed on Mar. 5, 2003, provisional application No. 60/452,317, filed on Mar. 5, 2003.

(30) Foreign Application Priority Data

Apr. 13, 2000 (GB) ..... 0008988.8

(51) Int. Cl.
*E21B 7/20* (2006.01)

(52) U.S. Cl. ..... 175/26; 175/171; 175/57; 166/380

(58) Field of Classification Search ..... 175/26, 175/57, 171, 424
See application file for complete search history.

(56) References Cited

U.S. PATENT DOCUMENTS

| | | | |
|---|---|---|---|
| 122,514 | A | 1/1872 | Bullock |
| 761,518 | A | 5/1904 | Lykken |
| 1,077,772 | A | 11/1913 | Weathersby |
| 1,185,582 | A | 5/1916 | Bignell |
| 1,301,285 | A | 4/1919 | Leonard |
| 1,324,303 | A | 12/1919 | Carmichael |
| 1,342,424 | A | 6/1920 | Cotten |
| 1,418,766 | A | 6/1922 | Wilson |
| 1,459,990 | A | 6/1923 | Reed |
| 1,471,526 | A | 10/1923 | Pickin |
| 1,545,039 | A | 7/1925 | Deavers |
| 1,561,418 | A | 11/1925 | Duda |
| 1,569,729 | A | 1/1926 | Duda |
| 1,585,069 | A | 5/1926 | Youle |
| 1,597,212 | A | 8/1926 | Spengler |
| 1,728,136 | A | 9/1929 | Power |
| 1,777,592 | A | 10/1930 | Thomas |
| 1,825,026 | A | 9/1931 | Thomas |
| 1,830,625 | A | 11/1931 | Schrock |
| 1,842,638 | A | 1/1932 | Wigle |
| 1,851,289 | A | 3/1932 | Owen |
| 1,880,218 | A | 10/1932 | Simmons |
| 1,917,135 | A | 7/1933 | Littell |

1,930,825 A 10/1933 Raymond
1,981,525 A 11/1934 Price
1,998,833 A 4/1935 Crowell
2,017,451 A 10/1935 Wickersham
2,049,450 A 8/1936 Johnson
2,060,352 A 11/1936 Stokes
2,102,555 A 12/1937 Dyer
2,105,885 A 1/1938 Hinderliter
2,167,338 A 7/1939 Murcell
2,214,226 A 9/1940 English
2,214,429 A 9/1940 Miller
2,216,226 A 10/1940 Bumpous
2,216,895 A 10/1940 Stokes
2,228,503 A 1/1941 Boyd et al.
2,295,803 A 9/1942 O'Leary
2,305,062 A 12/1942 Church et al.
2,324,679 A 7/1943 Cox
2,344,120 A 3/1944 Baker
2,345,038 A 3/1944 Wallace
2,370,832 A 3/1945 Baker
2,379,800 A 7/1945 Hare
2,383,214 A 8/1945 Prout
2,414,719 A 1/1947 Cloud
2,499,630 A 3/1950 Clark
2,522,444 A 9/1950 Grable
2,536,458 A 1/1951 Munsinger
2,610,690 A 9/1952 Beatty
2,621,742 A 12/1952 Brown
2,627,891 A 2/1953 Clark
2,641,444 A 6/1953 Moon
2,650,314 A 8/1953 Hennigh et al.
2,663,073 A 12/1953 Bieber et al.
2,668,689 A 2/1954 Cormany
2,692,059 A 10/1954 Bolling, Jr.
2,696,367 A 12/1954 Robishaw
2,720,267 A 10/1955 Brown
2,738,011 A 3/1956 Mabry
2,741,907 A 4/1956 Genender et al.
2,743,087 A 4/1956 Layne et al.
2,743,495 A 5/1956 Eklund
2,764,329 A 9/1956 Hampton
2,765,146 A 10/1956 Williams
2,805,043 A 9/1957 Williams
2,898,971 A 8/1959 Hempel
2,953,406 A 9/1960 Young
2,978,047 A 4/1961 DeVaan
3,001,585 A 9/1961 Shipiet
3,006,415 A 10/1961 Burns et al.
3,041,901 A 7/1962 Knights
3,054,100 A 9/1962 Jones
3,087,546 A 4/1963 Wooley
3,090,031 A 5/1963 Lord
3,102,599 A 9/1963 Hillburn
3,111,179 A 11/1963 Albers et al.
3,117,636 A 1/1964 Wilcox et al.
3,122,811 A 3/1964 Gilreath
3,123,160 A 3/1964 Kammerer
3,124,023 A 3/1964 Marquis et al.
3,131,769 A 5/1964 Rochemont
3,159,219 A 12/1964 Scott
3,169,592 A 2/1965 Kammerer
3,191,677 A 6/1965 Kinley
3,191,680 A 6/1965 Vincent
3,193,116 A 7/1965 Kenneday et al.
3,195,646 A 7/1965 Brown
3,273,660 A 9/1966 Jackson et al.
3,353,599 A 11/1967 Swift
3,380,528 A 4/1968 Timmons
3,387,893 A 6/1968 Hoever
3,392,609 A 7/1968 Bartos
3,419,079 A 12/1968 Current
3,467,180 A 9/1969 Pensotti
3,477,527 A 11/1969 Koot
3,489,220 A 1/1970 Kinley
3,518,903 A 7/1970 Ham et al.
3,548,936 A 12/1970 Kilgore et al.
3,550,684 A 12/1970 Cubberly, Jr.
3,552,507 A 1/1971 Brown
3,552,508 A 1/1971 Brown
3,552,509 A 1/1971 Brown
3,552,510 A 1/1971 Brown
3,552,848 A 1/1971 Van Wagner
3,559,739 A 2/1971 Hutchison
3,566,505 A 3/1971 Martin
3,570,598 A 3/1971 Johnson
3,575,245 A 4/1971 Cordary et al.
3,602,302 A 8/1971 Kluth
3,603,411 A 9/1971 Link
3,603,412 A 9/1971 Kammerer, Jr. et al.
3,603,413 A 9/1971 Grill et al.
3,606,664 A 9/1971 Weiner
3,621,910 A 11/1971 Sanford et al.
3,624,760 A 11/1971 Bodine
3,635,105 A 1/1972 Dickmann et al.
3,656,564 A 4/1972 Brown
3,662,642 A 5/1972 Bromell
3,669,190 A 6/1972 Sizer et al.
3,680,412 A 8/1972 Mayer et al.
3,691,624 A 9/1972 Kinley
3,691,825 A 9/1972 Dyer
3,692,126 A 9/1972 Rushing et al.
3,696,332 A 10/1972 Dickson, Jr. et al.
3,700,048 A 10/1972 Desmoulins
3,712,376 A 1/1973 Owen et al.
3,729,057 A 4/1973 Werner
3,746,330 A 7/1973 Taciuk
3,747,675 A 7/1973 Brown
3,760,894 A 9/1973 Pitifer
3,776,307 A 12/1973 Young
3,776,320 A 12/1973 Brown
3,776,991 A 12/1973 Marcus
3,785,193 A 1/1974 Kinley et al.
3,808,916 A 5/1974 Porter et al.
3,818,734 A 6/1974 Bateman
3,838,613 A 10/1974 Wilms
3,840,128 A 10/1974 Swoboda, Jr. et al.
3,848,684 A 11/1974 West
3,857,450 A 12/1974 Guier
3,870,114 A 3/1975 Pulk et al.
3,881,375 A 5/1975 Kelly
3,885,679 A 5/1975 Swoboda, Jr. et al.
3,901,331 A 8/1975 Djurovic
3,911,707 A 10/1975 Minakov et al.
3,913,687 A 10/1975 Gyongyosi et al.
3,915,244 A 10/1975 Brown
3,934,660 A 1/1976 Nelson
3,935,910 A 2/1976 Gaudy et al.
3,945,444 A 3/1976 Knudson
3,947,009 A 3/1976 Nelmark
3,948,321 A 4/1976 Owen et al.
3,964,556 A 6/1976 Gearhart et al.
3,980,143 A 9/1976 Swartz et al.
4,049,066 A 9/1977 Richey
4,054,332 A 10/1977 Bryan, Jr.
4,054,426 A 10/1977 White
4,064,939 A 12/1977 Marquis
4,069,573 A 1/1978 Rogers, Jr. et al.
4,077,525 A 3/1978 Callegari et al.
4,082,144 A 4/1978 Marquis
4,083,405 A 4/1978 Shirley
4,085,808 A 4/1978 Kling
4,095,865 A 6/1978 Denison et al.
4,100,968 A 7/1978 Delano
4,100,981 A 7/1978 Chaffin
4,127,168 A 11/1978 Hanson et al.
4,127,927 A 12/1978 Hauk et al.

4,133,396 A 1/1979 Tschirky
4,142,739 A 3/1979 Billingsley
4,159,564 A 7/1979 Cooper, Jr.
4,173,457 A 11/1979 Smith
4,175,619 A 11/1979 Davis
4,182,423 A 1/1980 Ziebarth et al.
4,186,628 A 2/1980 Bonnice
4,189,185 A 2/1980 Kammerer, Jr. et al.
4,194,383 A 3/1980 Huzyak
4,221,269 A 9/1980 Hudson
4,227,197 A 10/1980 Nimmo et al.
4,241,878 A 12/1980 Underwood
4,257,442 A 3/1981 Claycomb
4,262,693 A 4/1981 Giebeler
4,274,777 A 6/1981 Scaggs
4,274,778 A 6/1981 Putnam et al.
4,277,197 A 7/1981 Bingham
4,280,380 A 7/1981 Eshghy
4,281,722 A 8/1981 Tucker et al.
4,287,949 A 9/1981 Lindsey, Jr.
4,288,082 A 9/1981 Setterberg, Jr.
4,311,195 A 1/1982 Mullins, II
4,315,553 A 2/1982 Stallings
4,319,393 A 3/1982 Pogonowski
4,320,915 A 3/1982 Abbott et al.
4,324,407 A 4/1982 Upham et al.
4,336,415 A 6/1982 Walling
4,384,627 A 5/1983 Ramirez-Jauregui
4,392,534 A 7/1983 Miida
4,396,076 A 8/1983 Inoue
4,396,077 A 8/1983 Radtke
4,407,378 A 10/1983 Thomas
4,408,669 A 10/1983 Wiredal
4,413,682 A 11/1983 Callihan et al.
4,427,063 A 1/1984 Skinner
4,429,620 A 2/1984 Burkhardt et al.
4,437,363 A 3/1984 Haynes
4,440,220 A 4/1984 McArthur
4,445,734 A 5/1984 Cunningham
4,446,745 A 5/1984 Stone et al.
4,449,596 A 5/1984 Boyadjieff
4,460,053 A 7/1984 Jurgens et al.
4,463,814 A 8/1984 Horstmeyer et al.
4,466,498 A 8/1984 Bardwell
4,469,174 A 9/1984 Freeman
4,470,470 A 9/1984 Takano
4,472,002 A 9/1984 Beney et al.
4,474,243 A 10/1984 Gaines
4,483,399 A 11/1984 Colgate
4,489,793 A 12/1984 Boren
4,489,794 A 12/1984 Boyadjieff
4,492,134 A 1/1985 Reinholdt et al.
4,494,424 A 1/1985 Bates
4,515,045 A 5/1985 Gnatchenko et al.
4,529,045 A 7/1985 Boyadjieff et al.
4,531,581 A 7/1985 Pringle et al.
4,544,041 A 10/1985 Rinaldi
4,545,443 A 10/1985 Wiredal
4,570,706 A 2/1986 Pugnet
4,580,631 A 4/1986 Baugh
4,583,603 A 4/1986 Dorleans et al.
4,588,030 A 5/1986 Blizzard
4,589,495 A 5/1986 Langer et al.
4,592,125 A 6/1986 Skene
4,593,773 A 6/1986 Skeie
4,595,058 A 6/1986 Nations
4,604,724 A 8/1986 Shaginian et al.
4,604,818 A 8/1986 Inoue
4,605,077 A 8/1986 Boyadjieff
4,605,268 A 8/1986 Meador
4,610,320 A 9/1986 Beakley
4,613,161 A 9/1986 Brisco
4,620,600 A 11/1986 Persson
4,625,796 A 12/1986 Boyadjieff
4,630,691 A 12/1986 Hooper
4,646,827 A 3/1987 Cobb
4,649,777 A 3/1987 Buck
4,651,837 A 3/1987 Mayfield
4,652,195 A 3/1987 McArthur
4,655,286 A 4/1987 Wood
4,667,752 A 5/1987 Berry et al.
4,671,358 A 6/1987 Lindsey, Jr. et al.
4,676,310 A 6/1987 Scherbatskoy et al.
4,676,312 A 6/1987 Mosing et al.
4,678,031 A 7/1987 Blandford et al.
4,681,158 A 7/1987 Pennison
4,681,162 A 7/1987 Boyd
4,683,962 A 8/1987 True
4,686,873 A 8/1987 Lang et al.
4,691,587 A 9/1987 Farrand et al.
4,693,316 A 9/1987 Ringgenberg et al.
4,697,640 A 10/1987 Szarka
4,699,224 A 10/1987 Burton
4,708,202 A 11/1987 Sukup et al.
4,709,599 A 12/1987 Buck
4,709,766 A 12/1987 Boyadjieff
4,725,179 A 2/1988 Woolslayer et al.
4,735,270 A 4/1988 Fenyvesi
4,738,145 A 4/1988 Vincent et al.
4,742,876 A 5/1988 Barthelemy et al.
4,744,426 A 5/1988 Reed
4,759,239 A 7/1988 Hamilton et al.
4,760,882 A 8/1988 Novak
4,762,187 A 8/1988 Haney
4,765,401 A 8/1988 Boyadjieff
4,765,416 A 8/1988 Bjerking et al.
4,770,259 A 9/1988 Jansson
4,773,689 A 9/1988 Wolters
4,775,009 A 10/1988 Wittrisch et al.
4,778,008 A 10/1988 Gonzalez et al.
4,781,359 A 11/1988 Matus
4,788,544 A 11/1988 Howard
4,791,997 A 12/1988 Krasnov
4,793,422 A 12/1988 Krasnov
4,800,968 A 1/1989 Shaw et al.
4,806,928 A 2/1989 Veneruso
4,813,493 A 3/1989 Shaw et al.
4,813,495 A 3/1989 Leach
4,821,814 A 4/1989 Willis et al.
4,825,947 A 5/1989 Mikolajczyk
4,828,050 A 5/1989 Hashimoto
4,832,552 A 5/1989 Skelly
4,836,064 A 6/1989 Slator
4,836,299 A 6/1989 Bodine
4,842,081 A 6/1989 Parant
4,843,945 A 7/1989 Dinsdale
4,848,469 A 7/1989 Baugh et al.
4,854,386 A 8/1989 Baker et al.
4,858,705 A 8/1989 Thiery
4,867,236 A 9/1989 Haney et al.
4,878,546 A 11/1989 Shaw et al.
4,880,058 A 11/1989 Lindsey et al.
4,883,125 A 11/1989 Wilson et al.
4,901,069 A 2/1990 Veneruso
4,904,119 A 2/1990 Legendre et al.
4,909,741 A 3/1990 Schasteen et al.
4,915,181 A 4/1990 Labrosse
4,921,386 A 5/1990 McArthur
4,936,382 A 6/1990 Thomas
4,960,173 A 10/1990 Cognevich et al.
4,962,579 A 10/1990 Moyer et al.
4,962,819 A 10/1990 Bailey et al.
4,962,822 A 10/1990 Pascale
4,997,042 A 3/1991 Jordan et al.
5,009,265 A 4/1991 Bailey et al.
5,022,472 A 6/1991 Bailey et al.

5,024,273 A 6/1991 Coone et al.
5,027,914 A 7/1991 Wilson
5,036,927 A 8/1991 Willis
5,049,020 A 9/1991 McArthur
5,052,483 A 10/1991 Hudson
5,060,542 A 10/1991 Hauk
5,060,737 A 10/1991 Mohn
5,062,756 A 11/1991 McArthur et al.
5,069,297 A 12/1991 Krueger
5,074,366 A 12/1991 Karlsson et al.
5,082,069 A 1/1992 Seiler et al.
5,083,608 A 1/1992 Abdrakhmanov et al.
5,085,273 A 2/1992 Coone
5,096,465 A 3/1992 Chen et al.
5,109,924 A 5/1992 Jurgens et al.
5,111,893 A 5/1992 Kvello-Aune
5,141,063 A 8/1992 Quesenbury
RE34,063 E 9/1992 Vincent et al.
5,148,875 A 9/1992 Karlsson et al.
5,156,213 A 10/1992 George et al.
5,160,925 A 11/1992 Dailey et al.
5,168,942 A 12/1992 Wydrinski
5,172,765 A 12/1992 Sas-Jaworsky et al.
5,176,518 A 1/1993 Hordijk et al.
5,181,571 A 1/1993 Mueller
5,186,265 A 2/1993 Henson et al.
5,191,932 A 3/1993 Seefried et al.
5,191,939 A 3/1993 Stokley
5,197,553 A 3/1993 Leturno
5,224,540 A 7/1993 Streich et al.
5,233,742 A 8/1993 Gray et al.
5,234,052 A 8/1993 Coone et al.
5,245,265 A 9/1993 Clay
5,251,709 A 10/1993 Richardson
5,255,741 A 10/1993 Alexander
5,255,751 A 10/1993 Stogner
5,271,468 A 12/1993 Streich et al.
5,271,472 A 12/1993 Leturno
5,272,925 A 12/1993 Henneuse et al.
5,282,653 A 2/1994 LaFleur et al.
5,284,210 A 2/1994 Helms et al.
5,285,008 A 2/1994 Sas-Jaworsky et al.
5,285,204 A 2/1994 Sas-Jaworsky
5,291,956 A 3/1994 Mueller et al.
5,294,228 A 3/1994 Willis et al.
5,297,833 A 3/1994 Willis et al.
5,303,772 A 4/1994 George et al.
5,305,830 A 4/1994 Wittrisch
5,305,839 A 4/1994 Kalsi et al.
5,311,952 A 5/1994 Eddison et al.
5,318,122 A 6/1994 Murray et al.
5,320,178 A 6/1994 Cornette
5,322,127 A 6/1994 McNair et al.
5,323,858 A 6/1994 Jones et al.
5,332,043 A 7/1994 Ferguson
5,332,048 A 7/1994 Underwood et al.
5,340,182 A 8/1994 Busink et al.
5,343,950 A 9/1994 Hale et al.
5,343,951 A 9/1994 Cowan et al.
5,343,968 A 9/1994 Glowka
5,348,095 A 9/1994 Worrall et al.
5,351,767 A 10/1994 Stogner et al.
5,353,872 A 10/1994 Wittrisch
5,354,150 A 10/1994 Canales
5,355,967 A 10/1994 Mueller et al.
5,361,859 A 11/1994 Tibbitts
5,368,113 A 11/1994 Schulze-Beckinghausen
5,375,668 A 12/1994 Hallundbaek
5,379,835 A 1/1995 Streich
5,386,746 A 2/1995 Hauk
5,388,651 A 2/1995 Berry
5,392,715 A 2/1995 Pelrine
5,394,823 A 3/1995 Lenze
5,402,856 A 4/1995 Warren et al.
5,409,059 A 4/1995 McHardy
5,433,279 A 7/1995 Tessari et al.
5,435,386 A 7/1995 LaFleur
5,435,400 A 7/1995 Smith
5,452,923 A 9/1995 Smith
5,456,317 A 10/1995 Hood, III et al.
5,458,209 A 10/1995 Hayes et al.
5,461,905 A 10/1995 Penisson
5,462,120 A 10/1995 Gondouin
5,472,057 A 12/1995 Winfree
5,477,925 A 12/1995 Trahan et al.
5,494,122 A 2/1996 Larsen et al.
5,497,840 A 3/1996 Hudson
5,501,286 A 3/1996 Berry
5,503,234 A 4/1996 Clanton
5,520,255 A 5/1996 Barr et al.
5,526,880 A 6/1996 Jordan, Jr. et al.
5,535,824 A 7/1996 Hudson
5,535,838 A 7/1996 Keshavan et al.
5,540,279 A 7/1996 Branch et al.
5,542,472 A 8/1996 Pringle et al.
5,542,473 A 8/1996 Pringle et al.
5,547,029 A 8/1996 Rubbo et al.
5,551,521 A 9/1996 Vail, III
5,553,672 A 9/1996 Smith, Jr. et al.
5,553,679 A 9/1996 Thorp
5,560,426 A 10/1996 Trahan et al.
5,560,437 A 10/1996 Dickel et al.
5,560,440 A 10/1996 Tibbitts
5,566,772 A 10/1996 Coone et al.
5,575,344 A 11/1996 Wireman
5,577,566 A 11/1996 Albright et al.
5,582,259 A 12/1996 Barr
5,584,343 A 12/1996 Coone
5,588,916 A 12/1996 Moore
5,611,397 A 3/1997 Wood
5,613,567 A 3/1997 Hudson
5,615,747 A 4/1997 Vail, III
5,645,131 A 7/1997 Trevisani
5,651,420 A 7/1997 Tibbitts et al.
5,661,888 A 9/1997 Hanslik
5,662,170 A 9/1997 Donovan et al.
5,662,182 A 9/1997 McLeod et al.
5,667,011 A 9/1997 Gill et al.
5,667,023 A 9/1997 Harrell et al.
5,667,026 A 9/1997 Lorenz et al.
5,685,369 A 11/1997 Ellis et al.
5,685,373 A 11/1997 Collins et al.
5,697,442 A 12/1997 Baldridge
5,706,894 A 1/1998 Hawkins, III
5,706,905 A 1/1998 Barr
5,711,382 A 1/1998 Hansen et al.
5,717,334 A 2/1998 Vail, III et al.
5,718,288 A 2/1998 Bertet et al.
5,720,356 A 2/1998 Gardes
5,730,221 A 3/1998 Longbottom et al.
5,730,471 A 3/1998 Schulze-Beckinghausen et al.
5,732,776 A 3/1998 Tubel et al.
5,735,348 A 4/1998 Hawkins, III
5,735,351 A 4/1998 Helms
5,743,344 A 4/1998 McLeod et al.
5,746,276 A 5/1998 Stuart
5,755,299 A 5/1998 Langford, Jr. et al.
5,772,514 A 6/1998 Moore
5,785,132 A 7/1998 Richardson et al.
5,785,134 A 7/1998 McLeod et al.
5,787,978 A 8/1998 Carter et al.
5,791,410 A 8/1998 Castille et al.
5,791,416 A 8/1998 White et al.
5,794,703 A 8/1998 Newman et al.
5,803,191 A 9/1998 Mackintosh
5,803,666 A 9/1998 Keller 5,813,456 A 9/1998 Milner et al.
5,823,264 A 10/1998 Ringgenberg
5,826,651 A 10/1998 Lee et al.
5,828,003 A 10/1998 Thomeer et al.
5,829,520 A 11/1998 Johnson
5,829,539 A 11/1998 Newton et al.
5,833,002 A 11/1998 Holcombe
5,836,395 A 11/1998 Budde
5,836,409 A 11/1998 Vail, III
5,839,330 A 11/1998 Stokka
5,839,515 A 11/1998 Yuan et al.
5,839,519 A 11/1998 Spedale, Jr.
5,842,149 A 11/1998 Harrell et al.
5,842,530 A 12/1998 Smith et al.
5,845,722 A 12/1998 Makohl et al.
5,850,877 A 12/1998 Albright et al.
5,860,474 A 1/1999 Stoltz et al.
5,878,815 A 3/1999 Collins
5,887,655 A 3/1999 Haugen et al.
5,887,668 A 3/1999 Haugen et al.
5,890,537 A 4/1999 Lavaure et al.
5,890,540 A 4/1999 Pia et al.
5,890,549 A 4/1999 Sprehe
5,894,897 A 4/1999 Vail, III
5,901,787 A 5/1999 Boyle
5,907,664 A 5/1999 Wang et al.
5,908,049 A 6/1999 Williams et al.
5,909,768 A 6/1999 Castille et al.
5,913,337 A 6/1999 Williams et al.
5,921,285 A 7/1999 Quigley et al.
5,921,332 A 7/1999 Spedale, Jr.
5,931,231 A 8/1999 Mock
5,947,213 A 9/1999 Angle et al.
5,950,742 A 9/1999 Caraway
5,954,131 A 9/1999 Sallwasser
5,957,225 A 9/1999 Sinor
5,960,881 A 10/1999 Allamon et al.
5,971,079 A 10/1999 Mullins
5,971,086 A 10/1999 Bee et al.
5,984,007 A 11/1999 Yuan et al.
5,988,273 A 11/1999 Monjure et al.
6,000,472 A 12/1999 Albright et al.
6,012,529 A 1/2000 Mikolajczyk et al.
6,021,850 A 2/2000 Wood et al.
6,024,169 A 2/2000 Haugen
6,026,911 A 2/2000 Angle et al.
6,029,748 A 2/2000 Forsyth et al.
6,035,953 A 3/2000 Rear
6,056,060 A 5/2000 Abrahamsen et al.
6,059,051 A 5/2000 Jewkes et al.
6,059,053 A 5/2000 McLeod
6,061,000 A 5/2000 Edwards
6,062,326 A 5/2000 Strong et al.
6,065,550 A 5/2000 Gardes
6,070,500 A 6/2000 Dlask et al.
6,070,671 A 6/2000 Cumming et al.
6,079,498 A 6/2000 Lima et al.
6,079,509 A 6/2000 Bee et al.
6,082,461 A 7/2000 Newman et al.
6,085,838 A 7/2000 Vercaemer et al.
6,089,323 A 7/2000 Newman et al.
6,098,717 A 8/2000 Bailey et al.
6,106,200 A 8/2000 Mocivnik et al.
6,119,772 A 9/2000 Pruet
6,135,208 A 10/2000 Gano et al.
6,142,545 A 11/2000 Penman et al.
6,155,360 A 12/2000 McLeod
6,158,531 A 12/2000 Vail, III
6,161,617 A 12/2000 Gjedebo
6,170,573 B1 1/2001 Brunet et al.
6,172,010 B1 1/2001 Argillier et al.
6,173,777 B1 1/2001 Mullins
6,179,055 B1 1/2001 Sallwasser et al.
6,182,776 B1 2/2001 Asberg
6,186,233 B1 2/2001 Brunet
6,189,616 B1 2/2001 Gano et al.
6,189,621 B1 2/2001 Vail, III
6,196,336 B1 3/2001 Fincher et al.
6,199,641 B1 3/2001 Downie et al.
6,202,764 B1 3/2001 Ables et al.
6,206,112 B1 3/2001 Dickinson, III et al.
6,216,533 B1 4/2001 Woloson et al.
6,217,258 B1 4/2001 Yamamoto et al.
6,220,117 B1 4/2001 Butcher
6,223,823 B1 5/2001 Head
6,224,112 B1 5/2001 Eriksen et al.
6,227,587 B1 5/2001 Terral
6,234,257 B1 5/2001 Ciglenec et al.
6,237,684 B1 5/2001 Bouligny, Jr. et al.
6,244,363 B1 6/2001 McLeod
6,263,987 B1 7/2001 Vail, III
6,273,189 B1 8/2001 Gissler et al.
6,275,938 B1 8/2001 Bond et al.
6,290,432 B1 9/2001 Exley et al.
6,296,066 B1 10/2001 Terry et al.
6,305,469 B1 10/2001 Coenen et al.
6,309,002 B1 10/2001 Bouligny
6,311,792 B1 11/2001 Scott et al.
6,315,051 B1 11/2001 Ayling
6,325,148 B1 12/2001 Trahan et al.
6,343,649 B1 2/2002 Beck et al.
6,347,674 B1 2/2002 Bloom et al.
6,349,764 B1 2/2002 Adams et al.
6,357,485 B2 3/2002 Quigley et al.
6,359,569 B2 3/2002 Beck et al.
6,360,633 B2 3/2002 Pietras
6,367,552 B1 4/2002 Scott et al.
6,367,566 B1 4/2002 Hill
6,371,203 B2 4/2002 Frank et al.
6,374,506 B1 4/2002 Schutte et al.
6,374,924 B1 4/2002 Hanton et al.
6,378,627 B1 4/2002 Tubel et al.
6,378,630 B1 4/2002 Ritorto et al.
6,378,633 B1 4/2002 Moore
6,390,190 B2 5/2002 Mullins
6,392,317 B1 5/2002 Hall et al.
6,397,946 B1 6/2002 Vail, III
6,401,820 B1 6/2002 Kirk et al.
6,405,798 B1 6/2002 Barrett et al.
6,408,943 B1 6/2002 Schultz et al.
6,412,554 B1 7/2002 Allen et al.
6,412,574 B1 7/2002 Wardley et al.
6,419,014 B1 7/2002 Meek et al.
6,419,033 B1 7/2002 Hahn et al.
6,425,444 B1 7/2002 Metcalfe et al.
6,427,776 B1 8/2002 Hoffman et al.
6,429,784 B1 8/2002 Beique et al.
6,431,626 B1 8/2002 Bouligny
6,443,241 B1 9/2002 Juhasz et al.
6,443,247 B1 9/2002 Wardley
6,446,323 B1 9/2002 Metcalfe et al.
6,446,723 B1 9/2002 Ramons et al.
6,457,532 B1 10/2002 Simpson
6,458,471 B2 10/2002 Lovato et al.
6,464,004 B1 10/2002 Crawford et al.
6,464,011 B2 10/2002 Tubel
6,484,818 B2 11/2002 Alft et al.
6,494,272 B1 * 12/2002 Eppink et al. ..... 175/57
6,497,280 B2 12/2002 Beck et al.
6,497,289 B1 12/2002 Cook et al.
6,527,047 B1 3/2003 Pietras
6,527,049 B2 3/2003 Metcalfe et al.
6,527,064 B1 3/2003 Hallundbaek
6,527,493 B1 3/2003 Kamphorst et al.
6,536,520 B1 3/2003 Snider et al.
6,536,522 B2 3/2003 Birckhead et al.

6,536,993 B2 3/2003 Strong et al.
6,538,576 B1 3/2003 Schultz et al.
6,540,025 B2 4/2003 Scott et al.
6,543,552 B1 4/2003 Metcalfe et al.
6,547,017 B1 4/2003 Vail, III
6,553,825 B1 4/2003 Boyd
6,554,063 B2 4/2003 Ohmer
6,554,064 B1 4/2003 Restarick et al.
6,571,868 B2 6/2003 Victor
6,578,630 B2 6/2003 Simpson et al.
6,585,040 B2 7/2003 Hanton et al.
6,591,471 B1 7/2003 Hollingsworth et al.
6,591,905 B2 7/2003 Coon
6,595,288 B2 7/2003 Mosing et al.
6,612,383 B2 9/2003 Desai et al.
6,619,402 B1 9/2003 Amory et al.
6,622,796 B1 9/2003 Pietras
6,634,430 B2 10/2003 Dawson et al.
6,637,526 B2 10/2003 Juhasz et al.
6,640,903 B1 11/2003 Cook et al.
6,648,075 B2 11/2003 Badrak et al.
6,651,737 B2 11/2003 Bouligny
6,655,460 B2 12/2003 Bailey et al.
6,666,274 B2 12/2003 Hughes
6,668,684 B2 12/2003 Allen et al.
6,668,937 B1 12/2003 Murray
6,679,333 B2 1/2004 York et al.
6,688,394 B1 2/2004 Ayling
6,688,398 B2 2/2004 Pietras
6,691,801 B2 2/2004 Juhasz et al.
6,698,595 B2 3/2004 Norell et al.
6,702,029 B2 3/2004 Metcalfe et al.
6,702,040 B1 3/2004 Sensenig
6,705,413 B1 3/2004 Tessari
6,708,769 B2 3/2004 Haugen et al.
6,715,430 B2 4/2004 Choi et al.
6,719,071 B1 4/2004 Moyes
6,722,559 B1 4/2004 Millar et al.
6,725,917 B2 4/2004 Metcalfe
6,725,919 B2 4/2004 Cook et al.
6,725,924 B2 4/2004 Davidson et al.
6,725,938 B1 4/2004 Pietras
6,732,822 B2 5/2004 Slack et al.
6,742,584 B1 6/2004 Appleton
6,742,591 B2 6/2004 Metcalfe
6,742,596 B2 6/2004 Haugen
6,742,606 B2 6/2004 Metcalfe et al.
6,745,834 B2 6/2004 Davis et al.
6,749,026 B2 6/2004 Smith et al.
6,752,211 B2 6/2004 Dewey et al.
6,758,278 B2 7/2004 Cook et al.
6,802,374 B2 10/2004 Edgar et al.
6,832,658 B2 12/2004 Keast
6,837,313 B2 1/2005 Hosie et al.
6,840,322 B2 1/2005 Haynes
6,845,820 B1 1/2005 Hebert et al.
6,848,517 B2 2/2005 Wardley
6,854,533 B2 2/2005 Galloway
6,857,486 B2 2/2005 Chitwood et al.
6,857,487 B2 2/2005 Galloway et al.
6,892,819 B2 5/2005 Cook et al.
6,920,932 B2 7/2005 Zimmerman
6,923,255 B2 8/2005 Lee
6,926,126 B2 8/2005 Baumann et al.
6,941,652 B2 9/2005 Echols et al.
6,953,096 B2 10/2005 Gledhill et al.
7,000,695 B2 2/2006 Steele et al.
7,004,264 B2 2/2006 Simpson et al.
7,013,992 B2 3/2006 Tessari et al.
7,013,997 B2 3/2006 Vail, III
7,036,610 B1 5/2006 Vail, III
7,040,420 B2 5/2006 Vail, III
7,044,241 B2 5/2006 Angman
7,048,050 B2 5/2006 Vail, III et al.
7,082,997 B2 8/2006 Slack
7,083,005 B2 8/2006 Galloway et al.
7,090,004 B2 8/2006 Warren et al.
7,093,675 B2 8/2006 Pia
7,096,982 B2 8/2006 McKay et al.
7,100,710 B2 9/2006 Vail, III
7,100,713 B2 9/2006 Tulloch
7,108,072 B2 9/2006 Cook et al.
7,108,080 B2 9/2006 Tessari et al.
7,108,083 B2 9/2006 Simonds et al.
7,108,084 B2 9/2006 Vail, III
7,117,957 B2 10/2006 Metcalfe et al.
7,124,825 B2 10/2006 Slack
7,128,154 B2 10/2006 Giroux et al.
7,137,454 B2 11/2006 Pietras
7,140,443 B2 11/2006 Beierbach et al.
7,140,455 B2 11/2006 Walter et al.
7,143,847 B2 12/2006 Pia
7,147,068 B2 12/2006 Vail, III
7,159,668 B2 1/2007 Herrera
7,165,634 B2 1/2007 Vail, III
2001/0000101 A1 4/2001 Lovato et al.
2001/0002626 A1 6/2001 Frank et al.
2001/0013412 A1 8/2001 Tubel
2001/0040054 A1 11/2001 Haugen et al.
2001/0042625 A1 11/2001 Appleton
2001/0045284 A1 11/2001 Simpson et al.
2001/0047883 A1 12/2001 Hanton et al.
2002/0040787 A1 4/2002 Cook et al.
2002/0066556 A1 6/2002 Goode et al.
2002/0074127 A1 6/2002 Birckhead et al.
2002/0074132 A1 6/2002 Juhasz et al.
2002/0079102 A1 6/2002 Dewey et al.
2002/0108748 A1 8/2002 Keyes
2002/0134555 A1 9/2002 Allen et al.
2002/0145281 A1 10/2002 Metcalfe et al.
2002/0157829 A1 10/2002 Davis et al.
2002/0162690 A1 11/2002 Hanton et al.
2002/0166668 A1 11/2002 Metcalfe et al.
2002/0170720 A1 11/2002 Haugen
2002/0189806 A1 12/2002 Davidson et al.
2002/0189863 A1 12/2002 Wardley
2003/0029641 A1 2/2003 Meehan
2003/0034177 A1 2/2003 Chitwood et al.
2003/0042022 A1 3/2003 Lauritzen et al.
2003/0056947 A1 3/2003 Cameron
2003/0056991 A1 3/2003 Hahn et al.
2003/0070841 A1 4/2003 Merecka et al.
2003/0070842 A1 4/2003 Bailey et al.
2003/0111267 A1 6/2003 Pia
2003/0141111 A1 7/2003 Pia
2003/0146023 A1 8/2003 Pia
2003/0164250 A1 9/2003 Wardley
2003/0164251 A1 9/2003 Tulloch
2003/0164276 A1 9/2003 Snider et al.
2003/0173073 A1 9/2003 Snider et al.
2003/0173090 A1 9/2003 Cook et al.
2003/0183424 A1 10/2003 Tulloch
2003/0213598 A1 11/2003 Hughes
2003/0217865 A1 11/2003 Simpson et al.
2003/0221519 A1 12/2003 Haugen et al.
2004/0000405 A1 1/2004 Fournier, Jr. et al.
2004/0003490 A1 1/2004 Shahin et al.
2004/0003904 A1 1/2004 Vincent et al.
2004/0011534 A1 1/2004 Simonds et al.
2004/0011566 A1 1/2004 Lee
2004/0016575 A1 1/2004 Shahin et al.
2004/0060697 A1 4/2004 Tilton et al.
2004/0060700 A1 4/2004 Vert et al.
2004/0069500 A1 4/2004 Haugen
2004/0069501 A1 4/2004 Haugen et al.
2004/0079533 A1 4/2004 Buytaert et al.

| | | | |
|---|---|---|---|
| 2004/0108142 | A1 | 6/2004 | Vail, III |
| 2004/0112603 | A1 | 6/2004 | Galloway et al. |
| 2004/0112646 | A1 | 6/2004 | Vail |
| 2004/0112693 | A1 | 6/2004 | Chen et al. |
| 2004/0118613 | A1 | 6/2004 | Vail |
| 2004/0118614 | A1 | 6/2004 | Galloway et al. |
| 2004/0123984 | A1 | 7/2004 | Vail |
| 2004/0124010 | A1 | 7/2004 | Galloway et al. |
| 2004/0124011 | A1 | 7/2004 | Gledhill et al. |
| 2004/0124015 | A1 | 7/2004 | Vaile et al. |
| 2004/0129456 | A1 | 7/2004 | Vail |
| 2004/0140128 | A1 | 7/2004 | Vail |
| 2004/0144547 | A1 | 7/2004 | Koithan et al. |
| 2004/0173358 | A1 | 9/2004 | Haugen |
| 2004/0182679 | A1 | 9/2004 | Steele et al. |
| 2004/0216892 | A1 | 11/2004 | Giroux et al. |
| 2004/0216924 | A1 | 11/2004 | Pietras et al. |
| 2004/0216925 | A1 | 11/2004 | Metcalfe et al. |
| 2004/0221997 | A1 | 11/2004 | Giroux et al. |
| 2004/0226751 | A1 | 11/2004 | McKay et al. |
| 2004/0238218 | A1 | 12/2004 | Runia et al. |
| 2004/0244992 | A1 | 12/2004 | Carter et al. |
| 2004/0245020 | A1 | 12/2004 | Giroux et al. |
| 2004/0251025 | A1 | 12/2004 | Giroux et al. |
| 2004/0251050 | A1 | 12/2004 | Shahin et al. |
| 2004/0251055 | A1 | 12/2004 | Shahin et al. |
| 2004/0262013 | A1 | 12/2004 | Tilton et al. |
| 2005/0000691 | A1 | 1/2005 | Giroux et al. |
| 2005/0011643 | A1 | 1/2005 | Slack et al. |
| 2005/0077048 | A1 | 4/2005 | Hall |
| 2005/0096846 | A1 | 5/2005 | Koithan et al. |
| 2005/0152749 | A1 | 7/2005 | Anres et al. |
| 2005/0183892 | A1 | 8/2005 | Oldham et al. |
| 2005/0274547 | A1 | 12/2005 | Fincher et al. |
| 2006/0070771 | A1 | 4/2006 | McClain et al. |
| 2007/0068703 | A1 | 3/2007 | Tessari et al. |
| 2007/0079995 | A1 | 4/2007 | McClain et al. |

FOREIGN PATENT DOCUMENTS

| | | |
|---|---|---|
| CA | 2 335 192 | 11/2001 |
| DE | 3 213 464 | 10/1983 |
| DE | 3 523 221 | 2/1987 |
| DE | 3 918 132 | 12/1989 |
| DE | 4 133 802 | 10/1992 |
| EP | 0 087 373 | 8/1983 |
| EP | 0 162 000 | 11/1985 |
| EP | 0 171 144 | 2/1986 |
| EP | 0 265 344 | 4/1988 |
| EP | 0 285 386 | 10/1988 |
| EP | 0 397323 | 4/1990 |
| EP | 0 426 123 | 5/1991 |
| EP | 0 462 618 | 12/1991 |
| EP | 0 474 481 | 3/1992 |
| EP | 0479583 | 4/1992 |
| EP | 0 525 247 | 2/1993 |
| EP | 0 554 568 | 8/1993 |
| EP | 0 589 823 | 3/1994 |
| EP | 0 659 975 | 6/1995 |
| EP | 0 790 386 | 8/1997 |
| EP | 0 881 354 | 4/1998 |
| EP | 0 571 045 | 8/1998 |
| EP | 0 961 007 | 12/1999 |
| EP | 0 962 384 | 12/1999 |
| EP | 1 006 260 | 6/2000 |
| EP | 1 050 661 | 11/2000 |
| EP | 1148206 | 10/2001 |
| EP | 1 256 691 | 11/2002 |
| FR | 2053088 | 7/1970 |
| FR | 2741907 | 6/1997 |
| FR | 2 841 293 | 12/2003 |
| GB | 540 027 | 10/1941 |
| GB | 709 365 | 5/1954 |
| GB | 716 761 | 10/1954 |
| GB | 733596 | 7/1955 |
| GB | 7 928 86 | 4/1958 |
| GB | 8 388 33 | 6/1960 |
| GB | 881 358 | 11/1961 |
| GB | 887150 | 1/1962 |
| GB | 9 977 21 | 7/1965 |
| GB | 1 277 461 | 6/1972 |
| GB | 1 306 568 | 3/1973 |
| GB | 1 448 304 | 9/1976 |
| GB | 1 469 661 | 4/1977 |
| GB | 1 582 392 | 1/1981 |
| GB | 2 053 088 | 2/1981 |
| GB | 2 115 940 | 9/1983 |
| GB | 2 170 528 | 8/1986 |
| GB | 0 235 105 | 9/1987 |
| GB | 2 201 912 | 9/1988 |
| GB | 2 216 926 | 10/1989 |
| GB | 2 221 482 | 2/1990 |
| GB | 2 223 253 | 4/1990 |
| GB | 2 224 481 | 9/1990 |
| GB | 2 239 918 | 7/1991 |
| GB | 2 240 799 | 8/1991 |
| GB | 2 275 486 | 4/1993 |
| GB | 2 294 715 | 8/1996 |
| GB | 2 313 860 | 2/1997 |
| GB | 2 320 270 | 6/1998 |
| GB | 2 320 734 | 7/1998 |
| GB | 2 324 108 | 10/1998 |
| GB | 2 326 896 | 1/1999 |
| GB | 2 333 542 | 7/1999 |
| GB | 2 335 217 | 9/1999 |
| GB | 2 345 074 | 6/2000 |
| GB | 2 348 223 | 9/2000 |
| GB | 2347445 | 9/2000 |
| GB | 2 349 401 | 11/2000 |
| GB | 2 350 137 | 11/2000 |
| GB | 2 357 101 | 6/2001 |
| GB | 2 357 530 | 6/2001 |
| GB | 2 352 747 | 7/2001 |
| GB | 2 365 463 | 2/2002 |
| GB | 2 372 271 | 8/2002 |
| GB | 2 372 765 | 9/2002 |
| GB | 2 382 361 | 5/2003 |
| GB | 2381809 | 5/2003 |
| GB | 2 386 626 | 9/2003 |
| GB | 2 389 130 | 12/2003 |
| GB | 2 396 375 | 6/2004 |
| RU | 2 079 633 | 5/1997 |
| RU | 2079633 | 5/1997 |
| SU | 112631 | 1/1956 |
| SU | 659260 | 4/1967 |
| SU | 247162 | 5/1967 |
| SU | 395557 | 12/1971 |
| SU | 415346 | 3/1972 |
| SU | 481689 | 6/1972 |
| SU | 461218 | 4/1973 |
| SU | 501139 | 12/1973 |
| SU | 585266 | 7/1974 |
| SU | 583278 | 8/1974 |
| SU | 601390 | 1/1976 |
| SU | 581238 | 2/1976 |
| SU | 655843 | 3/1977 |
| SU | 781312 | 3/1978 |
| SU | 899820 | 6/1979 |
| SU | 955765 | 2/1981 |
| SU | 1304470 | 8/1984 |
| SU | 1618870 | 1/1991 |
| SU | 1808972 | 5/1991 |
| WO | WO82/01211 | 4/1982 |
| WO | WO90/06418 | 6/1990 |
| WO | WO 91/16520 | 10/1991 |
| WO | WO92/01139 | 1/1992 |

| | | |
|---|---|---|
| WO | WO92/18743 | 10/1992 |
| WO | WO92/20899 | 11/1992 |
| WO | WO93/07358 | 4/1993 |
| WO | WO93/24728 | 12/1993 |
| WO | WO 95/10686 | 4/1995 |
| WO | WO96/18799 | 6/1996 |
| WO | WO 96/28635 | 9/1996 |
| WO | WO97/05360 | 2/1997 |
| WO | WO97/08418 | 3/1997 |
| WO | WO98/01651 | 1/1998 |
| WO | WO98/05844 | 2/1998 |
| WO | WO 98/09053 | 3/1998 |
| WO | WO98/11322 | 3/1998 |
| WO | WO98/32948 | 7/1998 |
| WO | WO98/55730 | 12/1998 |
| WO | WO99/04135 | 1/1999 |
| WO | WO 99/11902 | 3/1999 |
| WO | WO99/18328 | 4/1999 |
| WO | WO 99/23354 | 5/1999 |
| WO | WO99/24689 | 5/1999 |
| WO | WO99/35368 | 7/1999 |
| WO | WO 99/37881 | 7/1999 |
| WO | WO99/41485 | 8/1999 |
| WO | WO 99/50528 | 10/1999 |
| WO | WO99/58810 | 11/1999 |
| WO | WO 99/64713 | 12/1999 |
| WO | WO 00/04269 | 1/2000 |
| WO | WO 00/05483 | 2/2000 |
| WO | WO 00/08293 | 2/2000 |
| WO | WO 00/09853 | 2/2000 |
| WO | WO 00/11309 | 3/2000 |
| WO | WO 00/11310 | 3/2000 |
| WO | WO 00/11311 | 3/2000 |
| WO | WO 00/28188 | 5/2000 |
| WO | WO 00/37768 | 6/2000 |
| WO | WO 00/37771 | 6/2000 |
| WO | WO 00/37772 | 6/2000 |
| WO | WO 00/37773 | 6/2000 |
| WO | WO 00/39429 | 7/2000 |
| WO | WO 00/39430 | 7/2000 |
| WO | WO 00/41487 | 7/2000 |
| WO | WO 00/46484 | 8/2000 |
| WO | WO 00/50730 | 8/2000 |
| WO | WO 00/50732 | 8/2000 |
| WO | WO 00/66879 | 11/2000 |
| WO | WO 00/77431 | 12/2000 |
| WO | WO 01/12946 | 2/2001 |
| WO | WO 01/46550 | 6/2001 |
| WO | WO 01/60545 | 8/2001 |
| WO | WO 01/66901 | 9/2001 |
| WO | WO 01/79650 | 10/2001 |
| WO | WO 01/81708 | 11/2001 |
| WO | WO 01/83932 | 11/2001 |
| WO | WO 01/94738 | 12/2001 |
| WO | WO 01/94739 | 12/2001 |
| WO | WO 02/14649 | 2/2002 |
| WO | WO 02/29199 | 4/2002 |
| WO | WO 02/44601 | 6/2002 |
| WO | WO 02/081863 | 10/2002 |
| WO | WO 02/086287 | 10/2002 |
| WO | WO 02/092956 | 11/2002 |
| WO | WO 03/008790 | 1/2003 |
| WO | WO 03/074836 | 9/2003 |
| WO | WO 03/087525 | 10/2003 |
| WO | WO 2004/022903 | 3/2004 |

OTHER PUBLICATIONS

PCT Invitation to Pay Fees, International Application No. PCT/US2004/003164, dated Aug. 17. 2004.

Hahn, et al., "Simultaneous Drill and Case Technology—Case Histories, Status and Options for Further Development," Society of Petroleum Engineers, IADC/SPE Drilling Conference, New Orlean, LA Feb. 23-25, 2000 pp. 1-9.

M.B. Stone and J. Smith, "Expandable Tubulars and Casing Drilling are Options" Drilling Contractor, Jan./Feb. 2002, pp. 52.

M. Gelfgat, "Retractable Bits Development and Application" Transactions of the ASME, vol. 120, Jun. (1998), pp. 124-130.

"First Success with Casing-Drilling" Word Oil, Feb. (1999), pp. 25.

Dean E. Gaddy, Editor, "Russia Shares Technical Know-How with U.S." Oil & Gas Journal, Mar. (1999), pp. 51-52, and 54-56.

U.S. Appl. No. 10/794,800, filed Mar. 5, 2004.

U.S. Appl. No. 10/832,804, filed Apr. 27, 2004.

U.S. Appl. No. 10/795,214, filed Mar. 5, 2004.

U.S. Appl. No. 10/794,795, filed Mar. 5, 2004.

U.S. Appl. No. 10/775,048, filed Feb. 9, 2004.

U.S. Appl. No. 10/772,217, filed Feb. 2, 2004.

U.S. Appl. No. 10/788,976, filed Feb. 27, 2004.

U.S. Appl. No. 10/794,797, filed Mar. 5, 2004.

U.S. Appl. No. 10/767,322, filed Jan. 29, 2004.

U.S. Appl. No. 10/795,129, filed Mar. 5, 2004.

U.S. Appl. No. 10/794,790, filed Mar. 5, 2004.

U.S. Appl. No. 10/162,302, filed Jun. 4, 2004.

Rotary Steerable Technology—Technology Gains Momentum, Oil & Gas Journal, Dec. 28, 1998.

Directional Drilling, M. Mims, World Oil, May 1999, pp. 40-43.

Multilateral Classification System w/Example Applications, Alan MacKenzie & Cliff Hogg, World Oil, Jan. 1999, pp. 55-61.

Tarr, et al., "Casing-while-Drilling: The Next Step Change In Well Construction," World Oil, Oct. 1999, pp. 34-40.

De Leon Mojarro, "Breaking A Paradigm: Drilling With Tubing Gas Wells," SPE Paper 40051, SPE Annual Technical Conference And Exhibition, Mar. 3-5, 1998, pp. 465-472.

De Leon Mojarro, "Drilling/Completing With Tubing Cuts Well Costs By 30%," World Oil, Jul. 1998, pp. 145-150.

Littleton, "Refined Slimhole Drilling Technology Renews Operator Interest," Petroleum Engineer International, Jun. 1992, pp. 19-26.

Anon, "Slim Holes Fat Savings," Journal of Petroleum Technology, Sep. 1992, pp. 816-819.

Anon, "Slim Holes, Slimmer Prospect," Journal of Petroleum Technology, Nov. 1995, pp. 949-952.

Vogt, et al., "Drilling Liner Technology For Depleted Reservoir," SPE Paper 36827, SPE Annual Technical Conference And Exhibition, Oct. 22-24, pp. 127-132.

Mojarro, et al., "Drilling/Completing With Tubing Cuts Well Costs By 30%," World Oil, Jul. 1998, pp. 145-150.

Sinor, et al., Rotary Liner Drilling For Depleted Reservoirs, IADC/SPE Paper 39399, IADC/SPE Drilling Conference, Mar. 3-6, 1998, pp. 1-13.

Editor, "Innovation Starts At The Top At Tesco," The American Oil & Gas Reporter, Apr. 1998, p. 65.

Tessari, et al., "Casing Drilling—A Revolutionary Approach To Reducing Well Costs," SPE/IADC Paper 52789, SPE/IADC Drilling Conference, Mar. 9-11, 1999, pp. 221-229.

Silverman, "Novel Drilling Method—Casing Drilling Process Eliminates Tripping String," Petroleum Engineer International, Mar. 1999, p. 15.

Silverman, "Drilling Technology—Retractable Bit Eliminates Drill String Trips," Petroleum Engineer International, Apr. 1999, p. 15.

Laurent, et al., "A New Generation Drilling Rig: Hydraulically Powered And Computer Controlled," CADE/CAODC Paper 99-120, CADE/CAODC Spring Drilling Conference, Apr. 7 & 8, 1999, 14 pages.

Madell, et al., "Casing Drilling An Innovative Approach To Reducing Drilling Costs," CADE/CAODC Paper 99-121, CADE/CAODC Spring Drilling Conference, Apr. 7 & 8, 1999, pp. 1-12.

Tessari, et al., "Focus: Drilling With Casing Promises Major Benefits," Oil & Gas Journal, May 17, 1999, pp. 58-62.

Laurent, et al., "Hydraulic Rig Supports Casing Drilling," World Oil, Sep. 1999, pp. 61-68.

Perdue, et al., "Casing Technology Improves," Hart's E & P, Nov. 1999, pp. 135-136.

Warren, et al., "Casing Drilling Application Design Considerations," IADC/SPE Paper 59179, IADC/SPE Drilling Conference, Feb. 23-25, 2000 pp. 1-11.
Warren, et al., "Drilling Technology: Part I—Casing Drilling With Directional Steering In The U.S. Gulf of Mexico," Offshore, Jan. 2001, pp. 50-52.
Warren, et al., "Drilling Technology: Part II—Casing Drilling With Directional Steering In The Gulf Of Mexico," Offshore, Feb. 2001, pp. 40-42.
Shepard, et al., "Casing Drilling: An Emerging Technology," IADC/SPE Paper 67731, SPE/IADC Drilling Conference, Feb. 27-Mar. 1, 2001, pp. 1-13.
Editor, "Tesco Finishes Field Trial Program," Drilling Contractor, Mar./Apr. 2001, p. 53.
Warren, et al., "Casing Drilling Technology Moves To More Challenging Application," AADE Paper 01-NC-HO-32, AADE National Drilling Conference, Mar. 27-29, 2001, pp. 1-10.
Shephard, et al., "Casing Drilling: An Emerging Technology," SPE Drilling & Completion, Mar. 2002, pp. 4-14.
Shephard, et al., "Casing Drilling Successfully Applied In Southern Wyoming," World Oil, Jun. 2002, pp. 33-41.
Forest, et al., "Subsea Equipment For Deep Water Drilling Using Dual Gradient Mud System," SPE/IADC Drilling Conference, Amsterdam, The Netherlands, Feb. 27, 2001-Mar. 1, 2001, 8 pages.
World's First Drilling With Casing Operation From A Floating Drilling Unit, Sep. 2003, 1 page.
Filippov, et al., "Expandable Tubular Solutions," SPE paper 56500, SPE Annual Technical Conference And Exhibition, Oct. 3-6, 1999, pp. 1-16.
Coronado, et al., "Development Of A One-Trip ECP Cement Inflation And Stage Cementing System For Open Hole Completions," IADC/SPE Paper 39345, IADC/SPE Drilling Conference, Mar. 3-6, 1998, pp. 473-481.
Coronado, et al., "A One-Trip External-Casing-Packer Cement-Inflation And Stage-Cementing System," Journal Of Petroleum Technology, Aug. 1998, pp. 76-77.
Quigley, "Coiled Tubing And Its Applications," SPE Short Course, Houston, Texas, Oct. 3, 1999, 9 pages.
Bayfiled, et al., "Burst And Collapse Of A Sealed Multilateral Junction: Numerical Simulations," SPE/IADC Paper 52873, SPE/IADC Drilling Conference, Mar. 9-11, 1999, 8 pages.
Marker, et al., "Anaconda: Joint Development Project Leads To Digitally Controlled Composite Coiled Tubing Drilling System," SPE paper 60750, SPIE/ICOTA Coiled Tubing Roundtable, Apr. 5-6, 2000, pp. 1-9.
Cales, et al., Subsidence Remediation—Extending Well Life Through The Use Of Solid Expandable Casing Systems, AADE Paper 01-NC-HO-24, American Association Of Drilling Engineers, Mar. 2001 Conference, pp. 1-16.
Coats, et al., "The Hybrid Drilling Unite: An Overview Of an Integrated Composite Coiled Tubing And Hydraulic Workover Drilling System," SPE Paper 74349, SPE International Petroleum Conference And Exhibition, Feb. 10-12, 2002, pp. 1-7.
Sander, et al., "Project Management And Technology Provide Enhanced Performance For Shallow Horizontal Wells," IADC/SPE Paper 74466, IADC/SPE Drilling Conference, Feb. 26-28, 2002, pp. 1-9.
Coats, et al., "The Hybrid Drilling System: Incorporating Composite Coiled Tubing And Hydraulic Workover Technologies Into One Integrated Drilling System," IADC/SPE Paper 74538, IADC/SPE Drilling Conference, Feb. 26-28, 2002, pp. 1-7.
Galloway, "Rotary Drilling With Casing—A Field Proven Method Of Reducing Wellbore Construction Cost," Paper WOCD-0306092, World Oil Casing Drilling Technical Conference, Mar. 6-7, 2003, pp. 1-7.
Fontenot, et al., "New Rig Design Enhances Casing Drilling Operations In Lobo Trend," paper WOCD-0306-04, World Oil Casing Drilling Technical Conference, Mar. 6-7, 2003, pp. 1-13.
McKay, et al., "New Developments In The Technology Of Drilling With Casing: Utilizing A Displaceable DrillShoe Tool," Paper WOCD-0306-05, World Oil Casing Drilling Technical Conference, Mar. 6-7, 2003, pp. 1-11.
Sutriono-Santos, et al., "Drilling With Casing Advances To Floating Drilling Unit With Surface BOP Employed," Paper WOCD-0307-01, World Oil Casing Drilling Technical Conferece, Mar. 6-7, 2003, pp. 1-7.
Vincent, et al., "Liner And Casing Drilling—Case Histories And Technology," Paper WOCD-0307-02, World Oil Casing Drilling Technical Conference, Mar. 6-7, 2003, pp. 1-20.
Maute, "Electrical Logging: State-of-the Art," The Log Analyst, May-Jun. 1992, pp. 206-227.
Tessari, et al., "Retrievable Tools Provide Flexibility for Casing Drilling," Paper No. WOCD-0306-01, World Oil Casing Drilling Technical Conference, 2003, pp. 1-11.
Evans, et al., "Development And Testing Of An Economical Casing Connection For Use In Drilling Operations," paper WOCD-0306-03, World Oil Casing Drilling Technical Conference, Mar. 6-7, 2003, pp. 1-10.
Detlef Hahn, Friedhelm Makohl, and Larry Watkins, Casing-White Drilling System Reduces Hole Collapse Risks, Offshore, pp. 54, 56, and 59, Feb. 1998.
Yakov A. Gelfgat, Mikhail Y. Gelfgat and Yuri S. Lopatin, Retractable Drill Bit Technology—Drilling Without Pulling Out Drillpipe, Advanced Drilling Solutions Lessons From the FSU; Jun. 2003; vol. 2, pp. 351-464.
Tommy Warren, SPE, Bruce Houtchens, SPE, Garret Madell, SPE, Directional Drilling With Casing, SPE/IADC 79914, Tesco Corporation, SPE/IADC Drilling Conference 2003.
LaFleur Petroleum Services, INc., "Autoseal Circulating Head," Engineering Manufacturing, 1992, 11 Pages.
Valves Wellhead Equipment Safety Systems, W-K-M Division, ACF Industries, Catalog 80, 1980, 5 Pages.
Canrig Top Drive Drilling Systems, Harts Petroleum Engineer International, Feb. 1997, 2 Pages.
The Original Portable Top Drive Drilling System, TESCO Drilling Technology, 1997.
Mike Killalea, Portable Top Drives: What's Driving The Marked?, IADC, Drilling Contractor, Sep. 1994, 4 Pages.
500 or 650 ECIS Top Drive, Advanced Permanent Magnet Motor Technology, TESCO Drilling Technology, Apr. 1998, 2 Pages.
500 or 650 HCIS Top Drive, Powerful Hydraulic Compact Top Drive Drilling System, TESCO Drilling Technology, Apr. 1998, 2 Pages.
Product Information (Sections 1-10) CANRIG Drilling Technology, Ltd., Sep. 18, 1996.
PCT Search Report, International Application No. PCT/US2004/003164, dated Feb. 2, 2005.
Alexander Sas-Jaworsky and J. G. Williams, Development of Composite Coiled Tubing For Oilfield Services, SPE 26536, Society of Petroleum Engineers, Inc., 1993.
A. S. Jafar, H.H.Al-Attar, and I. S. El-Ageli, Discussion and Comparison of Performance of Horizontal Wells in Bouri Field, SPE 26927, Society of Petroleum Engineers, Inc. 1996.
G. F. Boykin, The Role of A Worldwide Drilling Organization and the Road to the Future, SPE/IADC 37630, 1997.
M. S. Fuller, M. Littler, and I. Pollock, Innovative Way To Cement a Liner Utilizing a New Inner String Liner Cementing Process, 1998.
Helio Santos, Consequences and Relevance of Drillstring Vibration on Wellbore Stability, SPE/IADC 52820, 1999.
Chan L. Daigle, Donald B. Campo, Carey J. Naquin, Rudy Cardenas, Lev M. Ring, Patrick L. York, Expandable Tubulars: Field Examples of Application in Well Construction and Remediation, SPE 62958, Society of Petroleum Engineers Inc., 2000.
C. Lee Lohoefer, Ben Mathis, David Brisco, Kevin Waddell, Lev Ring, and Patrick York, Expandable Liner Hanger Provides Cost-Effective Alternative Solution, IADC/SPE 59151, 2000.
Kenneth K. Dupal, Donald B. Campo, John E. Lofton, Don Weisinger, R. Lance Cook, Michael D. Bullock, Thomas P. Grant, and Patrick L. York, Solid Expandable Tubular Technology—A Year of Case Histories In the Drilling Environment, SPE/IADC 67770, 2001.
Mike Bullock, Tom Grant, Rick Sizemore, Chan Daigle, and Pat York, Using Expandable Solid Tubulars To Solve Well Construction Challenges In Deep Waters And Maturing Properties, IBP 27500, Brazilian Petroleum Institute—IBP, 2000.

Coiled Tubing Handbook, World Oil, Gulf Publishing Company, 1993.

Multilateral Case History, Onshore-Nigeria, Baker Hughes, 2000.

Multilateral Case History, Offshore Norway, Baker Hughes, 1995.

Tommy Warren, Bruce Houtchens, and Garrett Madell, Directional Drilling With Casing, SPE/IADC 79914, SPE/IADC Drilling Conference, Amsterdam, The Netherlands, Feb. 19-21, 2003, pp. 1-10.

European Search Report, Application No. 04707464.8, dated May 22, 2006.

EP Partial Search Report, Application No. 04 707 464-, 6-1266, dated Mar. 9, 2006.

Charles O. Vail and Verne Smith, New Developments In Air-Gas Drilling and Completions, World Oil, Part One, Nov. 1963, pp. 70-73.

Charles O. Vail and Verne Smith, New Developments In Air-Gas Drilling and Completions, World Oil, Part Two, Dec. 1963, pp. 82-86.

* cited by examiner

*Primary Examiner*—William Neuder
(74) *Attorney, Agent, or Firm*—Patterson & Sheridan, LLP

(57) ABSTRACT

Apparatus and methods for drilling with casing. In an embodiment, methods and apparatus for deflecting casing using a diverter apparatus are disclosed. In another embodiment, the apparatus comprises a motor operating system disposed in a motor system housing, a shaft operatively connected to the motor operating system, the shaft having a passageway, and a divert assembly disposed to direct fluid flow selectively to the motor operating system and the passageway in the shaft. In another aspect, methods and apparatus for directionally drilling a casing into the formation are disclosed. Methods and apparatus for measuring the trajectory of a wellbore while directionally drilling a casing into the formation are also described.

50 Claims, 50 Drawing Sheets

FIG. 43
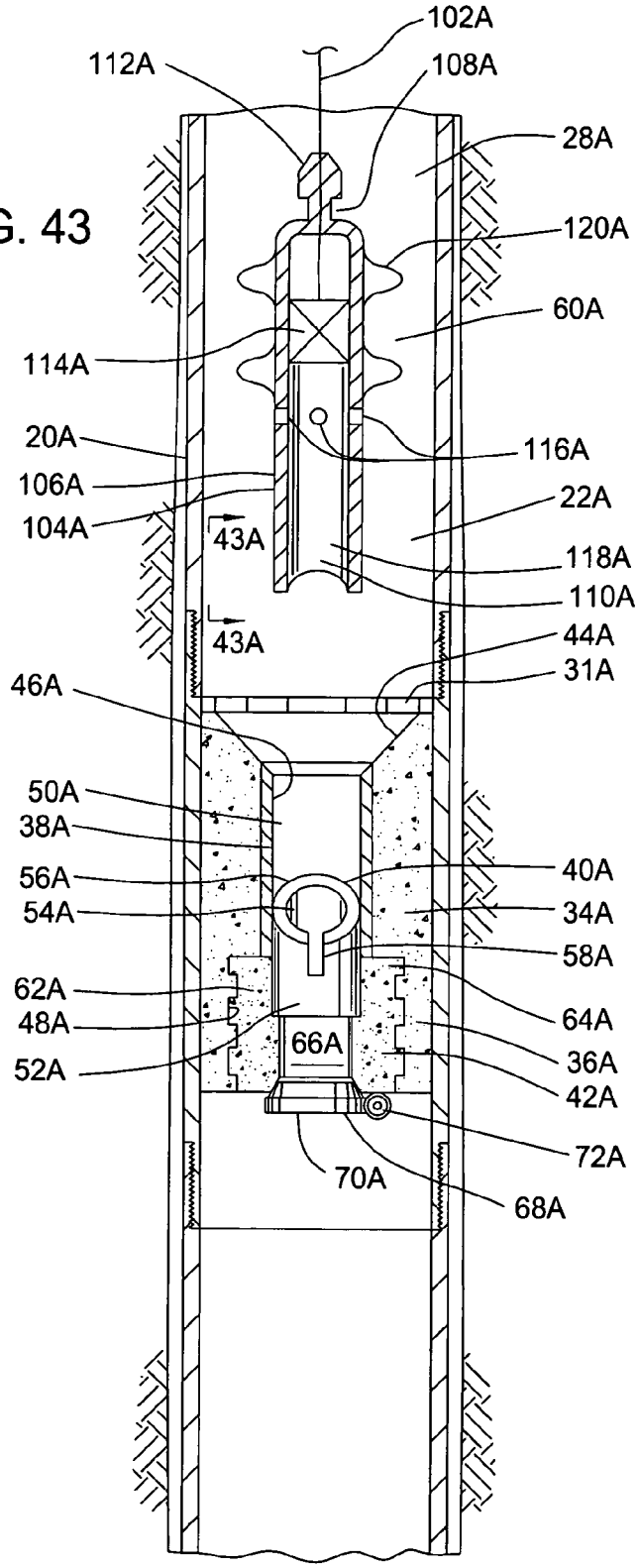
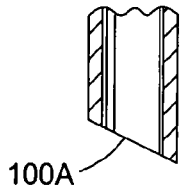
FIG. 43A

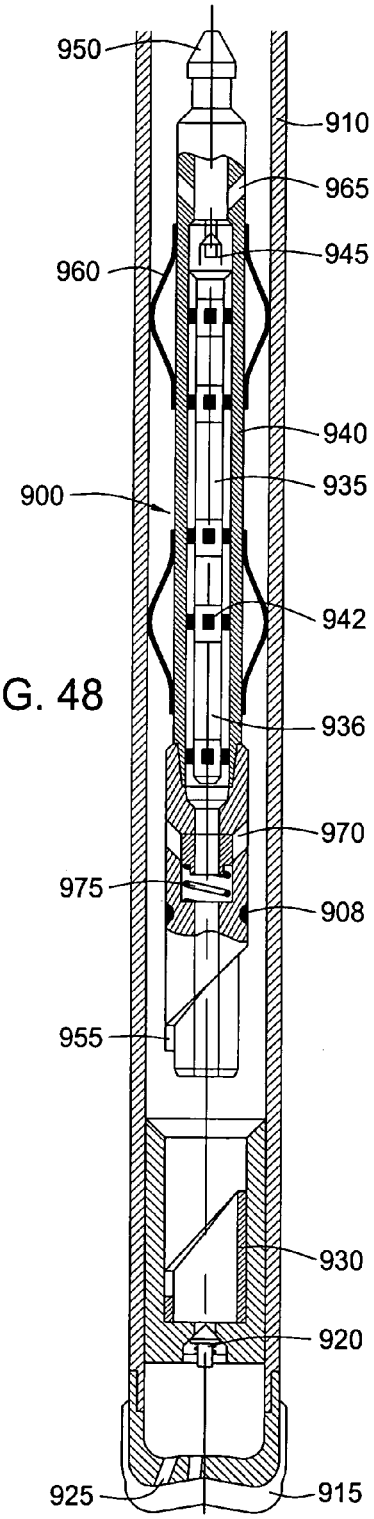
FIG. 48
FIG. 49
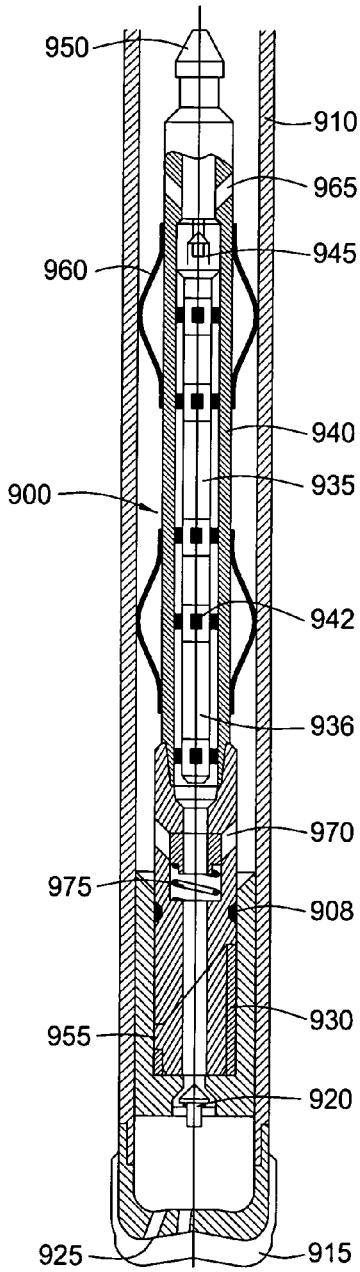

APPARATUS AND METHODS FOR DRILLING A WELLBORE USING CASING

CROSS-REFERENCE TO RELATED APPLICATIONS

This application is a continuation-in-part of U.S. patent application Ser. No. 10/257,662 filed on Apr. 2, 2001, now U.S. Pat. No. 6,848,517, which application is herein incorporated by reference in its entirety. U.S. patent application Ser. No. 10/257,662 is the national phase application of PCT/GB01/01506 filed on Apr. 2, 2001.

This application claims benefit of U.S. Provisional Patent Application Ser. No. 60/444,088 filed on Jan. 31, 2003, which application is herein incorporated by reference in its entirety. This application further claims benefit of U.S. Provisional Patent Application Ser. No. 60/452,202 filed on Mar. 5, 2003, which application is herein incorporated by reference in its entirety. This application further claims benefit of U.S. Provisional Patent Application Ser. No. 60/452,186 filed on Mar. 5, 2003, which application is herein incorporated by reference in its entirety. This application further claims benefit of U.S. Provisional Patent Application Ser. No. 60/452,317 filed on Mar. 5, 2003, which application is herein incorporated by reference in its entirety.

This application is a continuation-in-part of U.S. patent application Ser. No. 10/331,964, filed on Dec. 30, 2002, now U.S. Pat. No. 6,857,487.

BACKGROUND OF THE INVENTION

1. Field of the Invention

Embodiments of the present invention generally relate to methods and apparatus for drilling and completing a well. More particularly, embodiments of the present invention relate to methods and apparatus for directionally drilling with casing. Even more particularly, embodiments of the present invention generally relate to the field of well drilling, particularly to the field of well drilling for the extraction of hydrocarbons from subsurface formations, wherein the direction of the drilling of the wellbore is steered and the need to determine the orientation of the drill bit within the earth is present.

2. Description of the Related Art

In conventional well completion operations, a wellbore is formed by drilling to access hydrocarbon-bearing formations. Drilling is accomplished utilizing a drill bit which is mounted on the end of a drill support member, commonly known as a drill string. The drill string is often rotated by a top drive or a rotary table on a surface platform or rig. Alternatively, the drill bit may be rotated by a downhole motor mounted at a lower end of the drill string. After drilling to a predetermined depth, the drill string and drill bit are removed (e.g., pulled out), and a section of the casing is lowered into the wellbore. An annular area is formed between the string of casing and the formation, and a cementing operation may then be conducted to fill the annular area with cement. The combination of cement and casing strengthens the wellbore and facilitates the isolation of certain areas of the formation behind the casing for the production of hydrocarbons.

It is common to employ more than one string of casing in a wellbore. Typically, the well is drilled to a first designated depth with a drill bit on a drill string. The drill string is then removed, and a first string of casing or conductor pipe is run into the wellbore and set in the drilled out portion of the wellbore. Cement is circulated into the annulus outside the casing string. Next, the well is drilled to a second designated depth, and a second string of casing or liner is run into the drilled out portion of the wellbore. The second string is set at a depth such that the upper portion of the second string of casing overlaps the lower portion of the first string of casing. The second liner string is fixed or hung off the first string of casing utilizing slips to wedge against an interior surface of the first casing. The second string of casing is then cemented. The process may be repeated with additional casing strings until the well has been drilled to a target depth. In this manner, wells are typically formed with two or more strings of casing of an ever-decreasing diameter.

As an alternative to the conventional method, a method of drilling with casing is often utilized to position casing strings of decreasing diameter within a wellbore. Drilling with casing utilizes a cutting structure (e.g., drill bit or drill shoe) attached to the lower end of the same casing string which will line the wellbore. The entire casing string may be rotated by mechanical devices at the surface, which ultimately rotates the drill bit so that the drill bit drills into the formation. Once the well has been drilled to the target depth with the casing in place, the casing may be cemented to complete the well. Additional casing strings may be run through the first casing string and drilled further into the formation to form a wellbore of a second depth, and this process may be completed with subsequent additional casing strings. Drilling with casing is often the preferred method of well completion because only one run-in of the working string into the wellbore is necessary to form and line the wellbore.

Drilling with casing is useful in drilling and lining a subsea wellbore, particularly in a deep water well completion operation. When forming a subsea wellbore, the length of wellbore that has been drilled with a drill string is subject to potential collapse because of the soft formations present at the ocean floor. Also, sections of the wellbore intersecting regions of high pressure can cause damage to the drilled wellbore during the time lapse between the formation of the wellbore and the lining of the wellbore. Drilling with casing removes such time lapses and alleviates these problems.

An alternative drilling with casing method which is sometimes practiced instead of rotating the casing string to drill into the formation involves "jetting" or pushing the casing into the formation. Because hydraulic energy from nozzles in a drill bit is often sufficient to remove the formation without using bit cutters, it is often necessary to jet the pipe into the ground by forcing pressurized fluid through the inner diameter of the casing string concurrent with lowering the casing string into the wellbore. The fluid and the mud are thus forced to flow upward outside the casing string, so that the casing string remains essentially hollow to receive the casing strings of decreasing diameter which contribute to lining the wellbore. To accomplish jetting of the pipe, holes or nozzles may be formed through the lower end of the drill bit to allow fluid flow through the casing string and up into the annular space between the outside of the casing string and the wellbore. The holes may be essentially symmetric with respect to the drill bit so that a uniform amount of fluid is released along the diameter of the casing string.

In a further alternate drilling with casing method, a motor and a drill bit may be attached to a drill pipe and positioned at a terminal portion of the first casing string to allow rotational drilling of the casing string into the formation if desired, as well as allowing jetting by lowering the casing string into the formation to continue. The drill bit may be rotated while the first casing string is lowered into the formation to facilitate drilling the first casing string to a desired depth. Upon reaching the desired depth, the drill bit and the drill pipe may continue to drill down to a target depth to enable placement of the second casing string. When casing string reaches the target depth, the drill pipe, motor, and drill bit are pulled out of the wellbore while the casing string remains within the wellbore prior to cementing the casing string into the wellbore. The second casing string is run in and placed in the wellbore at the target depth, the motor system retrieved, and then the second casing string is cemented therein. Additional cost and time for completing a wellbore are inherent results of the current drilling with casing operation because the motor system must be retrieved from the wellbore prior to the cementing operation.

For various reasons, it may be necessary to deviate from the natural (e.g., substantially vertical) direction of the wellbore and drill a deviated hole. Drilling with casing techniques may also be utilized to drill a deviated hole, commonly referred to as "directional drilling with casing."

In subsea drilling operations, a drilling platform is supported by the subterranean formation at the bottom of a body of water. The drilling platform is the surface from which the casing sections and strings, cutting structures, and other supplies are lowered to form a subterranean wellbore lined with casing. Each drilling platform represents a relatively significant cost. Also, governmental regulations allow only a limited number of platforms over a given surface area of the body of water. Accordingly, platforms must be spaced a predetermined distance apart for drilling subterranean wellbores. Additionally, each platform must only occupy a specified area of the surface of the body of water. Because only a certain number of platforms of a given dimension are allowed over a given surface area and because of the possibly prohibitive economic cost of multiple platforms, the number of wellbores drilled into the subterranean formation should be the maximum amount of wellbores which can be drilled into the subterranean formation from the permitted platforms. In this manner, hydrocarbon production is maximized, because increasing the producing wells increases the hydrocarbons obtainable at the surface of the wellbore. Each wellbore formed is therefore valuable as an independent producing well which directly increases production from the hydrocarbon source.

A common problem with drilling subsea wellbores is encountered due to the attempt to maximize hydrocarbon production by maximizing the number of wellbores drilled from slots in a platform of limited surface area. To drill the maximum amount of wells, the slots in the platform must exist at extremely close proximity to one another. The closer the proximity of the slots to one another, the more wellbores which can be drilled over a given surface area. Unfortunately, drilling the wellbores through the slots which are so close to one another leaves little room for even small directional deviations when the wellbore is not drilled directly downward into the subsea formation. Sometimes, the wellbores are accidentally deflected and drilled into one another, causing the wellbores to intersect. When two or more wellbores intersect, at least one wellbore is eliminated as an independent hydrocarbon production source. Thus, the allowed drilling area from the platform is reduced, causing a decrease in the production of hydrocarbons from the subsea formation.

To avoid the intersection of wellbores, the wellbores are often drilled at an angle from the slots in the platform. The wellbores drilled from the outermost slots on the platform are typically drilled at an angle outward from the platform, and the outward angle decreases progressively for the inward slots. Thus, wellbores should deviate slightly away from other wellbores to avoid interference with one another. Other instances exist when it would be desirable to directionally drill a wellbore, such as when drilling at an angle is necessary to reach a production zone.

Various methods of deviated drilling or nudging are currently practiced. One method involves pre-drilling a hole directionally with a drill bit on a drill string. In this method, a wellbore is drilled into the formation at an angle. The drill string is then removed and a string of casing placed into the pre-drilled hole. This method fails to prevent caving in of the wellbore between the time in which the hole is drilled and the time in which the casing is inserted into the wellbore. Moreover, the increased time and expense inherent in running the drill string and the casing string into the wellbore separately are disadvantages of this method.

Another method to accomplish the deviation involves first drilling a pilot hole which is smaller in diameter than the desired wellbore and angled in the desired direction. The hole is then enlarged to subsequently run the casing therethrough. This method involves at least two run-ins of the drill string to drill two holes of different diameter, increasing time, expense, and wellbore collapse potential.

There is a need, therefore, for apparatus and methods which are effective for drilling the casing into the formation in subsea well completion operations. There is a further need for nudging methods and apparatus which effectively deviate the subterranean wellbore while drilling the string of casing into the formation to prevent intersection of the wellbores.

Additionally, with the current drilling systems, drilling tools and casing strings need to be run and/or retrieved a plurality of times into and/or out of the wellbore to complete drilling, casing, casing expansion, and cementing operations, resulting in substantial costs and length of time for completing a well. Therefore, there is a need for an apparatus and method for performing drilling, casing, expansion, and cementing operations which substantially reduce the time and costs for completing a well. Particularly, there is a need for an apparatus and method for performing a drilling operation while casing the wellbore which allows a cement operation to be performed subsequently without having to first retrieve the motor system utilized for the drilling operation. Additionally, it would be desirable for the apparatus to be able to perform these operations in a variety of settings utilizing different equipment and tools. It would be desirable for the apparatus to perform deviated drilling or nudging operations which produce deviated wells.

As an alternate technique of drilling with casing which may be utilized instead of merely attaching a cutting structure to the casing, a bottomhole assembly ("BHA") having a drill bit may be lowered into the formation with a casing. The drill bit is exposed through the lower end of the casing, and the BHA is secured to a bottom portion of the inner diameter of the casing. After lowering the casing into the formation, the drill bit is rotated either in a rotary mode by rotating the casing (e.g., utilizing the casing as a drill string) or in a slide mode by rotating the bit independently of the casing with a downhole drill motor. In either case, as the wellbore is extended, additional lengths of casing are added to the wellbore from the surface as the casing string advances with the wellbore.

FIG. 32 illustrates a conventional system for directional drilling with casing using a BHA 3100. As illustrated, the BHA 3100 with a pilot drill bit 3108 is typically run through the casing 3104 (lining a wellbore 3102) and secured to a bottom portion of the casing 3104 with a casing latch 3106. As previously described, the BHA 3100 may be operated in a rotary mode, by rotating the casing from the surface of the wellbore. As an alternative, the BHA 3100 may include a downhole motor 3112 above the pilot bit 3108. As illustrated, the motor 3112 may be integral with a bent subassembly (or housing) 3114 to bias the pilot in the desired deviated direction (thus, the motor 3112 is commonly referred to as a "bent housing motor"). The deviated hole is drilled by adjusting the bent subassembly 3114 to point the pilot bit 3108 in the desired deviated direction. The trajectory of the deviated hole is typically dictated by the curvature that passes through the centers of the pilot bit 3108, the bend in the motor 3112, and the casing latch 3106.

The deviated wellbore must be larger than the outside diameter of the casing 3104 to allow the casing to advance as the wellbore is extended. This is typically accomplished by utilizing an underreamer 3110 to enlarge a pilot hole drilled with the pilot bit 3108. In other words, as the motor 3112 is operated, the pilot bit 3108 is rotated forming the pilot hole, which is then enlarged by the underreamer 3110 following behind. To run the BHA 3100 through the casing 3104, expandable blades of the underreamer 3110 may be placed in a retracted position. The blades may be expanded prior to drilling the deviated hole and again retracted to retrieve the BHA 3100, through the casing 3104, after drilling. The BHA 3100 may also include sensing equipment 3109, commonly referred to as a logging-while-drilling (LWD) or measuring-while-drilling (MWD), to take trajectory measurements (e.g., inclination and azimuth) and possibly formation measurements (e.g., resistivity, porosity, gamma, density, etc.) at several points along the wellbore which may be later used to approximate the wellbore path. MWD equipment usually contains the wellbore surveying sensors, while LWD equipment usually contains formation logging sensors.

The typical BHA 3100, when connected to the casing 3104 with the casing latch 3106, extends about 90 to 100 feet below the lower end of the casing 3104. The extension of the BHA 3100 below the casing 3104 allows the pilot drill bit 3108 to form a rat hole (extended wellbore) below the lower end of the casing 3104. The rat hole has a diameter larger than the outer diameter of the casing 3104 due to the underreamer 3110. In the typical directional drilling process utilizing the BHA 3100, the pilot bit 3108 is rotated to drill directionally the casing 3104 into a formation. The casing 3104 is then released from engagement with the casing latch 3106 of the BHA 3100, and the casing 3104 is lowered over the BHA 3100 to the bottom of the rat hole. The BHA 3100 is eventually removed from the wellbore, and the casing 3104 is left in the wellbore.

The rat hole formation step and the step of lowering the casing 3104 over the BHA 3100 are required when using the current system of drilling with casing 3104 using a BHA 3100 because the bent housing 3114 must have a bend extending below the casing 3104 sufficient to introduce the desired trajectory into the deviated hole. Thus, the directional force for drilling the directional wellbore is supplied by the motor 3112 bend of the bent housing 3114 of the BHA 3100, as the bent housing motor 3112 pushes directly on and against the side of the wellbore. Because the bent housing motor 3112 pushes against the side of the wellbore, a resultant force is caused on the opposite side, of the underreamer 3110 and pilot drill bit 3108.

While the system illustrated in FIG. 32 may allow for the drilling of a deviated wellbore without removing casing, the system suffers a number of disadvantages. As an example, one disadvantage arises due to a lack of proper support between the casing latch 3106 and the point of contact of the pilot bit 3108. As the typical length between the casing latch 3106 and the pilot bit 3108 may be in the range of between 40 feet to 120 feet, the BHA 3100 may buckle and lean towards a lower end of the deviated hole as downward force (i.e., "weight on bit") is applied from the surface. This leaning is difficult to control and can severely affect the intended curvature and trajectory of the deviated hole. Further, without proper support, excessive lateral and axial vibrations in the BHA 3100 may reduce removal rate, reduce operating lifetime, and/or cause damage to the various components of the BHA 3110, particularly when drilling in rotary mode.

A further disadvantage of the system of FIG. 32 lies in the large length of the rat hole drilled below the lower end of the casing 3104, into which the casing 3104 must be lowered over the BHA 3100. Lowering the casing 3104 over the BHA 3100 in the 90-100 foot rat hole adds an extra step to the directional drilling with casing operation. Additionally, the system places unnecessary directional force directly on the BHA 3100. Still another disadvantage in conventional drilling with casing systems is that the MWD 3109 does not provide real time survey information and, thus, the trajectory of the deviated hole can only be verified after drilling. This is unfortunate because real time feedback regarding the trajectory of the wellbore as it is being extended could be used to control the drilling process (e.g., adjust rotation speed of the bit, weight-on-bit, steer a rotary-steerable assembly or downhole motor, etc.), to control the trajectory of the wellbore.

When directionally drilling with a drill string, as the well is drilled, the bore direction must be checked or monitored, to ensure that the bore direction is not deviating from its intended direction. Such monitoring is typically provided by positioning a survey tool in a downhole location, in a rotationally fixed or known position, and monitoring signals therefrom to determine the orientation of the drill string in the earth. Where the drill string is pulled from the well after the wellbore is drilled, and the well is then cased, this is easily accomplished by fixing the survey tool in a subassembly in the drill string, and thus the survey tool is continuously in the borehole when the drill bit is at the bottom of the hole. However, where the drill string is later used as the casing, this is not practicable because the orientation tool is expensive, and therefore it is undesirable to abandon it in the well. Also, the survey tool, if left in the well, would create an obstruction to well fluid recovery, or for the passage of an additional drilling element therepast and thence through the end of the casing to continue drilling the borehole to greater extent, and thus would need to be drilled or milled out of the bore hole. Therefore, there exists a need in the art for a mechanism to provide downhole orientation tools in situations where the drill string is subsequently used, in situ, as the well casing, without creating an undue impediment to well fluid recovery, and without the economic consequences of leaving the survey tool in the hole after the well is complete.

SUMMARY OF THE INVENTION

Embodiments of the invention provide systems and methods for performing drilling, casing, and cementing operations which substantially reduce the time and costs for completing a well. More particularly, embodiments of the invention provide systems and methods for performing a drilling operation while casing the wellbore which allows a cement operation to be performed subsequently without having to first retrieve the motor system utilized for the drilling operation.

In one aspect, embodiments of the present invention provide a method for directing a trajectory of a lined wellbore comprising providing a drilling assembly comprising a wellbore lining conduit and an earth removal member, directionally biasing the drilling assembly while operating the earth removal member and lowering the wellbore lining conduit into the earth, and leaving the wellbore lining conduit in a wellbore created by the biasing, operating and lowering.

Embodiments of the invention are capable of performing these operations in a variety of settings utilizing different equipment and tools and perform deviated drilling or nudging operations which produce deviated wells. For example, embodiments of the invention may be utilized with an inter string, a bent pup joint, an orientation device, or without such tool. Furthermore, the apparatus may be utilized to perform a casing expansion operation concurrently with the retrieval of the motor system utilized for the drilling operation.

In one embodiment, an apparatus for drilling is provided. The apparatus comprises a motor operating system disposed in a motor system housing, a shaft operatively connected to the motor operating system, the shaft having a passageway, and a divert assembly disposed to direct fluid flow selectively to the motor operating system and the passageway in the shaft. The divert assembly facilitates switching of fluid flow to the motor operating system during a drilling operation and fluid flow through the passageway in the motor system during a cementing operation such that the motor system need not be removed to perform a cementing operation for the well.

Another embodiment provides an apparatus for drilling with casing, comprising a casing, a motor system retrievably disposed in the casing, and a drill face operably connected to shaft of the motor system. The motor system comprises a motor operating system disposed in a motor system housing; a shaft operatively connected to the motor operating system, the shaft having a passageway; and a divert assembly disposed to direct fluid flow selectively to the motor operating system and the passageway in the shaft.

In another embodiment, a method for drilling and completing a well is provided. The method comprises pumping drilling fluid or drill mud to a motor system disposed in a casing; rotating an earth removal member, preferably a drill face, connected to the motor system; diverting fluid flow to a passageway through the motor system; and pumping cement through the passageway to the drill face. The motor system may be retrieved after the cement operation, and a casing expansion operation may be performed while retrieving the motor system.

An additional aspect of the present invention involves a method of initiating and continuing the formation of a wellbore by selectively altering the path of the casing string inserted into the formation as it travels downward into the formation. In one embodiment, the diverting apparatus comprises the casing string and cutting apparatus, along with a bend introduced into the casing string which influences the casing string to follow the general direction of the bend when forming a wellbore.

In another embodiment, the diverting apparatus comprises the casing string and cutting apparatus, as well as a diverter in the form of an inclined wedge releasably attached to a lower end of the casing string. In yet another embodiment, the diverting apparatus comprises the casing string, the cutting apparatus, and a fluid deflector. The diverting apparatus in yet another embodiment comprises the casing string, the cutting apparatus, the fluid deflector, and pads placed on the outer diameter of the casing string.

Another embodiment of the diverting apparatus also involves diverting fluid. In yet another embodiment, the diverting apparatus comprises the casing string, the cutting apparatus, and a second cutting apparatus disposed on the outer diameter of a portion of the casing string above the cutting apparatus.

A further aspect of the present invention is an apparatus and method for use with the diverting apparatus embodiments. The diverting apparatus is releasably connected to a drilling apparatus. In operation, after the wellbore path has been diverted by the diverting apparatus, the releasable connection between the drilling apparatus and the diverting apparatus is released. The drilling apparatus is then pulled upward to drill through the inner diameter of the casing string to remove any obstructions present inside the casing string which were previously used to divert the wellbore. Additional casing strings may then be hung off of the casing string, and further operations may then be conducted through the casing string. An even further aspect of the present invention involves a method and apparatus for surveying the path of the wellbore while penetrating the formation with the casing string to form the wellbore.

One embodiment provides a drilling assembly for extending a wellbore, the drilling assembly adapted to be run through casing lining the wellbore. The drilling assembly generally includes a casing latch for securing the drilling assembly to the casing, a bit attached to a bottom portion of the drilling assembly, a biasing member for providing the bit with a desired deviation from a center line of the wellbore, and at least one adjustable stabilizer for supporting the drilling assembly between the casing latch and the bit.

Another embodiment provides a drilling assembly for extending a wellbore, the drilling assembly attachable to casing lining the wellbore. The drilling assembly generally includes a bit disposed on a bottom portion of the drilling assembly, the bit adapted to be expanded from a first position for running through the casing to a second position for drilling a hole below the casing, the hole having a greater diameter than an outer diameter of the casing, and at least one stabilizer positioned between the bit and the bottom portion of the casing, the stabilizer adapted to be adjusted from a first position for running through a casing lining the wellbore to a second position for engaging an inner surface of the wellbore.

Another embodiment provides a method for drilling with casing. The method generally includes lowering a drilling assembly down a wellbore through casing, the drilling assembly comprising an adjustable stabilizer and one or more drilling elements, adjusting one or more support members of the stabilizer to increase a diameter of the stabilizer, and operating the drilling assembly to extend a portion of the wellbore below the casing, the extended portion having a diameter greater than an outer diameter of the casing.

The present invention generally provides methods and apparatus for positioning a downhole tool, such as a survey tool, in a downhole location in a fixed position relative to the drill string, both with respect to the distance between the survey tool and the drill bit, as well as the rotational alignment or orientation of the tool to the drill string and drill bit structure, and the capability to retrieve such tool before the well is used for production. In one embodiment, the drill string is provided with a drillable float sub, which includes an orientation member therein into which a survey tool, such as an orientation tool, is received in a known orientation when the survey tool is positioned in a downhole location within such drill string, and which is also useable as a cement float shoe, for traditional cementing operation to cement the casing in place in the borehole. The survey tool is thereby orientable in the drill string to enable meaningful orientation survey of the drill bit and bore orientation, either on a sampling or continuous basis. In another aspect, the survey tool may communicate information relating to orientation to the surface using via mud pulse telemetry, or other methods known to a person of ordinary skill in the art.

In a further embodiment, the float sub includes a muleshoe profile which receives a mating muleshoe profile of the survey tool. The muleshoe profile is positioned in a sleeve, into which the survey tool may be positioned, such that the muleshoe profile on the survey tool will align on the muleshoe profile of the float sub, thereby orienting the survey tool in the drill string. In a still further embodiment, the mule shoe profile of the float sub may include a secondary alignment member, to enable the landing of survey tools therein which do not include such mule shoe profile.

BRIEF DESCRIPTION OF THE PREFERRED EMBODIMENT

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

Figure 16:
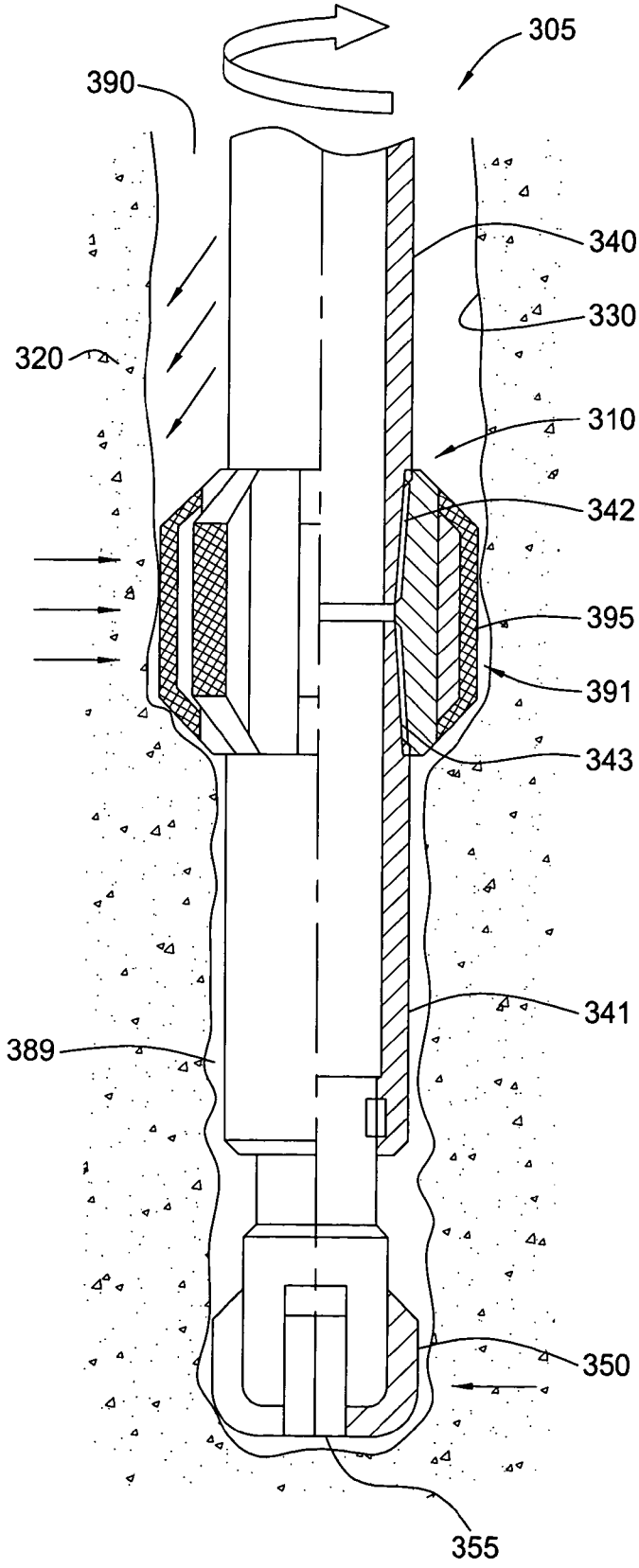

FIG. 16 is a cross-sectional view of a further alternate embodiment of a diverting apparatus of the present invention disposed within a subterranean wellbore. A cutting apparatus in the form of an elongated coupling extends outward from the outer diameter of the casing. The right side of the casing axis in FIG. 16 is cut away to show a threadable connection.

Figure 17:
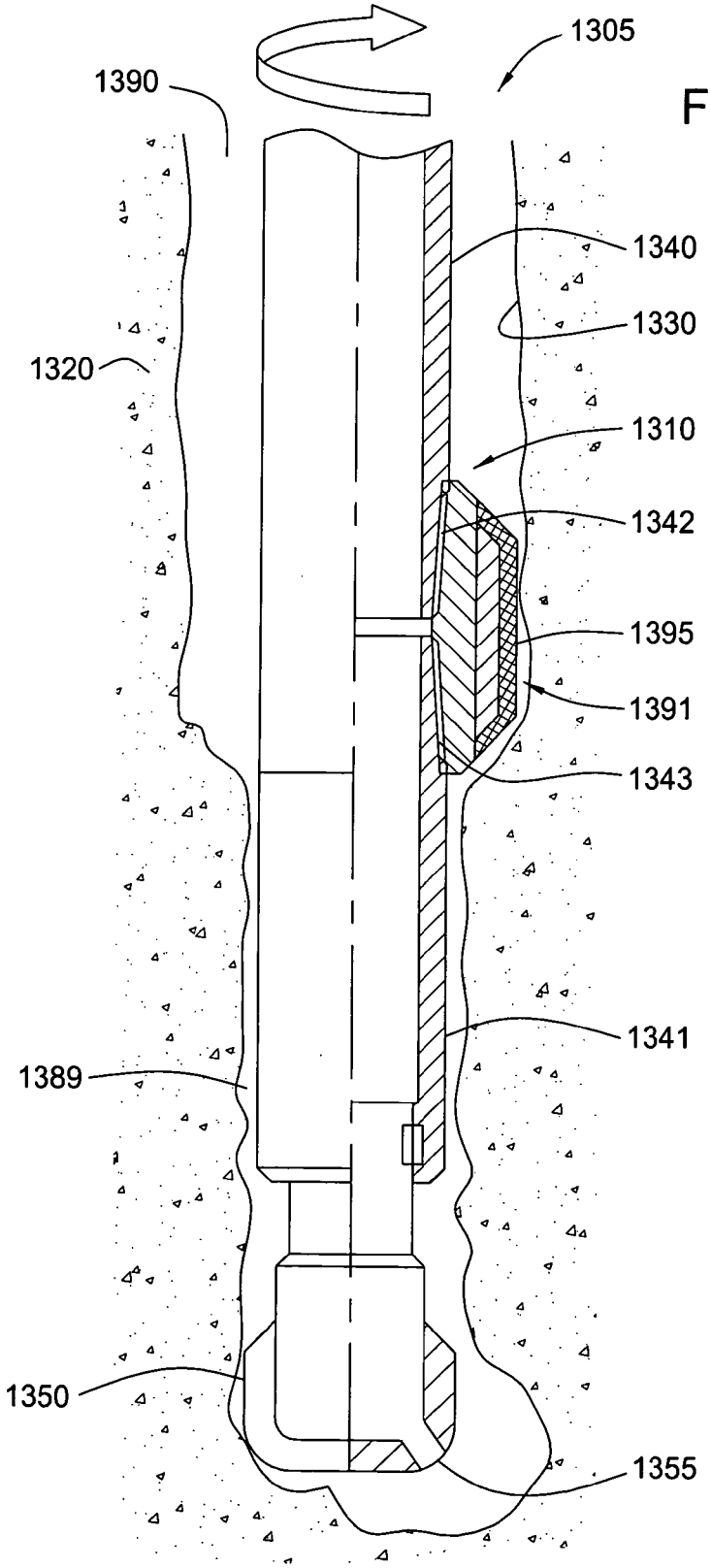

FIG. 17 shows an alternate embodiment of the diverting apparatus of the present invention having an eccentric stabilizer disposed thereon.

Figure 18:
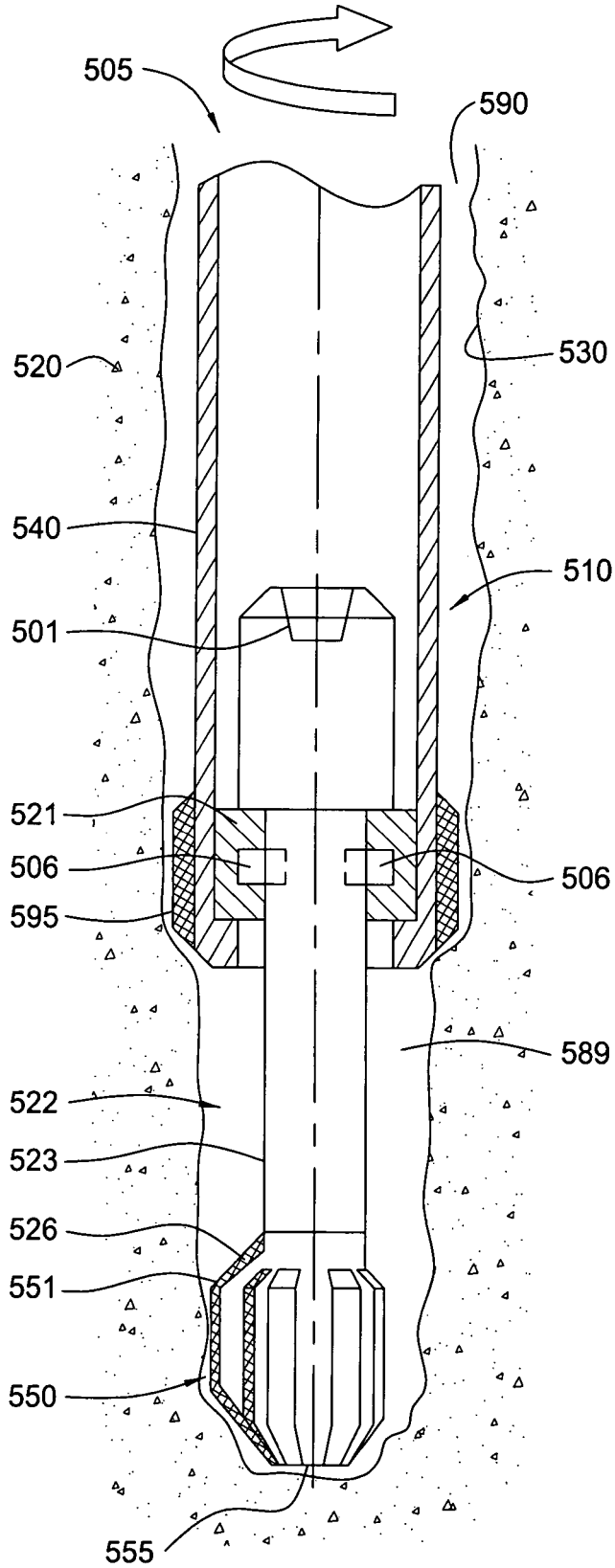

FIG. 18 is a cross-sectional view of a drilling apparatus for use with the diverting apparatus of the present invention in the run-in configuration. The drilling apparatus is shown after drilling a wellbore into the formation.

Figure 19:
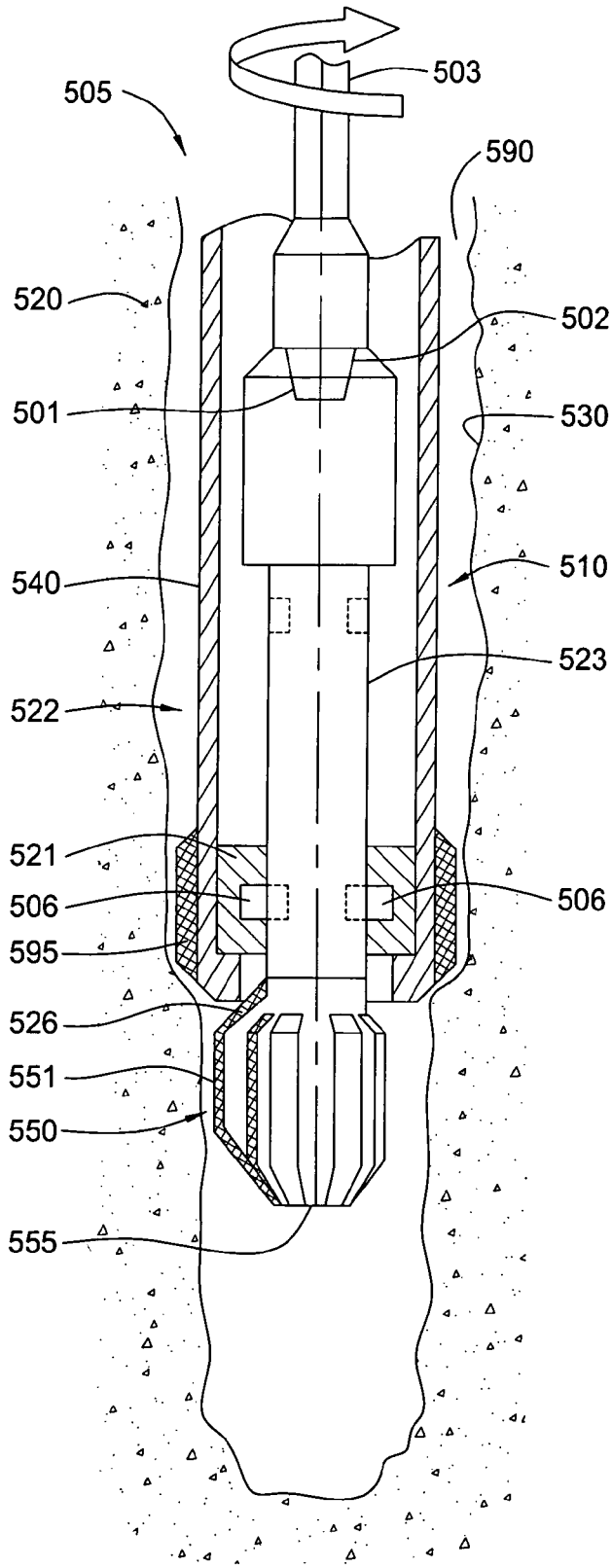

FIG. 19 is a cross-sectional view of the drilling apparatus of FIG. 18 drilling through the diverting apparatus upon removal from the wellbore.

Figure 20:
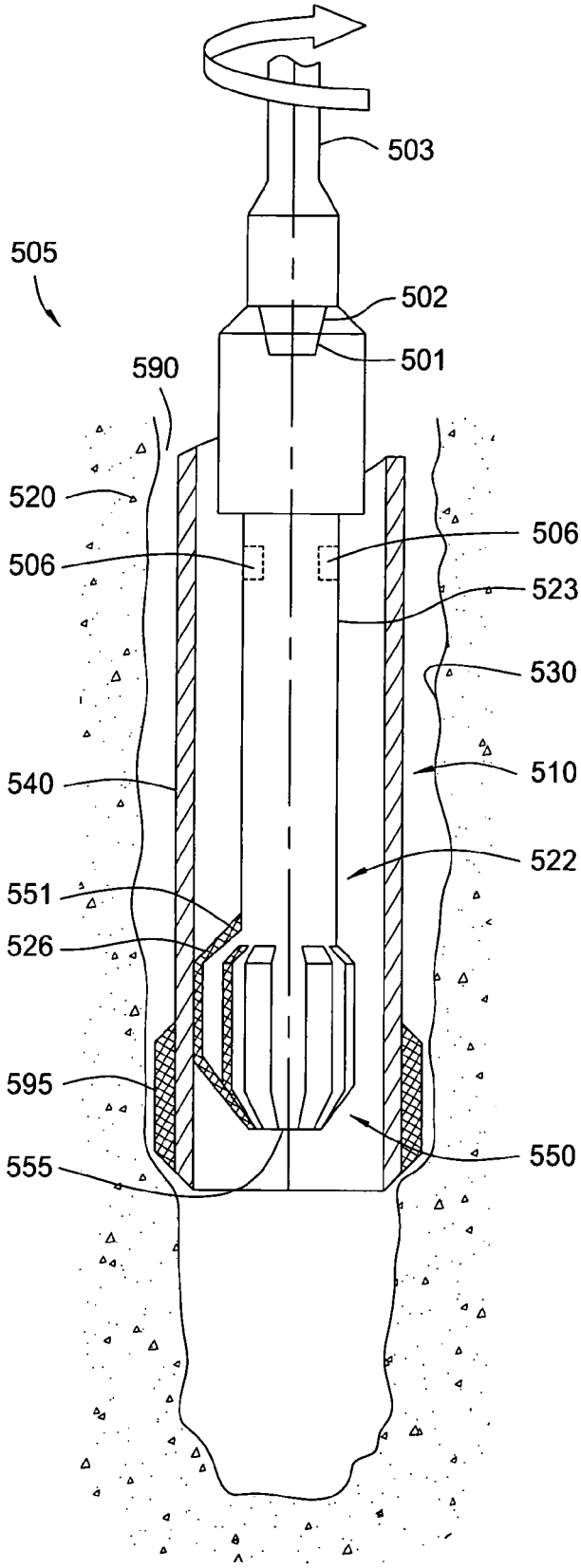

FIG. 20 is a cross-sectional view of the drilling apparatus of FIG. 18 upon removal of the drilling apparatus after drilling through the diverting apparatus.

Figure 21:
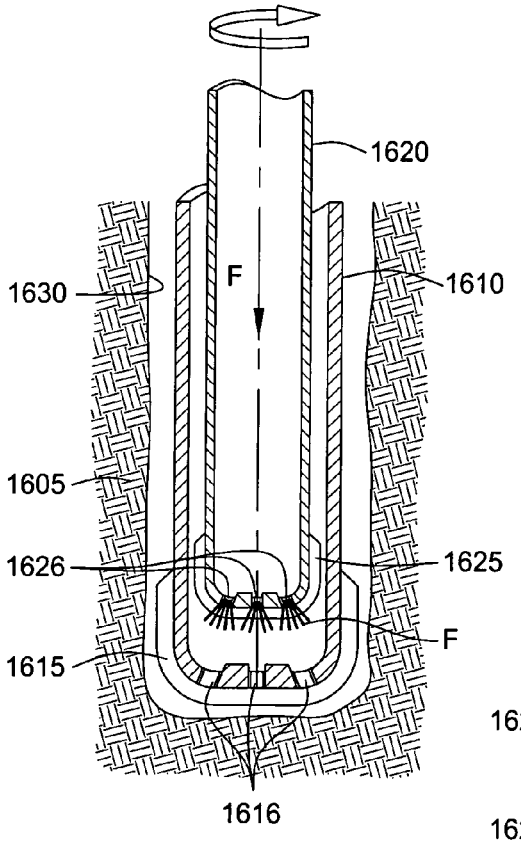
Figure 22:
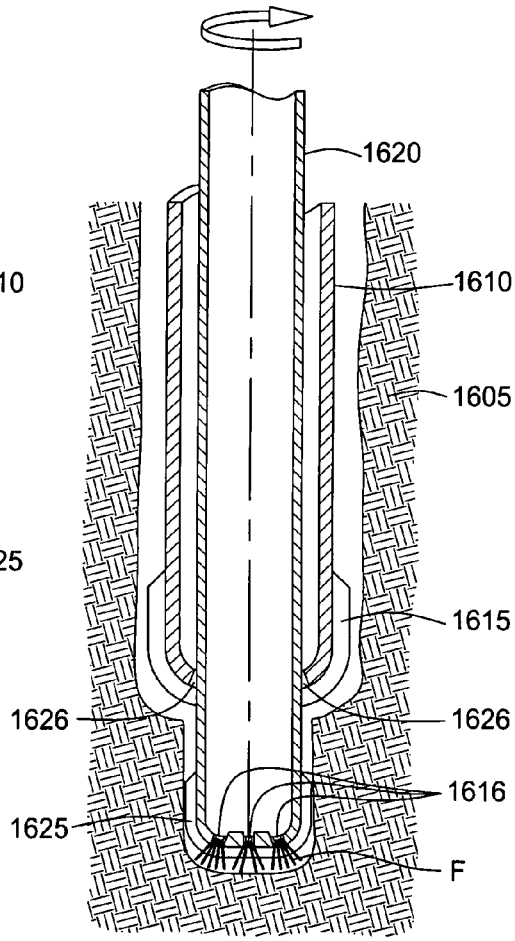

FIGS. 21 and 22 illustrate a process for drilling through casing.

Figure 23A:
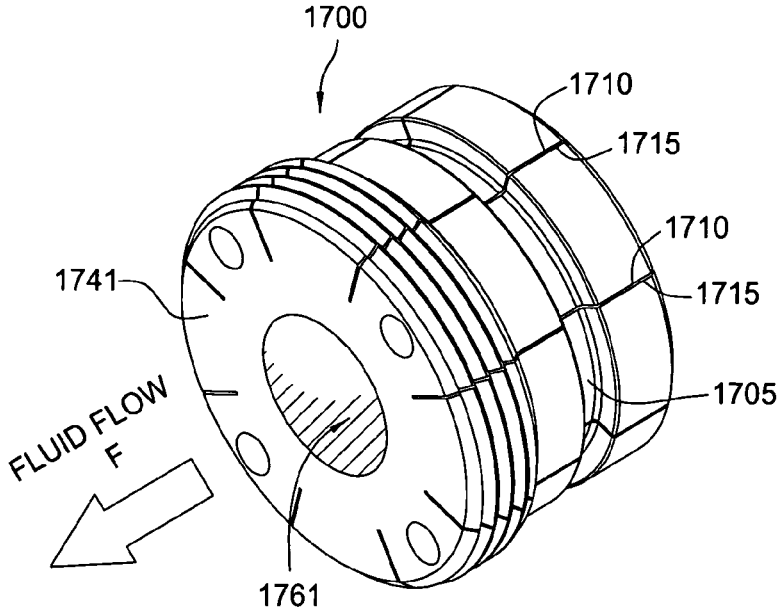
Figure 23B:
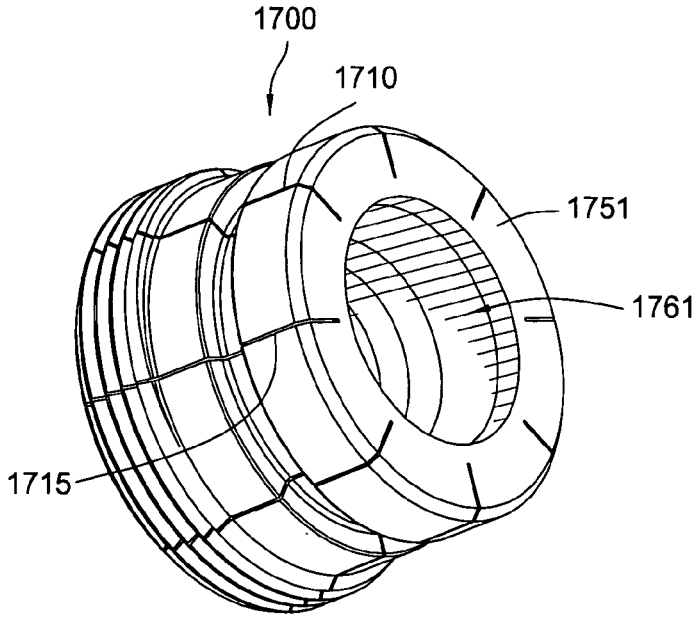

FIGS. 23A and 23B are perspective views of first and second ends of an embodiment of a drillable nozzle.

Figure 24A:
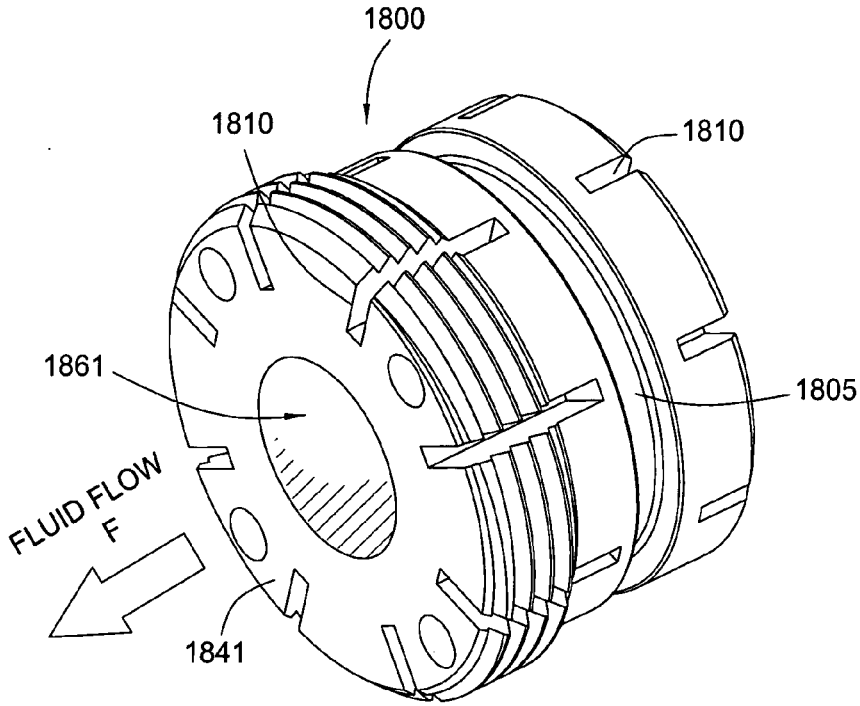
Figure 24B:
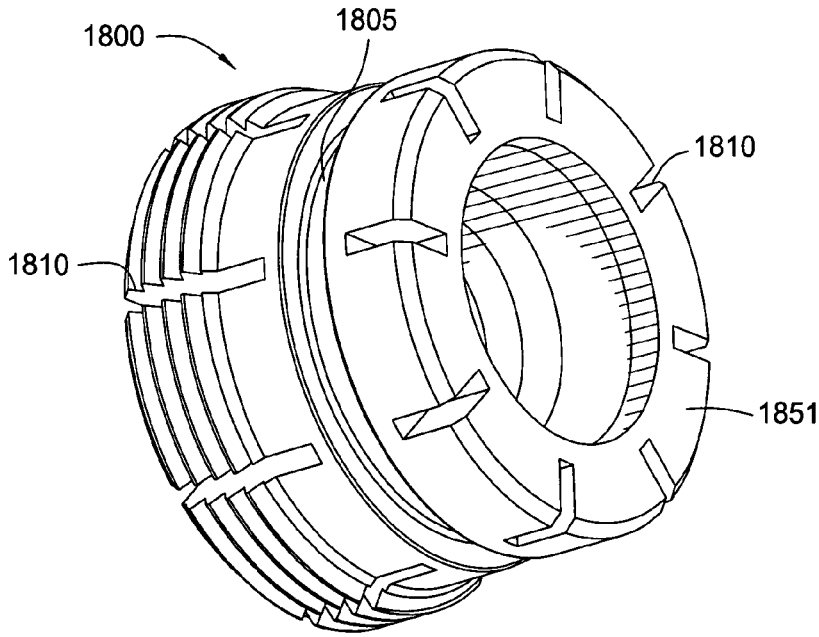

FIGS. 24A and 24B are perspective view of first and second ends of an alternative embodiment of a drillable nozzle.

Figure 25:
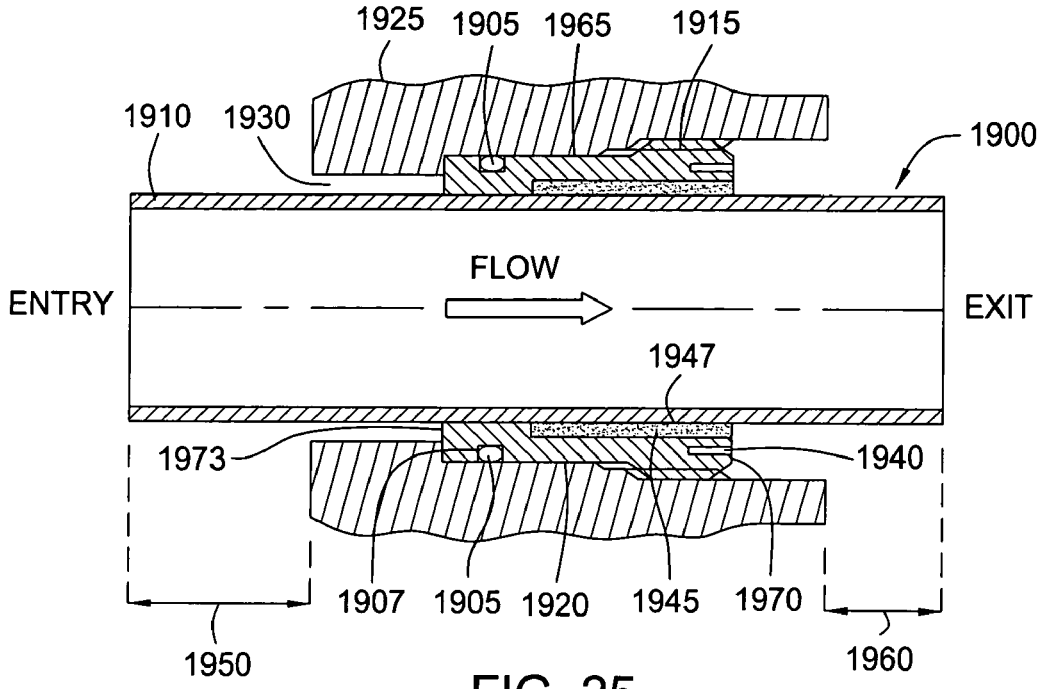

FIG. 25 is a section view of a first embodiment of a nozzle assembly disposed in a tool body.

Figure 26:
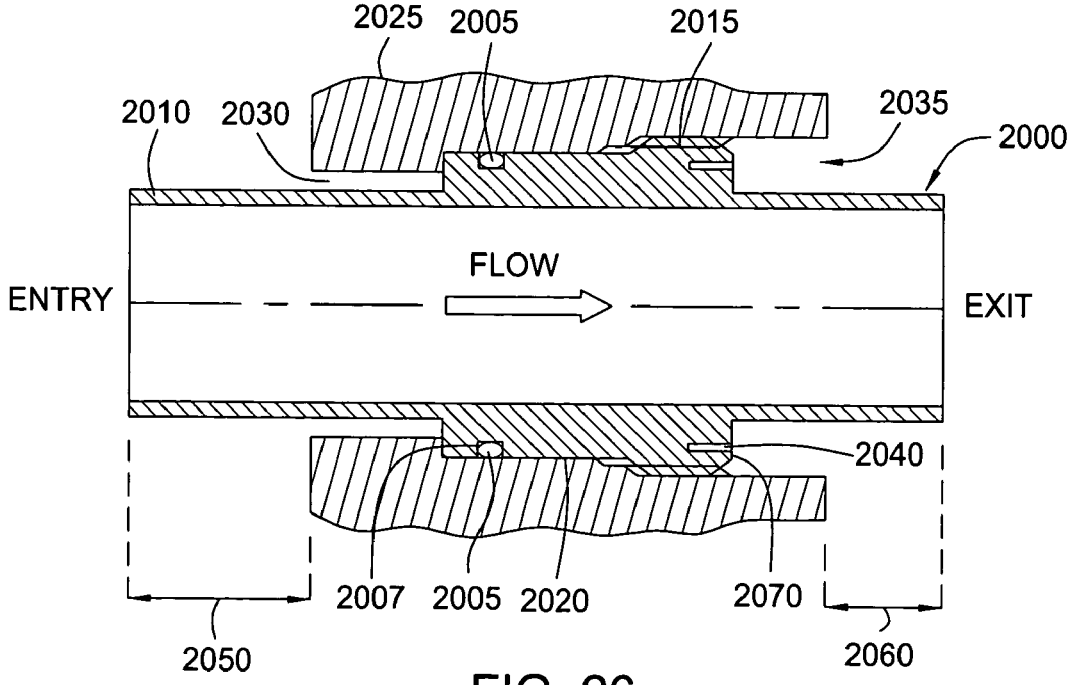

FIG. 26 is a section view of a second embodiment of a nozzle assembly disposed in a tool body.

Figure 27:
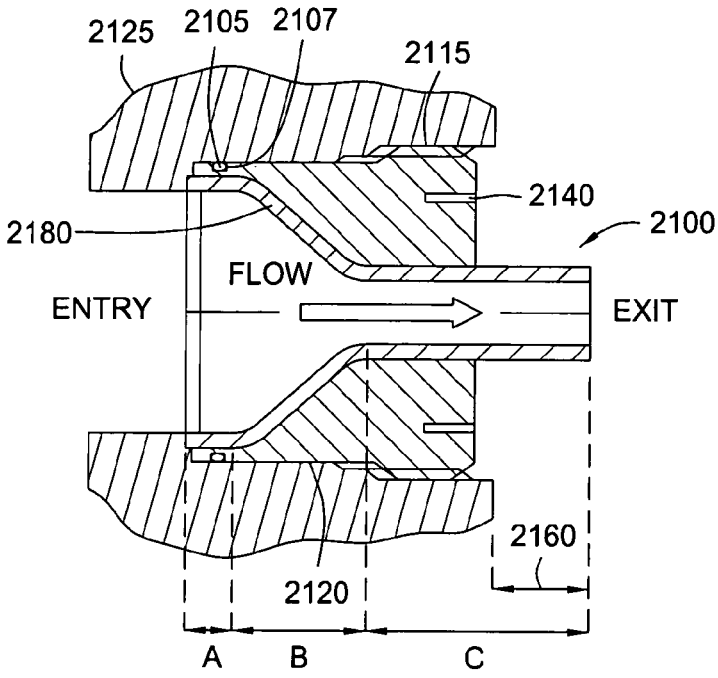

FIG. 27 is a section view of a third embodiment of a nozzle assembly disposed in a tool body.

Figure 28:
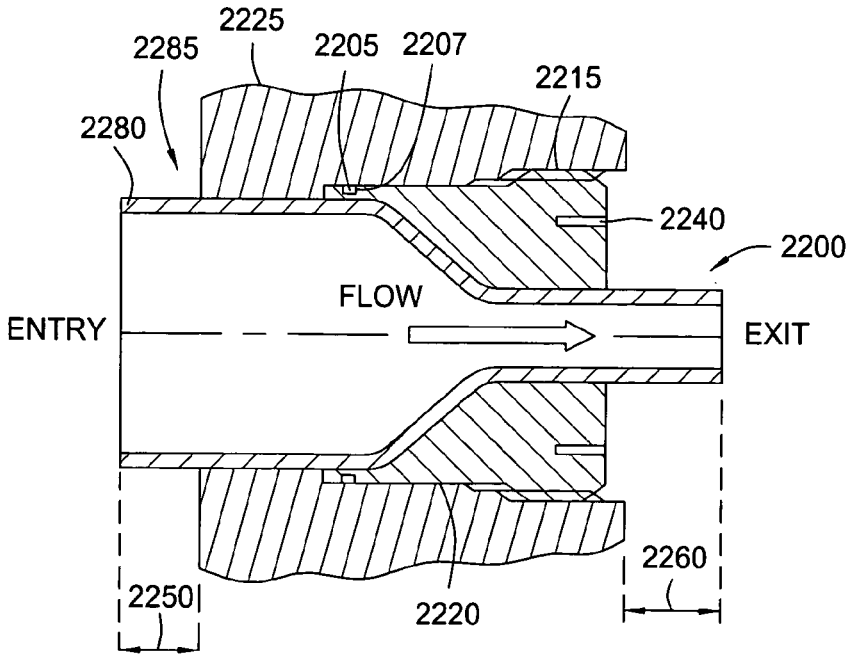

FIG. 28 is a section view of a fourth embodiment of a nozzle assembly disposed in a tool body.

Figure 29:
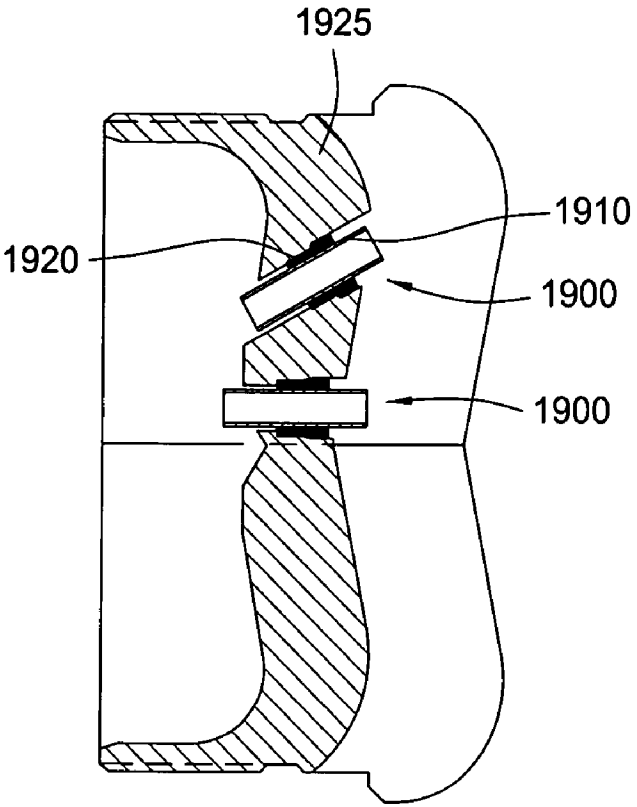

FIG. 29 is a section view of a tool body having nozzle assemblies disposed therein for drilling with casing.

Figure 30:
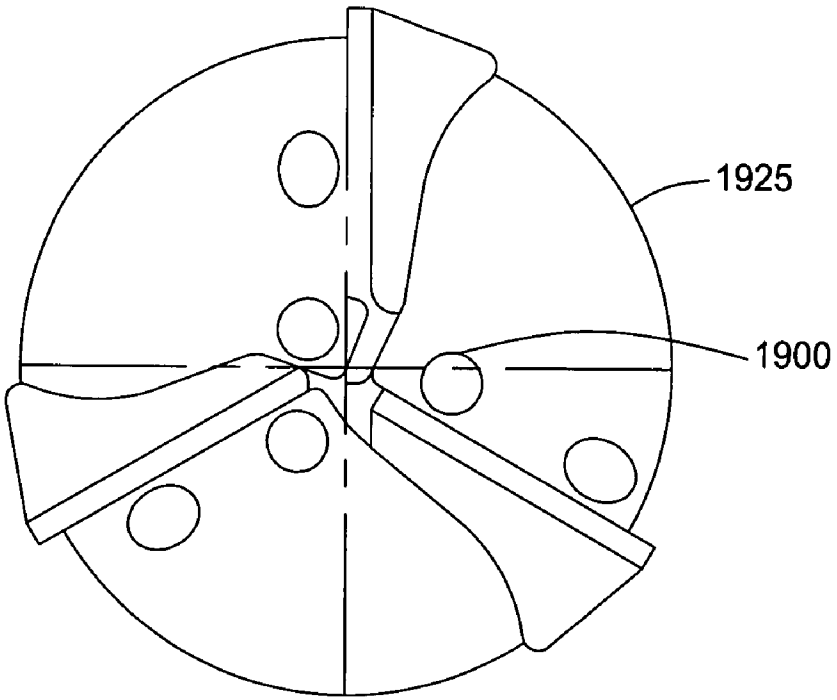

FIG. 30 is a cross-sectional view of a lower end of an earth removal member having fluid passages therethrough.

Figure 31:
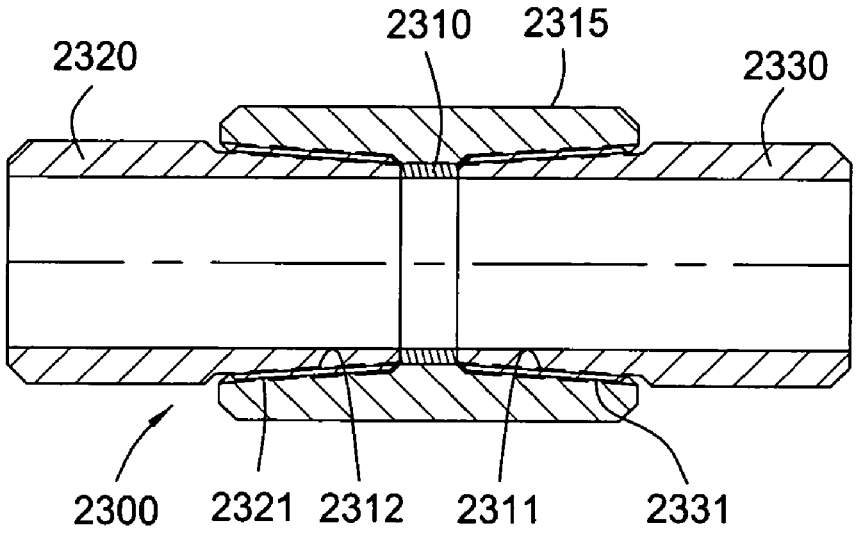

FIG. 31 is a section view of a casing string capable of use in the present invention.

Figure 32:
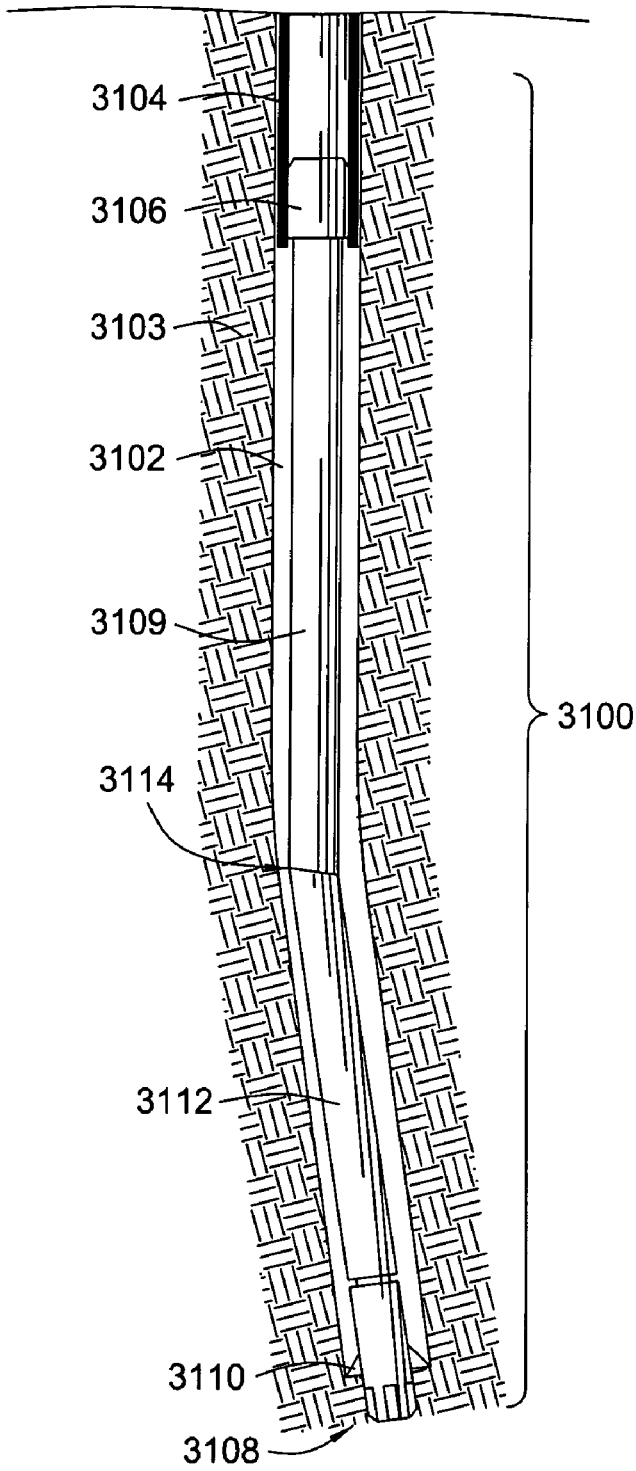

FIG. 32 illustrates an exemplary system for directional drilling according to the prior art.

FIGS. 33A-D illustrate a system for directional drilling according to an embodiment of the present invention.

Figure 34:
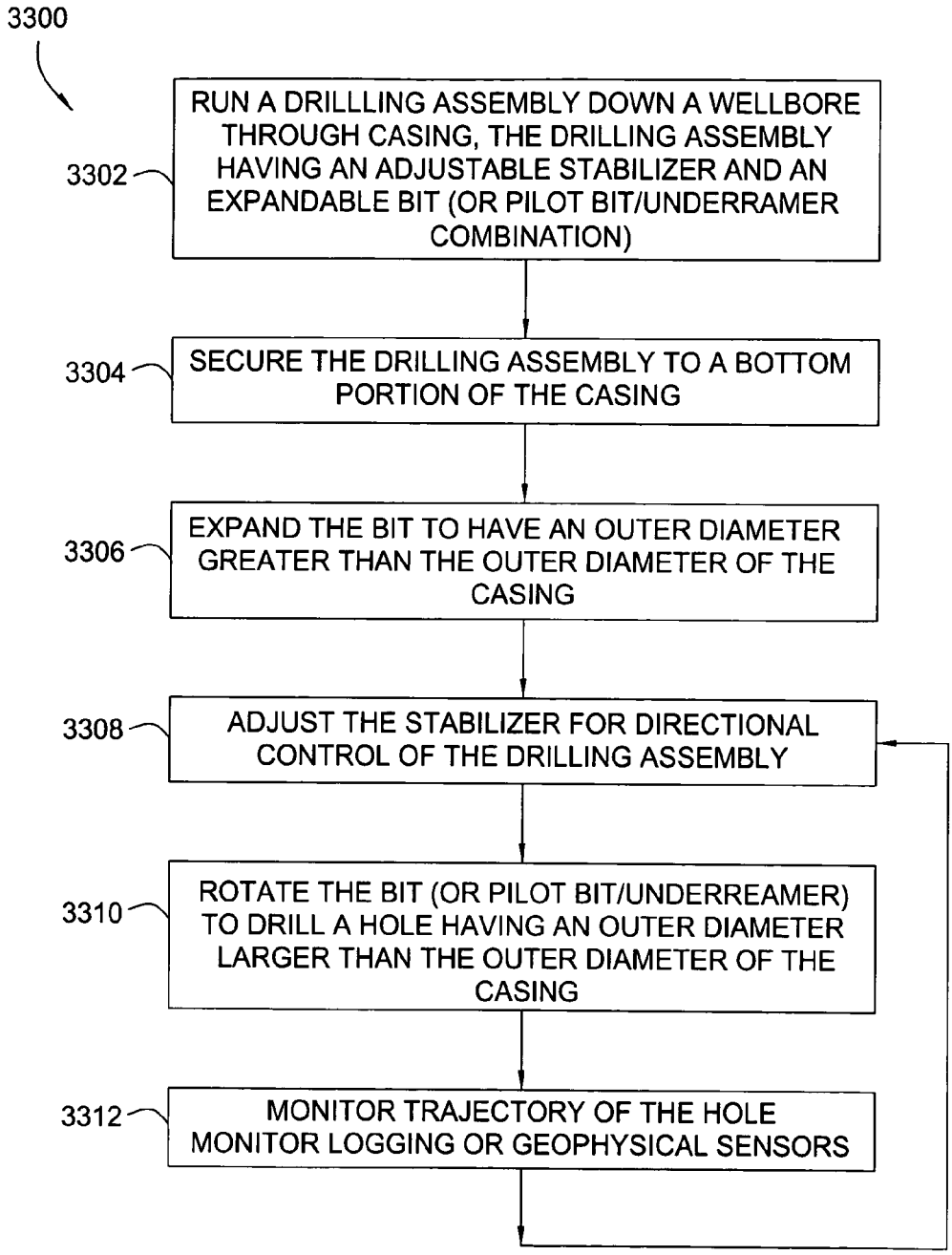

FIG. 34 is a flow diagram illustrating exemplary operations for directional drilling with casing according to an embodiment of the present invention.

Figure 35:
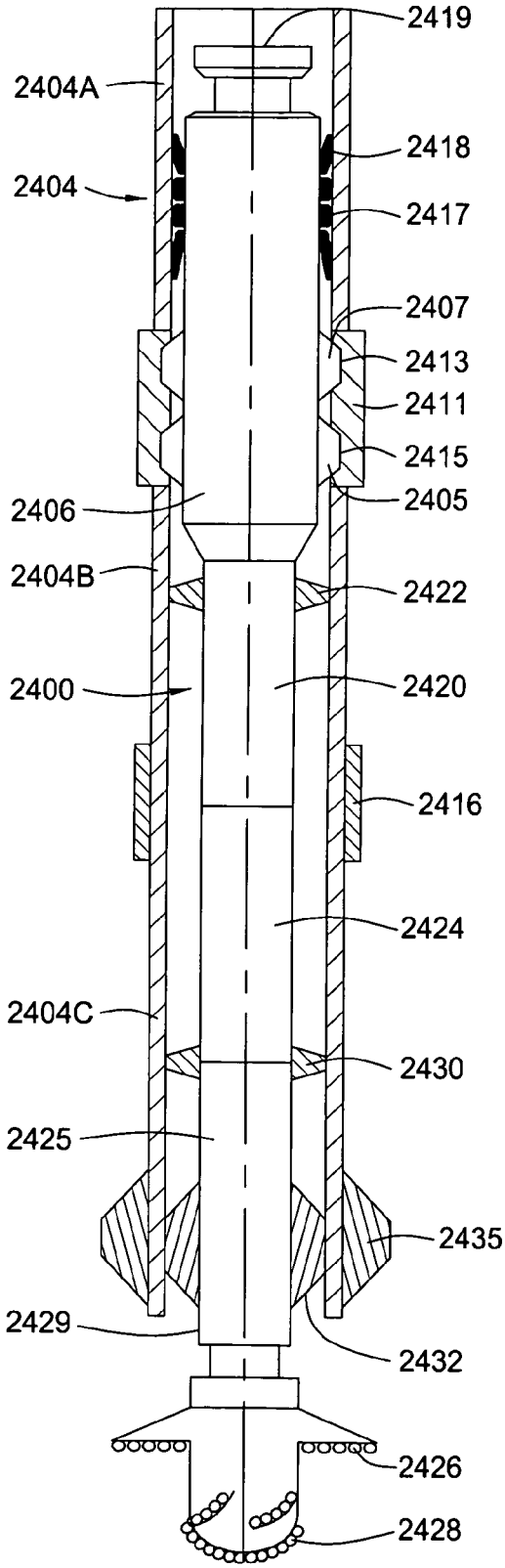

FIG. 35 shows a sectional view of an alternate embodiment of a system for directional drilling with casing according to the present invention. An eccentric casing bias pad is shown on casing.

Figure 36:
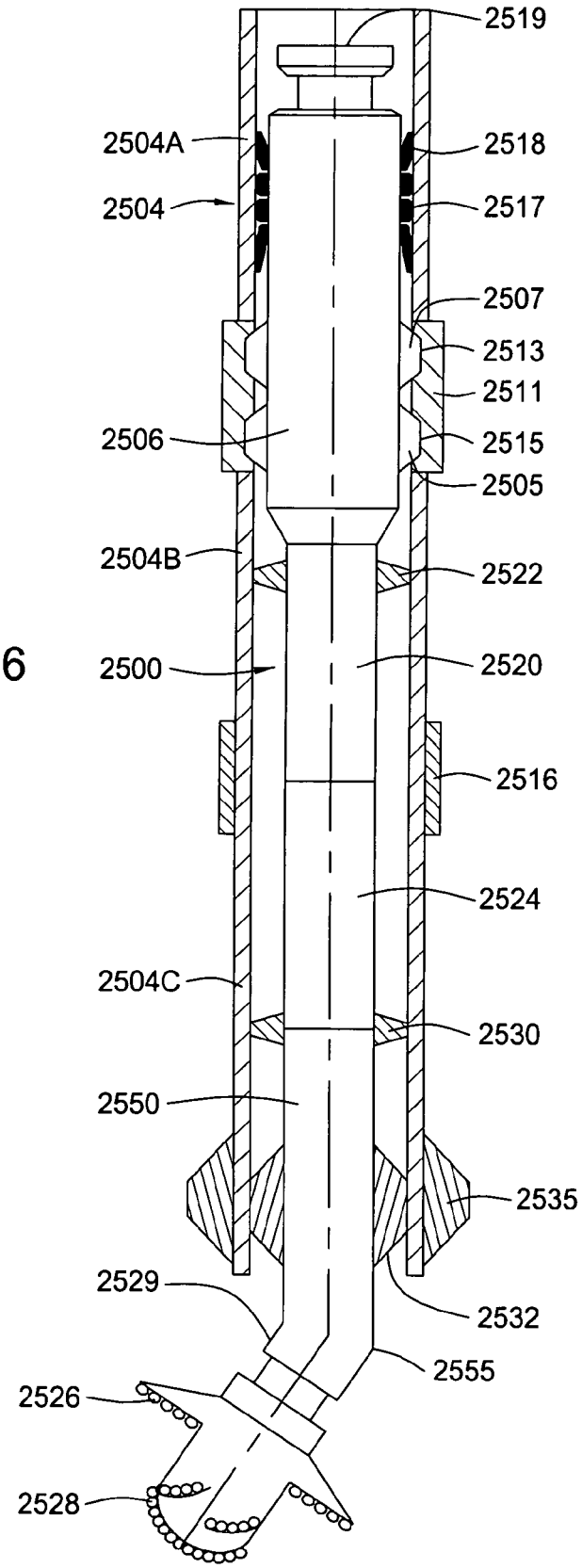

FIG. 36 shows a sectional view of a further alternate embodiment of a system for directional drilling with casing.

Figure 37:
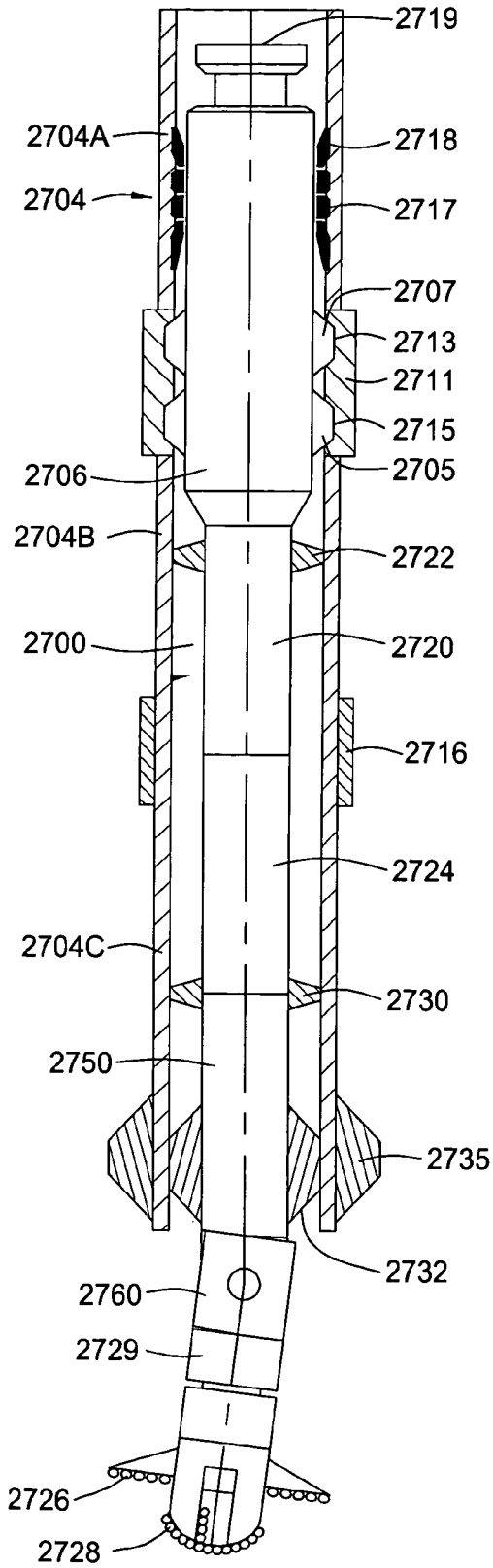

FIG. 37 is a cross-sectional view of another embodiment of a directional drilling assembly equipped with an articulating housing.

Figure 38A:
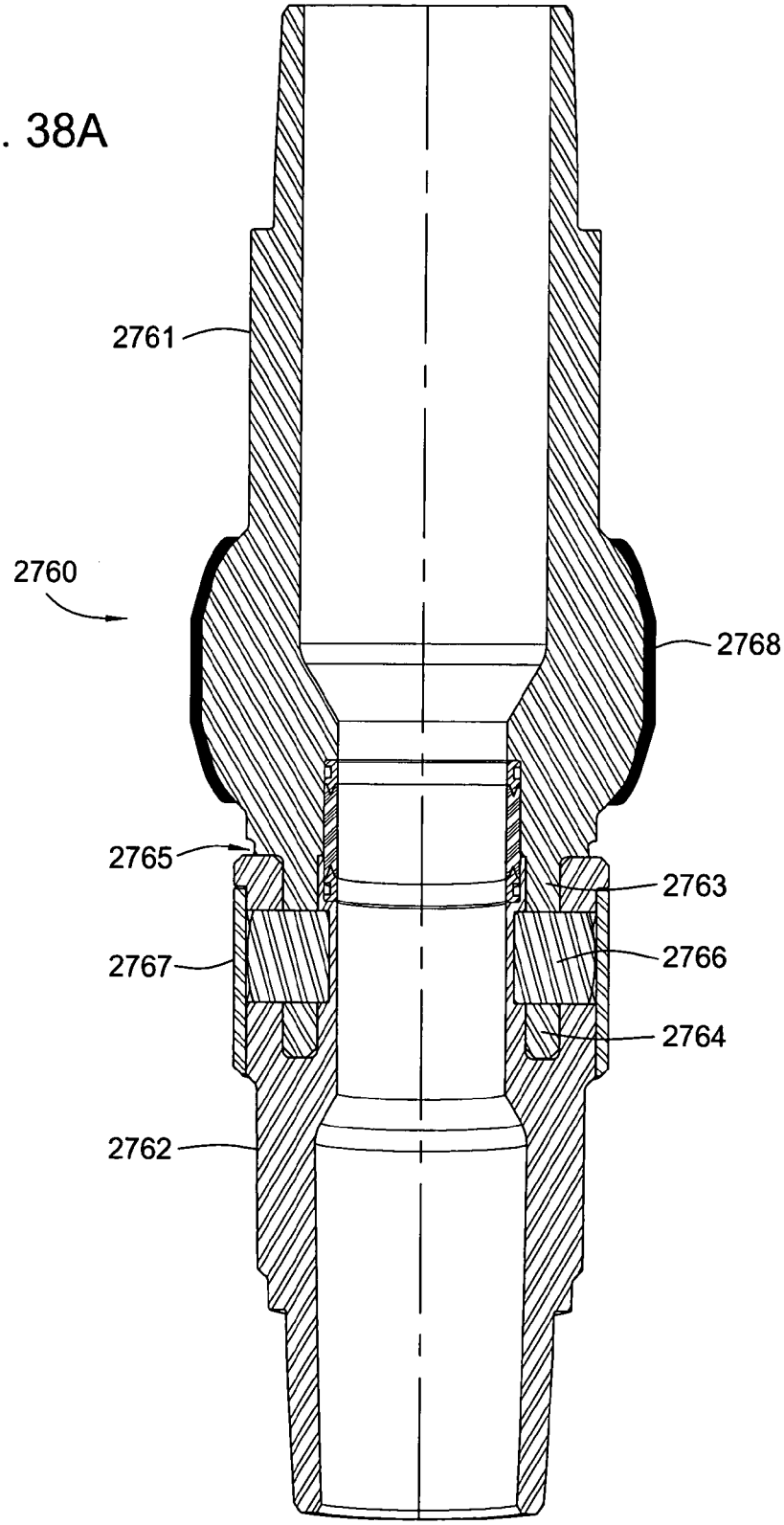
Figure 38B:
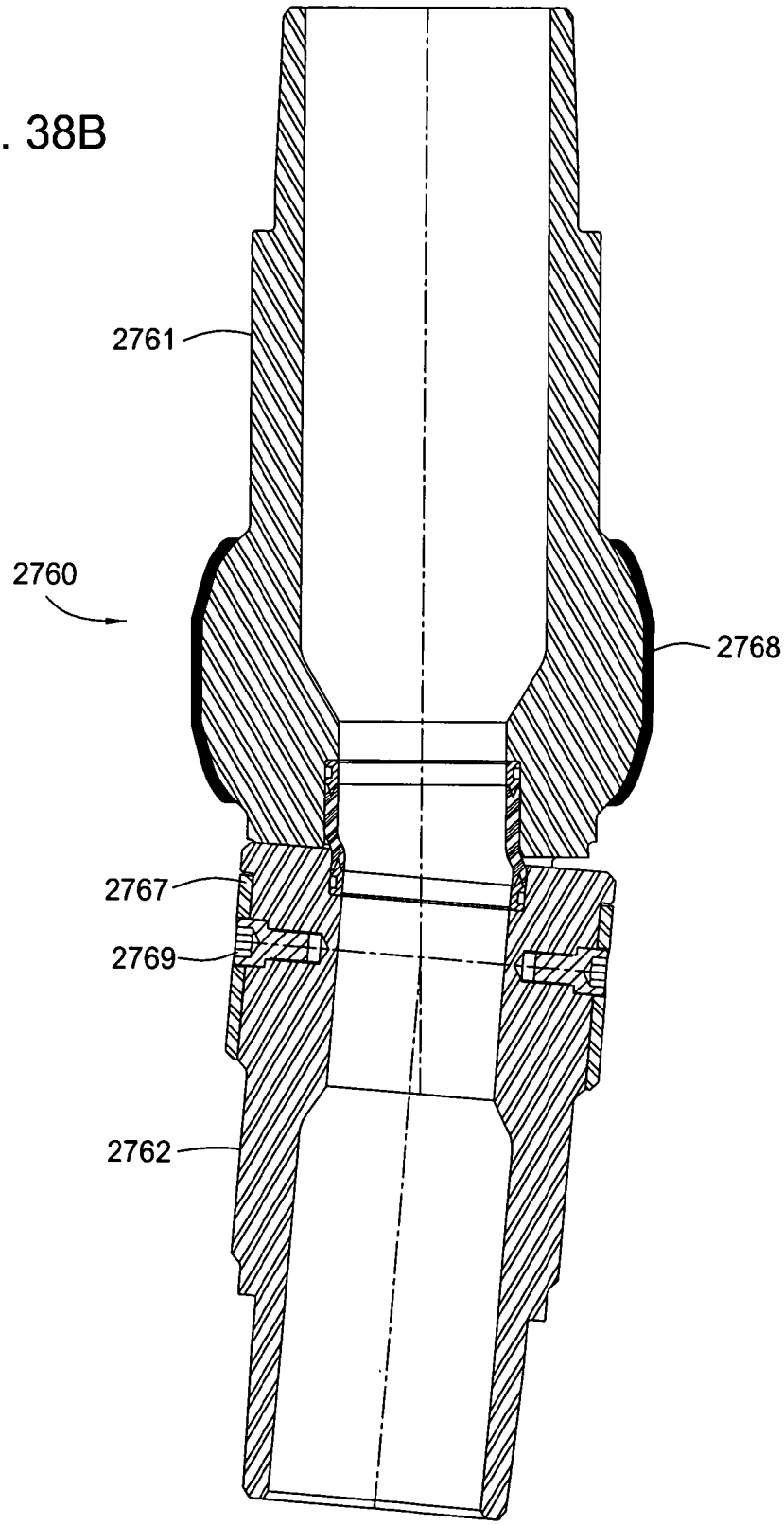

FIGS. 38A-B show an exemplary articulating housing according to aspects of the present invention.

Figure 39:
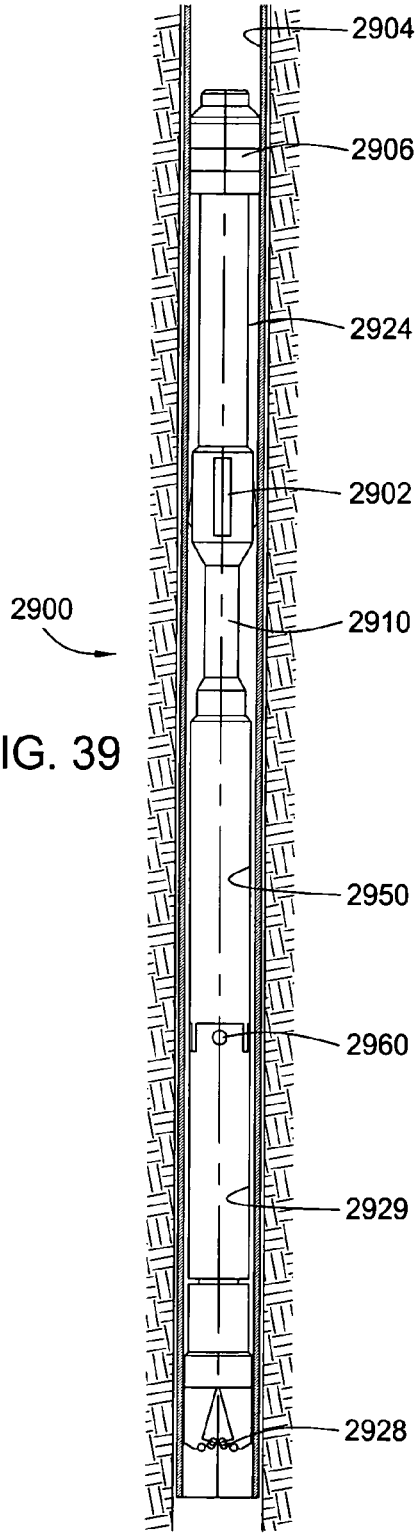

FIG. 39 shows another embodiment of a directional drilling assembly.

Figure 40:
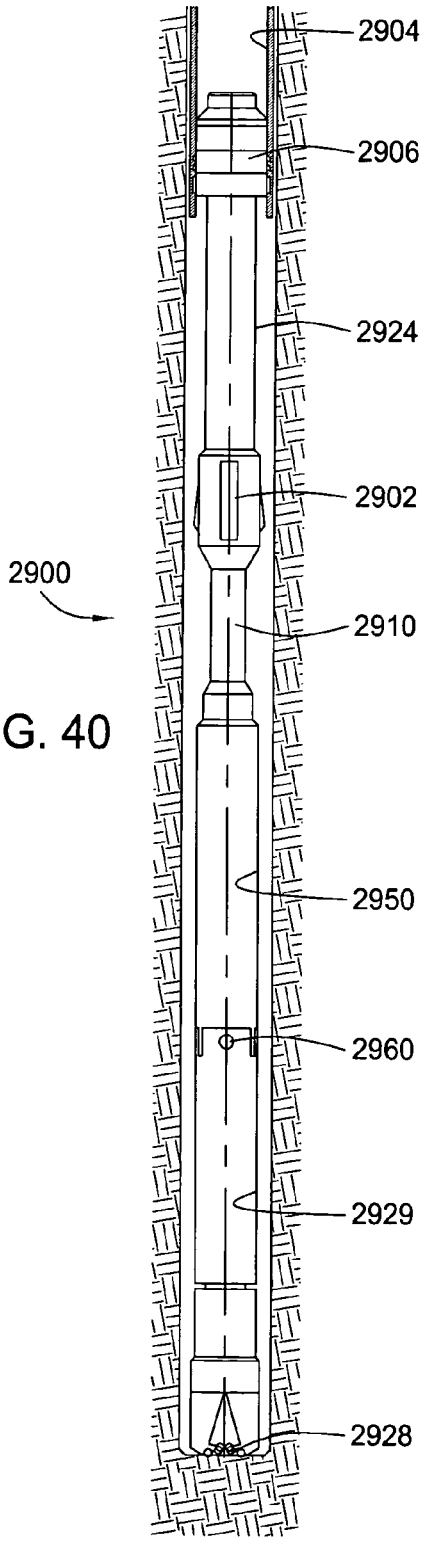
Figure 45:
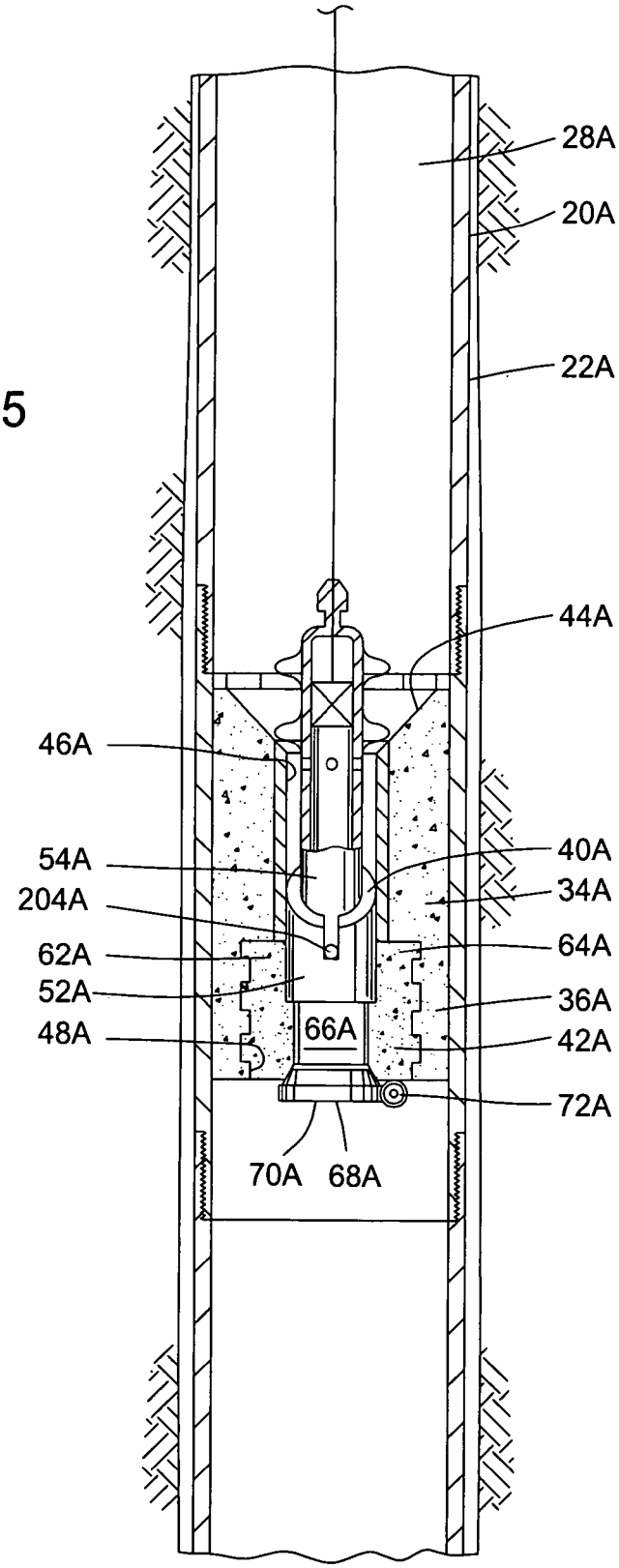

FIG. 40 shows the directional drilling assembly of FIG. 45 after the BHA has reached the bottom of the wellbore.

Figure 41:
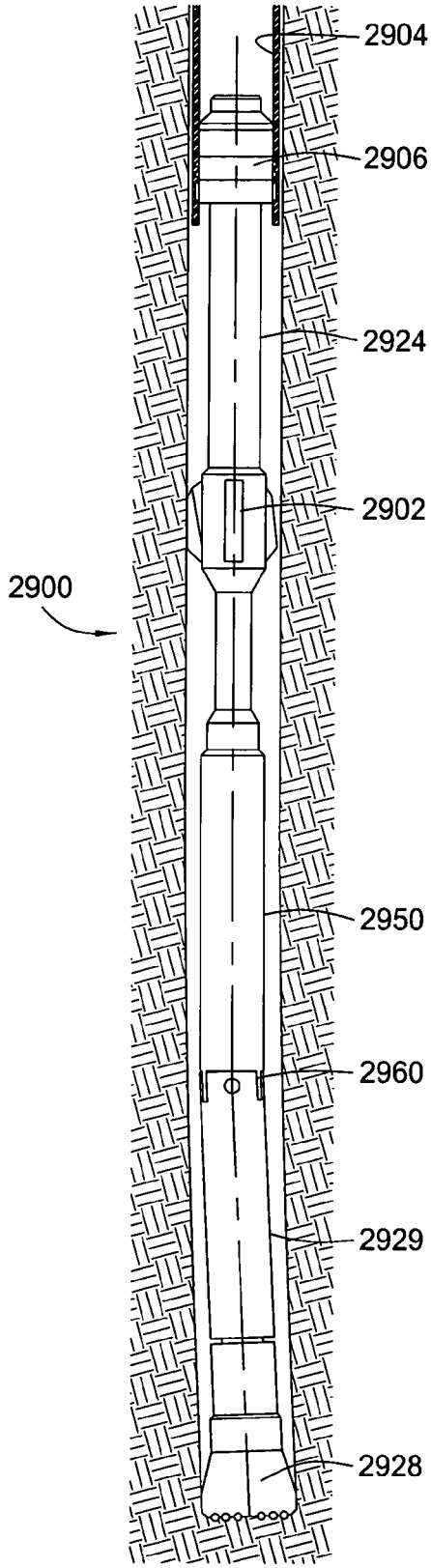

FIG. 41 shows the directional drilling assembly of FIG. 45 in operation.

Figure 42:
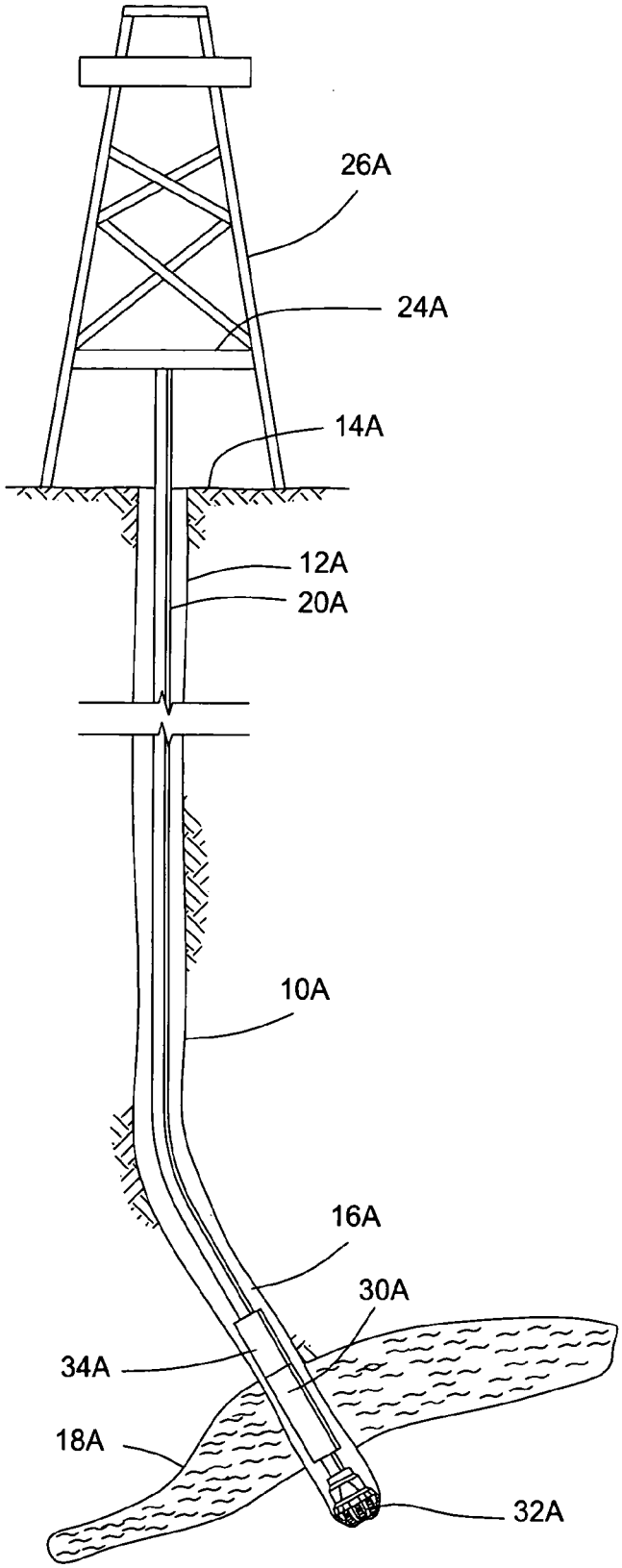

FIG. 42 is a schematic view, in section, of a directional borehole being drilled.

FIG. 43 is a sectional view of a float sub in a downhole location indicated in FIG. 42 and a sectional view of a survey tool receivable therein.

FIG. 43A shows a side view of the survey tool of FIG. 43.

Figure 44:
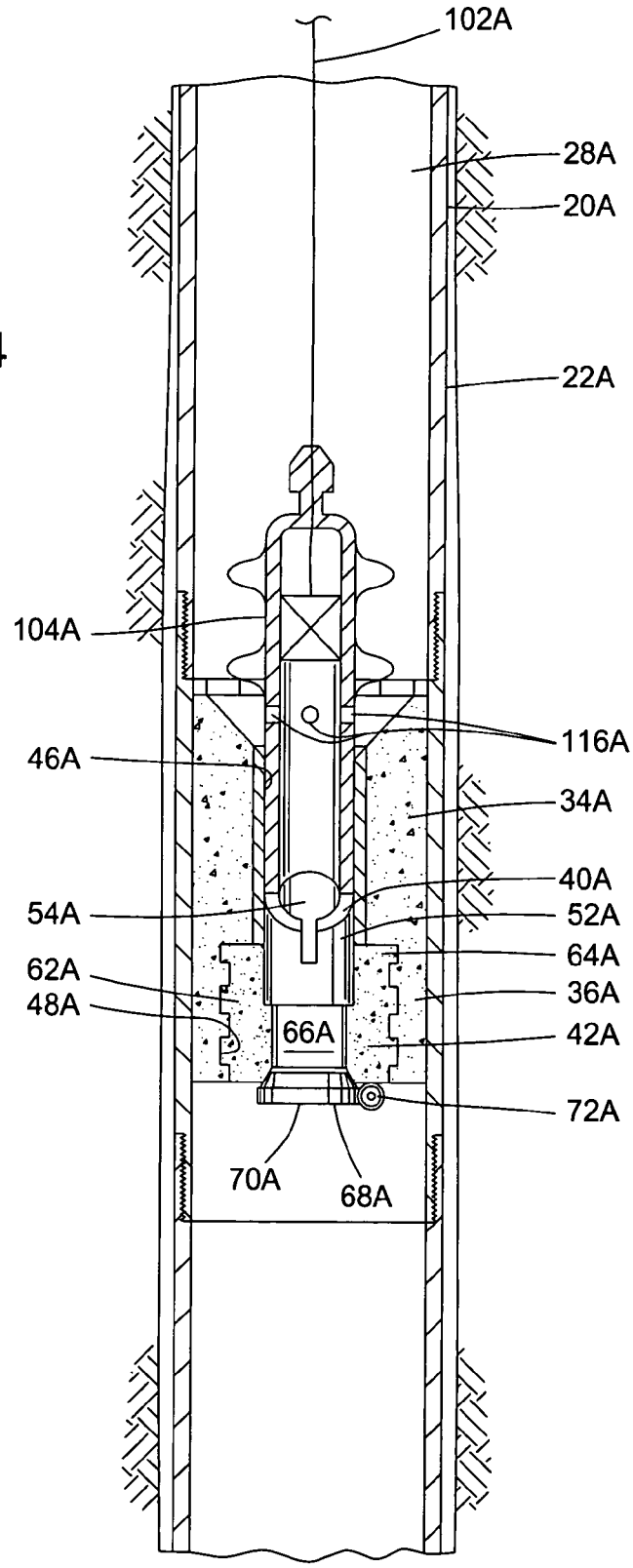

FIG. 44 is a sectional view of the float sub of FIG. 43, showing a survey tool in section, received and landed therein.

FIG. 45 is a sectional view of a float sub as in FIG. 44, showing an alternative embodiment of a survey tool shown partially in section to be received therein.

Figure 46:
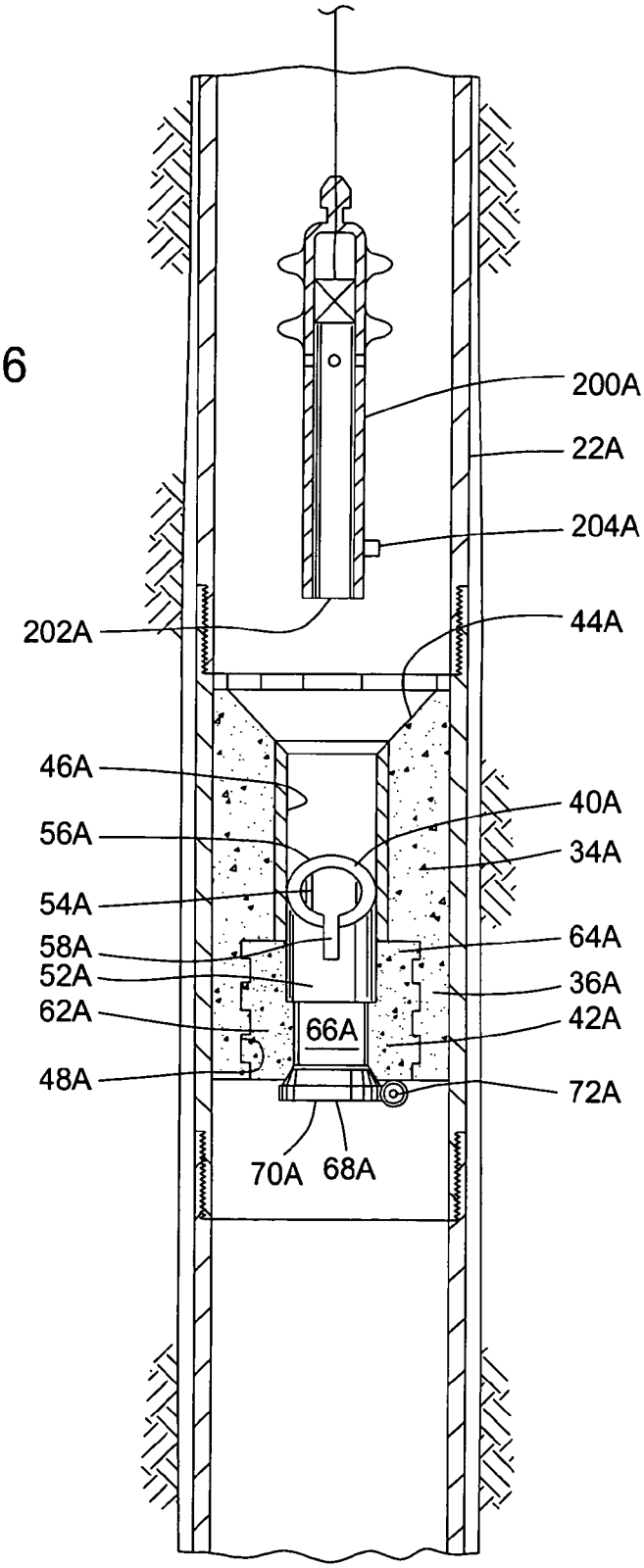

FIG. 46 is a partial sectional view of the float sub of FIG. 45, showing the survey tool in and landed on the float sub.

Figure 47:
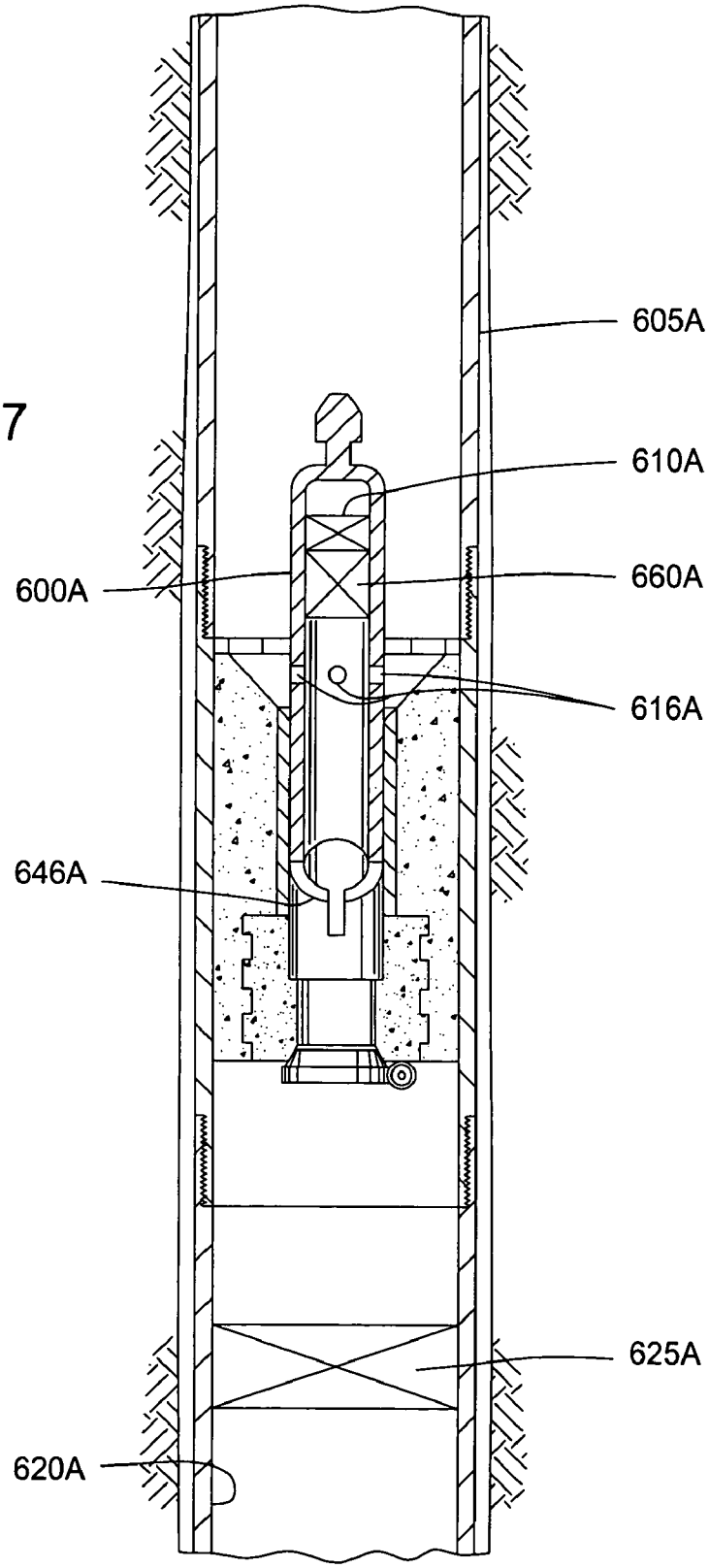

FIG. 47 shows a partial view of a float sub having a wellbore survey tool or sensor disposed therein.

FIG. 48 shows an embodiment of a survey tool assembly according to aspects of the present invention.

FIG. 49 shows the survey tool assembly of FIG. 48 in the survey mode.

Figure 50:
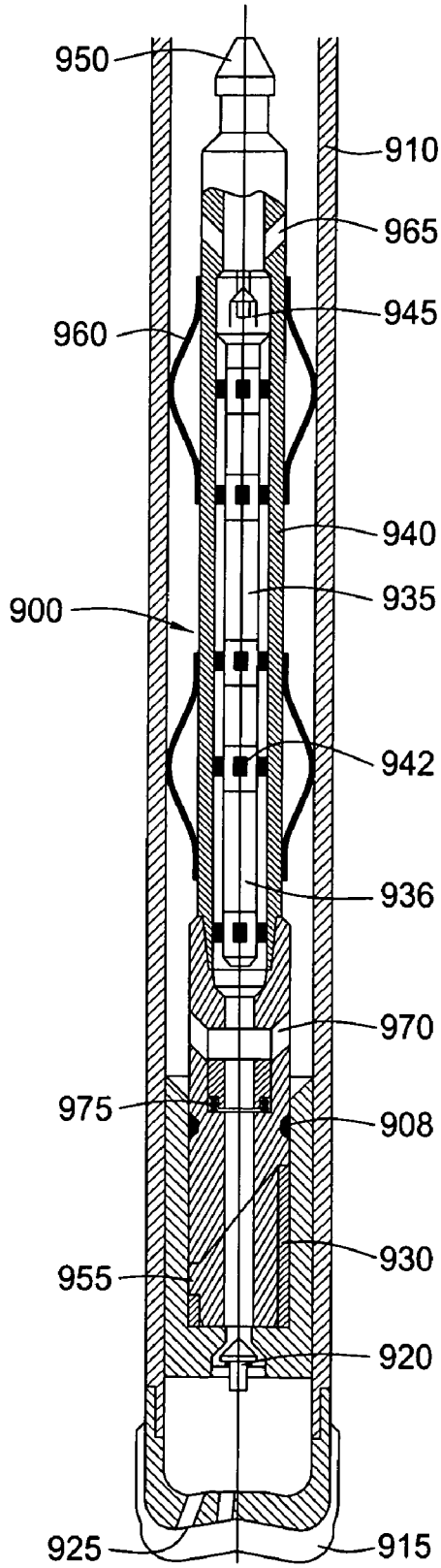

FIG. 50 shows the survey tool assembly of FIG. 48 in the drilling mode.

Figure 51:
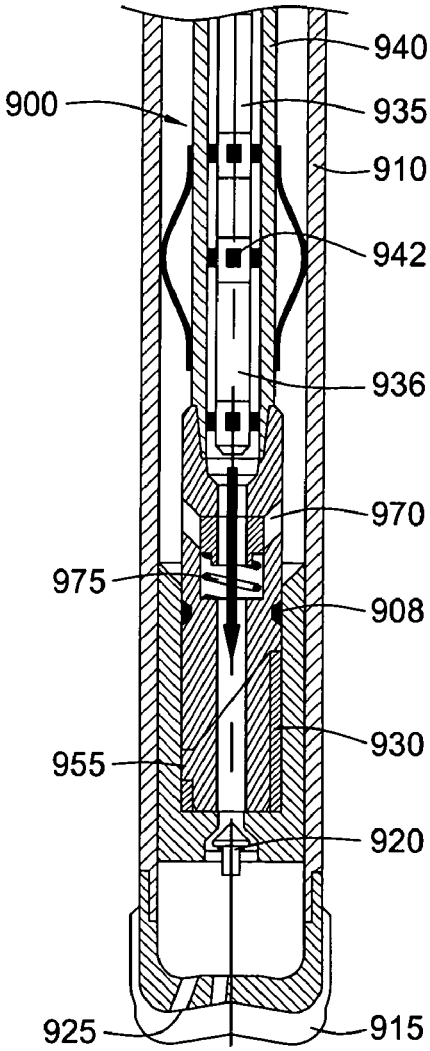

FIG. 51 shows the bypass valve of the survey tool assembly of FIG. 48 in the closed position.

Figure 52:
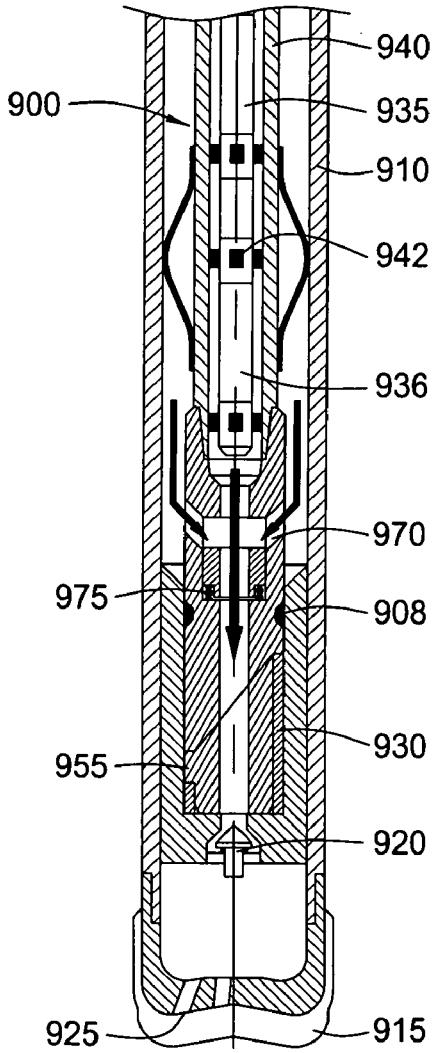

FIG. 52 shows the bypass valve of the survey tool assembly of FIG. 48 in the open position.

Figure 53A:
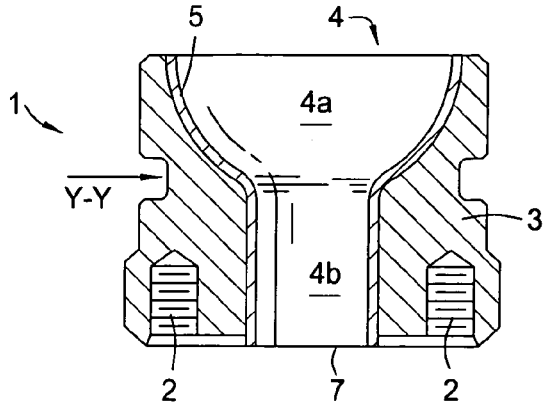

FIG. 53A is a sectional elevation of an earth boring bit nozzle.

Figure 53B:
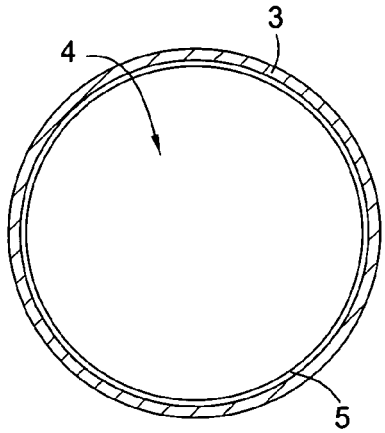

FIG. 53B is a sectional view through the section y-y of FIG. 53A.

Figure 54:
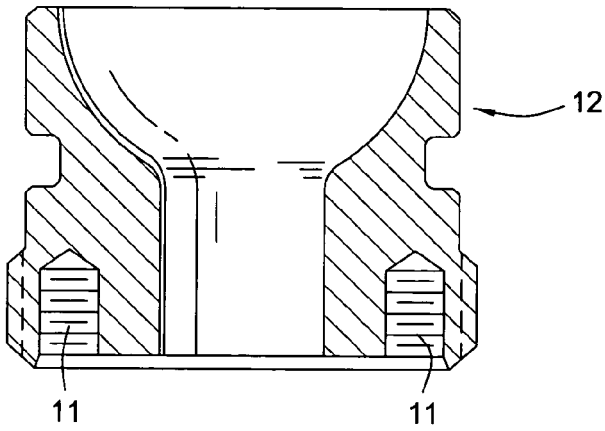

FIG. 54 shows an alternate embodiment of a bit nozzle made substantially of a non-metallic metal.

Figure 55:
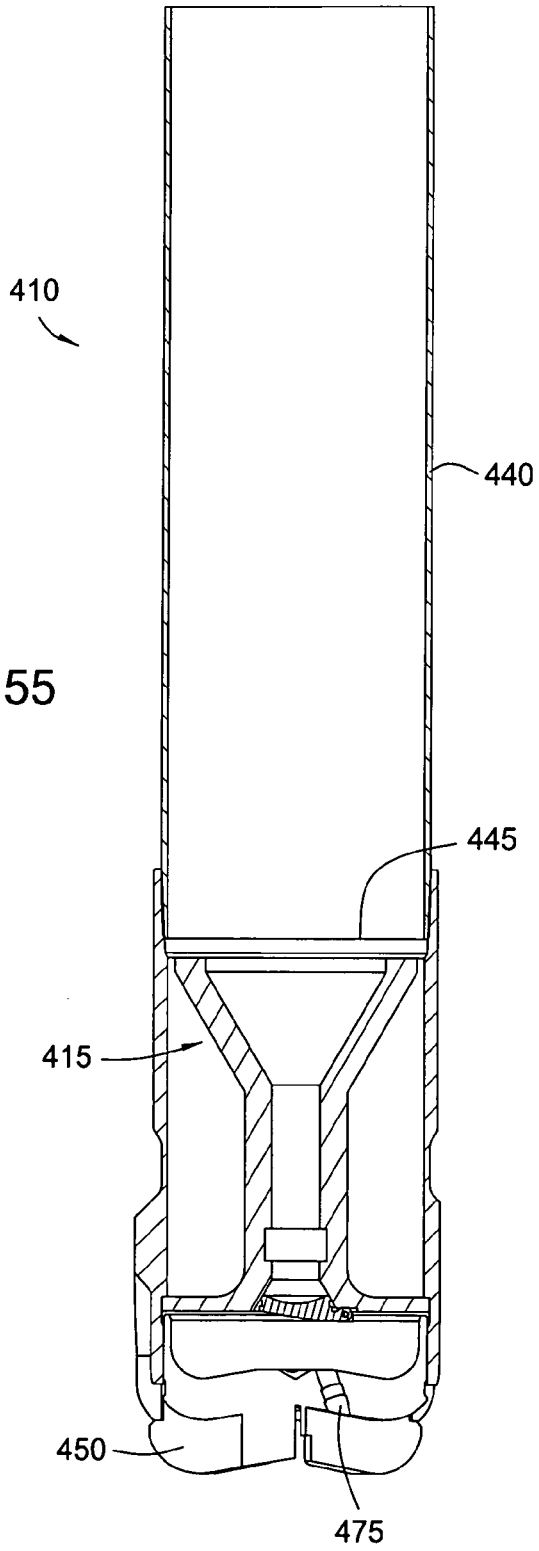

FIG. 55 shows a cross-sectional view of an alternate embodiment of a diverting apparatus disposed within a subterranean wellbore for use in directional drilling.

Figure 56A:
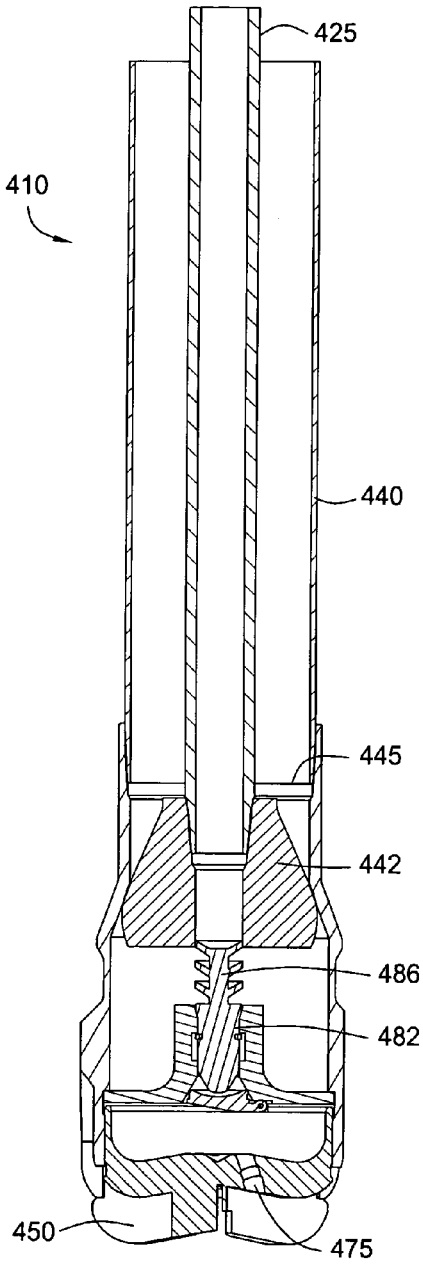

FIG. 56A is a cross-sectional view of a diverting apparatus used for expanding a casing.

Figure 56B:
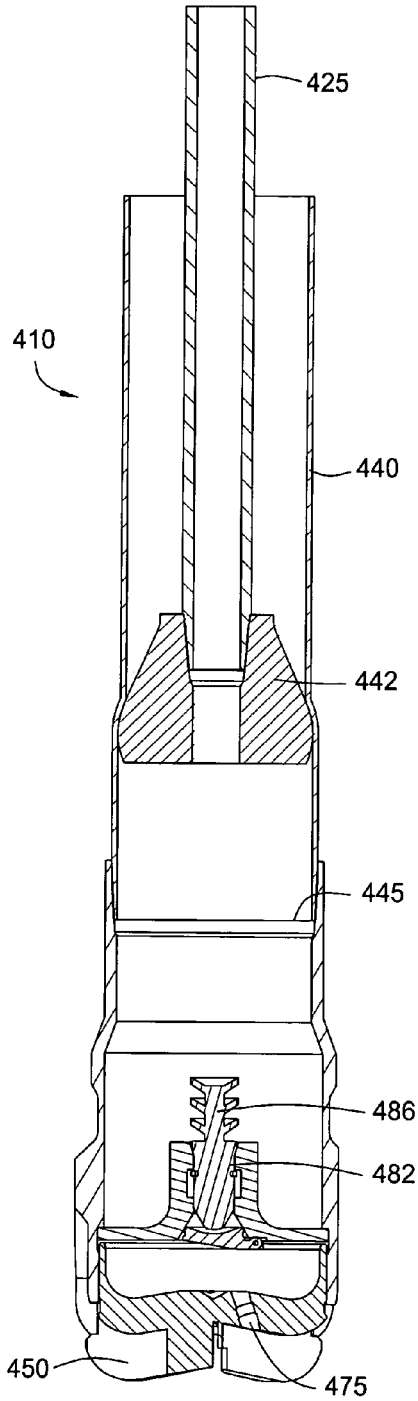

FIG. 56B is a cross-sectional view of the diverting apparatus of FIG. 56A in the process of expanding the casing.

Figure 57:
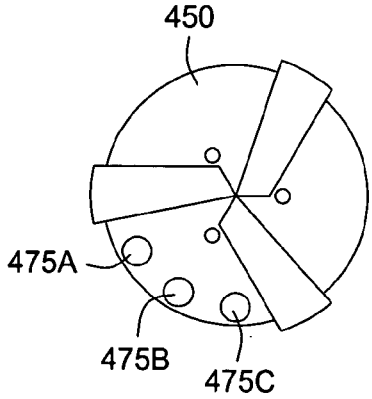

FIG. 57 is an upward sectional view of an earth removal member for use in the present invention.

DETAILED DESCRIPTION OF THE PREFERRED EMBODIMENT

In the following embodiments of the present invention, the casing may be alternately jetted and rotated to form a wellbore. The rotation of the casing string may be accomplished either by rotating the entire casing or by rotating the cutting structure relative to the casing using a mud motor operatively attached to the casing.

Embodiments of the present invention provide systems and methods for performing drilling with casing operations which substantially reduce the time and costs for completing a well. More particularly, some embodiments of the present invention provide systems and methods for performing a drilling operation while casing the wellbore which allows a cement operation to be performed subsequently without having to first retrieve the motor system utilized for the drilling operation.

Figure 1:
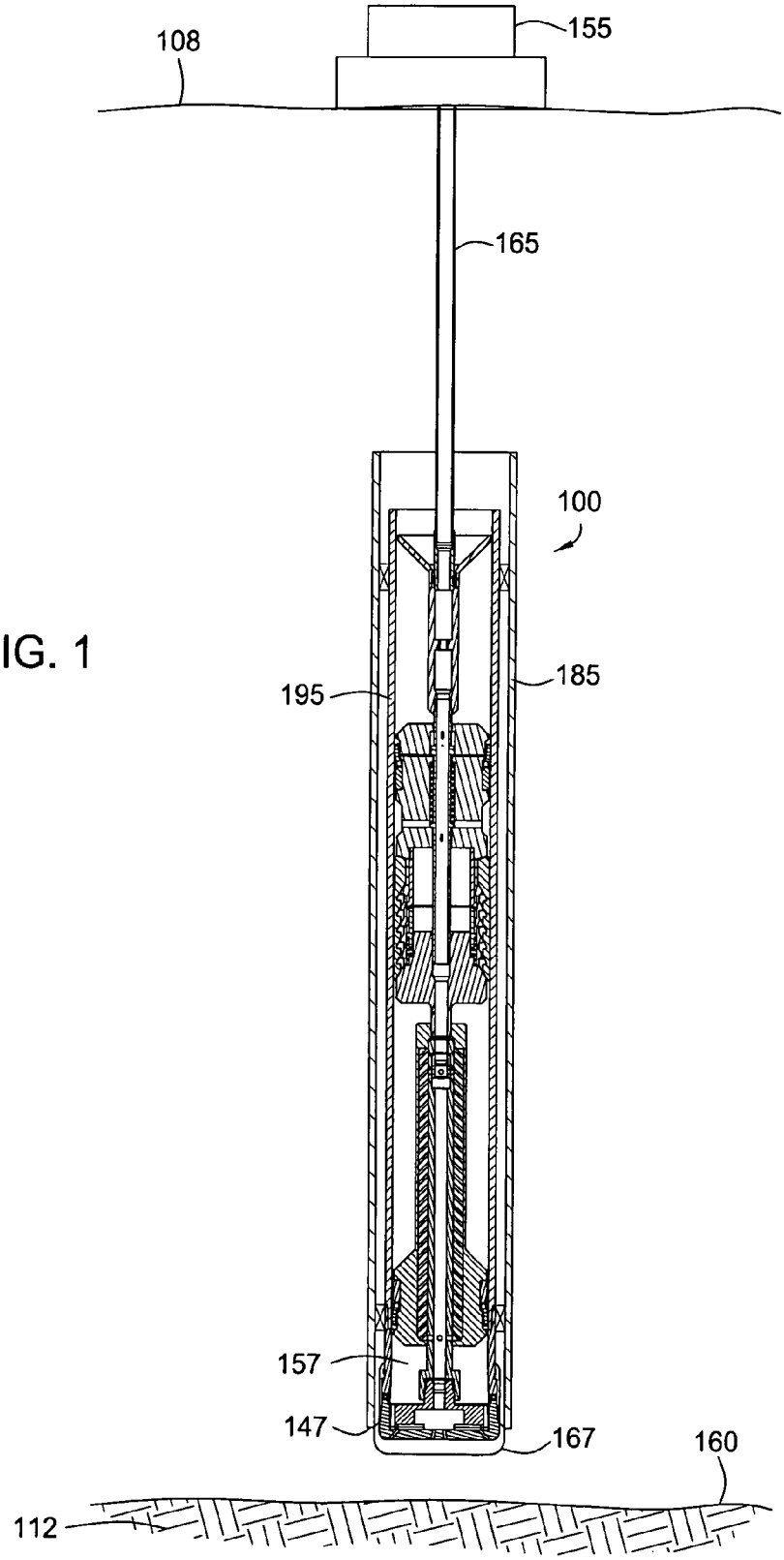
FIG. 1 is a schematic view of one embodiment of a system for drilling and completing a well in a formation under water.

FIG. 1 is a schematic view of one embodiment of a system 100 for drilling and completing a well in a formation 112 under water 108. Although the system 100 is shown in context of a deep sea drilling operation, embodiments of the invention may be utilized in drilling operations on land as well as under water 108. As shown in FIG. 1, the system 100 includes a first, outer casing 185, a second, inner casing 195, and a drilling system 157. The inner casing 195 is releasably connected, preferably releasably latched, onto the outer casing 185, and the drilling system 157 is releasably connected, preferably releasably latched, in the inner casing 195. The drilling system 157 includes an earth removal member, preferably in the form of a drill bit or drill shoe 167 which protrudes outside a terminal portion 147 of the outer casing 185. An inter string or drill string 165 connects the drilling system 157 to a ship or platform 155 at the surface of water 108. The system 100 may be utilized to drill and case a well in the formation 112 under the sea floor or mud line 160.

Typically, casing 185 or 195 is made up of sections of casing. Each section of casing has a pin end and a box end for threadedly connecting to another section of casing above and/or below the casing section. A casing string includes more than one section of casing threadedly connected to one another. As used herein, casing may include a section of casing or a string of casing.

Figure 2A:
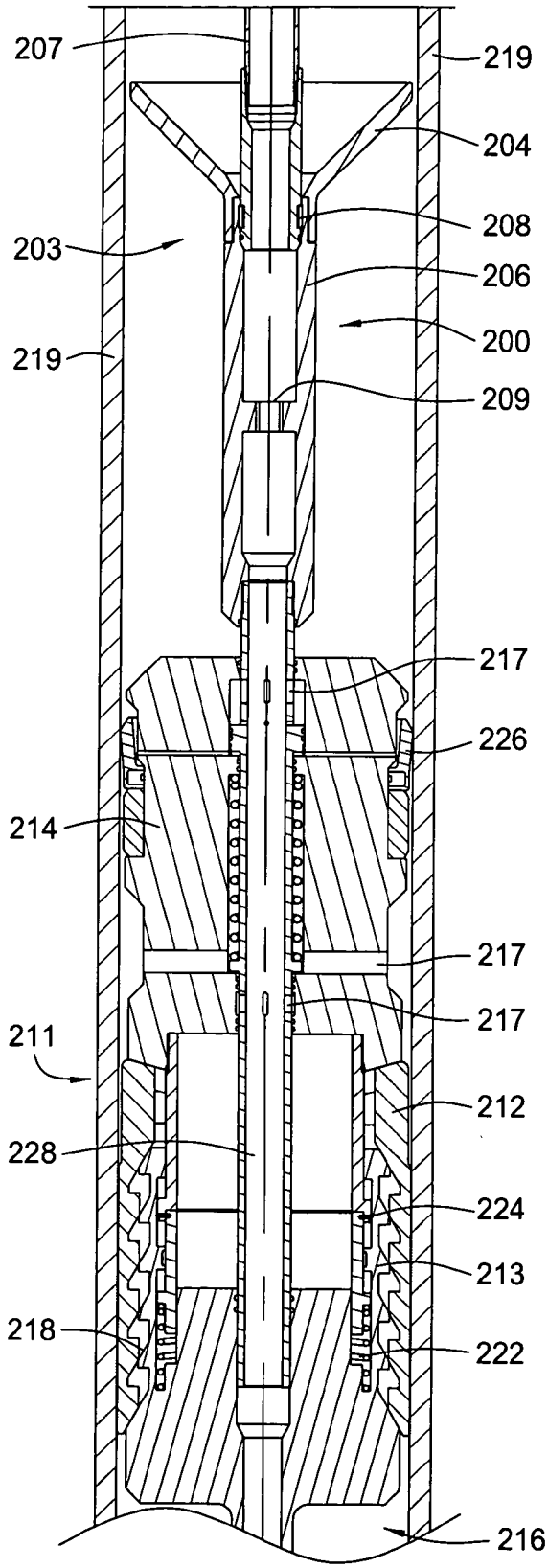
FIGS. 2A and 2B show a cross-sectional view of one embodiment of a hollow shaft motor drilling system disposed in a casing.
Figure 2B:
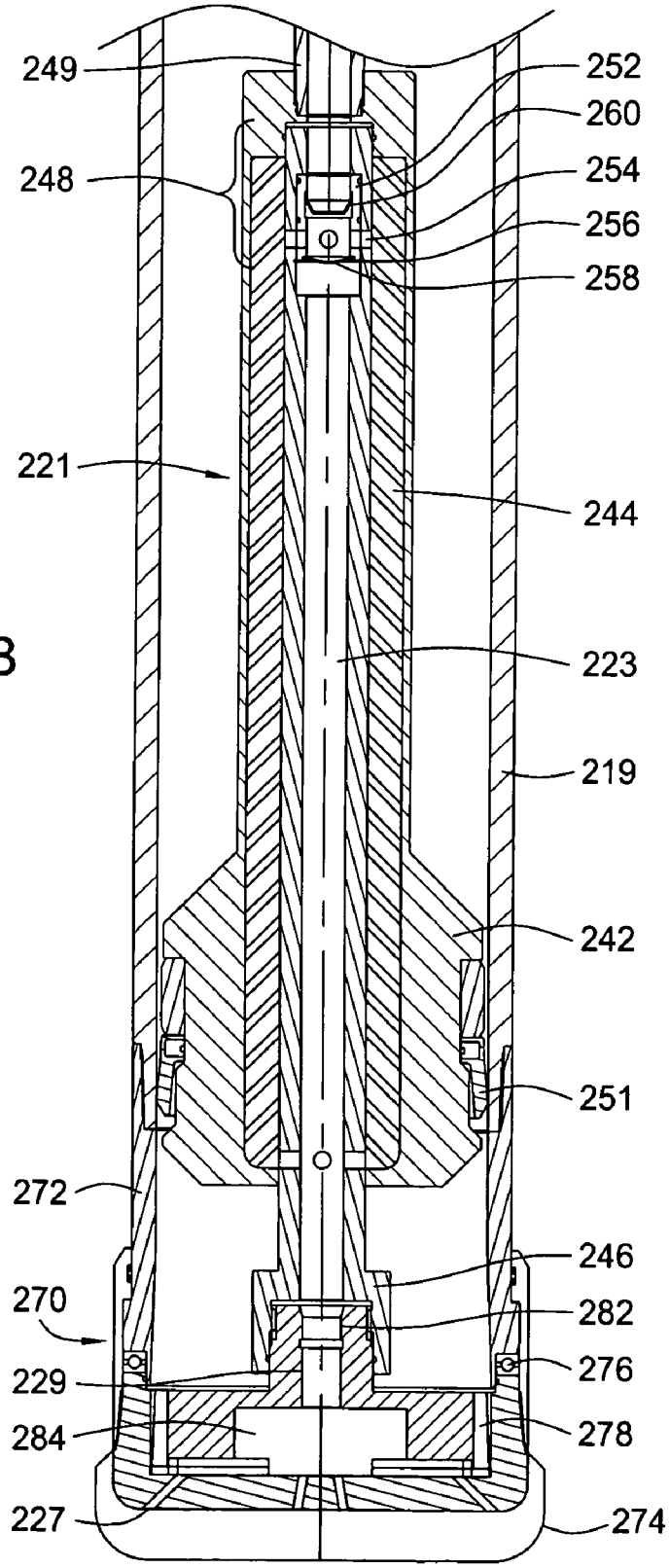

FIGS. 2A and 2B show a cross-sectional view of one embodiment of a hollow shaft motor drilling system 200 disposed in a casing 219. The hollow shaft motor drilling system 200 illustrates one embodiment of the drilling system 157, and the casing 219 is representative of the second casing 195. The hollow shaft motor drilling system 200 generally comprises a casing latch 211, a hollow shaft motor 221 and a drill shoe 270. The hollow shaft motor drilling system 200 may include a guide assembly 203 attached to the casing latch 211. In one embodiment, the guide assembly 203 includes a conical portion 204 and a tubular portion 206. The conical portion 204 guides mechanical devices run in from the surface or drilling fluid or drill mud into the tubular portion 206. Such mechanical devices may include an inter string or drill string 207, a closing ball, a latching dart 286 (see FIGS. 5 and 6), and other devices attached to a wireline. The tubular portion 206 also provides a plurality of receptacle seats such as a spear seat 208 for receiving a stinger attached to an inter string 207 and a orientation tool landing seat 209 for receiving an orientation tool for performing a survey. The tubular portion 206 is attached to the casing latch 211 and provides a fluid passageway which connects to a fluid passageway in the casing latch 211.

The casing latch 211 is fixedly attached to the hollow shaft motor 221 and provides a mechanism for securing the hollow shaft motor drilling system 200 against an interior surface of the casing 219. In one embodiment, the casing latch 211 includes a set of gripping members, preferably retractable slips 212, disposed between an upper body 214 and a lower body 216. The lower body 216 includes one or more angled surfaces 218 which urge the slips 212 outwardly when the slips 212 are pushed against the angled surfaces 218. A locking mechanism, preferably a locking ring 213, is utilized to keep the slips 212 in the set position against the interior surface of the casing 219 once the slips 212 are extended. The locking ring 213 may be spring loaded by a coil spring 222 and released from a locking position by breaking one or more release shear pins 224.

An upper cup seal assembly 226 is disposed on an outer surface of the upper body 214 to provide a seal between the casing latch 211 and the casing 219. The casing latch 211 includes an axial tube 228 which provides a fluid passageway through the casing latch 211 to the hollow shaft motor 221. One or more bypass ports 217 may be disposed on the axial tube 228 and on the upper body 214 to facilitate fluid flow (e.g., drilling fluid or drill mud) during retrieval of the hollow shaft motor drilling system 200. The lower body 216 of the casing latch 211 is attached to the hollow shaft motor 221.

The hollow shaft motor 221 provides the mechanism for rotating the drilling member 270 (e.g., a rotating drill face on a drill shoe). In one embodiment, the hollow shaft motor 221 includes a housing 242, a motor operating system 244, a shaft 246, and a fluid divert assembly 248. The housing 242 includes an upper opening 249 which provides the connection to the casing latch 211 and continues the axial passageway 228 from the casing latch 211. A lower cup seal 251 may be disposed on an outer surface of the housing 242 to provide a seal against the interior surface of the casing 219.

In one embodiment, the motor operating system 244 is a hydraulic motor system which is operated by fluids (e.g., drilling fluid or drill mud) pumped through the motor operating system 244. The motor operating system 244 may be a stator system or a turbine system and turns the shaft 246. The shaft 246 is disposed axially along the hollow shaft motor 221 and includes an axial passageway 223 which is connected to the axial passageway 228 from the casing latch 211. The fluid divert assembly 248 is disposed at an upper portion of the axial passageway 223 to divert fluids into the motor operating system 244 or to direct fluid flow through the passageway 223.

In one embodiment, the fluid divert system 248 includes a closing sleeve 252, one or more divert ports 254, and a shear ring 256. In normal drilling operation, the shear ring 256 keeps the closing sleeve 252 in the open position which allows the divert ports 254 to divert fluids into the motor operating system 244. To move the closing sleeve 252 to the closed position (i.e., where the divert ports 254 are blocked from directing fluids into the motor operating system 244), the shearing ring 256 is broken by mechanical means, for example, by dropping a ball 261 (see FIG. 3) from the surface. The fluid divert system 248 also includes a rupture disk 258 and an extrudable ball seat 260 for facilitating moving the closing sleeve 252 to a closed position which shuts off fluid delivery to the motor operating system 244 and diverts fluid flow through the axial passageway 223 in the shaft 246.

The extrudable ball seat 260 includes a seat opening and may be made from a frangible material such as brass, aluminum, rubber, plastic, mild steel, and other material which may be opened, extruded or expanded when a predetermined pressure is applied to the seat opening. For example, when a ball 261 (see FIG. 3) has been dropped into the extrudable ball seat 260 with fluids continually pumped behind the ball 261, pressure builds up against the extrudable ball seat 260, and when a predetermined pressure has been reached, the shear ring 256 breaks and the sleeve 252 shifts down and closes port(s) 254. Next, a second predetermined pressure is reached and the extrudable ball seat 260 opens up and allows the ball 261 to travel through the seat opening, with sufficient force to break through the rupture disk 258. The rupture disk 258 may be made from a flangeable material which, when ruptured or broken by a ball 261, opens up in a clover leaf pattern generally and does not break off into pieces. When a rupture disk 258 has been broken, fluid flow is directed through the passageway 223 in the shaft 246 to the drill shoe 270.

The drill shoe 270 is disposed at a terminal portion of the casing 219. The drill shoe 270 includes a mounting portion 272 for connecting to the end of the casing 219. The mounting portion 272 secures the drill shoe 270 to the casing 219. The drill shoe 270 includes a rotating drill face 274 which is rotatably disposed on the mounting portion 272. A set of bearings 276 is disposed between the mounting portion 272 and the rotating drill face 274 to facilitate rotational movement of the rotating drill face 274. Alternatively, a ball joint (not shown) can be utilized instead of the bearings 276. Utilizing a ball joint would facilitate adjustment of the drill face 274 angle (or azimuth of the bit face) relative to the axis of the casing 219. A spindle 278 is attached to the rotating drill face 274. The spindle 278 is connected to a terminal portion of the shaft 246 of the hollow shaft motor 221 which provides the rotational movement to the rotating drill face 274. The spindle 278 includes a central passageway 229 which is connected to the axial passageway 223 in the shaft 246 of the hollow shaft motor 221. The central passageway 229 facilitates fluid flow (e.g., drill mud or cement) to one or more nozzles 227 (preferably bit nozzles) in the rotating drill face 274. The nozzles 227 allow fluid flow out of the drill face 274 and into the annulus between the casing 219 and the formation to facilitate drilling operations and cementing operations. A dart seat 282 is positioned on the central passageway 229 for receiving a dart which may be utilized to seal the central passageway 229.

FIGS. 2A and 2B illustrate one embodiment of the drill system 200 which may be utilized for a drilling and casing operation in which the casing 219 is of a set length and the drill pipe (or inter string) 207 may be added from the surface during the operation. In one embodiment, the hollow shaft motor drilling system 200 may be utilized in offshore deep sea drilling in which the distance from the water surface to the sea floor is greater than the length of the casing 219. The hollow shaft motor drilling system 200 may be disposed on an inner casing 195 of a nested casing configuration, as shown in FIG. 1. The inner casing 195 may be latched to an outer casing 185 utilizing a J-slot mechanism (not shown). In one embodiment, the outer casing 185 is a 36-inch diameter casing, while the inner casing 195 is a 22-inch diameter casing, and a drill shoe 270 or 135 having a 26-inch drill surface or drill bit is attached to the tip of the inner casing 195. The nested casing configuration is attached to the surface platform 155 utilizing an inter string 165 and lowered down to the sea floor 160.

To begin the drilling operation, referring again to FIGS. 2A and 2B, drilling fluid or drill mud is pumped from the surface through the inter string 207 attached to the hollow shaft motor drilling system 200 to provide the hydraulic power to drive the motor operating system 221 which rotates the drill shoe 270. The outer casing 185 (see FIG. 1) is jetted/drilled to a first target depth with the inner casing 195, 219 latched inside. The outer casing 195, 219 may be directionally drilled into the formation using any of the embodiments shown in FIGS. 13-20 and described below.

By nudging the outer casing 195, 219, the direction of the wellbore may be started so that subsequent casing may be drilled further into the wellbore at an angle.

Figure 3:
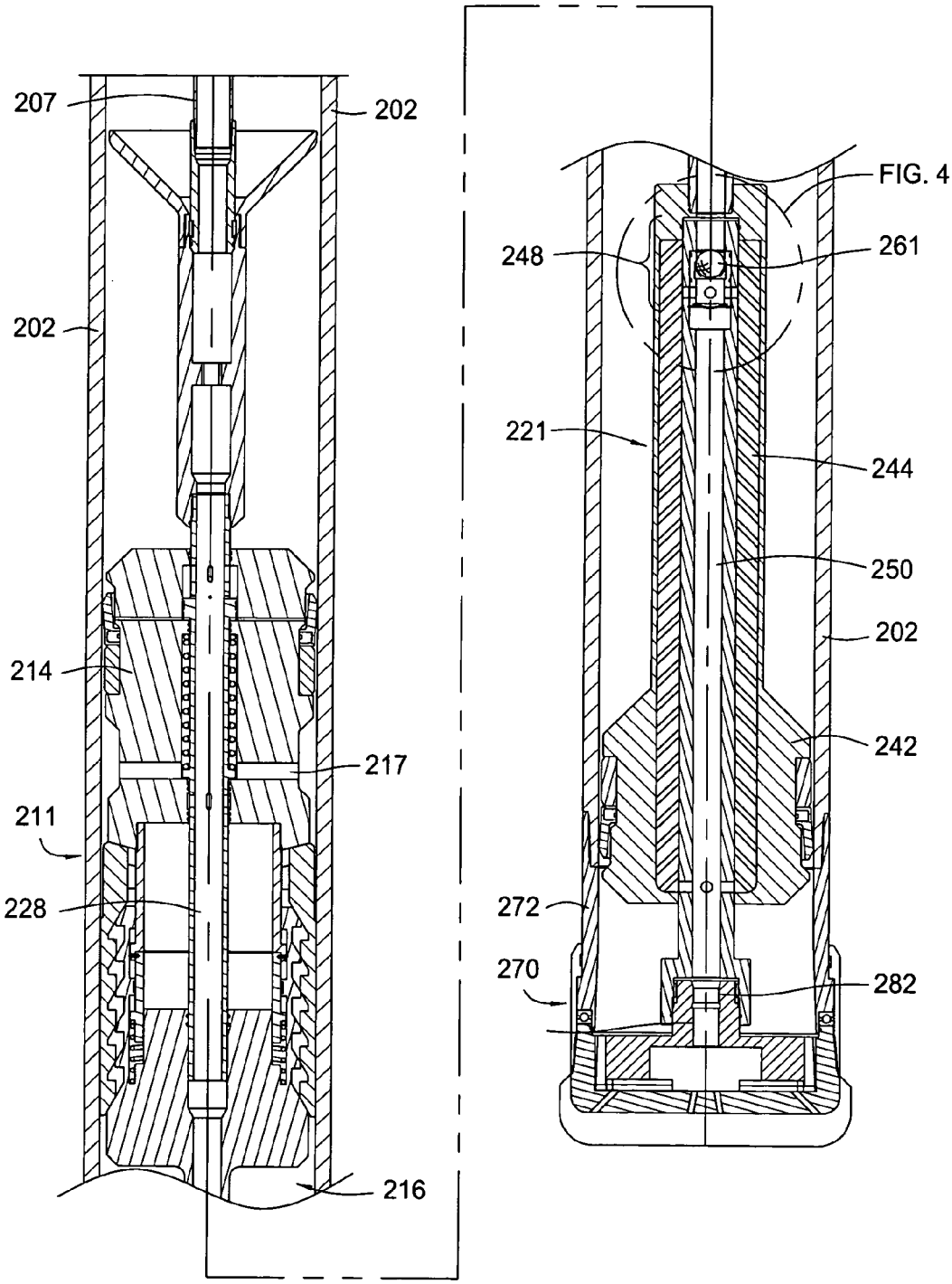
FIG. 3 is a cross-sectional view of one embodiment of a hollow shaft motor drilling system illustrating a fluid divert operation.

Once this first target depth has been reached, the inner casing 195, 219 is released from the outer casing 185 (e.g., by turning the inner casing 195, 219 through the J-slot mechanism) and continued to be drilled/jetted down until a second target depth is reached. The methods and apparatus of FIGS. 13-20 described below may also be used on the outer casing 185. Once the inner casing 195, 219 has reached the target depth, as shown in FIG. 3, a ball 261 is dropped from the surface through the casing 195, 219 and into the extrudable ball seat 260 to shut off fluid flow to the motor operating system 244 and divert the flow to the passageway 223 in the shaft 246. The ball 261 is then pressured from the surface to a first predetermined pressure to shear ring 256, thus moving the sleeve 252 to a closed position. At a second predetermined pressure, ball 261 extrudes through the seat 260, then impacts and breaks rupture disc 258, as shown in FIG. 3.

Figure 4:
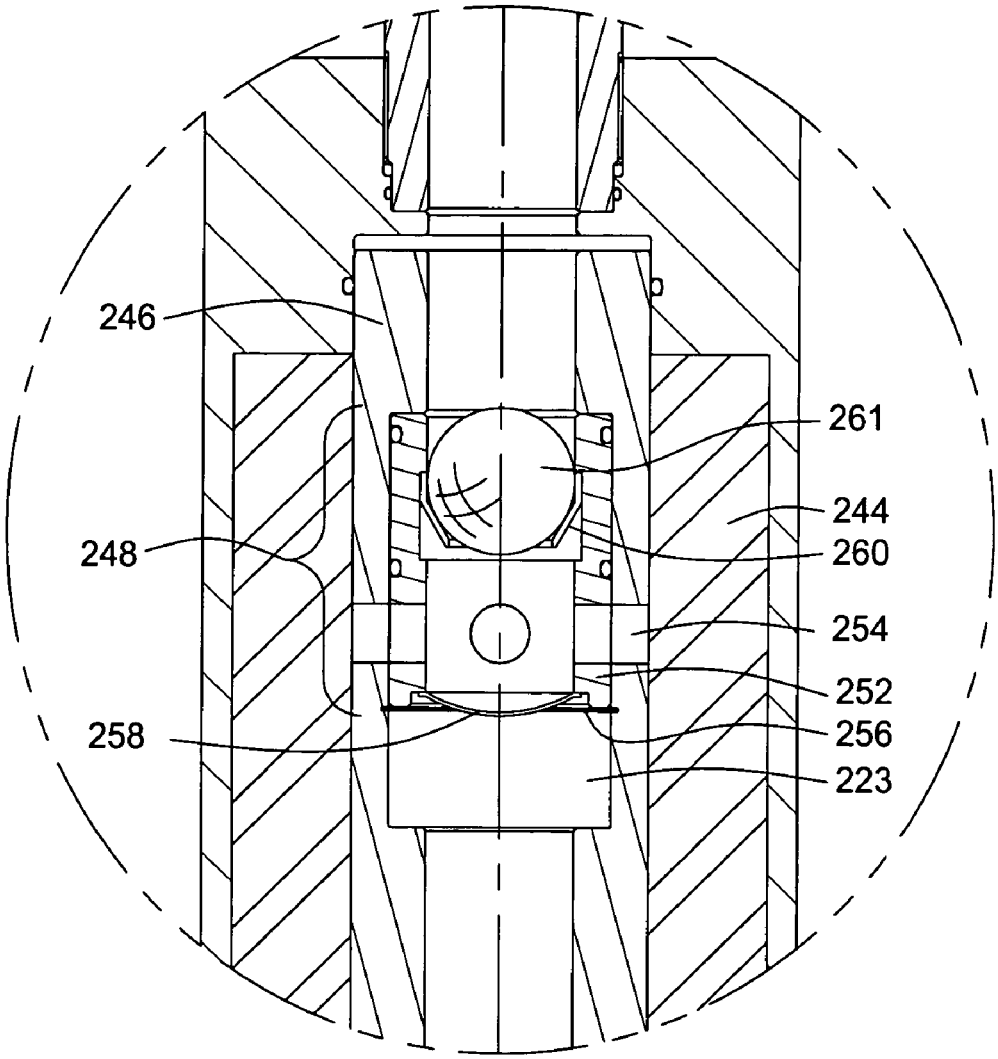
FIG. 4 is a partial cross-sectional view of one embodiment of the divert system of FIG. 3.

FIG. 3 is a cross-sectional view of one embodiment of a hollow shaft motor drilling system 200 illustrating a fluid divert operation. FIG. 4 is a partial cross-sectional view of one embodiment of a divert system 248 in a closed position in which the ports 254 are closed off from delivering fluid flow to the motor operating system 244. To open fluid flow to the passageway 223 in the shaft 246, fluid (e.g., drilling fluid, drill mud, or cement) may be pumped in behind the ball 261 to build up pressure against the ball seat 260, and once sufficient pressure is reached, the shear ring 256 breaks and the sleeve 252 closes the port(s) 254. When a second predetermined pressure is reached, the ball 261 shoots through the extrudable ball seat 260 and breaks through the rupture disk 258, allowing fluid flow through the passageway 223. The ball 261 travels through the passageway 223 and falls into a cavity 284 (shown in FIG. 2) in the spindle 278. Once the divert system 248 is set to direct fluid flow through the passageway 223, a cementing operation may be performed.

Figure 5:
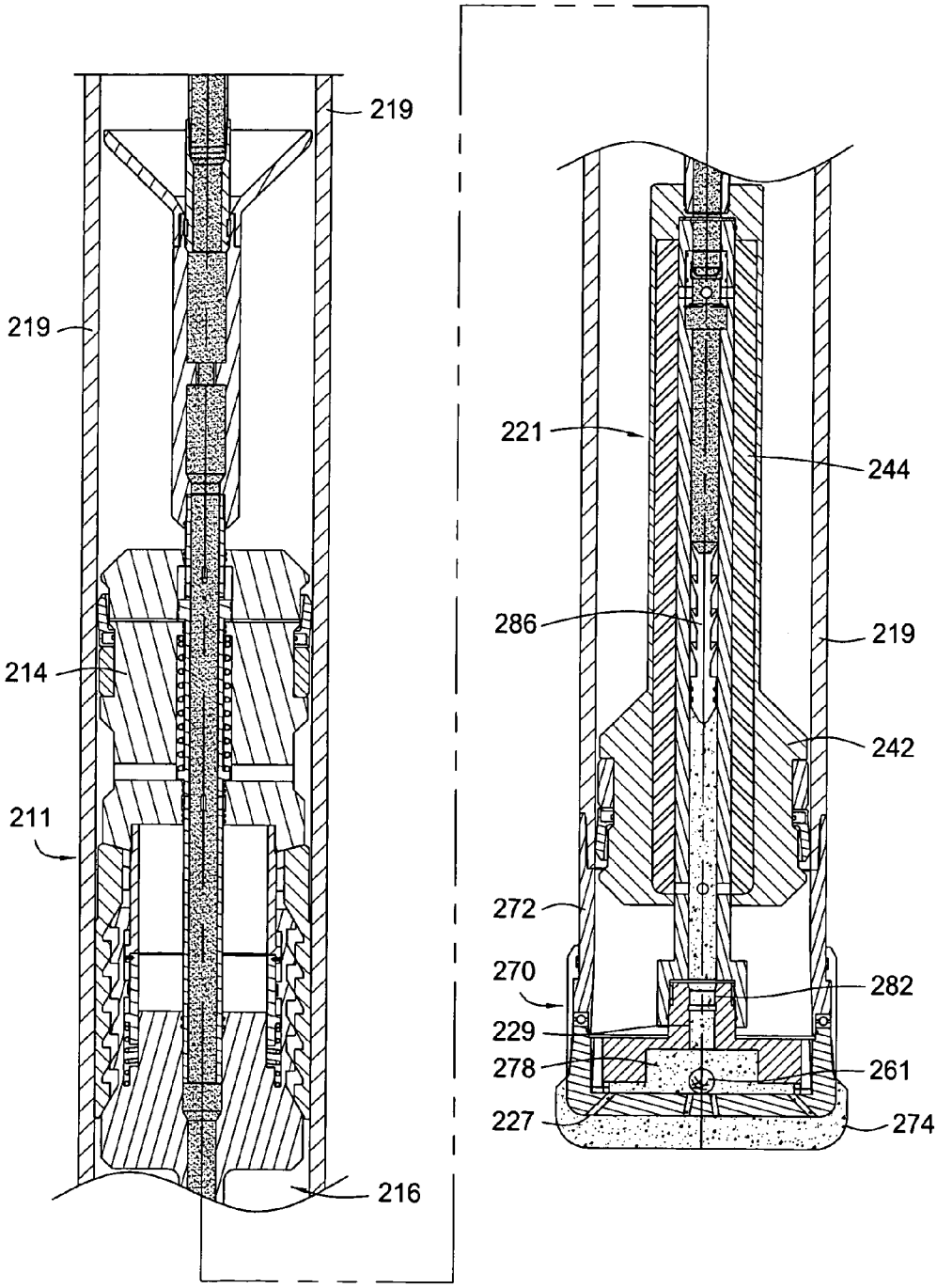
FIG. 5 is a cross-sectional view of one embodiment of a hollow shaft motor drilling system illustrating a cementing operation.

FIG. 5 is a cross-sectional view of one embodiment of a hollow shaft motor drilling system 200 illustrating a cementing operation. A physically alterable bonding material, preferably cement, may be pumped from the surface through hollow shaft motor drilling system 200 and through one or more bit nozzles 227 in the drill face 274, filling or partially filling gaps between the casing 219 and the formation. After sufficient cement has been pumped through to cement the casing 219 in place, a latching dart 286 is inserted from the surface to close off the central passageway 229 in the spindle 278. The latching dart 286 is utilized to prevent back flow through the central passageway 229 in the spindle 278 and to stop flow through the one or more bit nozzles 227 in the drill face 274. Alternatively, instead of or in addition to the latching dart 286, a float valve may be utilized to prevent back flow fluid pumped down through the drill shoe 270. The latching dart 286 is displaced down to the dart seat 282 by mud pumped in behind the dart 286 from the surface. Once the latching dart 286 is secured onto the dart seat 282, a system retrieval operation may be performed to retrieve the motor system 221 and the casing latch 211.

Figure 6:
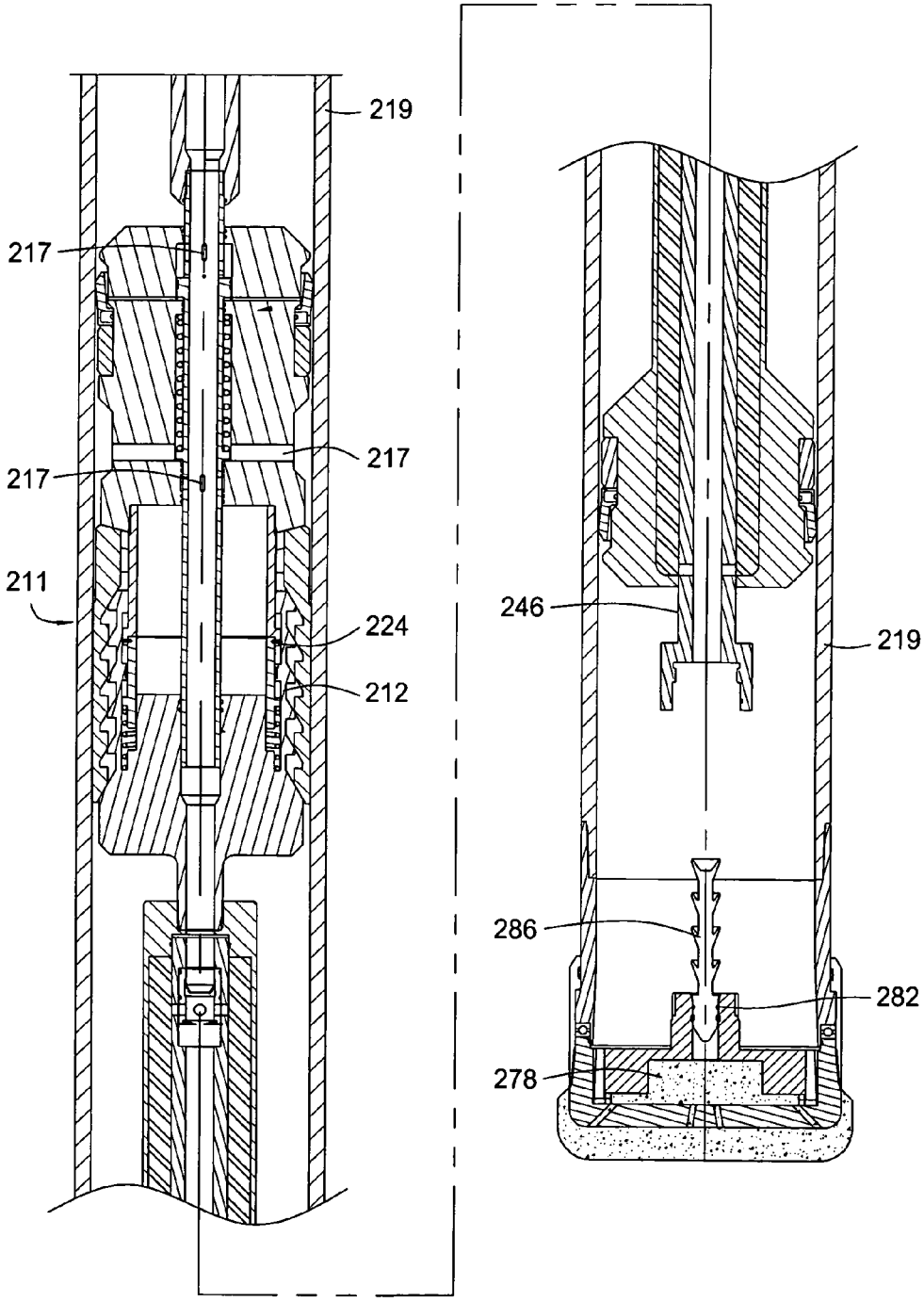
FIG. 6 is a cross-sectional view of one embodiment of a hollow shaft motor drilling system illustrating a system retrieval operation.

FIG. 6 is a cross-sectional view of one embodiment of a hollow shaft motor drilling system 200 illustrating a system retrieval operation. With the latching dart 286 in the dart seat 282, the slips 212 on the casing latch 211 may be released by a mechanical jerking action (e.g., utilizing the inter string 207 or a wireline) which shears the releasing shear pin 224. Once the releasing shear pin 224 is broken, the slips 212 collapse inwardly and release from the interior surface of the casing 219, and the motor system 221 and the casing latch 211 may be retrieved (e.g., physically picked up) from the surface by retracting or pulling up on the inter string 207. In the retrieving operation, the shaft 246 of the motor system 221 is detached from the spindle 278 of the drill shoe 270, leaving the latching dart 286 in the dart seat 282. As the casing latch 211 is moved up toward the surface, the bypass ports 217 may be opened to allow remaining mud in the system to flow through the bypass ports 217 into the casing 219. If a float valve is utilized in the drill shoe 270, the motor system 221 may be retrieved utilizing mechanical means other than the inter string (or drill pipe) 207, such as, for example, cable wireline, coiled tubing, coiled sucker rod, etc.

As described above, the hollow shaft motor drilling system 200 facilitates drilling with casing and enables cementing the well in one single trip down without having to first retrieve the motor system 221 and the drill bit 270. Considerable time is reduced in drilling and casing a well, resulting in substantial economic saving. Embodiments of the hollow shaft motor drilling system 200 may be utilized in a variety of applications.

Figure 7:
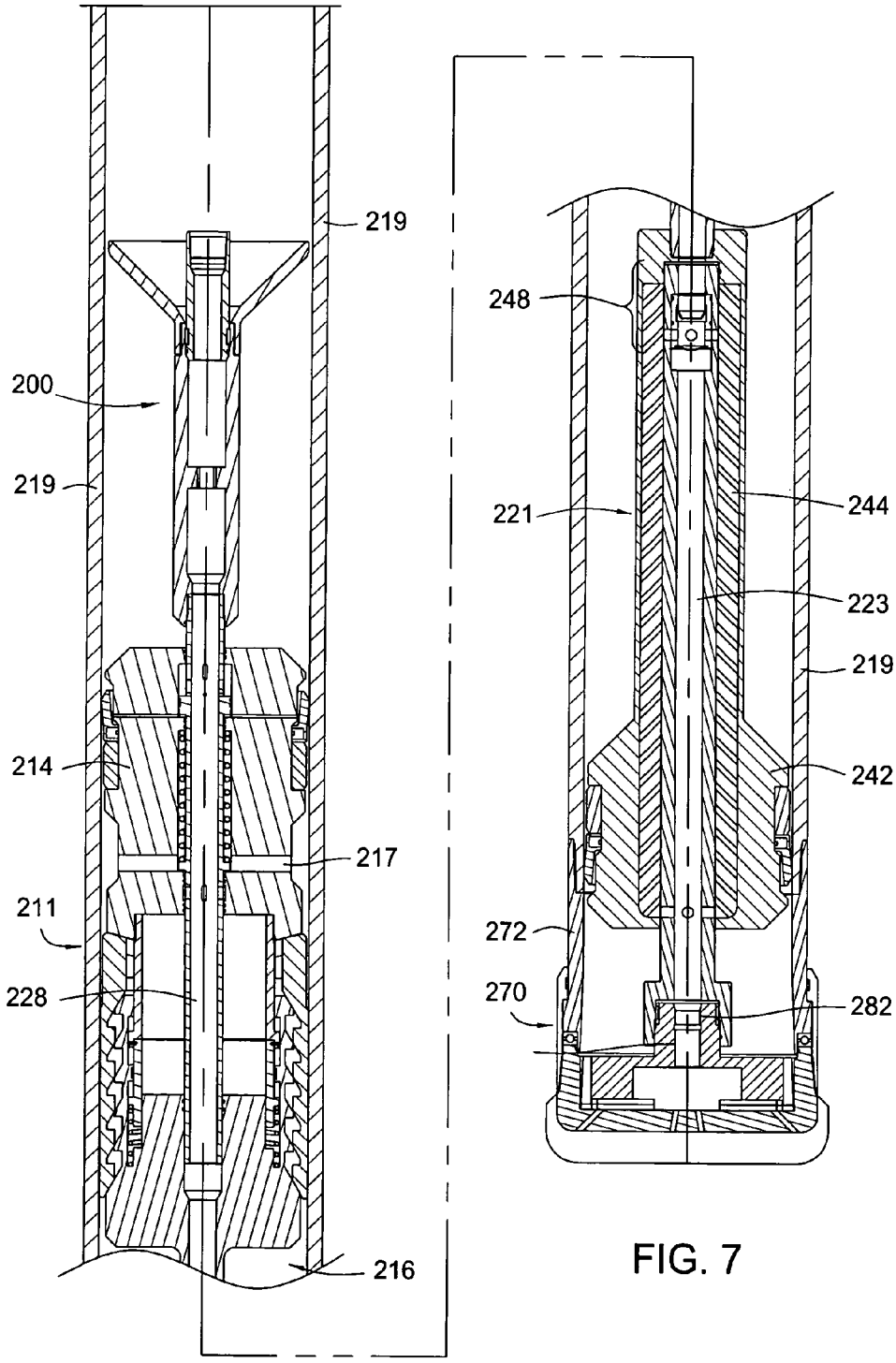
FIG. 7 illustrates one embodiment of the drill system which may be utilized for a drilling and casing operation in which casing may be added during the operation.

FIG. 7 illustrates one embodiment of the drilling system 200 which may be utilized for a drilling and casing operation in which casing may be added during the operation. To begin the drilling operation, drilling fluid or drill mud is pumped from the surface through the inner diameter of the casing 219 to the hollow shaft motor drilling system 200 to provide the hydraulic power to drive the motor operating system 221 which rotates the drill shoe 270. The casing 219 is jetted/drilled to a target depth. The ability to drill a hole without rotating the casing 219 while adding casing at the surface may reduce the time needed to perform the drilling operations. Alternatively, the casing 219 may be rotated by surface equipment (e.g., top drive, rotary table, etc.) during the jetting/drilling operation without or in addition to rotating the drill shoe 270. Once the casing 219 has reached the target depth, a fluid divert operation, a cementing operation, and a retrieval operation may be performed, similar to the description above relating to FIGS. 3-6, except fluids are pumped down from the surface through the interior diameter of the casing 219 instead of the inter string 207.

Figure 8:
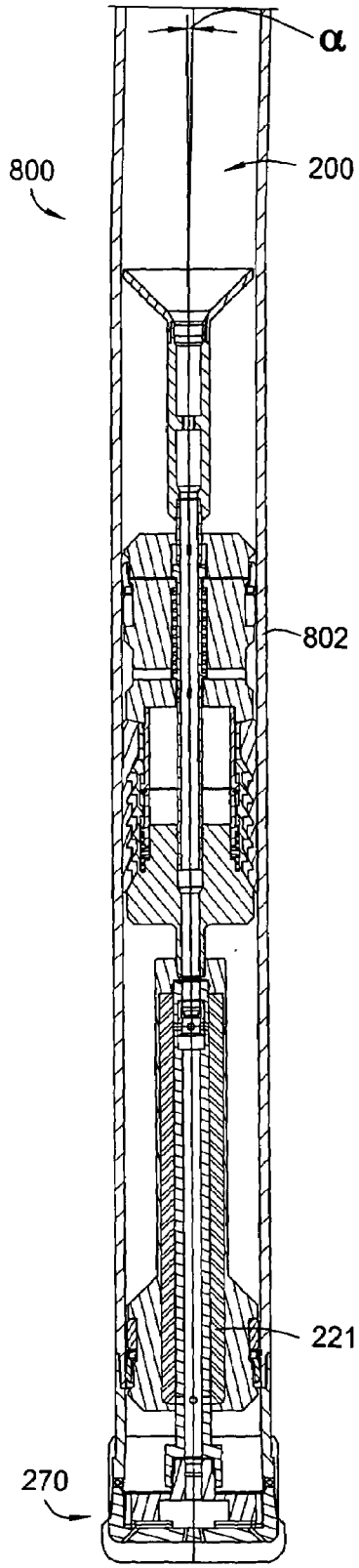
FIG. 8 is a cross-sectional view of one embodiment of a hollow shaft motor drilling system illustrating a drilling operation utilizing a bent pup joint.
Figure 9:
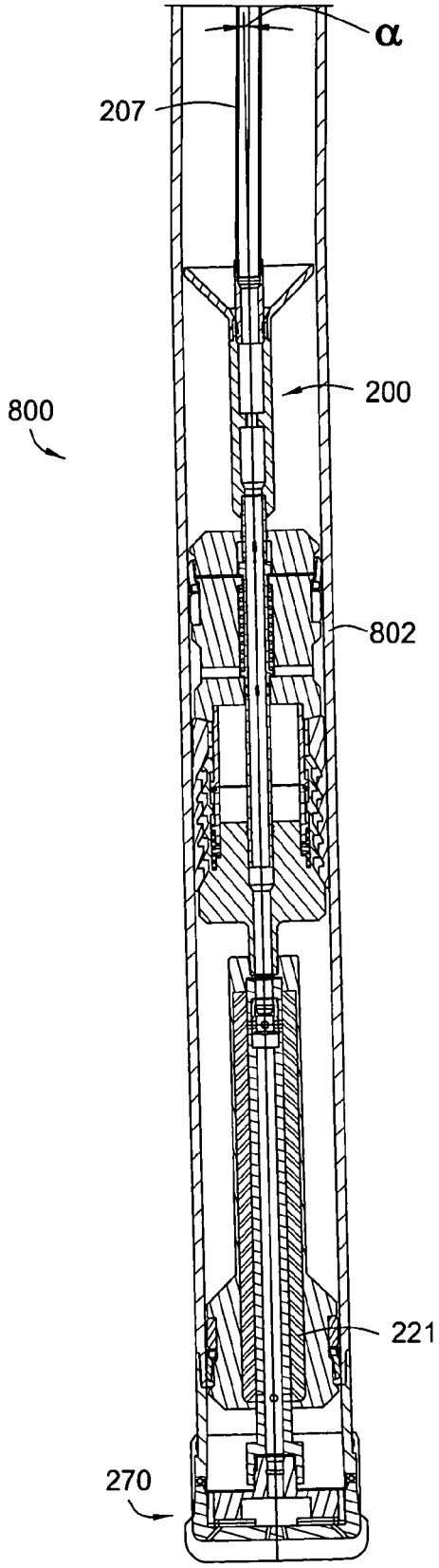
FIG. 9 is a cross-sectional view of one embodiment of a hollow shaft motor drilling system illustrating a drilling operation utilizing a bent pup joint and an inter string.

Embodiments of the invention may also be utilized to perform directional drilling. FIG. 8 is a cross-sectional view of one embodiment of a hollow shaft motor drilling system 800 illustrating a drilling operation utilizing a bent pup joint 802. As shown in FIG. 8, the motor system 221 and the drill shoe 270 are latched onto a bent pup joint 802. The bent pup joint 802 is threaded onto casing with casing 219 being rotated at the surface during straight hole sections and being slid during directional sections to drill the casing 219 into the formation at an angle $\alpha$. FIG. 9 is a cross-sectional view of one embodiment of a hollow shaft motor drilling system 800 illustrating a drilling operation utilizing a bent pup joint 802 and an inter string 207. This embodiment facilitates addition of inter string 207 to a bent pup joint assembly 800 from the surface. The casing 219 is of a set length while drill pipe (e.g., inter string) 207 is added at the surface. Both FIGS. 8 and 9 shows a bent angle $\alpha$ (e.g., one degree bend) from the main drilling axis. Utilizing a bent pup joint 802 allows for drilling a deviated hole or performing a nudging operation, without having to depend on a jetting/sliding operation. Typically, to keep the drilled hole straight, the casing 219 is rotated when the casing 219 is not sliding or in a slide mode. In an alternate embodiment, the inter string 207 may not be attached during the drilling operation, but may be utilized to retrieve the motor system 221. When an inter string 207 is utilized, it would be advantageous (e.g., faster) to perform the cementing operation utilizing the inter string 207.

Figure 10:
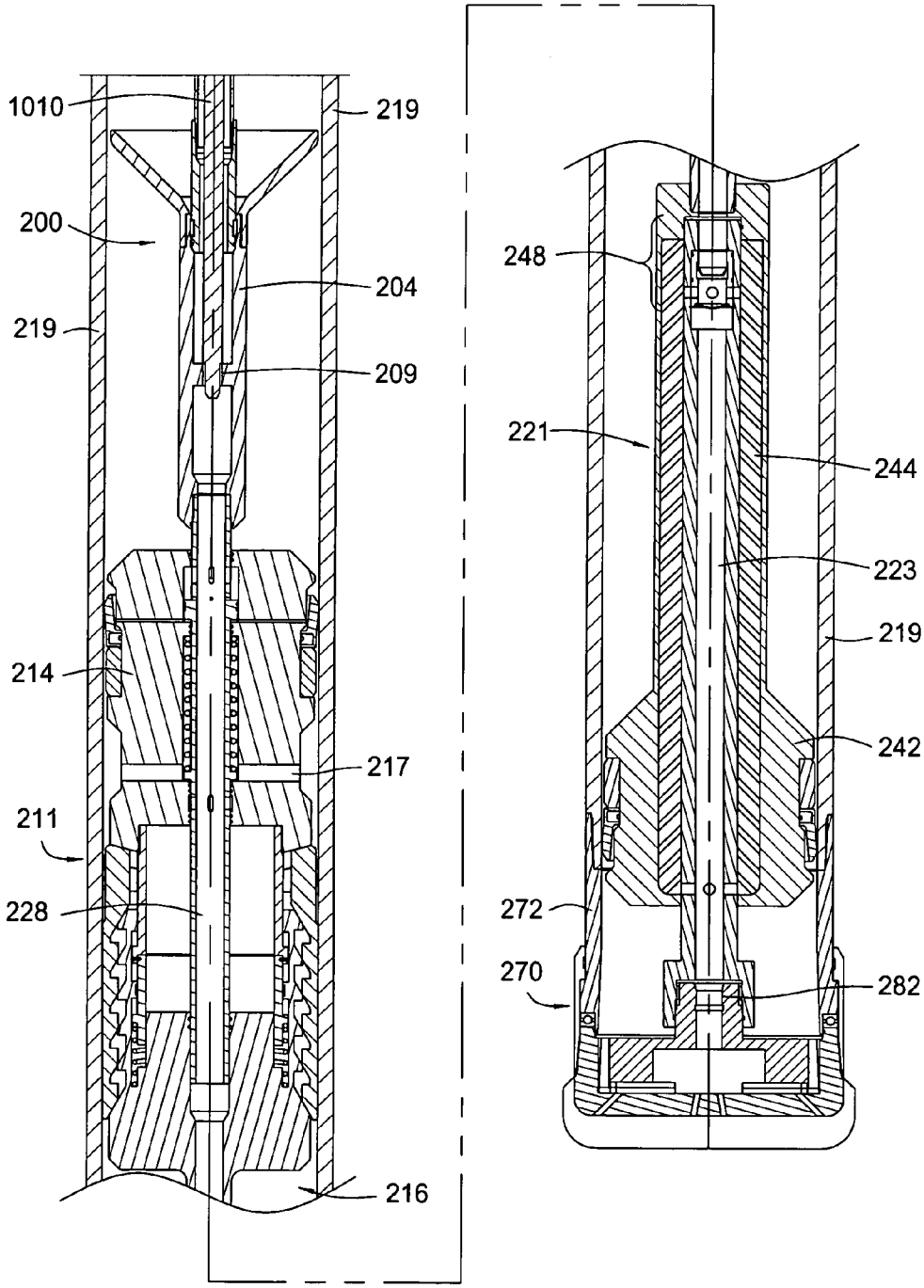
FIG. 10 is a cross-sectional view of one embodiment of a hollow shaft motor drilling system illustrating a surveying operation.

Embodiments of the invention may be utilized to perform a survey operation to determine the direction of drilling. FIG. 10 is a cross-sectional view of one embodiment of a hollow shaft motor drilling system 200 illustrating a surveying operation. At any time during the drilling operation, if a survey is needed to determine or confirm the direction of drilling, a survey operation may be performed by lowering an orientation device 1010 into the guide 204. In a survey operation, the inter string 207, if utilized, is withdrawn to allow usage of the orientation device 1010. The orientation device 1010 is inserted into the landing seat 209 to determine the azimuth deviation of the drilled well. After the survey has been performed, normal drilling operations may be resumed and corrections may be made to direct or deviate the well in the desired direction. The surveying operation may also be conducted while drilling in a measuring-while-drilling operation, so that the angle of the casing may be continuously adjusted while drilling without interrupting the drilling and casing operation.

Figure 11:
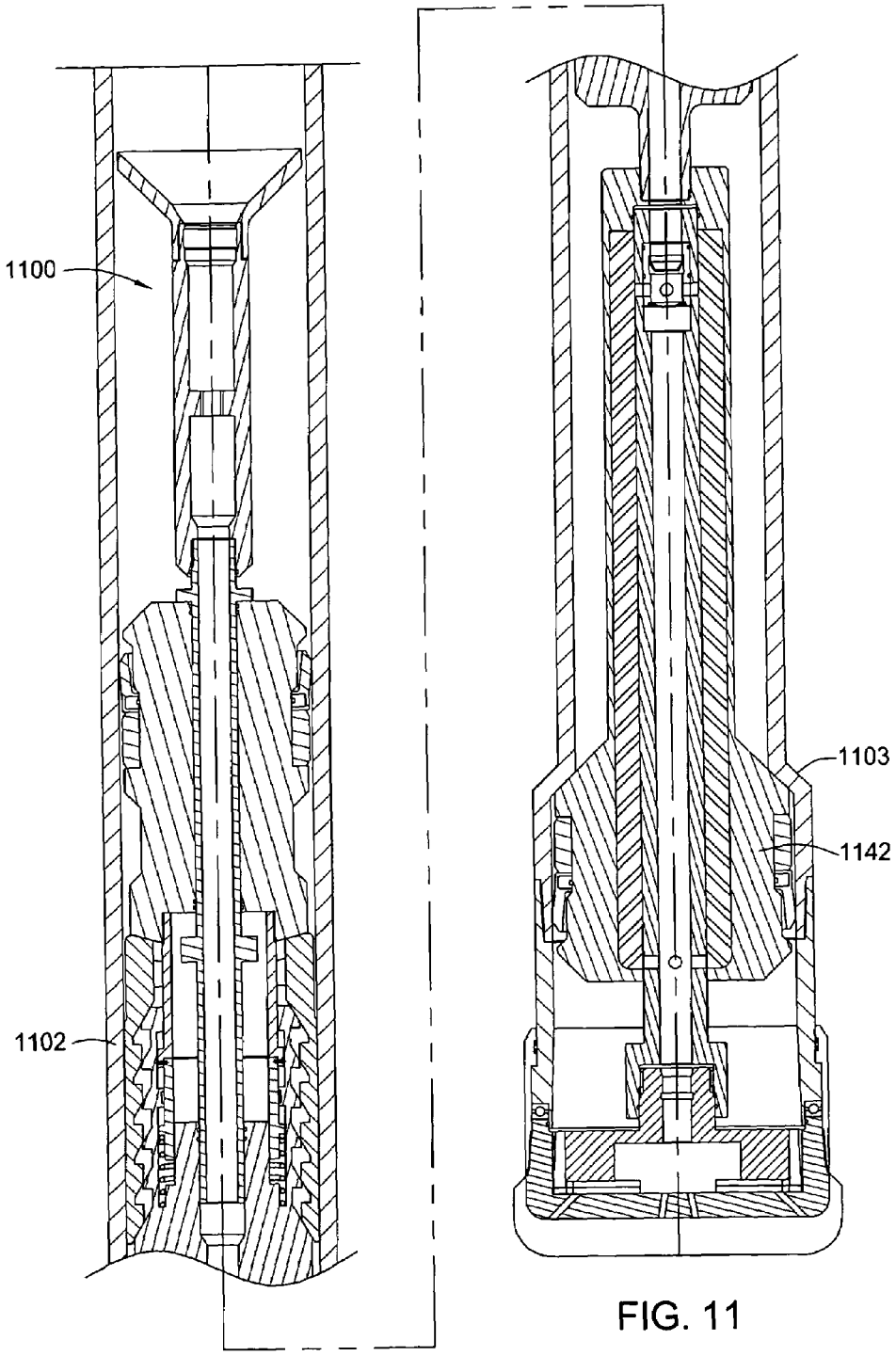
FIG. 11 is a cross-sectional view of one embodiment of a hollow shaft motor drilling system disposed in an expandable casing.

Embodiments of the invention may be utilized in a drilling with casing operation in which the casing 1102 may be cemented and expanded with the same run of the casing 1102. FIG. 11 is a cross-sectional view of one embodiment of a hollow shaft motor drilling system 1100 disposed in an expandable casing 1102. The hollow shaft motor drilling system 1100 includes similar components as the drilling system 200 described above except the housing 1142 of the hollow shaft motor drilling system 1100 is enlarged (as compare to housing 242) to conform with an enlarged terminal portion 1103 of the expandable casing 1102. Also, the casing latch 1110 does not include bypass ports such as the bypass ports 217 on the casing latch 211. Drilling and cementing operations as described above may be performed similarly utilizing the hollow shaft motor drilling system 1100. After the drilling and cementing operations have been performed, the expandable casing 1102 may be expanded or enlarged from the inside utilizing the enlarged housing 1142.

Figure 12:
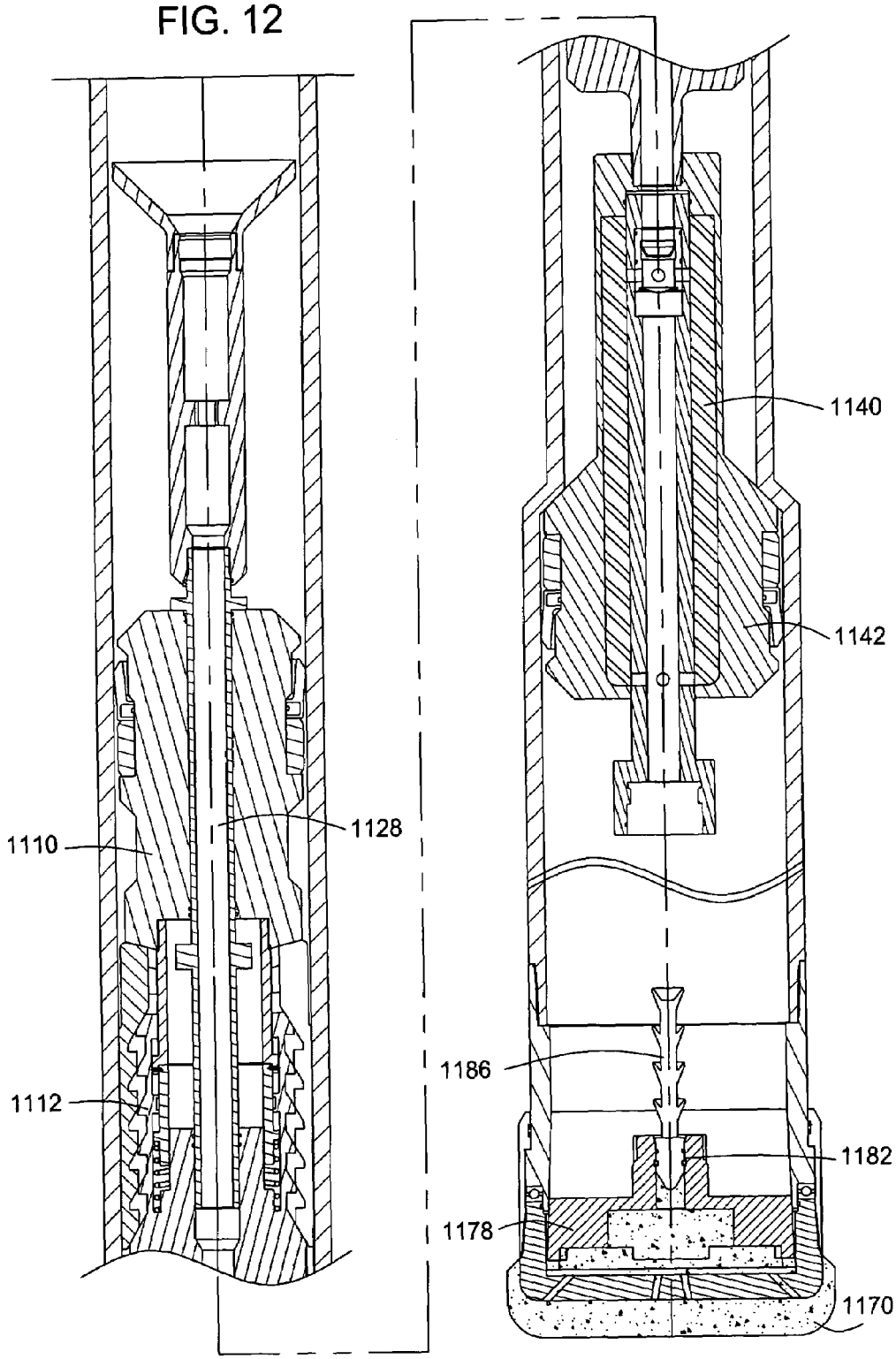
FIG. 12 is a cross-sectional view of one embodiment of a hollow shaft motor drilling system disposed in an expandable casing illustrating an operation for expanding the casing after cementing.

FIG. 12 is a cross-sectional view of one embodiment of a hollow shaft motor drilling system 1100 disposed in an expandable casing 1102 illustrating an operation for expanding the casing 1102 after cementing. After the cement has been pumped into the annulus between the casing 1102 and the formation and the latching dart 1186 has been placed into the dart seat 1182, the slips 1112 on the casing latch 1110 are released to allow retrieval of the motor system 1140 which causes expansion the casing 1102. The casing 1102 may be expanded by mechanically pulling up the enlarged housing 1142 (e.g., utilizing an inter string such as 207) or by pumping fluids (e.g., mud) down to push the housing 1142 up, or by a combination of both of these methods. In one embodiment, as the motor system 1140 is pulled up (e.g., utilizing inter string), mud is pumped through the passageways 1128 and 1150, filling the space inside the casing 1102 between the housing 1142 and the spindle 1178 of the drill shoe 1170. With more mud being pumped down from the surface, pressure builds up between the housing 1142 and the spindle 1178 and pushes the housing 1142 upwards. The housing 1142 pushes against the interior surface of the casing 1102, expanding the casing 1102 as the housing 1142 travels upwardly toward the surface. With the retrieval of the motor system 1140, the casing 1102 is expanded to a larger internal diameter. Furthermore, since the cement between the casing 1102 and the formation has just recently been pumped there and has not set or dried, expansion of the casing 1102 squeezes the cement into remaining voids in the formation, resulting in a better seal or stronger cement job of the casing 1102 in the formation.

With the embodiments of FIGS. 1-12, additional casing (not shown) may be used to drill through the remaining tools and any cement in the cemented casing 202, 802, 1102. The additional casing may include the motor drilling system therein, as described in relation to FIGS. 1-12. Additionally, the additional casing may be cemented into the formation and expanded by the motor drilling system.

Figure 13:
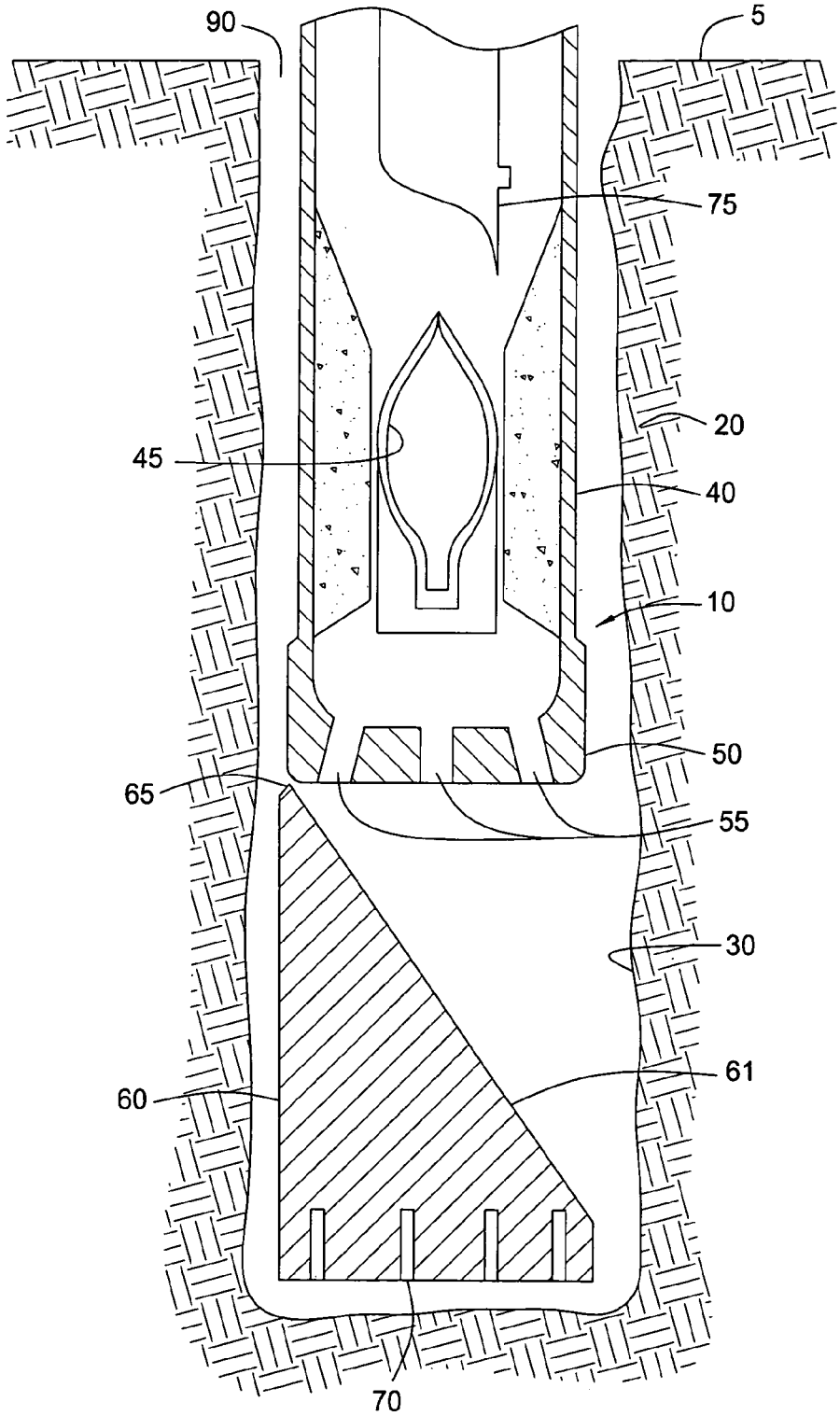
FIG. 13 is cross-sectional view of an embodiment of a diverting apparatus of the present invention disposed within a subterranean wellbore. A diverter is located below a casing with an earth removal member attached thereto.

In an additional aspect of the present invention, the motor drilling system 200 or 1100 described in relation to FIGS. 1-12 may be used in conjunction with preferentially deflecting a casing in the form of a casing section or casing string in the wellbore in a direction using the casing, as shown and described in relation to FIGS. 13-20. In the embodiments described herein, "casing string" refers to one or more sections of casing. More than one sections of casing are threadedly connected to one another. FIG. 13 shows a diverting apparatus 10 of the present invention disposed in a wellbore 30. The wellbore 30 is a hole drilled in a subterranean formation 20. The diverting apparatus 10 comprises a cutting apparatus 50 connected to a lower end of a casing string 40. The casing string 40 is inserted into the formation 20. The cutting apparatus 50 has perforations 55 therethrough which allow fluid circulation between the wellbore 30 and the casing string 40.

The diverting apparatus 10 also comprises a diverter 60 connected to the lower end of the casing string 40 below the cutting apparatus 50. The diverter 60 is connected to the lower end of the casing string 40 by a releasable attachment 65. The releasable attachment 65 is preferably a shearable connection. The diverter 60 is preferably an inclined wedge attached to a portion of the casing string 40 by the releasable attachment 65. The diverter 60 has securing profiles 70 disposed at the lower end thereof, which are slots formed within the diverter 60 for grabbing the formation 20. The securing profiles 70 provide traction for the diverter 60 while the casing string 40 is penetrating the formation 20, preventing rotational movement of the diverter 60.

Optionally, the casing string 40 of the diverting apparatus 10 may have a landing seat 45 disposed therein above the cutting apparatus 50. The landing seat 45 is a slot in which to fit a survey tool (not shown). Placing the survey tool into the landing seat 45 allows the angle at which the wellbore 30 is being drilled with respect to a surface 5 of the wellbore 30 to be ascertained and permits appropriate adjustment to the direction and/or angle of the wellbore 30. To determine the angle at which the wellbore 30 is being drilled, the survey tool is first calibrated at the surface 5. The survey tool is then run through the casing string 40 and into the landing seat 45. Once it is secured within the landing seat 45, a second reading of the survey tool is taken, which reveals the angle at which the wellbore 30 is drilled in relation to the surface 5. The survey tool and landing seat 45 permit continuous drilling with casing while surveying the conditions and direction of the wellbore 30. Adjustment to the direction of the wellbore 30 can be made during the drilling operation. The survey tool is preferably a gyroscope, which is known to those skilled in the art.

In operation, the diverting apparatus 10 is drilled into the formation 20 by axial movement to form a wellbore 30. As the casing 40 penetrates the formation 20 to form the wellbore 30, pressurized fluid is introduced into the casing 40 concurrent with the axial movement of the casing 40 so that fluid flows downward through the inner diameter of the casing 40, through the one or more nozzles 55, into the wellbore 30, and up through an annular space 90 between the outer diameter of the casing 40 and the inner diameter of the wellbore 30 to the surface 5. Once the diverting apparatus 10 has reached a predetermined depth within the wellbore 30, in one embodiment a downward axial force calculated to release the releasable attachment 65 is exerted on the casing 40 from the surface 5. The releasable attachment 65 releases so that the casing 40 with the cutting apparatus 50 attached thereto is moveable in relation to the diverter 60. Other embodiments not shown may allow the dropping of an object from the surface, such as a ball or dart, to release the diverting apparatus 10 from the casing 40. Other embodiments not shown may also include signals from the surface such as mud pulses to cause the release of the diverting apparatus 10 from the casing 40. Still other embodiments not shown may include the use of hydraulic pressure applied from the surface through the casing 40 or through a separate line such as an inter string to cause the release of the diverting apparatus 10 from the casing 40. Downward force from the surface 5 is applied to the casing 40, urging the casing 40 along an upper side 61 of the diverter 60, which remains at the same position within the wellbore 30. The obstruction caused by the diverter 60 forces the lower end of the casing 40 to deviate from its original axis at an angle essentially consistent with the slope of the upper side 61 of the diverter 60, causing the casing 40 to move preferentially in a direction. The survey tool may be placed within the landing seat 45 to determine the point at which the desired deviation angle has been reached. Once the desired angle of deviation is accomplished, a setting operation is conducted, as setting fluid such as cement is introduced into the casing 40 from the surface 5. The setting fluid flows downward into the casing 40, through the one or more nozzles 55, into the wellbore 30 and up into the annular space 90. The setting fluid then fills the annular space 90 to anchor the casing 40 within the wellbore 30. The diverter 60 remains permanently within the wellbore 30.

Additional casing (not shown) may then be drilled into the formation 20 below the casing 40 by rotational and/or axial force. The casing 40 serves as a template for the angle followed by the additional casing strings, so that the additional casing strings are biased in the preferential direction. Because the additional casing strings are hung from the casing 40, the additional casing strings divert in the desired direction at the angle in which the casing 40 was biased. A setting operation with setting fluid is conducted on additional casing strings as described above in relation to the casing 40.

Figure 14:
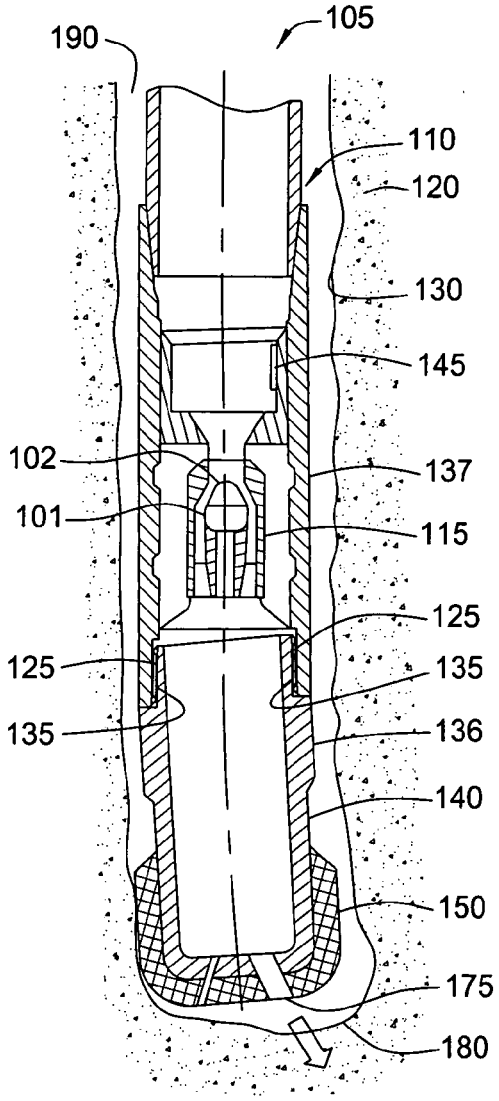
FIG. 14 is a cross-sectional view of an alternate embodiment of a diverting apparatus of the present invention disposed within a subterranean wellbore. A fluid deflector is disposed within the earth removal member attached to the casing.

FIG. 14 shows an alternate embodiment of a diverting apparatus 110 of the present invention. The diverting apparatus 110 is used to form a wellbore 130 in a formation 120. The diverting apparatus 110 comprises a casing string 140 wherein a bend is introduced into a portion of the casing string 140 to deflect the path of the wellbore 130 according to the bend in the casing string 140. The casing string 140 is used to penetrate the formation 120. The bend is not co-axial relative to the axis of the casing string 140. An arc is therefore integrated into the casing string 140 to urge the casing string 140 to form the diverted path for the wellbore 130. FIG. 14 illustrates introducing the bend into the casing string 140 by connecting component parts of the casing string 140 by male threads 135 which engage female threads 125 to form a threadable connection. In the shown embodiment of the diverting apparatus 110, the male and female threads 135 and 125 are oriented on the casing string 140 so that the connection of the component parts disposes a lower portion 136 of the casing string 140 below the threadable connection at an angle off of the vertical axis, so that the lower portion 136 of the casing string 140 is at an angle with respect to an upper portion 137 of the casing string 140. The female threads are not cut co-axially into the lower portion 136 of the casing string 140, so that the lower portion 136 of the casing string 140 is bent or slanted relative to the upper portion 137 of the casing string 140. As shown in FIG. 14, the lower portion 136 of the casing string 140 is at an angle biased to the right of the upper portion 137 of the casing string 140, which is essentially vertically disposed relative to a surface 105 of the wellbore 130.

The diverting apparatus 110 further comprises a cutting apparatus 150 connected to a lower end of the casing string 140. At a location which is off center from the vertical axis of the casing string 140, one or more fluid deflectors 175 are formed through the casing string 140 and the cutting apparatus 150. The fluid deflector 175 is preferably one or more nozzles through the casing string 140 and cutting apparatus 150 which is angled outward with respect to the axis of the casing string 140 in the same direction in which the fluid deflector 175 is biased. The fluid deflector 175 is biased and angled in the direction in which it is desired for the wellbore 130 to be diverted, which is the preferential direction of the wellbore 130.

Also part of the diverting apparatus 110 is a float sub 115. A float sub 115 is a tubular-shaped body which prevents fluid from flowing back up through the inner diameter of the casing string 140 after the setting fluid has been forced downward into the casing string 140 for the setting or cementing operation (described below). Also, the float sub 115 prevents fluid from flowing from the formation 120 in the casing string 140 to reduce frictional resistance while running the casing string 140 into the formation 120. The float sub 115 comprises a ball seat 102 with a ball 101 initially disposed therein, as shown in FIG. 14. The ball seat 102 may also be any type of one-way check valve, include a flapper-type valve. The diverting apparatus 110 further includes a landing seat 145 for a survey tool (not shown), which operates in the same manner as described above with respect to the landing seat 45 of FIG. 13. The float sub 115 and the landing seat 145 are preferably made of drillable material such as aluminum or plastic, so that they may be drilled through after the casing string 140 is set within the wellbore 130.

Figure 15:
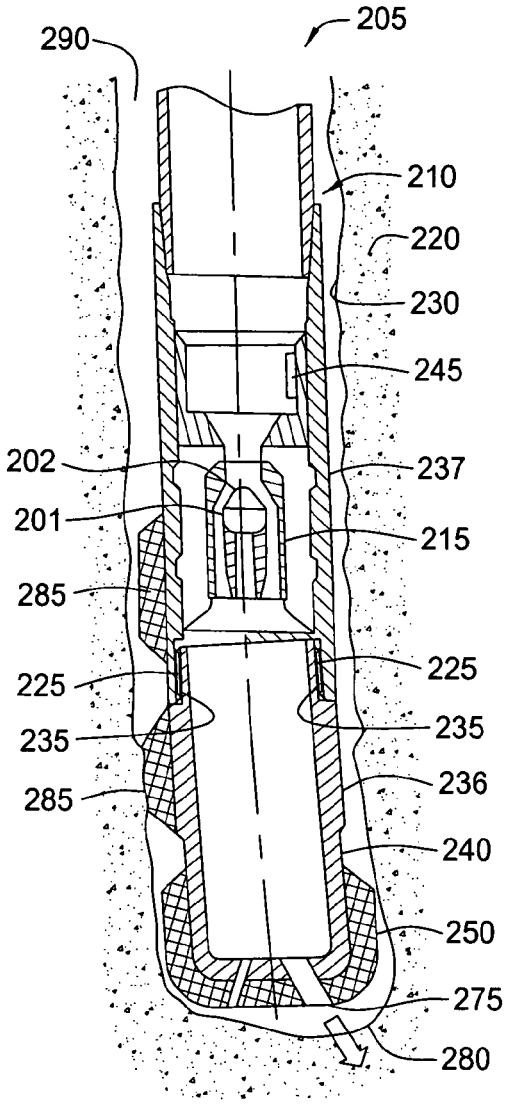
FIG. 15 is a cross-sectional view of an alternate embodiment of the diverting apparatus of FIG. 14 disposed within a subterranean wellbore. Stabilizer pads are disposed on the outer diameter of the casing.

FIG. 15 is an alternate embodiment of the diverting apparatus 110 of FIG. 14. The diverting apparatus 210 of FIG. 15, which forms a wellbore 230, comprises the same parts as those in FIG. 14; therefore, like parts are designated with the same last two numbers. For example, the wellbores are 130 and 230, the surfaces are 105 and 205, the formations are 120 and 220, and so on.

The diverting apparatus 210 of FIG. 15 also comprises one or more pads 285 which are disposed on the outer diameter of the casing string 240. Preferably, the pads 285 are located on the outer diameter of the casing string 240 on the side opposite the fluid deflector 275. As the casing string 240 is drilled deeper into the formation 220, the diverting apparatus 210 encounters increasing friction, making it increasingly difficult to drill the wellbore 230 into the formation 220. The pads 285, which are spaced vertically along the casing string 240, serve to reduce friction encountered in the formation 220. Furthermore, the pads 285 help to bias the casing string 240 outward at the desired angle in the preferred direction by keeping the casing string 240 from direct contact with the inner diameter of the wellbore 230. The pads 285 maintain the cutting structure 250 heading outward, preventing it from falling back to vertical with respect to the axis of the upper portion of the casing string 240.

The operation of the diverting apparatus 110 and 210 of FIGS. 14 and 15 is similar, so they will be described in conjunction with one another. In operation, the diverting apparatus 110, 210 is drilled into the wellbore 130, 230 axially by downward force applied from the surface 105, 205. The cutting apparatus 150, 250 drills into the formation 120, 220 due to the axial force. At the same time, pressurized fluid is introduced into the casing string 140, 240 from the surface 105, 205 to facilitate the downward movement of the diverting apparatus 110, 210 into the formation 120, 220. The fluid forms a path for the diverting apparatus 110, 210 in the formation and prevents mud and rock from the formation 120, 220 from filling the inner diameter of the casing string 140, 240. The fluid flows through the casing string 140, 240, through the float sub 115, 215, through the fluid deflector 175, 275, and into an annular space 190, 290 between the outer diameter of the casing string 140, 240 and the inner diameter of the wellbore 130, 230. Along the way, the fluid tends to flow into the area with the least obstruction. The fluid deflector 175, 275 urges the fluid outward into the formation 120, 220 at the angle in the preferred direction with respect to the vertical axis of the casing string 140, 240, where no obstruction is present. In this way, fluid flow is selectively diverted out of a portion of the casing string 140, 240 to form a deflected path for the wellbore 130, 230. The concentrated fluid flow into only one portion of the formation 120, 220 causes a profile 180, 280 in a portion of the formation 120, 220 to develop, forming a path through which the casing string 140, 240 may travel with less frictional resistance than the alternative paths through the formation 120, 220. The lower portion 136, 236 of the casing string 140, 240 is thus biased at an angle off of the vertical axis of the upper portion 137, 237 casing string 140, 240, in the general direction and at the general angle of the fluid deflector 175, 275, so that the wellbore 130, 230 is angled in the preferential direction and the path of the wellbore 130, 230 is deflected accordingly.

Additionally, the fluid tends to flow outward at the angle off of the vertical axis at which the bend in the casing string 140, 240, in this case the bend produced by the male and female threads 125, 225 and 135, 235, biased the diverting apparatus 110, 210. The lower portion 136, 236 of the casing string 140, 240 is thus urged at an angle in the preferential direction with respect to the upper portion 137, 237 of the casing string 140, 240 due to the fluid deflector 175, 275 and the threadable connections 125, 225 and 135, 235. In the embodiment of FIG. 15, the pads 285 further urge the diverting apparatus 210 in the desired direction by reducing friction of the casing string 240 against the formation 220 along the way downward, as well as by propping the lower end of the casing string 240 with the cutting apparatus 250, thus preventing the cutting apparatus 250 from falling back into the vertical angle with respect to the axis of the casing string 140, 240. In this way, in either embodiment, the path of the casing string 140, 240 and, thus, of the wellbore 130, 230, is deflected in the desired direction to avoid intersection with other wellbores.

After the casing string 140, 240 penetrates into the formation 120, 220 to form the wellbore 130, 230 at the desired angle at the desired depth, pressurized setting fluid such as cement may optionally be introduced into the wellbore 130, 230 from the surface 105, 205 through the casing string 140, 240. The setting fluid flows through the casing string 140, 240, through the float sub 115, 215, through the fluid deflector 175, 275, and then outward into the annular space 190, 290. The float sub 115, 215 functions much like a check valve, in the open position allowing setting fluid to flow downward through the casing string 140, 240, and in the closed position preventing setting fluid from flowing back upward through the casing string 140, 240 toward the surface 105, 205. Specifically, the setting fluid, when flowing into the casing string 140, 240 from the surface 105, 205, forces the ball 101, 201 downward within the float sub 115, 215 and out of the ball seat 102, 202. The setting fluid can thus flow around the ball 101, 201 and through the float sub 115, 215 to flow into the annular space 190, 290. The setting fluid solidifies within the annular space 190, 290 to secure the casing string 140, 240 within the wellbore 130, 230. When setting fluid is no longer introduced into the casing string 140, 240 to force the ball 101, 201 out of the ball seat 102, 202, the ball 101, 201 is again seated in the ball seat 102, 202 so that setting fluid cannot flow back upward within the casing string 140, 240 toward the surface 105, 205.

After setting the casing string 140, 240, the float sub 115, 215 and the landing seat 145, 245 may be drilled through by a cutting structure. Additional strings of casing (not shown) may then be hung off of the casing string 140, 240. The additional casing strings are biased at an angle with respect to the vertical axis because the casing string 140, 240 leads the additional casing strings in its general direction and angle. The additional casing strings are set with setting fluid just as the casing string 140, 240 was set.

FIGS. 14 and 15 show a bend introduced into the casing 140, 240 at the threadable connection of male and female threads 125, 225 and 135, 235. In the alternative, a bend in the casing 140, 240 could be integrally machined in the casing 140, 240. It is also contemplated that embodiments of the present invention may include merely bending the casing 140, 240. The bend in the casing 140, 240 would provide directional force for directionally drilling with the casing 140, 240.

FIG. 55 shows a further alternate embodiment of a nudging operation of the present invention. In this embodiment, no bend is introduced into the casing as is shown in FIGS. 14 and 15, and no eccentric pads 285 are located on the outer diameter of the casing as shown in FIG. 15. Rather, in the embodiment of FIG. 55, one or more fluid deflectors (nozzles) 475 are located on one side of an earth removal member 350 operatively attached to a lower end of a casing 440 and are angled outward with respect to the vertical axis of the casing 440, which may include a casing section or a casing string having a plurality of casing sections. As shown and described in relation to FIGS. 14-15, a fluid deflector 475 is formed through the casing 440 and the earth removal member 450, which is preferably a cutting apparatus such as a drill bit. The earth removal member 450 may be a bi-center bit, expandable bit, drillable cutting structure, or the like, depending upon the application. The fluid deflector 475 is biased and angled in the direction in which it is desired to divert the wellbore, or in the preferential direction of the wellbore. The fluid deflector 475 is substantially the same as the fluid deflectors 175 and 275 of FIGS. 14 and 15, respectively. As in the embodiments shown in FIGS. 14 and 15, any number of fluid deflectors 475 may be utilized in the present invention.

As in the embodiments shown in FIGS. 14 and 15, a float sub 415 and landing seat 445 for a survey tool (not shown) may be located within the diverting apparatus 410. Because the float sub 415 is substantially the same as the float subs 115, 215 shown and described with respect to FIGS. 14 and 15, the above description of the float subs 115, 215 of FIGS. 14 and 15 and their operation applies equally to the float sub 415 of FIG. 55. Similarly, because the landing seats 45, 145, and 245 of FIGS. 13, 14, and 15, respectively, are substantially the same as the landing seat 445, the above description of the landing seats 45, 145, and 245 and their operation applies equally to the embodiment of FIG. 55.

In a preferred embodiment, the diverting apparatus 410 includes a plurality of fluid deflectors or nozzles 475 grouped together on one side of the cutting apparatus 450. FIG. 57 illustrates a particularly preferred embodiment, which includes three fluid deflectors or nozzles 475A, 475B, and 475C through the casing 440 and cutting apparatus 450 for preferentially directing the fluid flow into the formation. The fluid deflectors 475A, B, and C may be pointed straight down, where the axes of the fluid deflector 475A, B, and C are parallel to the axis of the cutting apparatus 450. Alternately, the fluid deflectors 475A, B, and C may be angled radially outward from the cutting apparatus 450, so that the axes of the fluid deflectors 475A, B, and C are at an angle with respect to the axis of the cutting apparatus 450. In one embodiment, one or more of the fluid deflectors 475A, B, and C may be angled, while the remainder of the fluid deflectors 475A, B, and C may be straight. In a preferred embodiment, the vertical axes of the fluid deflectors 475 A, B, and C are angled approximately 30 degrees radially outward from the vertical axis of the cutting apparatus 450.

In operation, to form a deflected wellbore, the diverting apparatus 410 may be alternately jetted by flowing fluid through the casing 440 and into the fluid deflector 475 while simultaneously lowering the casing 440 into the formation, and rotated by rotating the entire casing 440 within the formation. During jetting of the fluid through the deflector 475, fluid through the deflector 475 forms a path for the diverting apparatus 410 in the formation in the same way as described above in relation to the fluid deflectors 175, 275 shown and described in relation to FIGS. 14 and 15. Namely, the fluid flows into the area of the formation having the least obstruction, and the angled orientation of the fluid deflector 475 urges the fluid outward from the casing 440 into the formation at the angle in the preferred direction with respect to the vertical axis of the casing 440. Concentrated fluid flow in a portion of the formation causes a profile in a corresponding portion of the formation to form so that the casing 440 travels through the path of least resistance to form a deflected wellbore path.

After the casing 440 has reached the desired depth within the formation, a physically alterable bonding material such as cement may be flowed through the casing 440 to set the casing 440 within the wellbore, in the same manner as described in relation to setting the casing 140, 240 of FIGS. 14 and 15, using the float sub 415. After possibly retrieving the survey tool which may optionally be located within the landing seat 445, if the float sub 415, landing seat 445, and cutting apparatus 450 are drillable, the float sub 415, landing seat 445, and cutting apparatus 450 may each be drilled through by a subsequent cutting structure, e.g., a cutting structure located on a subsequent drill string or subsequent casing. If the components are drilled through by a subsequent cutting apparatus on a subsequent casing, the additional casing may then be hung off the casing 440 (preferably at a lower end of the casing 440) and possibly set with a physically alterable drilling material within the wellbore. This process may be repeated as desired to drill and case the wellbore to a total depth. The additional casing strings are biased at an angle with respect to the vertical axis of the casing 440 because of the casing 440 deflection.

In a preferred operation of the embodiment shown in FIG. 55, the casing 440 may be alternately jetted and/or rotated to form a wellbore within the formation. To form a deviated wellbore, the rotation of the casing 440 is halted, and a surveying operation is performed using the survey tool (not shown) to determine the location of the one or more fluid deflectors 475 within the wellbore. Stoking may also be utilized to keep track of the location of the fluid deflector(s) 475, the method of which is described in relation to FIG. 31 (see below).

Once the location of the fluid deflector(s) 475 within the wellbore is determined, the casing 440 is rotated if necessary to aim the fluid deflector(s) 475 in the desired direction in which to deflect the casing 440. Fluid is then flowed through the casing 440 and the fluid deflector(s) 475 to form a profile (also termed a "cavity") in the formation. Then, the casing 440 may continue to be jetted into the formation. When desired, the casing 440 is rotated, forcing the casing 440 to follow the cavity in the formation. The locating and aiming of the fluid deflector(s) 475, flowing of fluid through the fluid deflector(s) 475, and further jetting and/or rotating the casing 440 into the formation may be repeated as desired to cause the casing 440 to deflect the wellbore in the desired direction within the formation.

A further alternate embodiment of the present invention involves accomplishing a nudging operation to directionally drill the casing 440 into the formation and expanding the casing 440 in a single run of the casing 440 into the formation, as shown in FIGS. 56A and 56B. Additionally, cementing of the casing 440 into the formation may optionally be performed in the same run of the casing 440 into the formation. FIGS. 56A-B show the diverting apparatus 410, including casing 440, the earth removal member or cutting apparatus 450, the one or more fluid deflectors 475 (which may be a plurality of fluid deflectors arranged as shown and described in relation to FIG. 57), and the landing seat 445 of FIG. 55.

Additional components of the embodiment of FIGS. 56A and 56B include an expansion tool 442 capable of radially expanding the casing 440, preferably an expansion cone 442; a latching dart 486; and a dart seat 482. The expansion cone 442 may have a larger outer diameter at its upper end than at its lower end, and preferably slopes radially outward from the upper end to the lower end. The expansion cone 442 may be mechanically and/or hydraulically actuated. The latching dart 486 and dart seat 482 are used in a cementing operation.

In operation, the diverting apparatus 410 is lowered into the wellbore with the expansion cone 442 located therein by alternately jetting and/or rotating the casing 440, most preferably by nudging the casing 440 according to the preferred method described in relation to FIG. 55. Next, a running tool 425 is introduced into the casing 440. A physically alterable bonding material, preferably cement, is pumped through the running tool 425, preferably an inner string. Cement is flowed from the surface into the casing 440, out the fluid deflector(s) 475, and up through the annulus between the casing 440 and the wellbore. When the desired amount of cement has been pumped, the dart 486 is introduced into the inner string 425. The dart 486 lands and seals on the dart seat 482. The dart 486 stops flow from exiting past the dart seat, thus forming a fluid-tight seal. Pressure applied through the inner string 425 may help urge the expansion cone 442 up to expand the casing 440. In addition to or in lieu of the pressure through the inner string 425, mechanical pulling on the inner string 425 helps urge the expansion cone 442 up.

Rather than using the latching dart 486, a float valve 415 as shown and described in relation to FIG. 55 may be utilized to prevent back flow of cement. The latching dart 486 is ultimately secured onto the dart seat 482, preferably by a latching mechanism.

The running tool 425 may be any type of retrieval tool. Preferably, the retrieval of the expansion cone 442 involves threadedly engaging a longitudinal bore through the expansion cone 442 with a lower end of the running tool 425. The running tool 425 is then mechanically pulled up to the surface through the casing 440, taking the attached expansion cone 442 with it. Alternately, the expansion cone 442 may be moved upward due to pumping fluid, down through the casing 440 to push the expansion cone 442 upward due to hydraulic pressure, or by a combination of mechanical and fluid actuation of the expansion cone 442. As the expansion cone 442 moves upward relative to the casing 440, the expansion cone 442 pushes against the interior surface of the casing 440, thereby radially expanding the casing 440 as the expansion cone 442 travels upwardly toward the surface. Thus, the casing 440 is expanded to a larger internal diameter along its length as the expansion cone 442 is retrieved to the surface.

Preferably, expansion of the casing 440 is performed prior to the cement curing to set the casing 440 within the wellbore, so that expansion of the casing 440 squeezes the cement into remaining voids in the surrounding formation, possibly resulting in a better seal and stronger cementing of the casing 440 in the formation. Although the above operation was described in relation to cementing the casing 440 within the wellbore, expansion of the casing 440 by the expansion cone 442 in the method described may also be performed when the casing 440 is set within the wellbore in a manner other than by cement.

As mentioned in relation to the embodiment of FIG. 55, the cutting apparatus 450 may be drilled through by a subsequent cutting structure (possibly attached to a subsequent casing) or may be retrieved from the wellbore, depending on the type of cutting structure 450 utilized (e.g., expandable, drillable, or bi-center bit). Regardless of whether the cutting structure 450 is retrievable or drillable, the subsequent casing may be lowered through the casing 440 and drilled to a further depth within the formation. The subsequent casing may optionally be cemented within the wellbore. The process may be repeated with additional casing strings.

FIG. 16 shows a diverting apparatus 310 drilled into a formation 320 to form a wellbore 330. The diverting apparatus 310 includes an upper casing 340, as well as a lower casing 341. The upper and lower casings 340 and 341 are inserted into the formation 320 as a unit. The lower casing 341 has a first cutting apparatus 350 attached to its lower end. At least one nozzle 355 runs through the lower end of the lower casing 341 as well as through the first cutting apparatus 350. The at least one nozzle 355 allows for fluid circulation between the casings 340, 341 and the wellbore 330.

The diverting apparatus 310 also includes an elongated coupling 391, which is a collar used to connect the upper and lower casing strings 340 and 341 to one another. An upper portion of the elongated coupling 391 is connected to a lower portion of the upper casing 340 by a threadable connection 342. Similarly, a lower portion of the elongated coupling 391 is attached to an upper portion of the lower casing 341 by a threadable connection 343. The elongated coupling 391 has a second cutting apparatus 395 located on its outermost portion. In the alternative, only one casing (not shown) may have a second cutting apparatus 395 disposed thereon, which is not necessarily attached by a threadable connection. The outer diameter of the second cutting apparatus 395/elongated coupling 391 is larger than the outer diameter of the first cutting apparatus 350. The second cutting apparatus 395 extends along a substantial portion of the length of the elongated coupling 391, and even along the lower portion of the elongated coupling 391, so that the cutting apparatus 395 cuts into the formation 320 as the diverting apparatus 310 is forced progressively downward to form the wellbore 330. The second cutting apparatus 395 possesses hole-opening blades which increase the inner diameter of the upper portion of the wellbore 330.

In operation, the diverting apparatus 310 is urged into the formation 320 by downward axial force applied from a surface 305 of the wellbore 330. The elongated coupling 391 of the diverting apparatus 310 allows the two casings 340 and 341 to be threaded together at the well site, so that the diverting apparatus 310 does not have to be pre-manufactured on the casing 340 or 341. In the alternative, the second cutting apparatus 395 may be pre-manufactured on the casing string (not shown). As described above in relation to the other embodiments, pressurized fluid is introduced into the diverting apparatus 310 through the inner diameter of the upper casing 340 as the casing 340, 341 penetrates into the formation 320 to form the wellbore 330, and then the fluid flows into the lower casing 341, through the at least one nozzle 355, up through a second annular space 389 between an inner diameter of the wellbore 330 and an outer diameter of the lower casing 341, up through a first annular space 390 between the inner diameter of the wellbore 330 and an outer diameter of the upper casing 340, and to the surface 305 of the wellbore 330.

While the diverting apparatus 310 is moving axially downward through the formation 320 and the fluid is circulating, the first cutting apparatus 350 cuts into the formation 320 to form a lower portion of the wellbore 330 approximately equal to its diameter. Likewise, the second cutting apparatus 395 at the same time cuts into the formation 320 to form an upper portion of the wellbore 330 approximately equal to its diameter. The outer diameter of the upper portion of the wellbore 330 is larger than the outer diameter of the lower portion of the wellbore 330 because of the difference in diameter between the first cutting apparatus 350 and the second cutting apparatus 395.

Because of the difference in diameters between the upper and lower portions of the wellbore 330, the first annular space 390 between the outer diameter of the upper casing 340 and the inner diameter of the upper portion of the wellbore 330 is larger than the second annular space 389 between the outer diameter of the lower casing 341 and the inner diameter of the lower portion of the wellbore 330. The axial movement is halted when the diverting apparatus 310 reaches its desired depth in the wellbore 330.

The first annular space 390 at the top of the wellbore 330 is larger than the second annular space 389 at the bottom of the wellbore 330 as a result of the enlarged diameter second cutting apparatus 395, so that a larger diametral clearance exists at the upper portion of the wellbore 330 than at the lower portion of the wellbore 330. The larger diametral clearance allows gravity to cause the casing to buckle in a direction. The direction in which gravity causes the casing to buckle is illustrated by the arrows disposed within the first annular space 390. Fulcrum force is illustrated by the arrows perpendicular to the axis of the casing 340, 341 and adjacent to the second cutting structure 395. A force in the opposite direction caused by formation 320 frictional resistance is depicted by the arrow perpendicular to the axis of the first cutting apparatus 350. The effect of the forces shown by the arrows in FIG. 16 is that the upper casing 340 moves laterally through the first annular space 390 while staying essentially anchored at the lower portion of the lower casing 341 by the second annular space 389, so that the diverting apparatus 310 angles in the preferred direction. The second cutting apparatus 395, or the additional dressing on the outer diameter of the casing 340 and/or 341, thus creates a larger cavity in the upper portion of the wellbore 330 than in the lower portion of the wellbore 330, which facilitates lateral movement of the casing 340 in the preferred direction to create a deflected path for the wellbore 330.

Again, a survey tool (not shown) placed in a landing seat (not shown) as described above may be used to determine whether the diverting apparatus 310 is bent in the desired direction at the desired angle. Once the diverting apparatus 310 is deviated into the desired angle, the first and second casings 340 and 341 are cemented into place by a setting operation as described above. All of the components disposed within the inner diameter of the casing 340 are preferably made of drillable material so that they may be drilled through after the setting operation so that the inner diameter of the casing 340 is essentially hollow for subsequent wellbore operations. Subsequent casings (not shown) are then run into the wellbore 330 and hung from the existing lower casing 341. The subsequent casings are biased in the desired direction at the desired angle because they essentially conform to the angle set by the original casings 340 and 341.

FIG. 17 shows an alternative embodiment of a diverting apparatus of the present invention. The diverting apparatus 1310 is substantially similar to the diverting apparatus 310 shown and described in relation to FIG. 16; as such, like parts will not be described again herein. The embodiment shown in FIG. 17 is different from the embodiment shown in FIG. 16 because instead of the concentric stabilizer acting as the second cutting apparatus, an eccentric stabilizer 1395 disposed asymmetrically on one side of the outer diameter of the casing 1340, 1341 adds additional directional force to the diverting apparatus 1310. In the depiction of the diverting apparatus 1310 shown in FIG. 17, the stabilizer 1395, which is preferably a 1-bladed actuable kick-pad, causes the upper portion of the casing 1340 to angle in the opposite direction from the eccentric stabilizer 1395. As an additional directional force acting in the same direction as the stabilizer 1395 is biasing the casing 1340, 1341, a fluid deflector 1355, or a perforation in the cutting apparatus 1350 angled in a direction with respect to vertical, may also be utilized to further deflect the path of the wellbore 1330 in a preferential direction at an angle with respect to the vertical axis of the casing.

In the operation of the embodiments of FIGS. 16-17, a two-step process may be utilized. First, oriented jetting through the one or more fluid deflectors (bit nozzles) 1355 may be accomplished to establish an initial inclination and direction of the casing. Then, the casing 340 and 341, 1340 and 1341 may be rotary drilled further into the formation using the second cutting apparatus 395, 1395 to build the angle. To rotary drill, the entire casing 340 and 341, 1340 and 1341 is rotated while lowering the casing into the formation 320, 1320. By using this two-step process, the more efficient rotary drilling method may be utilized to build the angle of the wellbore 330, 1330.

Finally, FIGS. 18-20 illustrate an apparatus and method which may be utilized with a diverting apparatus 510 to drill through the inner diameter of the diverting apparatus 510 and remove obstructions so that additional casing strings (not shown) may be hung from the diverting apparatus 510 after the initial diversion. The apparatus and method of FIGS. 18-20 may be used with any of the above embodiments to remove obstructing portions of the diverting apparatus residing within the inner diameter of the casing string after the casing string has been set within the wellbore. Referring to FIG. 18, the diverting apparatus 510 includes a casing string 540 with a second cutting apparatus 595 disposed on its outer diameter. The casing string 540 is inserted into a formation 520 to form a wellbore 530. The inner diameter of the casing string 540 has a drillable member 521 attached thereto which is connected to a drilling apparatus 522 through releasable connections 506. The releasable connections 506, which are preferably shearable connections, are used to fix the diverting apparatus 510 relative to the drilling apparatus 522 torsionally and axially.

The drilling apparatus 522 includes a drill string 523 with a first cutting apparatus 550 connected to its lower end. The first cutting apparatus 550 is smaller in diameter than the second cutting apparatus 595, so that the second cutting apparatus 595 possesses hole-opening blades which enlarge the inner diameter of the upper portion of the wellbore 530. The first cutting apparatus 550 has a cutting structure 551 attached to its lower end, at least one side parallel to a wellbore 530, and its backside 526 at an angle from the wellbore 530. The first cutting apparatus 550 has at least one nozzle 555 which allows fluid to flow into and in from a formation 520. Threads 501 are preferably located on an upper end of the drill string 523 on its inner diameter.

The operation of the diverting apparatus 510 and the drilling apparatus 522 is shown in FIGS. 18-20. FIG. 18 illustrates the diverting/drilling apparatus 510/522 during run-in of the casing string 540. The diverting apparatus 510 with the drilling apparatus 522 attached thereto is pushed downward axially into the formation 520 to form the wellbore 530. The diverting/drilling apparatus 510/522 may also be rotated from a surface 505 of the wellbore 530 if desired to drill through the formation 520. The first cutting apparatus 550 drills into the formation 520 due to the pressure placed on the casing string 540, which translates to the drilling apparatus 522. During the run-in of the casing string 540, the first cutting apparatus 550 on the drilling apparatus 522 initially forms a portion of the wellbore 530 of a first diameter. The second cutting apparatus 595 enlarges the diameter of the wellbore 530 in the portion of the wellbore 530 that it is forced into, as the second cutting apparatus 595 is larger in diameter than the first cutting apparatus 550. Thus, a first annular space 590 between the outer diameter of the casing string 540 and the inner diameter of the wellbore 530 is larger than a second annular space 589 between the outer diameter of the drill string 523 and the inner diameter of the wellbore 530. The second cutting apparatus 595, or the additional dressing on the outer diameter of the casing string 540, thus creates a larger cavity in the upper portion of the wellbore 530 than in the lower portion of the wellbore 530, which facilitates lateral movement of the casing string 540 in the preferred direction to create a deflected path for the wellbore 530. Pressurized fluid is introduced into the casing string 540 while the casing string 540 penetrates into the formation 520 to form the wellbore 530 to flush mud and other substances out of the casing string 540 through the at least one nozzle 555 in the cutting apparatus 550, outside the drill string 523 and the casing string 540, and up to the surface 505.

After the diverting/drilling apparatus 510/522 is drilled into the desired depth in the wellbore 530 at which to divert and set the casing string 540, a working string 503 or some other retrieving tool is lowered into the inner diameter of the casing string 540 (the working string 503 is shown in FIG. 19). The working string 503 retrieves the drill string 523 using a pulling tool profile on its lower end, preferably male threads 502 on the working string 503 which threadedly engage female threads 501 of the drill string 523.

FIG. 19 illustrates the next step in the operation of the diverting/drilling apparatus 510/522. The working string 503 is pulled upward axially from the surface 505 to release the releasable connection 506. The releasable connection 506 is preferably sheared off. As a consequence of the release, the drill string 523 is moveable axially and rotationally relative to the diverting apparatus 510. The drilling apparatus 522 is then pulled upward and rotated through the wellbore 530 by the working string 503. The cutting structure 551 on the backside 526 of the first cutting apparatus 550 contacts the lower end of the drillable member 521 and the portion of the releasable connection 506 remaining on the drillable member 521.

As seen in FIG. 20, the cutting structure 551 drills completely through the drillable member 521 and the remaining portion of the releasable connection 506 so that the drillable member 521 and releasable connection 506 are essentially destroyed. The inner diameter of the casing string 540 is therefore left effectively unobstructed so that wellbore operations may be performed or additional casing strings (not shown) may eventually be hung from the casing string 540. The drilling apparatus 522 is then removed from the wellbore 530 by the working string 503.

Finally, the casing string 540 is bent from the surface 505 to a side at an angle. Because of the larger first annular space 590 at the upper portion of the casing string 540, the casing string 540 is fixed at its lower end but moves through the first annular space 590 at its upper portion so that the casing string 540 is biased at an angle. The additional casing strings may then be hung off of the casing string 540 at the angle at which the casing string 540 is biased, allowing the wellbore 530 to deviate in the desired direction at the desired angle.

In the embodiments shown in FIGS. 13-20, the float sub may include, but is not limited to, the following: a check valve, poppet valve, flapper valve, or any other type of one-way valve. Drillable material utilized to form the float sub may include, but is not limited to, one or more of the following: aluminum, plastic, metal, cement, or combinations thereof.

Furthermore, in any of the embodiments shown in FIGS. 13-20, the cutting structure may be a drillable drill bit or an expandable bit latched into the casing. For an example of an expandable bit suitable for use in the present invention, refer to U.S. Patent Application Publication No. 2003/111267 or U.S. Patent Application Publication No. 2003/183424, each which is incorporated by reference herein in its entirety.

The diverting apparatus of the present invention and methods for their use allow effective diversion of a wellbore in a direction by deflecting a string of casing inserted into the wellbore. The apparatus and methods are simple to build and permit the wellbore diversion to be accomplished while drilling with casing in a subterranean wellbore. Accordingly, the apparatus and methods of the present invention aid in preventing the unwanted intersection of valuable subterranean wellbores.

The diverting apparatus of FIGS. 13-20 used for nudging may be utilized as the outer casing 185 shown in FIG. 1, while the inner casing 195 may be any of the embodiments depicted in FIGS. 1-12. In this manner, referring to FIG. 1, the system 100 is jetted and/or rotated to lower the outer casing 185 into the earth formation 112 at the desired depth to form a deviated wellbore. Next, the releasable connection between the inner casing 195 and the outer casing 185 is released, and the inner casing 195 is jetted and/or rotated, and the drilling system 157 may also be utilized to drill the inner casing 195 to the desired depth within the formation 112 while continuing to bias the direction and angle of the wellbore. The drilling system may include any of the embodiments shown in FIGS. 1-12.

In the most preferable embodiment of FIGS. 13-20, the casing is alternately rotated and/or lowered or jetted into the formation. The rotation and jetting alternation aids in achieving the desired trajectory of the wellbore.

In conventional drilling operations, hydraulic horsepower is delivered to the cutting structure through one or more very restrictive orifices or nozzles (commonly termed "bit nozzles") located in the cutting structure. The nozzles are usually located in the body of the cutting structure proximate to the bottom of the wellbore. The function of the nozzles is primarily to puncture the earth formation with "jet" impacts to facilitate formation of the wellbore, then to carry the cuttings up to the surface through the annulus between the wellbore and the casing. Additional functions of nozzles and the fluid flow therethrough include cleaning the cutting structure, cooling the bit cutters, and cleaning the bottom of the wellbore. For the nozzles to perform this function, the horsepower of the fluid flowing through the nozzles must be high during jetting. Because of the high horsepower of the hydraulic fluid traveling through the nozzles while jetting, the nozzles are subjected to extremely high erosion caused by pressure drop of the drilling fluid across the nozzles (e.g., from 500 to 3000 psi) and high velocity of the fluid through the nozzles (e.g., from 200 to 800 ft/s).

The necessary high flow rate of fluid through the nozzles to perform an adequate jetting operation requires that the nozzles be made of materials which allow the nozzles to be sufficiently hard and tough to withstand the erosion due to the fluid through the nozzles. Typically, therefore, a hard and tough material such as tungsten carbide and/or ceramic is used to jet into the formation with a drill string in conventional drilling operations, as nozzles constructed from one or more of these materials may endure for thousands of hours without suffering fatal damage from erosion. Drilling with casing operations, however, such as those that are shown in FIGS. 1-22, may require that the nozzles be drillable, and the current ceramic or tungsten carbide nozzles used for jetting in the drill string are not drillable.

Drilling with casing operations may require the same fluid intensity while jetting and/or rotating the casing as is required when circulating drilling fluid in the drill string while drilling. The amount of time that the fluid intensity must be maintained during drilling may be less for drilling with casing operations than in traditional drilling operations, however.

In the embodiments of the present invention shown in FIGS. 1-20, an expandable cutting structure or a drillable cutting structure may be utilized. An alternate embodiment may include a drillable cutting structure, possible including drillable nozzles. FIG. 21 shows a process for drilling through a drillable cutting structure 1615 such as a drill bit or drill shoe operatively attached to a casing 1610. The drillable cutting structure 1615 has drillable nozzles 1616 therein. The casing 1610 is lowered into the earth formation 1605 to form a wellbore 1630 by rotating the casing 1610 and/or by jetting the casing 1610. After the casing 1610 is lowered and/or drilled into the earth formation 1605 to the desired depth, in one embodiment the casing 1610 may be set therein using a physically alterable bonding material such as cement (not shown).

As shown in FIG. 21, a casing 1620 is lowered into the inner diameter of the casing 1610 while introducing fluid F through the inner diameter of the casing 1620, out through nozzles 1626 in a cutting structure 1625 in the casing 1620, and up to the surface. The cutting structure 1625 may, but does not necessarily have to be, drillable. The cutting structure 1625 may in the alternative be expandable and retrievable from the wellbore 1630.

FIG. 22 illustrates the next step in an embodiment of the method for drilling through a cutting structure on a casing. The casing 1620 is lowered and/or rotated through the casing 1610 to drill through at least a portion of the cutting structure 1615. The nozzles 1616 are preferably also drillable, as described below. FIG. 22 shows the casing 1620 drilling to a further depth within the formation 1605. After the casing 1620 is lowered to the desired depth within the formation 1605, the casing 1620 may be expanded in one embodiment. If desired, the casing 1620 may also be set therein using the physically alterable bonding material. Subsequently, the cutting structure 1625 may be left in the wellbore 1630 or may be drilled through by an additional casing (not shown) or by a drill string or other cutting device.

The present invention provides drillable nozzles for use while drilling with casing. For the cutting structure 1615 to be drillable, the base material and the nozzle(s) of the cutting structure 1615 must be soft enough to allow subsequent casing 1620 to drill therethrough. However, a nozzle constructed of a sufficiently soft material used in a drilling with casing application may only last a few hours under intense fluid erosion due to jetting. While enlarging the nozzle diameter to reduce velocity of the fluid through the nozzle aids in increasing nozzle longevity, this design remains problematic because the velocity of the fluid through the nozzle(s) may be so decreased that the casing no longer sufficiently drills through the formation during the jetting process.

FIGS. 23A-23B, 24A-B, and 25-29 show embodiments of the present invention of a drillable nozzle, of which one or more may be used in any of the embodiments in FIGS. 1-22. The nozzles shown in FIGS. 23A-23B, 24A-B, and 25-29 are insertable into the cutting structures of FIGS. 1-22 to provide a fluid path from the inner diameter of the casing into the wellbore. The drillable nozzle breaks into portions, preferably fragments or "cuttings", to be flowed to the surface using drilling fluid through the casing (not shown) which is used to drill through the drillable nozzle. The drillable nozzles of FIGS. 23A-23B, 24A-B, and 25-29 are drillable while remaining sufficiently devoid of erosive deconstruction to allow functional jetting through the nozzles with drilling fluid or any other fluid introduced into the nozzles.

In the embodiment shown in FIGS. 23A and 23B, the drillable nozzle 1700 is constructed of a hard, brittle, and wear-resistant material. Exemplary base materials which may be utilized to form the drillable nozzle 1700 include, but are not limited to, tungsten carbide, ceramic, and polycrystalline diamond (PDC). FIG. 23B shows a first end 1751 of the nozzle 1700, through which fluid F is flowable during a drilling with casing operation. While drilling with the casing attached to the cutting structure having at least one drillable nozzle 1700 therein, fluid F is flowable through the casing, into the first end 1751, through a bore 1761 disposed within the nozzle 1700, out through a second end 1741 of the nozzle 1700 (shown in FIG. 23A), then up through an annulus between the casing and the wellbore (or another casing disposed therearound) to the surface.

The drillable nozzle 1700 has one or more stressed portions therein, specifically shown as one or more stressed notches 1710 in FIGS. 23A-B. Preferably, the stressed notches 1710 are disposed within the outer diameter of the nozzle 1700 and are at least partially subflushed to the surface of the nozzle 1700. The stressed notches 1710 preferably extend the length of the nozzle 1700 coaxially with the bore 1761 of the nozzle 1700; however, it is contemplated that the stressed notches 1710 may extend only a portion of the length of the nozzle 1700. The stressed notches 1710 provide a stress point to cause the nozzle 1700 to break into portions or fragments when drilled through with a subsequent casing, drill string, or other cutting device. While not a requirement for use in the present invention, a preferred embodiment provides that the notches 1710 are spaced substantially equidistant from one another along the outer diameter of the nozzle 1700. The notches 1710 are preferably relatively narrow cuts throughout the length of the nozzle 1700.

An o-ring groove 1705 may exist within the outer diameter of the body of the nozzle 1700 around its circumference for disposing an o-ring (not shown) therein to seal the nozzle 1700 within a body of the tool in which the nozzle 1700 is disposed, such as a cutting tool (not shown). In one embodiment, a filler material 1715, preferably an extrudable material such as epoxy or vulcanized rubber, is disposed at least partially within the notches 1710 when the notches 1710 extend the length of the nozzle 1700 so that the o-ring may seal in the o-ring groove 1705.

FIGS. 24A and 24B illustrate another embodiment of a drillable nozzle 1800. A first end 1851 of the nozzle 1800 is shown in FIG. 24B, while a second end 1841 of the nozzle 1800 is depicted in FIG. 24A. When the drillable nozzle 1800 is disposed in a cutting tool (not shown) operatively connected to a lower end of a casing (not shown), fluid F flows through the casing, into the first end 1851 of the nozzle 1800, through a bore 1861 within the nozzle 1800, out through the second end 1841, then up through the annulus between the casing and the wellbore or between the casing and another casing disposed within the wellbore therearound.

The embodiment shown in FIGS. 24A and 24B is substantially the same as the embodiment shown in FIGS. 23A and 23B, except for the following aspects. The stressed notches 1810 extend only through a portion of the nozzle 1800, coaxial with the bore 1861. The notches 1810, which are again at least partially subflushed to the surface of the nozzle 1800, are interrupted along at least a portion of the outer diameter of the nozzle 1800. Preferably, the portion of the outer diameter of the nozzle 1800 over which the notches 1810 are interrupted is at least the at o-ring groove 1805, negating the need to fill the notches 1810 with filler material 1715 as in FIGS. 23A-B. An additional difference between the nozzle 1700 and the nozzle 1800 is that the notches 1810 are preferably substantially wider than the notches 1710.

In the embodiments of FIGS. 23A-B and 24A-B, the nozzles 1700 and 1800 provide longevity to and allow high flow rates of fluid to pass through the cutting structure operatively connected to the casing. At the same time, when the nozzles 1700 and 1800 are drilled through by a subsequent cutting structure placed on a subsequent casing or drill string, the broken nozzle portions may be circulated to the surface through an annulus between the subsequent casing or drill string and the wellbore.

FIGS. 25-28 show nozzle assemblies which may be utilized in a drillable cutting structure operatively attached to casing. FIGS. 25 and 26 show extended flow tubes 1910, 2010 having a minimum thickness and a substantially uniform inner diameter or bore along each of their lengths. The flow tubes 1910, 2010 each represent a portion of the nozzle assemblies 1900, 2000. FIGS. 27 and 28 show relatively thin profiled flow tubes 2180, 2280, each of which represent a portion of the nozzle assemblies 2100, 2200.

In the embodiment of the present invention illustrated in FIG. 25, the nozzle assembly 1900 includes a flow tube 1910 disposed within a nozzle retainer 1920. The flow tube 1910 is substantially tubular-shaped with a longitudinal bore therethrough. Additionally, the flow tube 1910, which is preferably constructed of a relatively hard material such as ceramic, tungsten carbide, or PDC, is relatively thin (i.e., has a low thickness, as measured from an outer diameter to an inner diameter of the flow tube 1910) to facilitate drillability of the flow tube 1910 when a cutting structure, such as an earth removal member attached to a casing or a drill string, is drilled through the flow tube 1910.

The flow tube 1910 has a substantially uniform inner diameter bore along its length to form a substantially straight bore through the flow tube 1910. The substantially straight bore of the flow tube 1910 maintains a minimal thickness along the length of the flow tube 1910, thus enhancing drillability of the flow tube 1910 with a subsequent cutting structure, as any profile of the flow tube 1910 other than a straight bore therethrough would require an increase in material thickness perpendicular to the axis of the flow tube 1910. The material thickness perpendicular to the axis of the flow tube 1910 is presented to the subsequent cutting structure for drilling therethrough. Also, the internal profile of the flow tube 1910 formed by the substantially straight bore therethrough potentially decreases erosion of one or more portions of the nozzle 1900 because the fluid does not have to change direction due to obstructions within the bore when flowing through the nozzle 1900.

The nozzle retainer 1920, which is preferably constructed of a relatively soft, drillable material such as copper or plastic, retains the flow tube 1910 therein. The flow tube 1910 is preferably mounted within the nozzle retainer 1920, which is a tubular-shaped body with a longitudinal bore therethrough. The nozzle retainer 1920 may include an installation and removal feature, such as slots 1940 shown in FIG. 25 in an exit side face 1970 of the nozzle retainer 1920. The slots 1940 facilitate installation and removal of the nozzle assembly 1900 from a tool body 1925.

An integral feature of the nozzle assembly 1900 is the extended length of the flow tube 1910. Due to the extended length of the flow tube 1910, the flow tube 1910 may be positioned as desired within the nozzle retainer 1920 by moving the flow tube 1910 up or down (right or left as shown in FIG. 25) within the nozzle retainer 1920. Moving the flow tube 1910 up or down coaxial with the retainer 1920 allows entry and exit points of the fluid (shown in FIG. 25, as the fluid flow moves left to right in the depicted assembly 1900) to be positioned as required either closer to or away from areas which may be susceptible to fluid erosion as a result of high velocity of the fluid and turbulence caused by the high flow rate of the fluid while the fluid is entering or exiting the flow tube 1910. Additionally, moving the flow tube 1910 down relative to the tool body 1925 would allow the exit point of the fluid from the nozzle assembly 1900 to be positioned closer to the formation than a typical nozzle design, thus improving effectiveness of the jetting through the nozzle assembly 1900 to remove portions of the formation by enabling increased control of exit standoff 1960 and entry standoff 1950. Exit standoff 1960 is the distance of fluid flow through the flow tube 1910 measured from between the exit side face of the tool body 1925 and the exit point of the fluid from the flow tube 1910, while entry standoff 1950 is the distance of fluid flow within the flow tube 1910 measured from between the entry side face of the tool body 1925 and the entry point of the fluid into the flow tube 1910.

The nozzle retainer 1920 is preferably constructed of a relatively soft, drillable material such as copper or plastic. The material that the retainer 1920 is made from is softer than the material of the flow tube 1910. Also, the material of the flow tube 1910 is more resistant to corrosion than the material of the retainer 1920. The internal bore of the retainer 1920 is profiled to produce a controlled fit over the outer diameter of the flow tube 1910, with a gap 1947 left between the flow tube 1910 and the retainer 1920 which is preferably substantially filled with a suitable adhesive 1945 for retaining the flow tube 1910 in the desired position within the retainer 1920.

The retainer 1920 is seated within a nozzle profile 1965 in a tool body 1925. The tool is preferably an earth removal member for cutting into an earth formation, and even more preferably a cutting structure such as a drill bit or drill shoe. The tool body 1925 is preferably constructed of a relatively soft, drillable material such as copper or plastic. An outer surface of the retainer 1920 has a seal groove 1907 having a seal 1905 therein for preventing fluid flow across the interface of the outer surface of the retainer 1920 and the nozzle profile 1965 of the tool body 1925. An external thread 1915 secures the nozzle assembly 1900 within the tool body 1925.

Advantageously, the embodiment of FIG. 25 allows adjustability of the entry and exit points away from the tool body 1925, creating a dead area 1930 in the fluid flow where high velocities and turbulence do not exist and directing fluid away from the retainer 1920 and tool body 1925 made of the soft, drillable material which is more susceptible to erosion due to fluid flow than the harder material of the flow tube 1910.

An alternate embodiment of a nozzle assembly 2000 of the present invention is shown in FIG. 26. The nozzle assembly 2000 is substantially similar to the nozzle assembly 1900 shown and described in relation to FIG. 25; therefore, like parts are labeled with like numbers (the last two digits of the numbers are the same). The difference between the assembly 2000 and the assembly 1900 is that the entire nozzle assembly 2000, including the nozzle retainer 2020 and the flow tube 2010, may be constructed of a soft, drillable material such as copper or plastic or of a non-drillable material (such as when used in a retrievable cutting structure rather than a drillable cutting structure, as described below). This design allows for ease of construction of the nozzle assembly 2000 because the nozzle assembly 2000 can be made in one piece. No adhesive 1945 is required in the embodiment of FIG. 26 because the nozzle assembly 2000 is one piece. The embodiment shown in FIG. 26 may be utilized in drilling applications when the flow regime is such that easily drillable materials such as copper or plastic may be used while still gaining the benefits of the removal of localized turbulence from the tool body 2025 itself due to the straight-bore flow tube 2010. This design allows for sleeving of the inner diameter of the flow tube 2010 by platting, shrink fitting, or any other suitable method to apply a wear-resistant material such as tungsten carbide and/or ceramic, where the thickness of the wear-resistant material is not so great as to detract from the process of drilling through the nozzle. The wear-resistant materials may be layered to obtain increased wear resistance and flexibility.

The nozzle assemblies 1900, 2000 shown in FIGS. 25-26 allow for adjustment of the entry and exit standoff 1950 and 2050, 1960 and 2060 by moving the flow tube 1910, 2010 within the tool body 1925, 2025. The flow tube 1910, 2010 may be moved towards the entry or exit point of the fluid from the flow tube 1910, 2010 as desired.

FIGS. 27 and 28 show further alternate embodiments of a nozzle assembly 2100, 2200. The embodiment shown in FIG. 27 includes the nozzle assembly 2100, which includes a nozzle retainer 2120 and a flow tube 2180. The flow tube 2180 is a profiled sleeve through which fluid flows from a tool such as a cutting structure attached to casing into the formation while jetting and/or drilling. In FIG. 27, the fluid enters into the flow tube 2180 from the left at an entry point and exits from the flow tube 2180 at an exit point. An inner diameter of the flow tube 2180 at the entry point of the fluid is larger than an inner diameter of the flow tube 2180 at the exit point of the fluid into the formation. Between the entry point of the fluid and a distance A along the flow tube 2180, the flow tube 2180 is of a first inner diameter. The flow tube 2180 then converges at an angle over a distance B to a second inner diameter, which is smaller than the first inner diameter. The second inner diameter is maintained over a distance C along the flow tube 2180 until the exit point of the flow tube 2180.

The flow tube 2180 is constructed from a relatively hard material such as ceramic, tungsten carbide, or PDC to limit erosion of the flow tube 2180, as described in relation to FIGS. 23A-B, 24A-B, and 25-26 above. The flow tube 2180 is relatively thin, as measured from the inner diameter of the flow tube 2180 to the outer diameter of the flow tube 2180, to facilitate drilling through the relatively hard material of the flow tube 2180 by the subsequent cutting structure, as described above in relation to FIGS. 25-26.

A relatively soft, drillable material such as copper or plastic is utilized to form the nozzle retainer 2120. The material making up the flow tube 2180 is harder than the material of the retainer 2120 and tool body 2125, and the material of the flow tube 2180 is more resistant to corrosion than the material of the retainer 2120. The drillability of the soft material allows the nozzle retainer 2120 to be of a larger thickness at the portion adjacent to the smaller diameter portion of the flow tube 2180 than its thickness at the other portions of the flow tube 2180. The retainer 2120 inner diameter thus essentially conforms to the outer diameter of the flow tube 2180.

The nozzle assembly 2100 is disposed in a tool body 2125, which is preferably an earth removal member such as a drill shoe or a drill bit. The tool body 2125 is preferably constructed of a relatively soft (at least compared to the flow tube 2180), drillable material such as copper, aluminum, cast iron, plastic, or combinations thereof. The material of the tool body 2185 may or may not be the same as the material of the retainer 2120. A seal 2105 is disposed within a seal groove 2107 formed in an outer diameter of the retainer 2120 to prevent fluid from traveling in the area between the inner diameter of the tool body 2125 and the outer diameter of the retainer 2120. Retaining threads 2115 are located between the tool body 2125 and the retainer 2120 for connecting the nozzle assembly 2100 to the tool body 2125.

The nozzle assembly 2100 is characterized by an extended exit. The extended exit is represented by an exit standoff 2160, which is the length of the flow tube 2180 which extends past the end of the tool body 2125 from which fluid flows upon exit from the flow tube 2180. The exit standoff 2160 diverts the flow turbulence into an area away from the nozzle retainer 2120 and the tool body 2125.

FIG. 28 shows an additional embodiment of the present invention. The embodiment shown in FIG. 28 is substantially the same as the embodiment shown in FIG. 27; therefore, substantially similar elements to FIG. 27 which are in the "21" series are labeled in FIG. 28 with the "22" series. The difference between the embodiment of FIG. 27 and the embodiment of FIG. 28 is that the embodiment shown in FIG. 28 not only includes the extended exit in the form of the exit standoff 2260, but also includes the extended entry in the form of the entry standoff 2250. The entry standoff 2250 is the length of the flow tube 2280 which extends past the end of the tool body 2225 into which fluid flows upon entry into the flow tube 2280. The extended entry of fluid through the flow tube 2280 provides an area of low turbulence next to the tool body 2225 at entry. In addition to their use in drillable application, the embodiments of FIGS. 27 and 28 may all be utilized in non-drillable applications such as in expandable cutting structures when drilling with casing.

Shown in FIG. 29 is an embodiment of an earth removal member 1925 ("tool body"), preferably a cutting structure in the form of a drill shoe or drill bit, which includes two nozzle assemblies 1900 therein. The nozzle assemblies 1900 are shown, but one or more of the nozzle assemblies 2000, 2100, 2200 may alternately be disposed within the tool body 2125. The upper nozzle assembly 1900 shown in FIG. 29 is oriented at an angle with respect to the vertical axis of the casing connected to the tool, thus illustrating the use of the nozzle assembly 1900, 2000, 2100, 2200 to directionally drill by jetting through a fluid diverter, or an oriented nozzle or jet, as shown and described in relation to FIGS. 14-15 and 17. FIG. 29 also demonstrates by the lower nozzle assembly 1900 shown in the figure that the nozzle assembly 1900, 2000, 2100, 2200 may also be utilized in casing drilling operations which do not involve nudging and directionally drilling.

In addition to their use in drillable applications, the above embodiments shown in FIGS. 25-29 may also be utilized in a retrievable cutting structure when a retrievable cutting structure is used with the embodiments of the invention shown in FIGS. 1-22, such as an expandable bit. The embodiment of FIG. 26 is especially applicable to non-drillable nozzles, where protection of the tool body 2025 at the entry and exit points is required, or when it is required to position the nozzle exit point closer to the formation.

FIG. 30 is a cross-sectional view of the lower end of a cutting structure having nozzles therethrough. In directional jetting, as shown and described in relation to FIGS. 14-15 and 17, one or more of the nozzles of the cutting structure may be blocked to prevent fluid flow therethrough. The unobstructed nozzles will produce selective fluid flow from only a portion of the cutting structure, so that fluid flow is asymmetrically introduced into the wellbore and forms a diverted path for the casing within the formation.

The alternate embodiments of FIGS. 53A, 53B, and 54 provide drill bit nozzles that are constructed to withstand the abrasive and erosive impact of jetted drilling fluid, while also being suitable for subsequent drilling operations intended to drill through drill bit bodies to which the nozzles are attached, and indeed the nozzles themselves. The embodiments of FIGS. 53A-B and 54 further provide a method of drilling a wellbore, wherein the drilling method is that commonly known as drilling with casing and wherein subsequent drilling may be undertaken by a subsequent drill bit, without the requirement of the removal of the earlier or first drill bit from the well bore, and wherein the earlier or first drill bit includes nozzles.

FIGS. 53A-B and 5 show embodiments of a new and improved drill bit nozzle comprising a body defining a through-bore, wherein the through-bore defines a passage for drilling fluid in use, wherein the surface of the through-bore within the body has a relatively high resistance to erosion and wherein the nozzle is characterized in that the body is made substantially of a material or materials that allow for the nozzle to be subsequently drilled through by standard wellbore drilling equipment. Preferably, the through bore has an enlarged concave portion at an inlet side of the nozzle, communicating with a smaller diameter cylindrical portion.

The nozzle body may be made of two materials, wherein the surface of the through-bore is made of a first material, wherein said first material is of relatively thin construction and has a high resistance to erosion, and wherein the remainder of the nozzle body is made of a second material that is easily drillable. The first or surface material may be a hard chrome. Alternatively, tungsten carbide or suitable alloys may be used, their suitability being assessed by their ability to withstand erosive forces from the well fluid jetted through the through-bore.

The second material forming substantially the majority of the nozzle body may be made typically of a softer metal, such as nickel, aluminum, copper or alloys of these. Preferably, the second material may be copper and the surface or first material is hard chrome, wherein the hard chrome is applied to the copper body by electro-plating.

Alternatively, a nozzle in accordance with the present invention may be made of a rubber material. In this respect, it is noted that while rubber is typically not a "hard" material, it does nevertheless have a high resistance to erosion. Moreover, rubber materials may be easily drilled by subsequent drilling bits. A nozzle in accordance with invention may be made of one or more materials and need not be made entirely or even partially of a metal material. Polyurethane or other elastomers may also be used.

Referring firstly to FIGS. 53A and 53B, there is shown a drill bit nozzle 1. The drill bit nozzle 1 is adapted to be threadably engaged with a drill bit body (not shown) by virtue of the threaded portions 2. The nozzle 1 is provided with an annular body 3 that defines a through-passage or through-bore 4. The through-bore 4 is formed with an inlet having a concave enlarged portion 4*a* which communicates with a cylindrical smaller diameter portion 4*b* leading to an outlet 7. The geometry of the through-bore 4 is such that well fluid is jetted at high velocity out the outlet 7.

It is recognized in the invention that the nozzle through-bore 4 is intended to receive drilling fluid at high velocities and with high pressure differentials. Accordingly, the surface 5 of the through-bore 4 is constructed of a material that is suitable for withstanding the abrasive and eroding nature of the drilling fluid in use. Not only must the surface of the through-passage withstand the eroding forces of the drilling fluid, but in view of the proximity of the nozzles to the cutting surface of the drill bit, excessive wear may be induced in the event of a nonresistant material being employed as a result of the impact of small rock particles and other debris cut by the drill bit from the well formation. The erosive effect of rock particles within drill bit nozzles is well known and documented. For this reason, the surface of the through-bore 4 is preferably made from a hard material which, in an example embodiment of FIGS. 53A-B, is a hard chrome material. In another example, tungsten carbide may be used as the surface material.

The surface material will typically be chosen as one which is able to be combined with a softer, drillable material whereby this softer, drillable material may form substantially the body of the drill bit nozzle, with the exception of the surface herein before mentioned. In the example embodiment illustrated in FIGS. 53A-B, the second material from which substantially all of the nozzle body is made is copper. Copper is selected as one suitable material as the surface coating of hard chrome may be easily applied to the copper body by electro-plating means. Additionally, copper is sufficiently soft to allow a subsequent drill bit to drill through the body of the nozzle.

In FIG. 54, an alternative nozzle 12 is made substantially of a single non-metallic material, preferably rubber. However, to enable the rubber nozzle 12 to be attached to a drill bit body, the nozzle 12 is provided with a threaded insert made of a metallic material. The threaded insert 11 is, nevertheless, made of a material which is sufficiently soft to allow a subsequent drill bit to drill through it.

An advantage of the present invention will be apparent from the method of use of the drill bit nozzle as shown in FIGS. 53A-B and 54 and described above which allows for a drill bit bearing drill bit nozzles to be left in a wellbore during the cementing of casing and subsequently drilled through by standard wellbore drilling equipment to allow for the well to be extended. The invention may be seen to overcome the difficulty of providing drill bit nozzles in a manner that allowed for their resistance to wear from the erosive characteristics of jetted drilling fluid, while nevertheless enabling subsequent conventional or standard wellbore drilling equipment to drill through them.

When nudging casing into the formation, it is sometimes useful to form a casing string made up of a plurality of casing sections. Making up the casing string involves rotating one casing section relative to another casing section to threadedly connect the casing sections together. Many of the directional drilling tools described in the figures of the present application include biasing tools (e.g., eccentric stabilizer and/or directional jet) disposed on the casing or within the casing, the location of which must be tracked from the surface of the wellbore to allow the operator to maintain the direction and angle of the deviated wellbore while drilling with the casing. One method of tracking the position of the biasing tool on the casing involves marking the position of the biasing tool when the casing having the biasing tool thereon is first lowered into the formation ("stoking or scribing in the hole"). Marking the position may be accomplished by drawing a vertical chalk line along the casing as one casing section is threaded onto another. Then, when the made-up casing string is lowered into the wellbore, the portion of the marked casing section which remains located above the wellbore (e.g., by a spider on a rig floor) becomes the reference point for marking a chalk like after the next section of casing is threaded onto the casing string.

An additional method of tracking the position of the biasing tool, which may be used in addition to the scribing method, is accomplished by the mechanism shown in FIG. 31. A casing string 2300 which may be utilized in the present invention while jetting into the formation includes a casing section 2320 having male threads 2321 threaded to a casing section 2330 having male threads 2331 by a collar 2315 having female threads 2311 and 2312. Disposed within the collar 2315 is a buttress torque ring 2310. The buttress torque ring 2310 is a spacer placed in between the ends of the pins 2331, 2321 of the casing sections 2330, 2320 to provide a stop mechanism to stop torquing of the casing sections 2330, 2320 at a given point. The buttress torque ring 2310 may be used to hold the chalk line when scribing in the hole so that the chalk mark does not lose accuracy as to the location of the biasing tool because the rotational position of the casing sections 2330, 2320 relative to one another changes.

Additional embodiments of the present invention generally provide improved methods and assemblies for drilling with casing (DWC). In contrast to the prior art, drilling assemblies according to the present invention are supported between an attachment point at a bottom of the casing and the point of drilling contact by one or more adjustable stabilizers. The stabilizers may have one or more adjustable support members that may be placed in a first (run-in) position giving the stabilizer a sufficiently small outer diameter to be run in through the casing with the drilling assembly. The support members may then be placed in a second position giving the stabilizer a sufficiently large outer diameter to engage an inner wall of the wellbore to provide support for the drilling assembly during drilling.

Additional embodiments of the present invention provide directional force for directionally drilling the assembly on the casing rather than the BHA. Moreover, embodiments of the present invention reduce the requisite length of the rat hole below the casing, thereby decreasing the amount by which the casing must be lowered into the rat hole after the BHA has drilled to the desired depth at which to place the casing within the wellbore.

For different embodiments, the drilling assemblies of the present invention may be adapted to operate in either a rotary or slide mode. For some embodiments, in an effort to decrease drilling time, an expandable bit having a higher removal rate than the conventional combination of an under-reamer and pilot bit may be utilized. While embodiments of the present invention may be particularly advantageous to directional drilling with casing, some embodiments may also be used to advantage in non-directional DWC systems. Such embodiments may lack the bent subassemblies shown in the following figures.

FIGS. 33A-D illustrate an exemplary DWC system for directionally drilling of a wellbore 4102 through a formation 4103 utilizing a drilling assembly, according to an embodiment of the present invention, comprising a bottom hole assembly (BHA) 4200 attached to a portion of casing 4104. As illustrated, the drilling assembly generally includes at least one adjustable stabilizer 4202. For some embodiments, the adjustable stabilizer 4202 may be positioned to provide support to the BHA 4200 between a casing latch 4106 and a earth removal member or drilling member, such as an expandable bit 4204. Accordingly, the adjustable stabilizer 4202 may decrease the amount of deflection of the BHA 4200, thereby improving directional control, increasing bit life, and increasing formation removal rate.

As illustrated, for some embodiments, the stabilizer 4202 may be positioned above a biasing member, such as a bent subassembly 4114 ("bent sub") used to bias the BHA 4200 in the desired direction. The bent sub 4114 may be fixed or adjustable to tilt the face of the bit 4204, typically from 0° to approximately 3° with respect to the centerline of the BHA 4200. As previously described, the bent sub 4114 may be integral with a downhole motor 4112. The number of adjustable stabilizers 4202 utilized in a system may depend on a number of factors, such as the weight-on-bit applied to the BHA 4200, the length of the BHA 4200, desired wellbore trajectory, etc.

While a conventional pilot bit and under reamer may be used for some embodiments, the expandable bit 4204 generally provides an increased removal rate and performs the same operations (e.g., forming an expanded hole below the casing 4104, allowing the casing string to advance with the wellbore). The increased removal rate may be accomplished by providing a greater density of cutting elements ("cutter density") in contact with the wellbore surface. For example, cutting members 4205 of the bit 4204 may include cutting elements arranged in full complement with the hole profile to achieve an optimal penetration rate. An example of an expandable bit is disclosed in International Publication Number WO 01/81708 A1, which is incorporated herein in its entirety. As described in the above referenced publication, cutting elements of the bit 4204 may be made of any suitable hard material, such as tungsten carbide or polycrystalline diamond (PDC).

Figure 33A:
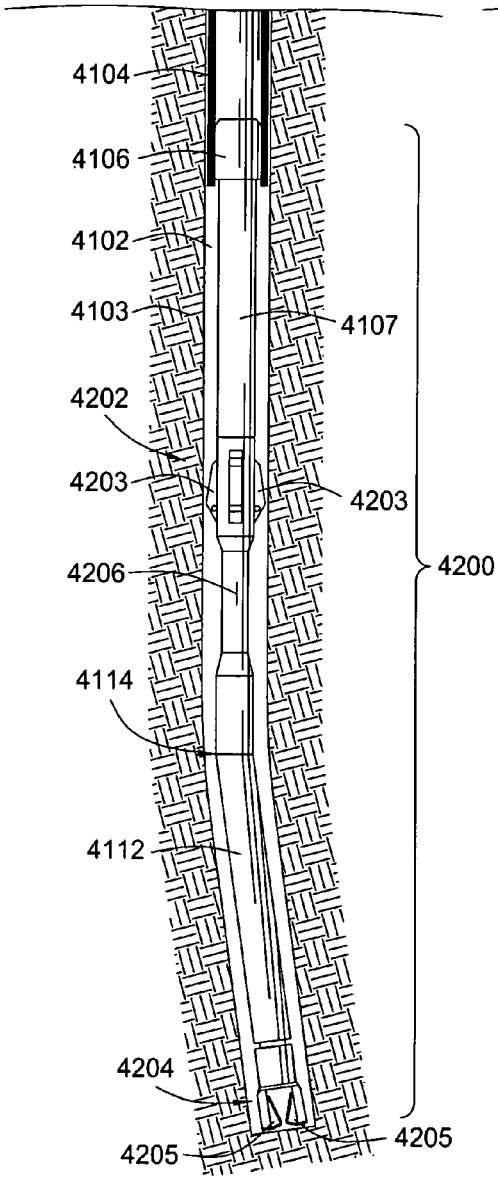

Operation of the BHA 4200 may be best described with reference to FIG. 34, which illustrates a flow diagram of exemplary operations 3300 for directional DWC, according to one embodiment of the present invention. At step 3302, a drilling assembly (e.g., the BHA 4200) is run down a wellbore 4102 through casing 4104, the drilling assembly having an (at least one) adjustable stabilizer 4202 and an expandable bit 4204. As illustrated in FIG. 33A, in order to run the BHA 4200 through the casing 4104, support members 4203 of the stabilizer 4202 and cutting members 4205 of the expandable bit 4204 may be placed in a first (run-in) position, wherein the stabilizer 4202 and expandable bit 4204 each have a total outer diameter less than the inner (drift) diameter of the casing 4104. The BHA 4200 is generally run until a securing mechanism, such as a casing latch 4106, is aligned with a bottom portion of the casing 4104. At step 3304, the drilling assembly is secured to a bottom portion of the casing 4104, for example, with the casing latch 4106.

Figure 33B:
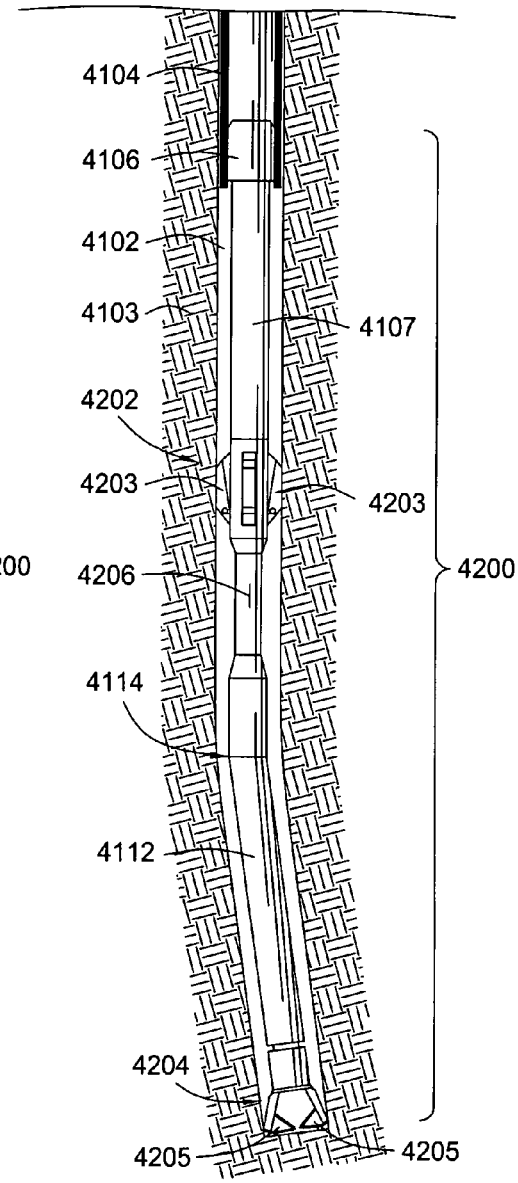

At step 3306, the bit 4204 is expanded to have an outer diameter greater than an outer diameter of the casing 4104. For example, as illustrated in FIG. 33B, the cutting members 4205 of the expandable bit 4204 may be expanded into an open position. Generally, movement of the cutting members 4205 between the retracted and expanded positions may be controlled through the use of hydraulic fluid flowing through the center of the expandable bit. For example, increasing the hydraulic pump pressure (i.e., by increasing the flow of drilling fluid) may move the cutting members 4205 into the expanded position while decreasing the hydraulic pressure may return the blades to the retracted position (e.g., for retrieval of the BHA 4200 after drilling operations are completed, for bit replacement, etc.).

At step 3308, the stabilizer 4202 is adjusted for directional control of the drilling assembly. For example, initially, an outer diameter of the stabilizer 4202 may be adjusted from the first (run-in) position to a second position having a sufficiently large diameter to engage the inner walls of the wellbore 4102 to support the BHA 4200 while drilling. During the drilling process, as will be described in greater detail below, the stabilizer 4202 may be adjusted to a third position (between the run-in position and the second position) to vary the under-gage amount (e.g., separation between support members 4203 and the inner walls of the wellbore 4102), in an effort to control the trajectory of the hole.

Figure 33C:
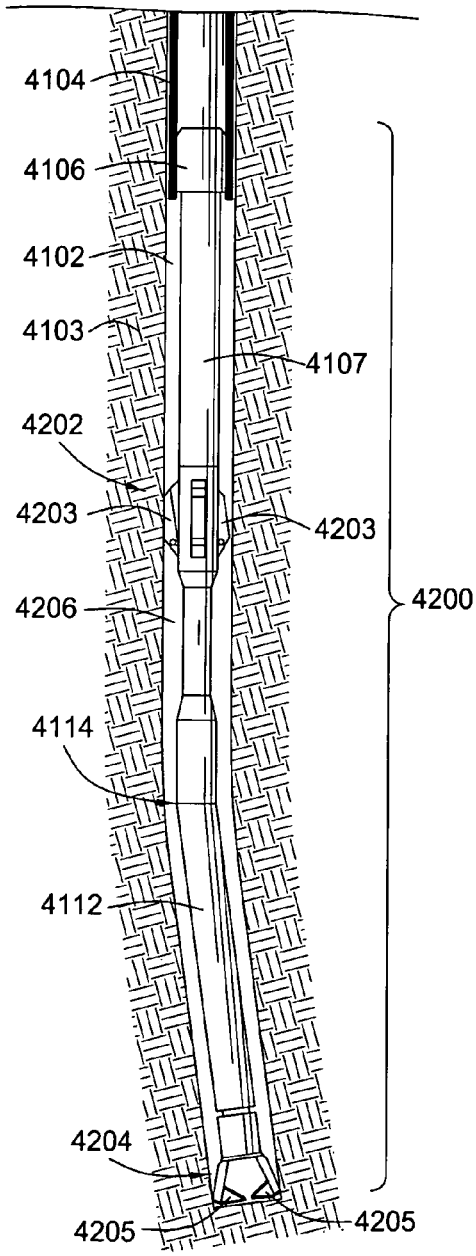
Figure 33D:
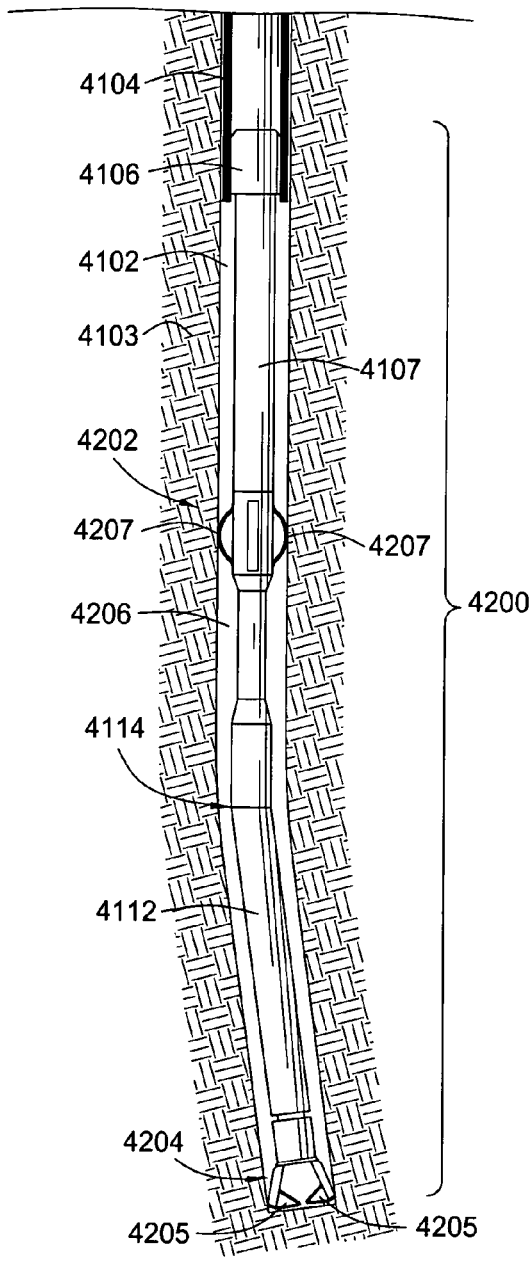

Means for adjusting the stabilizer 4202 may vary with different embodiments. For example, as illustrated in FIGS. 33A-33C, the support members 4203 may be implemented as movable arms/blades that may be retracted in the first (run-in) position (FIG. 33A), expanded in the second position, and partially retracted/expanded to the third position (FIG. 33C) to provide a separation between the stabilizer 4202 and the wellbore 4102. The stabilizer 4202 may be continuously adjustable to aid in directional control. As an alternative, one or more of the support members 4203 may be aligned to give the stabilizer 4202 a smaller diameter during run-in. The support members 4203 may then be misaligned (e.g., by rotating one of the support members 4203 relative to the other) to increase the diameter of the stabilizer 4202. As another alternative, the stabilizer 4202 may include one or more spring-type support members 4207 (shown in FIG. 33D) that may be adjusted between the first, second, and third positions. As yet another alternative, the stabilizer 4202 may include an inflatable or mechanical support member (not shown), that may be operated similar to a packing element to adjust the stabilizer between the first, second, and third (or more) positions.

In either case, adjustments to the stabilizer 4202 (between the various positions) may be made by any suitable means, such as hydraulic means (in a similar manner as described above with reference to the expandable bit 4204), mechanical means, and electrical or electro-mechanical means, etc. Regardless, the stabilizer 4202 may be designed for use in rotary and/or slide mode. For example, in slide mode, the stabilizer 4202 provides drill string centralization and prevents the BHA from leaning onto one side of the hole. For some embodiments, the stabilizer 4202 may include sensors that monitor relative movement of the casing 104 in order to allow the stabilizer 4202 to rotate with the casing 4104 or to slide as the casing 4104 is being rotated to aid in the control of the direction of the hole. In either case, the stabilizer 4202 may prevent BHA 4200 from buckling (and leaning to one side) when weight-on-bit is applied to the BHA 4200. By preventing deflection of the BHA 4200 within the wellbore 4102, the stabilizer 4202 may also reduce the amount of axial and lateral vibration.

As previously described, excessive vibration, particularly in rotary mode, may lead to less than optimal contact between the bit 4204 and the formation 4103, leading to reduced penetration rate and a corresponding increased drilling time, which increases production costs. Further, excessive vibration may also lead to catastrophic harmonics which may damage and/or destroy the various components of the BHA 4200. In an effort to further reduce vibration, the BHA 4200 may also include a flexible collar 4206, which may be designed to prevent vibration from traveling from the bent subassembly 4114 to an upper portion of the BHA 4200 (e.g., any portion above the flexible collar 4206). The flexible collar 4206 may be made of any suitable flexible-type materials capable of withstanding harsh downhole conditions.

At step 3310, the bit 4204 is rotated to drill a hole having an outer diameter larger than the outer diameter of the casing 4104. As previously described, embodiments of the BHA 4200 may be operated in a rotary mode or a slide mode. In rotary mode, the bit 4204 may be rotated with the casing 4104 and guided with a rotary-steerable assembly (not shown), having adjustable pads that may be used to "push off" the inner walls of the formation 4102 to adjust the deviation of the bit angle from center. In slide mode, the bit 4204 may be rotated by a steerable downhole motor 4112, which typically provides a high speed of rotation and a high rate of removal without the need to rotate the casing 4104. When operating in either mode, the stabilizer 4202 provides centralization and prevents the BHA 4200 from leaning to one side of the hole, thus allowing better control of the trajectory of the hole.

At step 3312, the trajectory of the hole is monitored. As previously described, in conventional DWC systems, the hole may be steered by geological indicators logged at certain points while drilling (logging while drilling, or "LWD") using at least one LWD tool. While this log may be used to reconstruct and verify the wellbore path after drilling, this may be too late to make corrections. However, by monitoring the trajectory of the hole while it is being drilled (measuring while drilling, or "MWD"), embodiments of the present invention may allow for corrections to be made at the surface, for example by adjusting weight on bit, adjusting angle of the bent sub, and/or steering the motor 4112.

Further, as previously described, the stabilizer 4202 may be adjusted in response to a monitored trajectory. For example, the support members 4203 may be adjusted to provide a separation between the stabilizer 4202 and the inner surface of the wellbore 4102. The separation between the stabilizer 4202 and the inner surface of the wellbore 4102 (as shown in FIG. 33C) may allow the bent housing 4114 of the motor 4112 to lean more to one side, thus increasing bit deflection. Accordingly, the under-gage of the stabilizer 4202 may be varied, for example, in an effort to control bit deflection of the bit from center, for example, to make relatively fine adjustments to the trajectory of the wellbore 4103 as it is extended.

The trajectory of the wellbore 4102 may be monitored with a measurement-while-drilling (MWD) tool 4107 which, as shown, may be disposed anywhere along the BHA 4200. The MWD tools 4107 may be generally used to evaluate the trajectory of the wellbore 102 in three-dimensional space while extending the wellbore 4102. Therefore, the MWD tool 4107 may generally include one or more sensors to measure the trajectory (e.g., azimuth and inclination) of the wellbore, such as a steering sensor, accelerometer, magnetometer, or the like.

Of course, the MWD tool 4107 may also have sensors to monitor one or more downhole parameters, such as conditions in the wellbore (e.g., pressure, temperature, wellbore trajectory, etc.) and/or geophysical parameters (e.g., resistivity, porosity, sonic velocity, gamma ray, etc.). For some embodiments, the MWD tool 4107 may log such parameters for later retrieval at the surface. Thus, the MWD tool 4107 may also perform the same functions as conventional LWD tools. Regardless of whether these parameters are logged or telemetered to the surface in real time, measuring these parameters while drilling may save an additional trip down the wellbore for the sole purpose of such measurements.

Any suitable telemetry techniques may be utilized to communicate the wellbore trajectory (and possibly any other parameters) monitored by the MWD tool 4107 to the surface of the wellbore 4102. Examples of suitable telemetry techniques may include electronic means (e.g., through a wireline or wired pipe) and/or digitally encoding data and transmitting to the surface as pressure pulses in a mud system using sensing devices including, but not limited to, one or more of the following: mud-pulse telemetry device; mud pulse on gyroscope device; gyroscopic telemetry device on wireline; gyroscopic telemetry electromagnetic device; gyroscopic telemetry acoustic device; gyroscopic telemetry mud pulse device; magnetic dipole including single shot and telemetry; wired casing as shown and described in relation to U.S. application Ser. No. 10/419,456 entitled "Wired Casing" and filed Apr. 21, 2003, which is incorporated by reference herein in its entirety; and fiber optic sensing devices. Any combination of sensors and/or telemetry may be utilized in the present invention. Regardless of the method used, based on the monitored trajectory as received at the surface, adjustments may be made at the surface (e.g., adjustments to the stabilizer 4202, weight on bit, speed of rotation, steering of the motor 4112 or rotary-steerable assembly, etc.).

Accordingly, the operations 3308-3310 may be repeated to extend the wellbore to a desired depth along a well-controlled trajectory. Once the desired depth is reached, the BHA 4200 may be retrieved from the wellbore. For example, the BHA 4200 may be retrieved by unlatching the casing latch 4106 and placing the stabilizer 4202 and expandable bit 4204 back in the run-in positions (as shown in FIG. 33A) and pulling the BHA 200 back to the surface through the casing 4104. The string of casing 4104 may then be extended into the newly drilled portion of the wellbore, for example by adding sections of casing 4104 from the surface.

However, retrieving the BHA 4200 through the entire length of casing 4104 may require a significant amount of time in which the formation around the newly drilled (and uncased) portion of the wellbore may settle, thereby making it difficult to subsequently advance the string of casing 4104. Therefore, for some embodiments, prior to completely retrieving the BHA 4200, the BHA 4200 may be only partially raised through the casing 4104 (e.g., enough that the bit 4205 is at least partially within the casing 4104). After partially raising the BHA 4200, the casing 104 may then be advanced into the newly drilled portion of the wellbore, for example, by adding additional sections of casing 4104 from the surface. Because partially raising the BHA 4200 may require significantly less time than completely raising the BHA 4200 to the surface (as during retrieval), the likelihood of the formation settling prior to advancing the casing 4104 is reduced. After advancing the casing 4104, the BHA 4200 may then be completely retrieved.

While the adjustable stabilizer 4202 is shown in FIGS. 33A-33D as positioned between the bit 4205 and casing latch 4106, for some embodiments, one or more adjustable stabilizers may be positioned above the casing latch 4106 instead of, or in addition to, the adjustable stabilizer 4202. As an example, an adjustable stabilizer 4202 may be positioned above the casing latch 4106 to provide support to the casing 4104, which, when utilized as part of the drilling assembly (including the BHA 4200), may also be subjected to similar strains as the BHA 4200. In other words, the casing 4104 may also be subjected to weight on bit and, particularly in the case of rotary operation, lateral and radial vibrations. Further, while not shown, a drilling assembly may include the BHA 4200 attached to a portion of casing run in through another portion of casing (not shown) already lining the wellbore. For example, the BHA 4200 may be attached to a portion of expandable casing. After extending the wellbore with the BHA 4200, the expandable casing may be advanced and expanded to line the extended portion of the wellbore. Of course, the BHA 4200 may be retrieved from the wellbore prior to the expanding.

In another embodiment, the expandable bit 4205 may be replaced with a combination of a pilot bit and underreamer. Embodiments of the present invention provide methods and assemblies for improved drilling with casing (DwC). By providing an adjustable stabilizer, the drilling assembly may be adequately supported, thus avoiding excessive deflection and vibration that commonly occurs in conventional DwC systems. Further, by, utilizing measurement-while-drilling equipment, trajectory of the wellbore may be measured in real time, thus allowing corrections of the trajectory to be made at the surface increasing the likelihood a desired trajectory will be achieved. A further additional embodiment may include closed-loop drilling to control the diameter of the adjustable stabilizer or motor bend angle, or a 3-D rotary steerable system. The closed-loop control could be a microprocessor, either uphole or downhole.

FIGS. 35-36 show alternate embodiments of a system for directionally drilling with casing. These embodiments provide methods and apparatus for drilling with a BHA releasably attached to casing which allow the directional force for the system to be placed directly on the casing rather than directly on the BHA.

FIG. 35 shows casing 2404 with a BHA 2400 releasably attached to an inner diameter thereof by a casing latch 2406. While a casing latch 2406 is shown in FIG. 35, any other method for releasably attaching the BHA 2400 to the inner diameter of the casing latch 2406 is contemplated for use in the present invention. The casing latch 2406 performs an orientation function (described below) as well as the function of releasably connecting the casing 2404 to the BHA 2400. To this end, one or more axial blades 2407 extend radially from the body of the casing latch 2406 portion of the BHA 2400. Additionally, one or more torque blades 2405 located below the axial blades 2407 extend radially from the body of the casing latch 2406. The torque blades 2405 may be included in any number, as with the axial blades 2407. The axial blades 2407 and torque blades 2405 are spring-loaded.

The casing 2404 includes one or more casing sections. FIG. 35 shows three casing sections 2404A, 2404B, and 2404C threadedly connected to one another. The lower casing section 2404C is threadedly connected to the middle casing section 2404B by a casing coupling 2416. The casing coupling 2416 may have female threads at upper and lower ends for threadedly connecting the lower end of the middle casing section 2404B to the upper end of the lower casing section 2404C, respectively. Likewise, the upper casing section 2404A is threadedly connected to the middle casing section 2404B by a profile collar 2411. The profile collar 2411 may have female threads at each end for connecting to the male threads of the lower end of the upper casing section 2404A and to the upper end of the middle casing section 2404B. The profile collar 2411 includes profiles 2413 therein for releasably engaging the axial blades 2407 and profiles 2415 therein for releasably engaging the torque blades 2405.

When employed to connect the BHA 2400 to the casing 2404, the BHA 2400 with the spring-loaded axial and torque blades 2407 and 2405 are run through the casing 2404. Once the blades 2407 and 2405 reach the profiles 2413 and 2415 in the inner diameter of the profile collar 2411, the bias force from the spring-loaded blades 2407 and 2405 causes the blades 2407 and 2405 to snap out into their respective profiles 2413 and 2415. The torque blades 2405 rotate a few degrees before snapping out into the profile collar 2411. The axial blades 2407 prevent the BHA 2400 from translating axially relative to the casing 2404, and the torque blades 2405 prevent the BHA 2400 from rotating relative to the casing 2404. While the profiles 2415 and 2413 are shown existing in the profile collar 2411 in FIG. 35, it is also contemplated for use in the present invention that profiles may exist in the casing 2404 itself to releasably engage the axial and torque blades 2407 and 2405.

An upper portion of the BHA 2400, shown here as the upper position of the casing latch 2406, possesses one or more packing elements 2417 on its outer diameter for sealingly engaging an annulus between the BHA 2400 and the casing 2404. The packing elements 2417 are preferably elastomeric for providing a seal between the casing 2404 and the BHA 2400. Additionally, cups 2418 located above and below the packing elements 2417 aid in sealing the annulus between the casings 2404 and the BHA 2400. The packing elements 2417 and the cups 2418 extend radially from the BHA 2400 circumferentially around the body of the casing latch 2406.

The upper end of the casing latch 2406 has threads 2419, preferably female threads, and/or a fishing profile to allow collets to latch into or around (see U.S. Pat. No. 3,951,219, which is herein incorporated by reference in its entirety) for connecting the BHA 2400 to the surface with a tubular body (not shown) so that the BHA 2400 can be retrieved at the desired time. Additionally, the upper end may have a GS profile. Possible tubular bodies which may retrieve the BHA 2400 include but are not limited to drill pipe, coiled tubing, coiled rod, or wireline. Below the casing latch 2406 in the BHA 2400 is a resistivity sub 2420 for housing one or more resistivity sensors (not shown) therein for use in taking real-time or periodic resistivity measurements. Around the resistivity sub 2420 is a stabilizer 2422 which extends radially from and preferably circumferentially around the BHA 2400. The stabilizer 2422 bridges the annulus between the BHA 2400 and the casing 2404 and maintains the position of the BHA 2400 within the casing 2404 at a preferred axial location to stabilize the BHA 2400 relative to the casing 2404.

The resistivity sub 2420 may contain one or more geophysical sensing devices capable of measuring parameters such as formation resistivity, formation radiation, formation density, and formation porosity. The sensing devices may be latched therein by embodiments of mechanisms shown in FIGS. 42-47 (see below). The section of casing (here, the middle casing section 2404B) disposed around the portion of the BHA 2400 having the resistivity device therein preferably has one or more resistivity antennas for use with the resistivity device. The resistivity sub 2420 is not required for use in the present invention, but only when resistivity measurements are desired during or after drilling.

Below the resistivity sub 2420 in the BHA 2400 is an MWD/LWD sub 2424, which may house one or more MWD or LWD sensing devices including, but not limited to, one or more of the following: mud-pulse telemetry device; mud pulse on gyroscope device; gyroscopic telemetry device on wireline; gyroscopic telemetry electromagnetic device; gyroscopic telemetry acoustic device; gyroscopic telemetry mud pulse device; magnetic dipole including single shot and telemetry; wired casing as shown and described in relation to U.S. application Ser. No. 10/419,456 entitled "Wired Casing" and filed Apr. 21, 2003, which is incorporated by reference herein in its entirety; and fiber optic sensing devices. Any combination of sensors and/or telemetry may be utilized in the present invention. As with the resistivity sub 2420 sensing devices, the MWD/LWD sub 2424 sensing devices may be latched therein by the mechanism shown in FIGS. 4-472. The sensing device(s) within the MWD/LWD sub 2424 are utilized to measure the angle with respect to the vertical axis of the casing 2404 at the surface of the earth to which the casing 2404 is deflected. The angle may be measured in real time while drilling the casing 2404 into the earth while the surveying tool remains within the MWD/LWD sub 2424, or alternatively, the angle may be measured periodically by halting drilling temporarily to lower the surveying tool into the MWD sub 2424 and measure the orientation of the casing 2404. Measuring the angle at which the casing 2404 is being or has been drilled allows the operator to adjust conditions, such as amount of drilling fluid flowed through the casing 2404 or the force placed on the casing 2404 from the surface to lower the casing 2404 into the earth formation, to alter the angle of deflection of the casing 2404 within the formation.

Because same directional MWD and LWD sensors are magnetic, the casing 2404 surrounding the MWD/LWD sub 2424 must usually be non-magnetic. However, because the casing 2404 is left downhole when drilling with casing, and because non-magnetic casing is more expensive than the magnetic casing usually drilled with when drilling with casing, it is desirable in some situations to drill with magnetic casing. To this end, a gyroscope may be utilized as the directional MWD/LWD sensor to eliminate the necessity to use non-magnetic casing around the MWD/LWD sub 2424. Magnetic casing may then be disposed around the MWD/LWD sub 2424. A preferred gyroscopic sensor for use in the present invention is a Gyrodata Gyro-Guide GWD gyro-while-drilling tool, as shown and described in Gyrodata Services Catalog, 2003, at page 31. Gyro-Guide is a fully integrated guidance system housed in the MWD tool string (here, the BHA 2400) which includes wireless telemetry for surveying while drilling. Use of the Gyro-Guide allows gyro-while-drilling rather than the operator having to repeatedly stop the drilling process, place the surveying tool (e.g., gyroscope) into the casing 2404 with wireline, take measurements, then remove the surveying tool prior to drilling further.

Below the MWD/LWD sub 2424 in the BHA 2400 is a mud motor 2425. Connected below the mud motor 2425 is an underreamer 2426 and a pilot bit 2428. The pilot bit 2428 and the underreamer 2426 may be replaced by a bi-center bit in one embodiment. The mud motor 2425 provides rotational force to the underreamer 2426 and pilot bit 2428 relative to the mud motor 2425 through a motor bearing pack 2429 when it is desired to rotate the pilot bit 2428 relative to the BHA 2400 and the casing 2404 and rotationally drill into the formation. The mud motor 2425 utilized may be similar to he mud motor shown and described in relation to FIGS. 1-12. The pilot bit 2428 and underreamer 2426 drill the casing 2404 into the formation. The pilot bit 2428 preferably has side cutting capability to allow the casing 2404 to veer at an angle with respect to the centerline of the wellbore after drilling to the side of the wellbore.

An optional stabilizer 2430 similar to the stabilizer 2422 may be located around the outer diameter of the BHA 2400 at a location near the connection between the MWD/LWD sub 2424 and the mud motor 2425. The stabilizer 2430 is preferably located adjacent to an eccentric casing bias pad 2435 (described below). Like the stabilizer 2422, the stabilizer 2430 also maintains the axial location of the BHA 2400 relative to the casing 2404 by bridging the annulus between the BHA 2400 and the casing 2404. An additional concentric stabilizer 2432 is disposed concentrically around the outer diameter of the mud motor 2425 near the lower end of the casing 2404 to stabilize the lower end of the BHA 2400 relative to the casing 2404.

The primary impetus for the directional bias of the casing string 2404 (with respect to the vertical axis of the casing string 2404 entering the formation from the surface) exists due to an eccentric casing bias pad 2435. The casing bias pad 2435 is disposed on only one side of the casing 2404 on the outer diameter of the casing 2404 to push the centerline of the casing 2404 at an angle with respect to the wellbore centerline, thus eccentering the casing 2404 relative to the wellbore. The casing bias pad 2435 is mounted near the lower end of the casing 2404. The directional bias angle of the casing 2404 is in the opposite side of the casing 2404 from the side of the casing 2404 to which the casing bias pad 2435 is attached. For example, as shown in FIG. 35, the eccentric bias pad 2435 is located on the right side of the casing 2404; therefore, the deviation angle of the casing 2404 will be to the left of the centerline of the wellbore. In one embodiment, the casing bias pad 2435 may cover approximately 90-100 degrees of circumference, but any angle is possible with the present invention. The height of the casing bias pad 2435, or the distance from the inner side of the casing bias pad 2435 mounted on the outer diameter of the casing 2404 to the outer side of the casing bias pad 2435 farthest from the casing 404 outer diameter, is predetermined prior to insertion of the assembly into the wellbore. The height of the casing bias pad 2435 at least partially determines the angle at which the casing 2404 deviates from the centerline of the wellbore. In an additional embodiment of the present invention, the bias pad 2435 may instead be an eccentric stabilizer With the eccentric casing bias pad 2435, the directional force for directionally drilling the wellbore at an angle is provided essentially perpendicular to the portion of the casing bias pad 2435 perpendicular to the axis of the casing 2404. The force is translated from the outer portion of the casing bias pad 2435 to the casing 2404 so that the directional force is primarily born by the casing 2404 rather than the BHA 2400, primarily because the BHA 2400, is housed almost completely within the casing 2404 rather than a large portion of the BHA 2400 extending below the casing 2404. In the embodiment shown in FIG. 35, the pilot bit 2428, the underreamer 2426 and a portion of the mod motor 2425 are the only portions of the BHA 2400 which extend below the casing 2404. Preferably, the length of the exposed BHA 2400 is approximately 5-10 feet in length. Ultimately, the directional bias force transmits from the wellbore, to the casing bias pad 2435, to the stabilizer 2432, through the motor bearing pack 2429, and then to the underreamer 2426 and pilot bit 2428.

The casing latch 2406, in addition to performing the function of latching the BHA 2400 to the casing 2404, orients the face of the MWD or LWD tool (not shown) located within the BHA 2400 to the casing bias pad 2435 so that the location of the casing bias pad 2435 on the casing 2404, and consequently the angle at which the casing 2404 is drilling, is readily ascertainable with respect to some reference point. The torque blades 2405 of the casing latch 2406 maintain the rotational position of the BHA 2400 relative to the casing 2404, therefore orienting the sensor with respect to where the eccentric pad 2435 is located by preventing rotation of the BHA 2400 within the casing 2404. Similarly, the MWD/LWD tool may be latched into the MWD/LWD sub 2424 by the apparatus and method shown and described in relation to FIGS. 42-47 so that the MWD/LWD tool does not rotate with respect to the casing latch 2406 body, thus maintaining the rotational position of the MWD/LWD tool with respect to the casing latch 2406 body so that the position of the eccentric bias pad 2435 is readily ascertainable. Thus, the operator can keep track of which in direction the casing 2404 is being drilled so that the wellbore can continue to be drilled in the same direction if desired.

FIG. 36 shows casing 2504 with a BHA 2500 releasably attached to, an inner diameter thereof by a casing latch 2506. As stated above in relation to FIG. 35, the casing latch 2506 may be substituted with any other means for attaching the casing 2504 to the BHA 2500. The casing components including the casing sections 2504A, 2504B, 2504C; profile collar 2511 including profiles 2513, 2515; and casing coupling 2516 are substantially similar to the casing sections 2404A, 2404B, 2404C, profile collar 2411, profiles 2413, 2415, and casing coupling 2416 shown and described in relation to FIG. 35. Also, most of the BHA components including the threads 2519; packing element 2517 and cups 2518; axial and torque blades 2507 and 2505; resistivity sub 2520; MWD/LWD sub 2524; underreamer 2526; pilot bit 2528; and stabilizers 2522, 2530, and 2532 are substantially similar to the threads 2419, packing element 2417, cups 2418, axial and torque blades 2407 and 2405, resistivity sub 2420, MWD/LWD sub 2424, underreamer 2426, pilot bit 2428, and stabilizers 2422, 2430, and 2432, as shown and described in relation to FIG. 35. Therefore, the above description of these components applies equally to the embodiment shown in FIG. 36.

The casing latch 2506 of FIG. 36 is substantially similar to the casing latch 2406 of FIG. 35, so the majority of the above description of the casing latch 2406 applies equally to the embodiment shown in FIG. 36. The primary difference between the casing latch 2506 and the casing latch 2406 is that the casing latch 2506 of FIG. 36 does not have to be an orienting latch to keep track of the location of the casing bias pad 2535, as the casing bias pad 2535 of FIG. 36 acts as a concentric stabilizer (see description below).

Instead of the mud motor 2425 of FIG. 35, a bent housing mud motor 2550 is connected to the lower end of the MWD/LWD sub 2524. The bent housing mud motor 2550 includes a bent motor connecting rod housing 2555 that is bent at an angle to cause the casing 2504 to deviate while drilling at an angle with respect to the centerline of the wellbore. The bent motor connecting rod housing 2550 is angled with respect to the rest of the BHA 2500 at the angle and direction in which it is desired to bias the casing 2504.

An additional difference between the system of FIG. 35 and the system of FIG. 36 is that rather than the eccentric casing bias pad 2435 of FIG. 35, the casing bias pad 2535 of FIG. 36 is circumferential and can be termed a stabilizer. Rather than an eccentric bias pad providing the orientation angle of the casing 2504, the bent motor connecting rod housing 2555 provides the orientation angle.

Just as in the embodiment of FIG. 35, the embodiment illustrated in FIG. 36 shows a majority of the BHA 2500 located within the casing 2504. The only portions of the BHA 2500 which are located below the casing 2504 are a portion of the bent motor connecting rod housing 2555, the motor bearing pack 2529, underreamer 2526, and pilot bit 2528. Again, the length of the BHA 2500 below the casing 2504 is preferably only approximately 5-10 feet.

In the operation of the embodiment of FIG. 36, the directional bias force is provided by the motor bend, which pushes against the side of the wellbore, causing a resultant force on the opposite side of the pilot bit 2528 and underreamer 2526. However, the directional force is transmitted by the casing 2504 instead of the BHA 2500, as in the embodiment of FIG. 35, so that the directional bias force transmits from the wellbore, to the casing bias pad 2535, then to the stabilizer 2532, through the motor bearing pack 2529, and then to the underreamer 526 and pilot bit 2528.

As in the embodiment shown in FIG. 35, the height of the casing bias pad 2535 is predetermined before lowering the assembly downhole. However, in the embodiment of FIG. 36, the mud motor bend angle is adjustable from the surface and/or downhole to adjust the angle at which the casing 2504 is drilled. In the embodiments of both FIGS. 35 and 36, the height and/or diameter of the casing bias pad 2435, 2535 (or eccentric stabilizer) is also adjustable from the surface of the wellbore and/or downhole.

In the embodiments of FIGS. 35-36, the non-magnetic casing section 2404C or 2504C may be constructed of any non-magnetic material consistent with MWD sensors. Also, other non-magnetic casing alternatives are contemplated for use with the present invention. The non-magnetic casing may be composite or metallic. Resistivity measurements from the resistivity sub 2420, 2520 may require repackaging of the sensor antennas and/or a special resistivity casing joint.

In the above embodiments shown and described in relation to FIGS. 35-36, in lieu of the underreamer 2426, 2526 and pilot bit 2428, 2528, an expandable bit (not shown) which is expandable to drill the wellbore, then retractable to a smaller outer diameter when retrieving the BHA 2400, 2500 from the casing 2404, 2504 may be utilized. An example of an expandable bit which may be used in the present invention is described in U.S. Patent Application Publication No. US2003/111267 or U.S. Patent Application Publication No. 2003/183424, each of which is incorporated by reference herein in its entirety.

The BHA 2400, 2500 components, including the latch 2406, 2506; MWD/LWD sub 2424, 2524; and resistivity sub 2520, may be arranged in a different order than is shown in FIGS. 35-36. Additionally, the stabilizers 2422; 2522; 2430, 2530; and 2432, 2532 may be placed in different longitudinal locations on the o.d. of the BHA 2400, 2500.

The operation of embodiments depicted in FIGS. 35-36 includes assembling the BHA 2400, 2500 and casing 2404, 2504. The BHA 2400, 2500 and casing 2404, 2504 assembly is then lowered into the formation and the assembly is caused to drill at an angle with respect to a vertical wellbore drilled into the formation. If desired, the mud motor may rotate the pilot bit 2428, 2528 while drilling at the angle. Once the assembly has drilled to the desired depth at which to leave the casing 2404, 2504 within the wellbore, the BHA 2400, 2500 is detached from the casing 2404, 2504. The casing 2404, 2504 is lowered over the BHA 2400, 2500, and the BHA 2400, 2500 is then retrieved from the wellbore using a tubular body such as drill pipe or wireline. The casing 2404, 2504 may then be cemented into the wellbore. Additional casing (not shown) may then be drilled through the casing 2404, 2504 into the formation and may be expanded into the casing 2404, 2504. This process may be repeated as desired.

FIG. 37 shows another embodiment of a directional drilling assembly. Particularly, the BHA 2700 is equipped with an articulating housing 2760 to provide the directional bias for drilling. As shown, the BHA 2700 is releasably attached to an inner diameter of the casing 2704 using a casing latch 2706. As stated above in relation to FIGS. 35 and 36, the casing latch 2706 may be substituted with any other means for attaching the casing 2704 to the BHA 2700. The casing components including the casing sections 2704A, 2704B, 2704C; profile collar 2711 including profiles 2713, 2717; and casing coupling 2716 are substantially similar to the casing sections 2404A, 2404B, 2404C, profile collar 2411, profiles 2413, 2415, and casing coupling 2416 shown and described in relation to FIG. 35. Also, most of the BHA components including the threads 2719; packing elements 2717 and cups 2718; axial and torque blades 2707 and 2705; resistivity sub 2720; MWD/LWD sub 2724; underreamer 2726; pilot bit 2728; and stabilizers 2722, 2730, and 2732 are substantially similar to the threads 2419, packing elements 2417, cups 2418, axial and torque blades 2407 and 2405, resistivity sub 2420, MWD/LWD sub 2424, underreamer 2426, pilot bit 2428, and stabilizers 2422, 2430, and 2432, as shown and described in relation to FIG. 35. Therefore, the above description of these components applies equally to the embodiment shown in FIG. 37.

Instead of a bent motor 2550 as shown in FIG. 36, a drilling motor 2750 equipped with an articulating housing 2760 is used to provide torque to rotate the pilot bit 2728 and the underreamer 2726 as illustrated in FIG. 37. The articulating housing 2760 can be pivoted to create an angle between the drilling motor 2750 and the motor bearing pack 2729, thereby causing the pilot bit 2728 to drill at an angle with respect to the centerline of the wellbore. In comparison to the bent motor 2550, the articulating housing 2760 allows the drilling motor 2750 to pass through the casing 2404 in a substantially concentric manner. In this respect, a larger drilling motor may be installed on the bottom hole assembly, thereby providing more power to the pilot bit 2728.

FIGS. 38A-B depict an exemplary articulating housing 2760 according to aspects of the present invention. The articulating housing 2760 includes a first articulating member 2761 engageable with a second articulating member 2762 as shown in FIG. 38A. In one embodiment, the first articulating member 2761 is connected to the drilling motor 2750, and the second articulating member 2762 is connected to the motor bearing pack 2729. As shown, the first and second articulating members 2761, 2762 are coupled using two male and female connections 2765. Specifically, each of the male connection members 2763 of the first articulating member 2761 is coupled to a respective female connection member 2764 of the second articulating member 2762. A pin 2766 may be inserted through each male and female connection 2765 to ensure engagement of the articulating members 2761, 2762. Additionally, a sleeve 2767 may be disposed around the pins 2766 to prevent the separation of the pin 2766 from the connections 2765. In turn, the sleeve may be attached to the articulating housing 2760 using another pin or screw 2769. Optionally, the first articulating member 2761 may include one or more stabilizers 2768 formed thereon.

FIG. 38B is another cross sectional view of the articulating housing 2760, which is rotated 90 degrees when compared to FIG. 38A. As shown, the second articulating member 2762 is deviated from the centerline of the first articulating member 2761. This is because the pin connection 2765 acts like a hinge to allow relative rotation between the first and second articulating members 2761, 2762. In this respect, the motor bearing pack 2729 and the pilot bit 2728 may be deviated from a centerline of the drilling motor 2750. Preferably, the articulating housing 2760 is adapted to allow the motor bearing pack 2729 deviate up to about 7 degrees from the centerline; more preferably, up to about 5 degrees; and most preferably, up to about 3 degrees.

FIGS. 39-41 show another embodiment of a directional drilling assembly. In FIG. 39, a BHA 2900 is being conveyed through a casing 2904. The BHA 2900 includes a casing latch 2906, a MWD/LWD tool 2924, an expandable stabilizer 2902, and a flexible collar 2910. The drilling motor 2950 is equipped with an articulating housing 2960 and a motor bearing pack 2929. An expandable bit 2928 is employed to extend the wellbore. It must be noted that the description of the components provided herein applies equally to the embodiment shown in FIGS. 39-41. For example, the MWD/LWD tool 2924 may include sensors to monitor conditions in the wellbore such as pressure and temperature as previously described. During run-in, the expandable stabilizer 2902 and the expandable bit 2928 are collapsed. Additionally, the articulating housing 2960 is substantially vertical. When compared to a BHA having a bent motor, the articulating housing 2960 provides more clearance between the drilling motor 2950 and the casing 2904. In this respect, a larger drilling motor may be used to generate more torque downhole.

In FIG. 40, the BHA 2900 has reached the bottom of the wellbore, but the drilling process has not started. As shown, the casing latch 2906 has been actuated to engage the BHA 2900 with the casing 2904. It can also be seen that the articulating housing 2960 and the BHA 2900 are still substantially vertical.

In FIG. 41, the drilling process has begun. The articulating housing 2960 is actuated by applying weight to the housing 2960. Because the expandable bit 2928 is in contact with the bottom of the wellbore, the housing 2960 experiences a force from above and below, thereby causing the housing 2960 to bend. In this manner, the expandable bit 2928 may be deviated from the centerline. Furthermore, the expandable stabilizer 2902 may be utilized to assist with direction control as discussed above. For example, the expandable stabilizer 2902 may be partially expanded and partially retracted as shown. Also, it can be seen that the expandable bit 2928 has been expanded to created larger diameter hole to accommodate the casing 2904.

Referring initially to FIG. 42, there is shown, in cross-section, a wellbore 10A in which drilling operations are being performed. Wellbore 10A is a directionally drilled borehole, having an entry portion 12A extending from the earth's surface 14A to a deviated portion 16A extending into a formation 18A from which hydrocarbons are likely to be found. The borehole 10A, although shown as having a generally dogleg profile, may have other profiles, such as deviating from vertical immediately upon entry to the earth.

To drill into the earth and thereby form borehole 10A, a drill string 20A, comprising a plurality of individual lengths of pipe or tubing 22A (one such shown in FIG. 43) and downhole equipment, such as a bent sub 30A, drill bit 32A and/or float tools 34A needed for drilling the well, are suspended from a drilling platform 24A of a rig 26A. On rig 26A are provided equipment (not shown) for setting the rotational alignment of the drill string 20A, to control the depth position of the drill string 20A, and to provided fluids such as drilling mud, water, cement, or other fluids used in the drilling of wells into the borehole 10A or down the hollow central portion 28A (shown in FIG. 43) of the drill string 20A to power the drill motor to turn the drill bit 32A.

Referring now to FIG. 43, there is shown a float sub 34A of the present invention, in this embodiment being integrally formed within a section of tubing 20A within the bent sub portion and thus placed into the drill string 20A at the time the drill string 20A was inserted into the earth. Float sub 34A generally includes an annular body portion 36A, having a configured central aperture 38A therethrough in which downhole peripherals such as mule shoe 52A and valve 42A may be positioned. The body portion 36A is preferably configured of a drillable material such as the cement used to secure the annulus between the borehole and the drill string 20A where the drill string 20A is used as casing, or of plastic, cast iron, aluminum, or such other easily drillable material such that the body portion, and the attendant mule shoe 52A and valve 42A can be easily removed from the casing by drilling them out in position in the drill string 20A. Central aperture 38A includes an upper guide portion 44A, in this embodiment configured as an integral frustoconical surface narrowing from an anti-rotation profile 31A formed at the upper surface of the float sub body 34A leading to landing bore 46A, and terminating in enlarged valve receipt bore 48A. Landing bore 46A is a generally right cylindrical bore, having an alignment sleeve 50A disposed therein within which is provided shoe 52A for the receipt of a survey tool 60A (shown positioned above the float sub 34A in FIG. 43) in an aligned position within the float sub 34A. As shown in FIG. 43, shoe 52A is generally a tubular member, the upper end of which is received in secured engagement with the inner diameter of sleeve 50A at the lowermost end thereof in the landing bore 40A. The upper surface of shoe 52A is provided with a mule shoe profile 54A, i.e., the uppermost annular surface 56A of shoe 52A facing in an up-bore direction is configured as a plane cut across the tubular profile of the shoe 52A at an angle to the centerline of the shoe 52A, such that the perimeter of the upper terminus of the shoe 52A at mule shoe profile 54A is an ellipse. Shoe 52A additionally includes a slot 58A, extending in a downhole direction from mule shoe profile 54A, in the wall of the shoe 52A. It is understood that the mule shoe profile 54A may include other geometries in addition to an ellipse.

Referring still to FIG. 43, valve body 62A is received downhole from shoe 52A, in valve receipt bore 48A. Valve body 62A generally includes a housing 64 having a through-bore 66A therethrough which extends from the lowermost extension of shoe 52A to a valve assembly 68A. Housing 64A is preferably cast in, threaded into, or otherwise permanently secured within body 34A before loading the float sub 34A into the drill string 20A. Valve assembly 68A is shown in this embodiment as a "flapper"-type valve, i.e., a valve wherein a cover plate 70A is connected by a spring-loaded hinge 72A to the housing 64A, such that cover plate 70A is positioned when in a closed position over the opening of bore 66A at the underside of the housing 64A to thereby seal the bore from entry of fluids from a location downhole therefrom into the bore 66A, and thus into the hollow interior region 28A of the drill string 20A. However, when fluid is directed down the hollow interior region 28A of the drill string 20A, such fluid may pass through the hollow interiors of the sleeve 50A and mule shoe 52A, and thus through the through-bore 66A to provide a sufficient force bearing upon the valve to cause the cover plate 70A to swing open about the hinge 72A, thereby allowing such fluids to pass therethrough and thence onwardly down the portion of the drill string 20A therebelow. The fluid may exit into the wellbore through the mud passages in the bit. In another embodiment, the fluid may pass through the powering passages in the mud-driven drill motor (not shown) before reaching the bit. The configuration of the float sub 34A shown in FIG. 43 locates the sleeve 50A generally co-linearly with the center of drill string 20A, and thus the receipt of a survey tool therein, as will be described further herein, will position the survey tool in the center of the drill string 20A. However, there exist survey tools where it would be useful to have the survey tool to one side of the drill string 20A, therefore, the bore 46A of the float sub 34A may be offset to one side or the other (i.e., not co-linear with the drill string 20A centerline) such that the sleeve 50 will likewise be offset from the centerline of the drill string 20A.

Referring still to FIG. 43, a survey tool 60A is shown within drill string 20A suspended on a wireline 102A above (or adjacent to) float sub 34A. Survey tool 60A generally includes a hollow, generally cylindrical body 104A having an outer cylindrical portion 106A having an inner diameter substantially equal to that of shoe 52A, and an outer diameter slightly smaller than the inner diameter of the sleeve 50A within which shoe 52A is received; an upper cover portion 108A from which wireline extends from the tool 60A; and an open lower end 110A. The lower end 110A is likewise configured with a mating mule shoe profile 100A (shown in FIG. 43A), cut at the same angle as that of shoe 52A, to provide a mating elliptical surface to that of the mule shoe profile 54A on shoe 52A. FIG. 43A shows a side view of the survey tool 60A having a mating profile 100A for mating with the mule shoe profile 54A on the shoe 52A.

To retrieve the survey tool 60A from the well where the tool 60A becomes separated from the wireline 102A, cover portion 108A may include a fishing neck 112A thereon for retrieving of the survey tool 60A with a fishing tool (not shown). In another embodiment, the tool 60A may be intentionally separated from the wireline 102A and left in place. In another embodiment still, the tool 60A may be pre-assembled with shoe 52A only to be retrieved later by wireline or pipe. The body 104A further includes a plurality of flow passages 116A extending therethrough which enable fluids to flow between the hollow portion 28A of the drill string 20A and the interior volume 118A of the body 104A. A plurality of stabilizers 120A are located on the outer surface of body 104A help center the survey tool 100A in the drill string 20A as it is lowered from the surface through hollow portion 28A.

Within survey tool 60A and connected to wireline 102A passing through upper cover portion 108A is a diagnostic apparatus 114A. In the embodiment shown, this diagnostic apparatus 114A is a geosensor and sender combination which, in conjunction with a computer and computer program therein, is able to determine orientation of the borehole 10A in the earth, and thus is needed to ensure that the borehole 10A is progressing in the desired direction once the rotational position of the survey tool 60A is known.

Referring now to FIG. 44, the receipt of survey tool 60A in shoe 52A is shown. Survey tool 60A is lowered down the hollow portion 28A of drill string 20A on wireline 102A such that lower end 110A thereof is received within landing bore 46A of float tool 34A. Where survey tool 60A is axially misaligned with landing bore 46A, i.e., is offset to one side of the drill string 20A, the lower end thereof will engage the tapered surface 44A on alignment bore 46A and be guided to the opening of sleeve 50A. Thence survey tool 60A is further lowered, such that the lower end thereof enters sleeve 50A and the mating mule shoe profile 100A on the lower end 110A of survey tool 60A will contact the mule shoe profile 54A on shoe 52A. Where the rotational alignment of the two profiles is not such that the plane of their elliptical faces is not parallel, further lowering of the survey tool 60A will cause the end 110A of survey tool 60A to slide upon the mule shoe profile. 54A of shoe 52A, simultaneously causing the survey tool 60A to rotate until the survey tool 60A is fully received against profile 54A such that the planar elliptical faces of each of profiles 54A, 100A are in parallel contact.

In the preferred embodiment hereof, the drill shoe includes a cutting apparatus which may be a traditional rock bit, a drill motor, or the like, preferably configured to be drilled through by a subsequent, smaller drill shoe passed down the casing. Alternatively, the drill shoe may include a jet section having a plurality of fluid jets extending from a central bore thereof (not shown) to the exterior thereof in a known circumferential position. Preferably, as is known in the art, the fluid jets may be selectively controlled to enable jetting into the formation for removal of formation materials and thereby create a deviation in the direction of the borehole direction. Thus, the drill string (or drill motor) may be rotated to drill ahead or the jets may be oriented by rotational positioning and selection thereof to drill directionally. The drill shoe also preferably includes a plurality of mud passages therethrough, through which drilling fluids may pass to lubricate or cool the cutting surface and enable the removal of cuttings from the borehole as the drilling fluid is recirculated to the earth's surface.

The orientation or rotational alignment of the mule shoe profile 54A, being known prior to the placement of the survey tool 60A therein, enables multiple functions to be accomplished downhole with a high degree of reliability. In one aspect, the survey tool 60A may be a gyroscope, which is adapted to acquire information relating to wellbore position. The position information is communicated to the surface via the wireline 120A. Particularly, surface components or controllers may receive information relating to the orientation of the gyro and the rotational position of the casing, including the bent sub. In turn, the position of the casing or the bent sub may be changed by rotating the casing at the surface to provide the desired orientation or position. Thereafter, the gyro may be removed via the wireline 120A, or if necessary via a fishing tool. After orientation, drilling or jetting through selective ports of the jet portion of the drill shoe may be undertaken to establish a new or desired direction of the borehole. The new direction of the borehole may be determined and verified by landing the gyro on the muleshoe profile 54A. Any additional directional modification may be performed, as needed, according to the method described above.

Alternatively, a measure-while-drilling tool ("MWD tool") or LWD tool 600A having a survey tool 660A may be used to determine and steer the drill shoe (located below 620A) as drilling progresses, as illustrated in FIG. 47. Many types of sensors may be utilized, including magnetic, gravity, gyro sensors and any combination thereof. Additionally, many types of telemetry including mud-pulse, electromagnetic, acoustic, wireline, fiberoptic, wired casing, and any combination thereof. Any combination of sensors and telemetry may be utilized. The advantage of using the fluid-driven or continuous MWD/LWD tool 600A is that the drilling may continue with the survey tool 660A landed on the bore 646A. The drilling may continue using a drill motor 625A, wherein the casing 605A need not be rotated as the drill shoe 620A is then mud flow powered, or a traditional rock bit is used and the casing 605A may be turned to supply the formation-bit motion and cutting power. The MWD/LWD tool 600A may be equipped with a mud pulse telemetry component 610A to send information such as inclination and azimuth of the wellbore back to the surface. In one aspect, mud pulse telemetry 610A includes manipulating fluid flow through holes 616A by varying the total flow area of the holes 616A such that pressure pulses are perceivable at the surface. In this respect, mud pulse telemetry 610A is a way to communicate information from downhole to surface. In this manner, the direction of the borehole may be checked with or without ongoing drilling operation in the borehole. It must be noted that information may also be sent back to the surface using other methods known to a person of ordinary skill in the art, for example electromagnetic communication.

Referring to FIGS. 42-44, the float sub 34A and survey tool 60A, in combination, enable simultaneous survey and drilling operations, as well as other simultaneous operations which may be useful in the downhole location. Specifically, survey tool 60A may be securely located in float sub 34A, while drilling mud, water, cement, or other liquids are flowed therethrough. Specifically, where fluids are flowed from the surface location and down hollow portion 28A of drill string 20A, such fluid, upon reaching survey tool, bears upon survey tool and tends to maintain it against shoe 52A, and such fluid likewise flows through flow passages 116A to the hollow interior 118A of the survey tool. Thence, such fluids flow through the hollow bore of shoe 52A and bore 66A in the valve body 64A, such that they bear upon and open or maintain open the valve cover plate 70A, and thus continue flowing down the remainder of the drill string 20A to locations such as the drill or mud motor and mud passages in the drill bit (not shown) and thence up the annulus between the drill string 20A and the borehole 10A. If the flow of fluid down the drill string 20A is interrupted or stopped or the pressure below the valve 68A exceeds the pressure of the mud at the valve 68A, the fluid in annulus will reflow back up the drill string 20A unless blocked. Such reflow would dislodge the survey tool from the shoe 52A, and may damage survey tool 60A. However, as cover plate 70A on valve body 42A is spring-loaded by hinge 72A to be biased in a closed direction, where the pressure above the valve approaches the back pressure exerted against the valve, the cover plate 70A will close over bore 66A. Further increases in back pressure caused by the fluid in the annulus 10A will only increase this closing force, thereby sealing off bore 66A and preventing further backflow or reflow of the fluids up the drill string 20A. Although the valve 68A has been described as a flapper-type valve, other valves such as check valves, poppet valves, auto-fill valves, or differential valves, the operation and construction of which are well known to those skilled in the art, may be substituted for the flapper valve without deviating from the scope of the invention.

Referring now to FIGS. 45 and 46, an alternative survey tool configuration is shown. In this embodiment, survey tool 200A is in all cases structured similar to survey tool 60A, except mule shoe profile of the survey tool 60A is replaced such that open lower end 202A of survey tool 200A is generally a right circular cylinder, and an alignment lug 204A is provided on the outer surface of tool 200A. As this tool is lowered into the float sub 34A from the position of FIG. 45 to the fully-landed position of the survey tool 200A of FIG. 46, lug 204A will engage the mule shoe profile 54A of shoe 52A and slide therealong, thereby rotating the survey tool 200A, as shown by the 90-degree turn of the tool 200A between FIG. 45 and FIG. 46, as tool 200A is further loaded into shoe 52A, until lug 204A is aligned with slot 58A, whence further lowering of tool 200A causes lug 204A to travel down to the base of slot 58A at which time tool 200A is fully engaged and aligned in shoe 52A. The survey tool 204A is smaller in diameter than survey tool 60A, as it must slide into shoe 52A whereas survey tool 60 rests upon the upper surface of the shoe 52A. Survey tool 200A is in all other respects identical to survey tool 60A, and the operation of the tool 200A in conjunction with mudflow therethrough is identical to that of survey tool 60A.

As with survey tool 60A, the orientation or rotational alignment of the survey tool 200A is known with respect to the position of the bent sub, the drill shoe, or the jet section, as the orientation of the slot 58A is known with respect to these portions of the drill string when they are assembled together before entering the borehole. Thus, survey tool 200A may comprise a gyro, and signals therefrom indicative of the direction in which the borehole is progressing and the alignment or orientation of the drill shoe components may be sent on wireline 120A to the surface to enable repositioning of the drill shoe components if needed, as was accomplished with respect to the survey tool 60A. Likewise, an MWD/LWD tool could be landed in the float sub 34A and utilize the alignment provided by the slot 58A to continue drilling and steering using the MWD/LWD. While the MWD/LWD tool is landed on the float sub 34A, the MWD/LWD tool can communicate the survey information to the surface via mud pulse telemetry, thereby eliminating the need to remove the survey tool to further drill the borehole.

The float sub 34A of the present invention provides multiple useful downhole features when provided in a drill string 20A. First, the position of the shoe 52A relative to the drill bit is noted prior to placement of the float sub 34A down the borehole, thereby enabling the use of data retrieved from or calculated by the survey tool to have a meaningful relation to the face being drilled. Additionally, the shoe 52A enables a known rotational alignment of the well survey tool 60A, 200A, when seated in the float sub 34A, which likewise enables meaningful data retrieval and generation for bit heading. Further, the use of an aligning element in combination with flow through the survey tool 60A, 200A housing, allows the drilling mud or other fluid flowing down the drill string 20A to be used to ensure that the survey tool 60A, 200A remains fully seated and thus properly oriented, as surveying is occurring, and likewise allows survey to occur when fluids are flowing through the system and thus as drilling is ongoing.

In each instance, after surveying is completed and well production need be initiated, the float sub 34A components must be removed or otherwise rendered non-impeding to the production of fluid from the well. Because the survey tool 60A 200A is merely sitting in the float sub 34A, it may be easily removed from the float sub 34A such as by extending a fishing tool (not shown) and engaging fishing neck 112A to pull the survey tool from the drill string 20A, or if the wireline 102A is sufficiently strong, the survey tool may be pulled up with the wire 102A. In another aspect, the survey tool 60A, 200A may be latched in the float sub 34A with a collet assembly, secured in place with shear screws or other methods known to a person of ordinary skill whereby the survey tool may be retrieved with relative ease.

Once the survey tool is removed, the float sub 34A is used to enable cementing of the casing 22A comprising the drill string 30A in place in the borehole, to case the borehole. Specifically, cement is flowed down the interior 28A of the casing 20A, and through the float sub 34A (as flowed drilling fluids), and thence out the mud passages in the drill shoe or other cementing passages provided therefore and into the annular space between the drill string 20A and the borehole 10A and 16A. This cement may need to cure in place without backing up through the interior of the drill string before hardening. Therefore, when the cementing fluid is no longer flowed down the drill string and a secondary, lighter liquid is poured into the drill string immediately behind the cement whereby the pressure in the drill string will be less than that in the annulus between the drill string 20A and the borehole 10A and 16A, the valve assembly 68A will close over the opening of bore 66A at the underside of the housing 64A to seal the bore from entry of cement back into the hollow interior region 28A of the drill string 20A. In another aspect, one or more isolation subs (not shown) may be positioned above or below the float shoe 34A to prevent leakage of cement back up the hollow region 28A if cement leaks past valve assembly 68A.

After the cement is cured, the float sub 34A is then removed, typically by directing a drill, mill, or cutter down the drill string 20A hollow portion 28A from the surface, and physically cutting or drilling through the shoe, housing, and valve assembly. The drill, mill, or cutter will readily drill through the cement or plasticbased components of the float sub, as well as any metal portion, into small pieces which may be recovered, in part, by being carried to the surface in drilling mud. Additionally, there is a benefit to having as much of the componentry as practicable, such as valve body 48A, etc. constructed of a material which is easily ground up or drilled through yet has sufficient strength to retain its shape under pressure. Once the float sub is removed, production tubing or other production elements can easily be passed through the drill string 20A past the former location of the float sub 34A. In instances where the borehole has not yet reached its ultimate depth, an additional casing to be cemented in place having a drilling bit and a drill motor operatively attached thereto may be used to drill through the float sub 34A and the drill motor at the bottom of the drill shoe to continue drilling further into the earth.

Although the invention has been described with respect to its use in a situation where the drill string 20A is to be used, in situ, as casing, the invention is as applicable to situations where a well is separately cased with tubing. In such an embodiment, a section of the casing may be provided with float sub 34A therein in a fixed longitudinal and angular alignment, and the distance from the float sub 34A to other locations of interest such as the end of the lowestmost casing in the stack noted. Thus, the float sub 34A may be used to enable survey tool alignment and positioning in casing, although drilling may not be simultaneously occurring.

Although the float sub 34A has been described in terms of a landing platform for receiving and orienting a survey tool, float sub 34A may be modified to include additional features, for example a latching collar or other receptacle formed therein to which a latching system such as a float collar or a cementing tool may be secured. Likewise, the float sub may be configured to include a stage tool, whereby a blocking member such as a ball (not shown) may be positioned to block the bore 66A, such that cement may be directed through the stage tool portion thereof (not shown).

In another aspect shown in FIGS. 48-52, the present invention provides a survey tool assembly 900 for use while directionally drilling with casing. FIG. 48 shows a casing 910 having a drill bit 915 and a cementing valve 920 disposed at a lower portion thereof. In one embodiment, a portion of the casing 910 may be manufactured from a non-magnetic casing. The drill bit 915 may include one or more fluid deflectors (bit nozzles) 925 angled in the direction of desired trajectory. The casing 910 may also include a receiving socket 930 for engagement with the survey tool assembly 900. Preferably, the receiving socket 930 is aligned or indexed with the fluid deflectors (bit nozzles) 925 to facilitate orientation of the survey tool assembly 900.

The survey tool assembly 900 may include survey tools such as a MWD tool 935 and a gyro 936. In one embodiment, the survey tools 935, 936 are disposed in the body 940 of the survey tool assembly 900 using one or more centralizers 942. A mud pulser 945 may be used to transmit information from the survey tools 935, 936 to the surface. The body 940 has a retrieving latch 950 disposed at one end, and an alignment key 955 disposed at another end. The alignment key 955 is adapted to engage the receiving socket 930 in a manner that orients the survey tool assembly 900 with the fluid deflectors (bit nozzles) 925. One or more seals 908 may be used to prevent fluid leakage between the survey tool assembly 900 and the casing 910. Additionally, spring bow centralizers 960 may be disposed on the outer portion of the body 940 to centralize the survey tool assembly 900 in the casing 910.

Many survey tools are actuated by fluid flow. To this end, the survey tool assembly 900 includes a fluid inlet channel 965 to allow fluid to flow into the body 940 to actuate the MWD tool 935 and the gyro 936. However, many survey tools operate in a fluid flow range that is often below what is necessary for other operations, for example, drilling operation. Consequently, the survey tool must be retrieved prior to the subsequent, higher flow rate operation. The process of repeatedly retrieving and deploying the survey tools is time consuming and expensive. To this end, the survey tool assembly 900 according to aspects of the present invention also includes a bypass valve 970 to allow the subsequent, higher flow rate operation to be performed without retrieving the survey tool assembly 900.

In one embodiment, the bypass valve 970 is disposed at a portion of the body 940 that is below the survey tools 935, 936. The bypass valve 970 is initially biased in the closed position by a biasing member 975, as illustrated in FIG. 48. An exemplary biasing member 975 includes a spring. When the bypass valve 970 is closed, fluid in the casing 910 can only flow into the body 940 of the survey tool assembly 900 through the inlet channel 965, as illustrated in FIG. 51. It must be noted that other types of bypass devices known to a person of ordinary skill in the art are contemplated within aspects of the present invention, for example, a fix orifice bypass.

The bypass valve 970 may be opened by providing a higher flow rate. Specifically, the bypass valve 970 opens when the flow rate in the casing 910 overcomes the directional force of the biasing member 975. Once opened, some of the fluid in the casing 910 may be directed through the bypass valve 970 instead of the inlet channel 965, as illustrated in FIG. 52. In this manner, a higher flow rate may be supplied to perform the subsequent, higher flow rate operation.

In operation, the survey tool assembly 900 is assembled inside the casing 910 and is lowered into the wellbore together with the casing 910. Particularly, the alignment key 955 is situated in the receiving socket 930 to orient the survey tool assembly 900 with the fluid deflectors 925, as illustrated in FIG. 49. A lower fluid flow rate is supplied to operate the survey tools 935, 936. The lower flow rate is insufficient to overcome the spring 975 of valve 970, but is sufficient to open the cementing valve 920, as shown in FIGS. 49 and 51. It must be noted that the lower flow rate may also be sufficient to operate the drill bit 915 at a slower rate. Information collected by the survey tools 935, 936 may be transmitted back to the surface by the mud pulser 945.

The bypass valve 970 is opened when the directional force of the spring is overcome by a higher flow rate. After the bypass valve 970 is opened, fluid flow through the survey tool assembly 900 may occur through the inlet channel 965 and the bypass valve 970, as illustrated in FIGS. 50 and 52. The higher flow rate may operate the drill bit 915 at a faster rate and provide more fluid flow through the fluid deflectors (bit nozzles) 925, thereby generating a more effective directional control. To collect survey information, the fluid flow may be decreased to close the bypass valve 970 and allow the operation of the survey tools 935, 936. Information collected by the survey tools 935, 936 may be transmitted back to the surface via mud-pulse telemetry using the mud pulser 945. This process of surveying and drilling may be repeated as desired. In this respect, the survey tools 935, 936 do not need to be retrieved and reconveyed downhole as drilling progresses, thereby saving time and cost of the operation. After drilling is complete, the survey tool assembly 900 may be retrieved by any manner known to a person of ordinary skill in the art. Preferably, the survey tool assembly 900 is retrieved by latching a wireline to the retrieving latch 950. In this manner, the survey tool assembly 900 may be reused in the next drilling operation.

Any of the above-mentioned downhole electromechanical devices such as drilling tools, directional tools, sensor package, cementing gear, and the like may be controlled or actuated by string rotation; mud pump cycling, wireline electric signal, wired casing signal, or combinations thereof. Controlling and/or actuating by string rotation may involve using a number of start/stop cycles and/or varying rpm. Controlling and/or actuating by mud pump cycling may involve using a number of start/stops of the flow rate and/or varying the flow rate.

In one embodiment, the present invention provides a method for directing a trajectory of a lined wellbore comprising providing a drilling assembly comprising a wellbore lining conduit and an earth removal member; directionally biasing the drilling assembly while operating the earth removal member and lowering the wellbore lining conduit into the earth; and leaving the wellbore lining conduit in a wellbore created by the biasing, operating and lowering. In one aspect, directionally biasing the drilling assembly comprises urging fluid through a non-axis-symmetric orifice arrangement of the drilling assembly. In one embodiment, the non-axis-symmetric orifice arrangement is disposed on the earth removal member. In another aspect, directionally biasing comprises urging the drilling assembly against a non-axis-symmetric pad arrangement included thereon. In one embodiment, the non-axisymmetric pad arrangement is disposed on the wellbore lining conduit.

In an additional embodiment, the present invention provides a method for directing a trajectory of a lined wellbore comprising providing a drilling assembly comprising a wellbore lining conduit and an earth removal member; directionally biasing the drilling assembly while operating the earth removal member and lowering the wellbore lining conduit into the earth; and leaving the wellbore lining conduit in a wellbore created by the biasing, operating and lowering. In one embodiment, the method further comprises a second wellbore lining conduit having a portion disposed substantially co-axially within the wellbore lining conduit.

In an additional embodiment, the present invention provides a method for directing a trajectory of a lined wellbore comprising providing a drilling assembly comprising a wellbore lining conduit and an earth removal member; directionally biasing the drilling assembly while operating the earth removal member and lowering the wellbore lining conduit into the earth; and leaving the wellbore lining conduit in a wellbore created by the biasing, operating and lowering, the drilling assembly further comprising a motor having a rotating shaft, the rotating shaft having a fluid passage therethrough. In an additional embodiment, the present invention provides a method for directing a trajectory of a lined wellbore comprising providing a drilling assembly comprising a wellbore lining conduit and an earth removal member; directionally biasing the drilling assembly while operating the earth removal member and lowering the wellbore lining conduit into the earth; and leaving the wellbore lining conduit in a wellbore created by the biasing, operating and lowering, wherein a latch member operatively connects the earth removal member to the wellbore lining conduit.

In one embodiment, the present invention provides an apparatus for drilling a well, comprising a motor operating system disposed in a motor system housing; a shaft operatively connected to the motor operating system, the shaft having a passageway; and a divert assembly disposed to direct fluid flow selectively to the motor operating system and the passageway in the shaft. In one aspect, the divert assembly comprises a closing sleeve having one or more ports, the closing sleeve disposed in the shaft. In another aspect, the divert assembly comprises a rupture disk disposed to block fluid flow to the passageway in the shaft.

Another embodiment of the present invention provides an apparatus for drilling a well, comprising a motor operating system disposed in a motor system housing; a shaft operatively connected to the motor operating system, the shaft having a passageway; and a divert assembly disposed to direct fluid flow selectively to the motor operating system and the passageway in the shaft. In one aspect, the motor operating system comprises a hydraulic system, while in another aspect, the motor operating system comprises a system selected from a turbine system and a stator system.

An additional embodiment of the present invention provides an apparatus for drilling a well, comprising a motor operating system disposed in a motor system housing; a shaft operatively connected to the motor operating system, the shaft having a passageway; and a divert assembly disposed to direct fluid flow selectively to the motor operating system and the passageway in the shaft; and a drill shoe rotatably connectable to a casing, the drill shoe comprising a rotatable drill face and a spindle connected to the shaft. In one aspect, the drill shoe includes a fluid connection to the passageway in the shaft. In another aspect, the drill shoe includes a shut-off mechanism for stopping fluid flow through the fluid connection.

In one embodiment, the present invention provides an apparatus for drilling a well, comprising a motor operating system disposed in a motor system housing; a shaft operatively connected to the motor operating system, the shaft having a passageway; and a divert assembly disposed to direct fluid flow selectively to the motor operating system and the passageway in the shaft; and a casing latch attached to the motor system housing, the casing latch connected to releasably secure the apparatus to an internal surface of a casing. In one aspect, the casing comprises a nozzle biased in a direction for directionally drilling the casing. In another aspect, the casing comprises a stabilizer proximate to a midpoint of the casing for directionally drilling the casing. In yet another aspect, the casing latch includes a fluid passage connected to the passageway in the shaft. In yet another aspect, the apparatus further comprises a guide assembly connected to the casing latch, the guide assembly having a cone portion and a tubular portion. In one aspect, the guide assembly includes one or more seats for receiving a device selected from an inter string and an orientation device.

Another embodiment of the present invention provides an apparatus for drilling a well, comprising a motor operating system disposed in a motor system housing; a shaft operatively connected to the motor operating system, the shaft having a passageway; and a divert assembly disposed to direct fluid flow selectively to the motor operating system and the passageway in the shaft, wherein the motor system housing includes an enlargement portion for expanding a casing size.

An additional embodiment of the present invention provides an apparatus for drilling with casing, comprising a casing; a motor system retrievably disposed in the casing, the motor system comprising a motor operating system disposed in a motor system housing; a shaft operatively connected to the motor operating system, the shaft having a passageway; a divert assembly disposed to direct fluid flow selectively to the motor operating system and the passageway in the shaft; and a drill face operably connected to shaft of the motor system. In one aspect, the apparatus further comprises a latch for releasably latching onto the casing, the latch fixedly connected to the motor system.

An additional embodiment of the present invention provides an apparatus for drilling with casing, comprising a casing; a motor system retrievably disposed in the casing, the motor system comprising a motor operating system disposed in a motor system housing; a shaft operatively connected to the motor operating system, the shaft having a passageway; a divert assembly disposed to direct fluid flow selectively to the motor operating system and the passageway in the shaft; and a drill face operably connected to shaft of the motor system, wherein the divert assembly comprises a closing sleeve having one or more ports, the closing sleeve disposed in the shaft. A further additional embodiment of the present invention provides an apparatus for drilling with casing, comprising a casing; a motor system retrievably disposed in the casing, the motor system comprising a motor operating system disposed in a motor system housing; a shaft operatively connected to the motor operating system, the shaft having a passageway; a divert assembly disposed to direct fluid flow selectively to the motor operating system and the passageway in the shaft; and a drill face operably connected to shaft of the motor system, wherein the divert assembly comprises a rupture disk disposed to block fluid flow to the passageway in the shaft.

An additional embodiment of the present invention provides an apparatus for drilling with casing, comprising a casing; a motor system retrievably disposed in the casing, the motor system comprising a motor operating system disposed in a motor system housing; a shaft operatively connected to the motor operating system, the shaft having a passageway; a divert assembly disposed to direct fluid flow selectively to the motor operating system and the passageway in the shaft; and a drill face operably connected to shaft of the motor system, wherein the motor operating system comprises a hydraulic system. A further additional embodiment provides an apparatus for drilling with casing, comprising a casing; a motor system retrievably disposed in the casing, the motor system comprising a motor operating system disposed in a motor system housing; a shaft operatively connected to the motor operating system, the shaft having a passageway; a divert assembly disposed to direct fluid flow selectively to the motor operating system and the passageway in the shaft; and a drill face operably connected to shaft of the motor system, wherein the motor operating system comprises a system selected from a turbine system and a stator system.

In one embodiment, the present invention provides an apparatus for drilling with casing, comprising a casing; a motor system retrievably disposed in the casing, the motor system comprising a motor operating system disposed in a motor system housing; a shaft operatively connected to the motor operating system, the shaft having a passageway; a divert assembly disposed to direct fluid flow selectively to the motor operating system and the passageway in the shaft; a drill face operably connected to shaft of the motor system; and a drill shoe rotatably connectable to the casing, the drill shoe having the drill face and a spindle connected to the shaft. In one aspect, the drill shoe includes a fluid connection to the passageway in the shaft. In a further aspect, the drill shoe includes a shut off mechanism for stopping fluid flow through the fluid connection.

In one embodiment, the present invention provides an apparatus for drilling with casing, comprising a casing; a motor system retrievably disposed in the casing, the motor system comprising a motor operating system disposed in a motor system housing; a shaft operatively connected to the motor operating system, the shaft having a passageway; a divert assembly disposed to direct fluid flow selectively to the motor operating system and the passageway in the shaft; a drill face operably connected to shaft of the motor system; and a casing latch attached to the motor system housing, the casing latch connected to releasably secure the apparatus to an internal surface of the casing. In one aspect, the casing latch includes a fluid passage connected to the passageway in the shaft.

In another embodiment, the present invention provides an apparatus for drilling with casing, comprising a casing; a motor system retrievably disposed in the casing, the motor system comprising a motor operating system disposed in a motor system housing; a shaft operatively connected to the motor operating system, the shaft having a passageway; a divert assembly disposed to direct fluid flow selectively to the motor operating system and the passageway in the shaft; a drill face operably connected to shaft of the motor system; a casing latch attached to the motor system housing, the casing latch connected to releasably secure the apparatus to an internal surface of the casing; and a guide assembly connected to the casing latch, the guide assembly having a cone portion and a tubular portion. In one aspect, the guide assembly includes one or more seats for receiving a device selected from an inter string and an orientation device.

The present invention provides in yet another embodiment an apparatus for drilling with casing, comprising a casing; a motor system retrievably disposed in the casing, the motor system comprising a motor operating system disposed in a motor system housing; a shaft operatively connected to the motor operating system, the shaft having a passageway; a divert assembly disposed to direct fluid flow selectively to the motor operating system and the passageway in the shaft; a drill face operably connected to shaft of the motor system, wherein the motor system housing includes an enlargement portion for expanding a casing size.

Another embodiment of the present invention includes a method for drilling and completing a well, comprising pumping drill mud to a motor system disposed in a casing; rotating a drill face connected to the motor system; diverting fluid flow to a passageway through the motor system; and pumping cement through the passageway to the drill face. In one aspect, the method further comprises releasably latching the motor system to the casing utilizing a casing latch.

A further embodiment of the present invention includes a method for drilling and completing a well, comprising pumping drill mud to a motor system disposed in a casing; rotating a drill face connected to the motor system; diverting fluid flow to a passageway through the motor system; and pumping cement through the passageway to the drill face, wherein the drill mud and the cement are pumped utilizing an inter string. In another embodiment, the present invention includes Another embodiment of the present invention includes a method for drilling and completing a well, comprising pumping drill mud to a motor system disposed in a casing; rotating a drill face connected to the motor system; diverting fluid flow to a passageway through the motor system; pumping cement through the passageway to the drill face; and retrieving the motor system from the casing.

Another embodiment of the present invention includes a method for drilling and completing a well, comprising pumping drill mud to a motor system disposed in a casing; rotating a drill face connected to the motor system; diverting fluid flow to a passageway through the motor system; pumping cement through the passageway to the drill face; and expanding the casing utilizing an enlarged portion of a housing for the motor system.

In a further embodiment, the present invention includes a method of initiating and continuing a path of a wellbore, comprising providing a first casing having a first earth removal member operatively disposed at a lower end thereof; penetrating a formation with the first casing to form the wellbore; selectively altering a trajectory of the wellbore while penetrating the formation of the first casing; flowing drilling fluid to a motor system disposed in a second casing, the second casing being releasably attached to an inner diameter of the first casing and having a second earth removal member; rotating the second earth removal member with the motor system; and selectively altering the trajectory of the second casing as it continues into the formation. In one aspect, the trajectory of the second casing is altered more than the trajectory of the first casing.

The present invention further includes in one embodiment a method of altering a path of a casing into a formation, comprising providing an outer casing with a deflector releasably attached to its lower end; penetrating the formation with the deflector; releasing the releasable attachment; deflecting the path of the outer casing in the formation by moving the casing string along the deflector; releasing an inner casing from a releasable attachment to the outer casing; and flowing drilling fluid to a motor system disposed within the inner casing to rotate an earth removal member operatively attached to the motor system while altering a trajectory of the inner casing drilling into the formation. In another embodiment, the present invention further includes an apparatus for deflecting a wellbore, comprising an outer casing with a member for deflecting the casing string preferentially in a direction; a first earth removal member operatively connected to a lower end of the outer casing; and an inner casing having a motor operating system disposed therein disposed within the outer casing and operatively attached thereto.

In a yet further embodiment, the present invention includes a method for preferentially directing a path of a casing to form a wellbore, comprising providing a second casing concentrically disposed within a first casing having a biasing member, the second casing having a motor system releasably attached therein; jetting the first casing having an earth removal member operatively connected thereto into a formation to a first depth while selectively altering the trajectory of the wellbore using the biasing member; releasing a releasable attachment between the first and second casing; providing drilling fluid to the motor system; and selectively altering a trajectory of the second casing while rotating an earth removal member operatively connected to a lower end of the motor system as the second casing continues into the formation. In one aspect, the biasing member includes a preferential jet for directing fluid flow asymmetrically through the first casing while jetting. In another aspect, the biasing member includes a stabilizing member disposed proximate to a midpoint of the first casing.

In an embodiment, the present invention includes a method for preferentially directing a path of a casing to form a wellbore, comprising providing a second casing concentrically disposed within a first casing having a biasing member, the second casing having a motor system releasably attached therein; jetting the first casing having an earth removal member operatively connected thereto into a formation to a first depth while selectively altering the trajectory of the wellbore using the biasing member; releasing a releasable attachment between the first and second casing; providing drilling fluid to the motor system; selectively altering a trajectory of the second casing while rotating an earth removal member operatively connected to a lower end of the motor system as the second casing continues into the formation; and diverting fluid flow to a passageway through the motor system. In one aspect, the method further comprises flowing a physically alterable bonding material through the passageway to the earth removal member.

An additional embodiment of the present invention includes a method for preferentially directing a path of a casing to form a wellbore, comprising providing a second casing concentrically disposed within a first casing having a biasing member, the second casing having a motor system releasably attached therein; jetting the first casing having an earth removal member operatively connected thereto into a formation to a first depth while selectively altering the trajectory of the wellbore using the biasing member; releasing a releasable attachment between the first and second casing; providing drilling fluid to the motor system; selectively altering a trajectory of the second casing while rotating an earth removal member operatively connected to a lower end of the motor system as the second casing continues into the formation; drilling the second casing to a second depth; and expanding the second casing. In one aspect, expanding the second casing is accomplished by retrieving the motor system from the second casing.

In another embodiment, the present invention includes a method for preferentially directing a path of a casing to form a wellbore, comprising providing a second casing concentrically disposed within a first casing having a biasing member, the second casing having a motor system releasably attached therein; jetting the first casing having an earth removal member operatively connected thereto into a formation to a first depth while selectively altering the trajectory of the wellbore using the biasing member; releasing a releasable attachment between the first and second casing; providing drilling fluid to the motor system; selectively altering a trajectory of the second casing while rotating an earth removal member operatively connected to a lower end of the motor system as the second casing continues into the formation; and retrieving the motor system from the second casing.

The present invention further includes, in one embodiment, a method for preferentially directing a path of a casing to form a wellbore, comprising providing a second casing concentrically disposed within a first casing having a biasing member, the second casing having a motor system releasably attached therein; jetting the first casing having an earth removal member operatively connected thereto into a formation to a first depth while selectively altering the trajectory of the wellbore using the biasing member; releasing a releasable attachment between the first and second casing; providing drilling fluid to the motor system; selectively altering a trajectory of the second casing while rotating an earth removal member operatively connected to a lower end of the motor system as the second casing continues into the formation; and selectively introducing a surveying tool into the motor operating system to selectively measure the trajectory of the wellbore. In one aspect, the surveying tool selectively measures the trajectory of the wellbore while drilling with the first or second casing.

In an embodiment, the present invention includes a method for preferentially directing a path of a casing to form a wellbore, comprising providing a second casing concentrically disposed within a first casing having a biasing member, the second casing having a motor system releasably attached therein; jetting the first casing having an earth removal member operatively connected thereto into a formation to a first depth while selectively altering the trajectory of the wellbore using the biasing member; releasing a releasable attachment between the first and second casing; providing drilling fluid to the motor system; and selectively altering a trajectory of the second casing while rotating an earth removal member operatively connected to a lower end of the motor system as the second casing continues into the formation; and measuring a trajectory of the wellbore while drilling with the first or second casing.

An embodiment of the present invention includes an apparatus for deflecting a wellbore, comprising a casing having upper and lower portions and an earth removal member operatively attached to its lower end; and at least one hole-opening blade disposed on the upper portion of the casing string for gravitationally bending the casing to alter a trajectory of the wellbore. The hole-opening blade comprises a concentric stabilizer in one aspect. In another aspect, the hole-opening blade is an eccentric stabilizer. An additional embodiment of the present invention includes an apparatus for deflecting a wellbore, comprising a casing having upper and lower portions and an earth removal member operatively attached to its lower end; at least one hole-opening blade disposed on the upper portion of the casing string for gravitationally bending the casing to alter a trajectory of the wellbore; and at least one angled perforation in the earth removal member for further altering the trajectory of the wellbore through asymmetric fluid flow through the perforation.

An embodiment of the present invention includes a method for deflecting a wellbore while drilling with casing, comprising providing a casing with a drilling member at a lower end thereof; penetrating a formation with the casing while selectively altering a trajectory of the casing; pumping drilling fluid to a motor system disposed in an additional casing disposed within the casing; rotating the additional casing with the motor system, the motor system having an earth removal member operatively attached to its lower end; and selectively altering a direction of additional casing to deflect the wellbore at a further trajectory. An additional embodiment includes a method of deflecting a wellbore while drilling with casing, comprising providing a casing with a drilling member at a lower end thereof; providing a deflecting member releasably attached to the drilling member; anchoring the deflecting member in the wellbore at a predetermined depth; and urging the drilling member along the deflector, thereby altering the direction of the wellbore.

A further embodiment of the present invention includes a method of deflecting a wellbore while drilling with casing, comprising providing a casing with a drilling member at a lower end thereof, the drilling member having at least one fluid path extending therefrom, the fluid path directed away from a longitudinal centerline of the string; and pumping fluid through the fluid path, thereby altering the direction of the wellbore. A further embodiment includes a method of deflecting a wellbore while drilling with casing, comprising forming a first, larger diameter wellbore; providing a second, lower, smaller diameter wellbore; and slanting a casing string to direct the lower end thereof away from the centerline of the wellbore, thereby altering the direction of the wellbore.

In another embodiment, the present invention includes a method of initiating and continuing a path of a wellbore, comprising providing a casing string and a cutting apparatus disposed at a lower portion of the casing string; penetrating a formation with the casing string to form the wellbore; and selectively altering the trajectory of the casing string as it continues into the formation. In one aspect, selectively altering the trajectory of the casing string comprises selectively jetting fluid to create an asymmetric flow pattern through a lower portion of the cutting apparatus. In another aspect, selectively altering the trajectory of the casing string comprises selectively diverting fluid flow out of a portion of the casing string. In one embodiment, selectively diverting fluid flow forms a profile in a portion of the formation through which the casing string continues.

An embodiment of the present invention includes a method of initiating and continuing a path of a wellbore, comprising providing a casing string and a cutting apparatus disposed at a lower portion of the casing string; penetrating a formation with the casing string to form the wellbore; and selectively altering the trajectory of the casing string as it continues into the formation, wherein selectively altering the trajectory of the casing string comprises laterally moving the casing string through an enlarged inner diameter of an upper portion of the wellbore. Another embodiment includes the present invention includes a method of initiating and continuing a path of a wellbore, comprising providing a casing string and a cutting apparatus disposed at a lower portion of the casing string; penetrating a formation with the casing string to form the wellbore; selectively altering the trajectory of the casing string as it continues into the formation; and surveying the path of the wellbore while selectively altering the trajectory of the casing string.

A further embodiment provides the present invention includes a method of initiating and continuing a path of a wellbore, comprising providing a casing string and a cutting apparatus disposed at a lower portion of the casing string; penetrating a formation with the casing string to form the wellbore; selectively altering the trajectory of the casing string as it continues into the formation; and introducing at least one additional casing string into the casing string. In an embodiment, the present invention includes a method of initiating and continuing a path of a wellbore, comprising providing a casing string and a cutting apparatus disposed at a lower portion of the casing string; penetrating a formation with the casing string to form the wellbore; and selectively altering the trajectory of the casing string as it continues into the formation, wherein penetrating the formation with the casing includes jetting fluid through at least one nozzle disposed in the cutting apparatus, the at least one nozzle having an extended bore which is adjustable to vary the penetration rate of the casing into the formation.

An embodiment of the present invention includes a method of altering a path of a casing string in a formation, comprising providing a casing string with a deflector releasably attached to its lower end; penetrating the formation with the deflector; releasing the releasable attachment; and deflecting the path of the casing string in the formation by moving the casing string along the deflector. In one aspect, the deflector comprises an inclined wedge.

An additional embodiment of the present invention includes an apparatus for deflecting a wellbore, comprising a casing string with means for deflecting the casing string preferentially in a direction; and a first cutting apparatus disposed at a lower portion of the casing string. In one embodiment, means for deflecting the casing string preferentially in the direction comprises an inclined wedge releasably attached to a lower portion of the cutting apparatus. In another embodiment, means for deflecting the casing string preferentially in the direction comprises an angled perforation through the lower portion of the casing string for receiving a fluid. In yet another embodiment, means for deflecting the casing string preferentially in the direction further comprises a bent portion in the casing string for deflecting the casing string preferentially in a direction. In another embodiment, means for deflecting the casing string preferentially in the direction comprises a second cutting apparatus larger in diameter than the first cutting apparatus disposed on a portion of the casing string above the first cutting apparatus.

An embodiment of the present invention includes an apparatus for deflecting a wellbore, comprising a casing string with means for deflecting the casing string preferentially in a direction; a first cutting apparatus disposed at a lower portion of the casing string; and a landing seat for securing a survey tool therein. In another embodiment, the present invention includes an apparatus for deflecting a wellbore, comprising a casing string with means for deflecting the casing string preferentially in a direction; and a first cutting apparatus disposed at a lower portion of the casing string, wherein the casing string comprises a lower casing string and an upper casing string, and wherein means for deflecting the casing string preferentially in the direction comprises a second cutting apparatus which connects the lower casing string to the upper casing string and is larger in diameter than the second cutting apparatus.

Another embodiment of the present invention includes an apparatus for deflecting a wellbore, comprising a casing string with means for deflecting the casing string preferentially in a direction; a first cutting apparatus disposed at a lower portion of the casing string; and a drilling apparatus releasably connected to an inner diameter of the casing string with a second cutting apparatus disposed on the drilling apparatus below the releasable connection. In one aspect, the second cutting apparatus comprises a cutting structure disposed on a portion facing the releasable connection.

An embodiment of the present invention includes an apparatus for deflecting a wellbore, comprising a casing string with means for deflecting the casing string preferentially in a direction; and a first cutting apparatus disposed at a lower portion of the casing string, wherein the first cutting apparatus includes at least one nozzle extending therethrough, the at least one nozzle having an extended straight bore extending longitudinally therethrough.

An embodiment of the present invention includes an apparatus for deflecting a wellbore, comprising a casing string with means for deflecting the casing string preferentially in a direction; and a first cutting apparatus disposed at a lower portion of the casing string, wherein the first cutting apparatus includes at least one nozzle extending therethrough, the at least one nozzle having an extended straight bore extending longitudinally therethrough. In one embodiment, the at least one nozzle is drillable or made of a soft material such as copper. In another embodiment, the at least one nozzle comprises a thin coating of a hard material, the hard material having a hardness greater than a hardness of a soft material. The hard material may be ceramic or tungsten carbide. The remainder of the at least one nozzle may comprise a soft material such as copper.

In another embodiment, the first cutting apparatus includes at least one nozzle extending therethrough, the at least one nozzle being drillable and having a profiled sleeve coating of a hard material. In another embodiment, the first cutting apparatus includes at least one drillable nozzle extending therethrough, the at least one nozzle comprising a hard material having stressed portions therein for increasing breakability of the at least one nozzle when drilled therethrough.

In another embodiment, the stressed portions include a plurality of stressed, longitudinal notches in the at least one nozzle. In another embodiment still, a sealing material is disposed in the plurality of stressed notches.

In another aspect, the present invention provides a nozzle assembly usable within a tool body while jetting a casing into a formation. The nozzle assembly includes soft, drillable material forming a nozzle retainer and a thin sleeve of a hard material disposed within the nozzle retainer, the hard material forming an longitudinal bore extending past the exit and entry points of a fluid flow path through a hole through the tool body, the hard material having a hardness greater than a hardness of the soft material. In one embodiment, the soft material is copper. In another embodiment, the hard material is ceramic. In another embodiment still, the thin sleeve position is adjustable relative to the nozzle retainer.

In another aspect, the present invention provides a method for preferentially directing a path of a casing string to form a wellbore. The method includes jetting the casing string with a cutting structure connected thereto into a formation; and selectively directing the casing string in a direction as the casing string continues into the formation. In one embodiment, selectively directing the casing string in the direction comprises using the casing string to create an annular space in an upper portion of the wellbore and laterally directing an upper portion of the casing string through the annular space. In another embodiment, selectively directing the casing string comprises integrating arcs in the casing string to urge the casing string to form the path in the wellbore while directing fluid asymmetrically out of the cutting structure. In another embodiment, the casing string comprises a tubular body with an inclined wedge attached to its lower portion, and wherein selectively directing the casing string comprises directing the path of the wellbore by obstructing an axial path of the tubular body by the inclined wedge.

In another aspect, the present invention provides an apparatus for deflecting a wellbore. The apparatus includes a casing string having upper and lower portions and at least one hole-opening blade disposed on the upper portion of the casing string. In one embodiment, the apparatus also includes a cutting structure disposed on the lower portion of the casing string. In another embodiment, the apparatus further includes a tubular body releasably connected to an inner diameter of the casing string, wherein the tubular body has a cutting apparatus disposed at its lower end comprising a cutting structure located on upper and lower portions thereof.

In another aspect, the present invention provides a method for deflecting a wellbore while drilling with casing. The method includes providing a casing string with a drilling member at a lower end thereof; penetrating a formation with the casing string; and selectively altering a direction of the lower end to deflect the wellbore.

In another aspect, the present invention provides an assembly for drilling with casing. The assembly includes a casing latch for securing the assembly to a portion of casing; a bit attached to a bottom portion of the assembly; a biasing member for providing the bit with a desired deviation from a center line of the wellbore; and at least one adjustable stabilizer. In one embodiment, the bit is an expandable bit. In another embodiment, the stabilizer has one or more support members adapted to be placed in a first position for running through the portion of casing and a second position for engaging an inner wall of the wellbore. In another embodiment still, the stabilizer is adjustable to at least a third position, wherein an outer diameter of the stabilizer in the third position is less than the outer diameter of the stabilizer in the second position. In yet another embodiment, assembly includes a flexible collar disposed between the bit and the casing latch. In another embodiment still, the biasing member is a bent housing of a downhole motor adapted to drive the bit. In a further embodiment, the assembly includes a measurement tool that is adapted to measure a trajectory of the wellbore and communicate the measured trajectory to the wellbore surface. In another embodiment, the assembly includes at least one additional adjustable stabilizer. The bit may be a pilot bit. The bit may also include an underreamer.

In another aspect, the present invention provides a drilling assembly for creating a wellbore, the drilling assembly having a casing portion; a bit assembly disposed on a bottom portion of the drilling assembly, the bit assembly adapted to be expanded from a first diameter to a second diameter; and at least one stabilizer adapted to be adjusted from a first position to at least a second position. In one embodiment, the casing portion is expandable. In another embodiment, the bit assembly comprises an expandable bit. In another embodiment still, the drilling assembly further comprises a biasing member for providing the bit with a desired deviation from a center line of the wellbore. In yet another embodiment, the assembly includes a biasing member for providing the bit assembly with a desired deviation from a center line of the wellbore. In a further embodiment, the assembly includes a downhole drilling motor adapted to rotate the bit. In another embodiment, the assembly includes a flexible collar disposed between the bit assembly and a bottom end of the casing portion. In another embodiment still, the assembly also includes a measurement tool adapted to measure a trajectory of the wellbore and communicate the measured trajectory to the wellbore surface.

In one aspect, the present invention provides a method for drilling with casing. The method includes lowering a drilling assembly down a wellbore through casing, wherein the drilling assembly comprises an adjustable stabilizer and one or more drilling elements. The method also includes adjusting one or more support members of the stabilizer to increase a diameter of the stabilizer and operating the drilling assembly to extend a portion of the wellbore below the casing, wherein the extended portion having a diameter greater than an outer diameter of the casing. In one embodiment, the drilling elements may include an expandable bit for expanding the expandable bit to have a larger outer diameter than the casing.

In another embodiment, the method may include measuring a trajectory of the wellbore, and in response to the measured trajectory, making one or more adjustments from a surface of the wellbore. The adjustments may involve adjusting the support members of the stabilizer or adjusting a weight applied to the bit. The method may also include sensing a geophysical parameter.

In another embodiment, the method may include partially raising the drilling assembly through the casing; advancing the casing into the extended portion of the wellbore; and raising the drilling assembly through the casing to a surface of the wellbore.

In another aspect, the present invention provides an apparatus for drilling a wellbore in an earth formation. The apparatus includes a drill string having a longitudinal bore therethrough and a drilling assembly connected at the lower end of the drill string. Preferably, the drilling assembly is selected to be operable to form a borehole and at least in part to be retrievable through the longitudinal bore of the drill string. The apparatus may also include a directional borehole drilling assembly connected to the drill string and including biasing means for applying a force to the drilling assembly to drive it laterally relative to the wellbore and at least one adjustable stabilizer, the adjustable stabilizer retrievable through the longitudinal bore of the drill string. In one embodiment, the adjustable stabilizer is positioned above the biasing means of the directional borehole drilling assembly. In another embodiment, the drilling assembly comprises an expandable bit selected to be operable to form a borehole having a diameter greater than an outer diameter of the drill string and to be retrievable through the longitudinal bore of the drill string.

In another aspect, the present invention provides a method for directionally drilling a well with a casing as an elongated tubular drill string and a drilling assembly retrievable from the lower distal end of the drill string without withdrawing the drill string from a wellbore being formed by the drilling assembly. The method includes providing the casing as the drill string; a directional borehole drilling assembly connected to the drill string and including biasing means for applying a force to the drilling assembly to drive it laterally relative to the wellbore; and providing an adjustable stabilizer to support the directional borehole drilling assembly. The method also includes connecting the drilling assembly to the distal end of the drill string and inserting the drill string, the directional borehole drilling assembly, and the drilling assembly into the wellbore. The method further includes adjusting the adjustable stabilizer; forming a wellbore having a diameter greater than the diameter of the drill string; and operating the biasing means to drive the drilling assembly laterally relative to the wellbore. The method further includes removing at least a portion of the drilling assembly from the distal end of the drill string; removing the at least a portion of the drilling assembly out of the wellbore through the drill string without removing the drill string from the wellbore; and leaving the drill string in the wellbore. In one embodiment, the one or more support members is adjusted to change, a diameter of the stabilizer. In another embodiment, prior to removing at least a portion of the drilling assembly from the distal end of the drill string, the method further includes partially raising at least a portion of the drilling assembly through the drill string and advancing the drill string within the wellbore.

In another aspect, the present invention provides an assembly for drilling with casing. The assembly includes a casing latch for securing the assembly to a portion of casing and a cutting structure attached to a bottom portion of the assembly. The assembly also includes a biasing member for providing the cutting structure with a desired deviation from a centerline of the wellbore, wherein biasing force for providing the cutting structure with the desired deviation is provided substantially by the casing. In one embodiment, the biasing member is an eccentric bias pad disposed on an outer diameter of the casing. The eccentric bias pad may alter the centerline of the casing relative to the borehole centerline in an opposite direction from the side of the casing on which the eccentric bias pad is disposed. In another embodiment, the biasing member comprises a bent motor housing within the casing. The assembly may also include a concentric stabilizer disposed around a lower end of the casing absorbs a majority of the biasing force. In another embodiment still, the casing latch is an orienting latch. In yet another embodiment, the assembly includes at least one of a measuring while drilling tool and a resistivity tool. In yet another embodiment, the cutting structure is expandable. In yet another embodiment, the assembly is retrievable from the casing.

In another aspect, the present invention provides a method of drilling with casing. The method includes providing a casing having an assembly releasably connected therein, the assembly comprising an earth removal member at its lower end and a biasing member. The biasing member deflects the earth removal member to a desired angle with respect to the centerline of the wellbore and to place a biasing force on the casing. In one embodiment, the method also includes sensing a geophysical parameter.

In another aspect, the present invention provides a method of forming a wellbore using a casing equipped with a cutting apparatus. The method includes positioning an orienting member in the casing, the orienting member having a predetermined orientation relative to the cutting apparatus; and positioning a survey tool with respect to the orienting member, such that an orientation of the survey tool in the casing is known. In one embodiment, the orienting member includes at least one flow aperture therethrough, and the survey tool includes at least one flow aperture therethrough. The orienting member provides an additional downhole functionality such as receiving a cementing tool therein or providing a stage tool integral therewith. In one embodiment, the orienting member may include a slot. In another embodiment, the orienting member may include a mule shoe profile and the survey tool includes a mating mule shoe profile receivable against the mule shoe profile of the landing shoe. The mule shoe profiles of the survey tool and the orienting member provide, upon mating of the mule shoe profiles, alignment between the landing shoe and the survey tool. In another embodiment, the orienting member includes a tubular element having a slot therein.

In another embodiment still, the casing comprises a float shoe and the orienting member is disposed in the float shoe. In another embodiment, the survey tool is positioned by landing the survey tool in the orienting member. In another embodiment still, the method further includes acquiring information relating a direction of the cutting apparatus. The method may also include sending the information to a receiving apparatus and steering the cutting apparatus in response to the information acquired. In another embodiment, the cutting apparatus includes a jetting assembly and/or a drilling bit. In yet another embodiment, the method also includes removing the survey tool before drilling is continued.

In another aspect, the present invention provides an apparatus for surveying a well wherein a drill string formed of a casing having a cutting apparatus. The apparatus includes an alignment member located in the drill string and a survey tool receivable in said alignment member and alignable thereby to a desired orientation in the drill string. In one embodiment, the alignment member includes a shoe having a profile thereon, the profile indexed rotationally with respect to the circumference of the drill string. The survey tool includes an alignment element interactive with the shoe upon locating of the survey tool in the shoe to provide a known alignment of the survey tool with the drill string. In another embodiment, the survey tool alignment element includes a profile matable with the profile of the alignment member. In yet another embodiment, the alignment member further includes a slot; the survey tool includes a generally cylindrical body having an alignment lug projecting therefrom; and the lug is positionable in the slot when the survey tool is disposed in the alignment member to provide a known orientation of the survey tool with the drill string.

In another embodiment still, the survey tool includes a generally hollow interior and an open end positionable in said alignment member, and at least one aperture extending through the body of said survey tool to communicate fluids from the casing to the hollow interior. The alignment member includes an aperture extending therethrough to communicate fluids from a region above the alignment member to a region below the alignment member, the alignment member otherwise blocking off the communication of fluids through the drill string therepast; and whereby upon placement of the survey tool in the alignment member for the alignment thereof, fluids may pass through the aperture, and thus through the hollow interior of the survey tool and through the alignment member. In another embodiment, the survey tool contains a survey apparatus located therein in a position so as not to interfere with fluid flow therethrough; and the survey apparatus may be operated to obtain borehole or formation information as fluid is flowing therethrough. In another embodiment, a drill shoe having a drill motor and a jetting apparatus is positioned on the end of the drill string, and the survey apparatus steers the drill shoe as the drill shoe penetrates an earth formation.

In yet another embodiment, the alignment member includes a stage tool and may further include a float tool to receive a cement shoe thereon.

In another aspect, the present invention provides an apparatus for drilling with casing. The apparatus includes casing having a drilling member disposed at a lower portion thereof and a pivoting member coupling the drilling member to the casing, wherein the drilling member may be pivoted away from a centerline of the casing for directional drilling. In one embodiment, apparatus further includes a drilling motor, wherein the pivoting member is coupled to the drilling motor.

In another aspect, the present invention provides a survey tool for use while drilling with casing. The survey tool includes a body having a bore therethrough and one or more measurement devices. The survey tool also includes an inlet for fluid communication between the casing and the bore of the body and a bypass valve for diverting fluid in the casing from the inlet. In one embodiment, the bypass valve is in a closed position when the fluid is at a lower fluid flow rate, while a higher flow rate places the bypass valve in an open position.

In another aspect, the present invention provides a method of collecting information while drilling with casing. The method includes providing a measurement tool in a casing, the measurement tool having a first inlet and a second inlet. The method also includes flowing fluid through a first channel to actuate the measurement tool and collecting information on a condition in the wellbore. The method also includes increasing fluid flow in the casing and flowing fluid through the second channel to continue drilling.

While the foregoing is directed to embodiments of the present invention, other and further embodiments of the invention may be devised without departing from the basic scope thereof, and the scope thereof is determined by the claims that follow.

The invention claimed is:

1. A method for preferentially directing a path of a casing to form a wellbore, comprising:

providing a second casing concentrically disposed within a first casing, the first casing having an earth removal member operatively connected thereto;

operating the first casing and the earth removal member to penetrate into a formation to a first depth;

releasing a releasable attachment between the first and second casing; and selectively altering a trajectory of the second casing while rotating the earth removal member as the second casing continues into the formation.

2. The method of claim 1, further comprising diverting fluid flow to a passageway through a motor system.

3. The method of claim 2, further comprising flowing a physically alterable bonding material through the passageway to the earth removal member.

4. The method of claim 1, wherein the first casing comprises a biasing member to facilitate altering the trajectory of the wellbore.

5. The method of claim 4, wherein the biasing member includes a preferential jet for directing fluid flow asymmetrically through the first casing while jetting.

6. The method of claim 4, wherein the biasing member includes a stabilizing member disposed proximate to a midpoint of the first casing.

7. The method of claim 4, further comprising diverting fluid flow to a passageway through a motor system.

8. The method of claim 7, further comprising flowing a physically alterable bonding material through the passageway to the earth removal member.

9. The method of claim 1, further comprising providing a motor system releasably attached to an inner portion of the second casing, the motor system adapted to rotate the earth removal member.

10. The method of claim 9, further comprising providing a drilling fluid to the motor system.

11. The method of claim 10, further comprising diverting the drilling fluid to a passageway through the motor system.

12. The method of claim 9, further comprising:

drilling the second casing to a second depth; and expanding the second casing.

13. The method of claim 12, wherein expanding the second casing is accomplished by retrieving the motor system from the second casing.

14. The method of claim 9, further comprising retrieving the motor system from the second casing.

15. The method of claim 9, further comprising selectively introducing a surveying tool into the motor system to selectively measure the trajectory of the wellbore.

16. The method of claim 15, wherein the surveying tool selectively measures the trajectory of the wellbore while drilling with the first or second casing.

17. The method of claim 1, wherein penetrating the first casing into the formation comprises jetting the first casing.

18. The method of claim 1, further comprising measuring a trajectory of the wellbore while drilling with the first or second casing.

19. An drilling assembly for directing a path of a wellbore, comprising:

an outer casing having a deflecting member for deflecting a direction of the drilling assembly;

an inner casing having a motor system disposed therein, the inner casing disposed within the outer casing and operatively attached thereto; and an earth removal member operatively connected to a lower end of the outer casing, wherein the earth removal member is rotatable by the motor system.

20. The apparatus of claim 19, wherein the deflecting member comprises an inclined wedge releasably attached to a lower portion of the cutting apparatus.

21. The apparatus of claim 19, wherein the deflecting member comprises an angled perforation through the lower portion of the casing string for receiving a fluid.

22. The apparatus of claim 21, wherein the deflecting member further comprises a bent portion in the casing string for deflecting the casing string preferentially in a direction.

23. The apparatus of claim 19, wherein the deflecting member comprises a second earth removal member larger in diameter than the first earth removal member disposed on a portion of the casing assembly above the first earth removal member.

24. The apparatus of claim 19, wherein the deflecting member further comprising a landing seat for securing a survey tool therein.

25. The apparatus of claim 19, wherein the earth removal member includes at least one nozzle extending therethrough, the at least one nozzle having an extended straight bore extending longitudinally therethrough.

26. The apparatus of claim 25, wherein the at least one nozzle is drillable.

27. The apparatus of claim 25, wherein the at least one nozzle comprises a soft material.

28. The apparatus of claim 27, wherein the soft material is copper.

29. The apparatus of claim 27, wherein the at least one nozzle comprises a thin coating of a hard material, the hard material having a hardness greater than a hardness of a soft material.

30. The apparatus of claim 29, wherein the hard material is ceramic.

31. The apparatus of claim 29, wherein the hard material is tungsten carbide.

32. The apparatus of claim 19, wherein the motor system is releasable from the inner casing and retrievable therefrom.

33. The apparatus of claim 19, wherein the motor system comprises:

a motor operating system disposed in a motor system housing;

a shaft operatively connected to the motor operating system, the shaft having a passageway; and a divert assembly disposed to direct fluid flow selectively to the motor operating system and the passageway in the shaft.

34. The apparatus of claim 33, further comprising a latch for releasably latching the motor system onto the inner casing.

35. The apparatus of claim 33, wherein the divert assembly comprises a dosing sleeve having one or more ports, the closing sleeve disposed in the shaft.

36. The apparatus of claim 33, wherein the divert assembly comprises a rupture disk disposed to block fluid flow to the passageway in the shaft.

37. The apparatus of claim 33, wherein the motor operating system comprises a hydraulic system.

38. The apparatus of claim 33, wherein the motor operating system comprises a system selected from a turbine system and a stator system.

39. The apparatus of claim 33, wherein the earth removal member includes a drill face and a spindle connected to the shaft.

40. The apparatus of claim 39, wherein the earth removal member includes a fluid connection to the passageway in the shaft.

41. The apparatus of claim 40, wherein the earth removal member includes a shut off mechanism for stopping fluid flow through the fluid connection.

42. The apparatus of claim 33, further comprising a casing latch attached to the motor system housing, the casing latch adapted to releasably secure the motor system to an internal surface of the inner casing.

43. The apparatus of claim 42, wherein the casing latch includes a fluid passage connected to the passageway in the shaft.

44. The apparatus of claim 42, further comprising a guide assembly connected to the casing latch, the guide assembly having one or more seats for receiving a device selected from an inter string and an orientation device.

45. The apparatus of claim 33, wherein the motor system housing includes an enlargement portion for expanding a casing size.

46. A method of initiating and continuing a path of a wellbore, comprising:

providing a first casing having a first earth removal member operatively disposed at a lower end thereof;

penetrating a formation with the first casing to form the wellbore;

selectively altering a trajectory of the wellbore while penetrating the formation with the first casing;

flowing drilling fluid to a motor system disposed in a second casing, the second casing being releasably attached to an inner diameter of the first casing and having a second earth removal member; and rotating the second earth removal member with the motor system.

47. The method of claim 46, wherein the trajectory of the second casing is altered more than the trajectory of the first casing.

48. A method of altering a path of a casing into a formation, comprising:

providing an outer casing with a deflector releasably attached to its lower end;

penetrating the formation with the deflector;

releasing the deflector from the outer casing; and deflecting the path of the outer casing in the formation by moving the casing string along the deflector.

49. The method of claim 48, further comprising releasing an inner casing from the outer casing.

50. The method of claim 49, further comprising flowing drilling fluid to a motor system disposed within the inner casing to rotate an earth removal member operatively attached to the motor system while altering a trajectory of the inner casing drilling into the formation.

* * * * *

UNITED STATES PATENT AND TRADEMARK OFFICE

CERTIFICATE OF CORRECTION

PATENT NO. : 7,334,650 B2
APPLICATION NO. : 10/772217
DATED : February 26, 2008
INVENTOR(S) : Giroux et al.

It is certified that error appears in the above-identified patent and that said Letters Patent is hereby corrected as shown below:

Title Page;

In the Related U.S. Application Data (63):

Please replace entire section as follows:

--Continuation-in-part of application 10/257,662 filed on Mar. 5, 2003, now Pat. No. 6,848,517, which is the national phase of PCT/GB01/01506, filed Apr. 2, 2001; said application no. 10/772,217 is a continuation-in-part of application no. 10/331,964, filed Dec. 30, 2002, now Pat. No. 6,857,487.--.

In References Cited (56):

Please delete "2,345,038 A 3/1944 Wallace" and insert --2,345,308 A 3/1944 Wallace--;

Please delete "3,001,585 A 9/1961 Shipiet" and insert --3,001,585 A 9/1961 Shiplet--;

Please delete "3,662,642 A 5/1972 Bromell" and insert --3,662,842 A 5/1972 Bromell--;

Please delete "2004/0003904 Al 1/2004 Vincent et al." and insert --2004/0003944 Al 1/2004 Vincent et al.--;

Please delete "2004/0182679 Al 9/2004 Steele et al." and insert --2004/0182579 Al 9/2004 Steele et al.--;

Please delete "GB 0 235 105 9/1987" and insert --EP 0 235 105 9/1987--;

Please delete "WO WO 00/37768 6/2000" and insert --WO WO 00/37766 6/2000--;

Please delete "WO WO 03/008790 1/2003" and insert--WO WO 03/006790 1/2003--.

In the Cross-Reference To Related Applications:

Column 1, Line 8, please delete "Apr. 2, 2001" and insert --Mar. 5, 2003--.

UNITED STATES PATENT AND TRADEMARK OFFICE

CERTIFICATE OF CORRECTION

PATENT NO. : 7,334,650 B2
APPLICATION NO. : 10/772217
DATED : February 26, 2008
INVENTOR(S) : Giroux et al.

It is certified that error appears in the above-identified patent and that said Letters Patent is hereby corrected as shown below:

In the Claims:

Column 74, Claim 35, Line 41, please delete "dosing" and insert --closing--.

Signed and Sealed this

Twelfth Day of August, 2008

JON W. DUDAS
*Director of the United States Patent and Trademark Office*